US012291945B1

(12) United States Patent
Ang et al.

(10) Patent No.: US 12,291,945 B1
(45) Date of Patent: May 6, 2025

(54) DOWNHOLE PERFORATING GUN SYSTEM

(71) Applicant: SWM International, LLC, Pampa, TX (US)

(72) Inventors: Dan Salkhai Ang, Keller, TX (US); David C. Parks, Calgary (CA); Dawna Mauldin, Pampa, TX (US); Sidney W. Mauldin, Pampa, TX (US)

(73) Assignee: SWM International, LLC, Pampa, TX (US)

( * ) Notice: Subject to any disclaimer, the term of this patent is extended or adjusted under 35 U.S.C. 154(b) by 0 days.

(21) Appl. No.: 18/317,485

(22) Filed: May 15, 2023

Related U.S. Application Data

(63) Continuation-in-part of application No. 18/110,804, filed on Feb. 16, 2023, now Pat. No. 11,976,539, and a continuation-in-part of application No. 17/831,900, filed on Jun. 3, 2022, now Pat. No. 11,867,032, said application No. 18/110,804 is a continuation of application No. 17/380,490, filed on Jul. 20, 2021, now Pat. No. 11,624,266, which is a continuation of application No. 16/293,508, filed on Mar. 5, 2019, now Pat. No. 11,078,762.

(60) Provisional application No. 63/196,922, filed on Jun. 4, 2021.

(51) Int. Cl.

| | |
|---|---|
| ***E21B 43/118*** | (2006.01) |
| ***E21B 43/117*** | (2006.01) |
| ***E21B 43/1185*** | (2006.01) |
| ***E21B 43/119*** | (2006.01) |
| *F42D 1/045* | (2006.01) |

(52) U.S. Cl.
CPC ..... *E21B 43/117* (2013.01); *E21B 43/1185* (2013.01); *E21B 43/119* (2013.01); *F42D 1/045* (2013.01)

(58) Field of Classification Search
CPC ..... E21B 43/118; E21B 43/119; F42D 1/22
See application file for complete search history.

(56) References Cited

U.S. PATENT DOCUMENTS

| | | | |
|---|---|---|---|
| 2,909,120 | A | 10/1959 | Lebourg |
| 3,307,626 | A | 3/1967 | Bielstein |
| 3,307,642 | A | 3/1967 | Smith |
| 3,419,070 | A | 12/1968 | Ernst |
| 3,704,749 | A | 12/1972 | Estes et al. |

(Continued)

FOREIGN PATENT DOCUMENTS

| | | |
|---|---|---|
| CN | 2698970 | 5/2005 |
| CN | 112103741 A | 12/2020 |

(Continued)

OTHER PUBLICATIONS

Final Written Decision for IPR2022-01372 dated Feb. 5, 2024, 65-pgs.

(Continued)

*Primary Examiner* — Kenneth L Thompson
(74) *Attorney, Agent, or Firm* — Cabello Hall Zinda, PLLC

(57) ABSTRACT

A downhole perforating gun system provides wireless electrical communication between an inner body conductor, a switch, a detonator, and a feedthrough, and further comprising a weight module and a bearing assembly wherein the weight module is rotatable by a weight via a bearing assembly based on gravity acting on one or more of the weights.

38 Claims, 104 Drawing Sheets

(56) References Cited

U.S. PATENT DOCUMENTS 4,022,518 A 5/1977 Gattaz
4,543,700 A 10/1985 Stout et al.
4,637,478 A * 1/1987 George ..... E21B 43/117 175/4.54
4,703,459 A 10/1987 Bower
4,728,296 A 3/1988 Stamm
RE32,755 E 9/1988 Vann
4,815,540 A 3/1989 Wallbillich, III
4,829,901 A 5/1989 Yates, Jr.
4,830,120 A 5/1989 Stout
4,886,126 A 12/1989 Yates, Jr.
4,917,187 A 4/1990 Burns et al.
4,949,793 A 8/1990 Rubbo et al.
4,979,567 A 12/1990 Rubbo
5,016,716 A 5/1991 Donovan et al.
5,025,861 A 6/1991 Huber et al.
5,033,553 A 7/1991 Miszewski et al.
5,044,441 A 9/1991 Rubbo et al.
5,067,568 A 11/1991 Yates, Jr. et al.
5,076,355 A 12/1991 Donovan et al.
5,131,472 A 7/1992 Dees et al.
5,131,869 A 7/1992 Wharton
5,156,213 A 10/1992 George et al.
5,226,494 A 7/1993 Rubbo et al.
RE34,451 E 11/1993 Donovan et al.
5,303,772 A 4/1994 George et al.
5,318,123 A 6/1994 Venditto et al.
5,320,176 A 6/1994 Naquin et al.
5,327,974 A 7/1994 Donovan et al.
5,346,014 A 9/1994 Ross
5,370,186 A 12/1994 Ireland
5,376,022 A 12/1994 Carr et al.
5,398,760 A 3/1995 George et al.
5,462,117 A 10/1995 Green et al.
5,497,807 A 3/1996 Rogers
5,526,880 A 6/1996 Jordan, Jr. et al.
5,569,053 A 10/1996 Nelson et al.
5,593,323 A 1/1997 Dernehl
5,611,401 A 3/1997 Myers, Jr. et al.
5,662,170 A 9/1997 Donovan et al.
5,680,905 A 10/1997 Green et al.
5,775,952 A 7/1998 Lu
5,964,294 A 10/1999 Edwards et al.
6,055,213 A 4/2000 Rubbo et al.
6,142,231 A 11/2000 Myers, Jr. et al.
6,148,916 A 11/2000 Sampson et al.
6,173,773 B1 1/2001 Almaguer et al.
6,227,868 B1 5/2001 Wlodarski
6,246,962 B1 6/2001 Schultz et al.
6,283,156 B1 9/2001 Motley
6,286,598 B1 9/2001 van Petegem et al.
6,295,912 B1 10/2001 Burleson et al.
6,296,066 B1 10/2001 Terry et al.
6,298,915 B1 10/2001 George
6,310,829 B1 10/2001 Green et al.
6,321,838 B1 11/2001 Skinner
6,325,146 B1 12/2001 Ringgenberg et al.
6,329,407 B1 12/2001 Jaehne et al.
6,333,784 B1 12/2001 Blasi et al.
6,371,219 B1 4/2002 Collins et al.
6,378,438 B1 4/2002 Lussier et al.
6,378,607 B1 4/2002 Ryan et al.
6,414,905 B1 7/2002 Owens et al.
6,435,278 B1 8/2002 Barlow et al.
6,439,121 B1 8/2002 Gillingham
6,446,720 B1 9/2002 Ringgenberg et al.
6,450,258 B2 9/2002 Green et al.
6,487,973 B1 12/2002 Gilbert, Jr. et al.
6,494,260 B2 12/2002 van Petegem et al.
6,497,284 B2 12/2002 van Petegem et al.
6,536,350 B2 3/2003 Cartland et al.
6,557,900 B1 5/2003 Austin
6,564,866 B2 5/2003 Clark et al.
6,566,635 B1 5/2003 Matsen et al.
6,591,912 B2 7/2003 Ross et al.
6,595,290 B2 7/2003 George et al.
6,626,241 B2 9/2003 Nguyen
6,630,668 B1 10/2003 Cramer et al.
6,647,890 B2 11/2003 Findlay
6,653,608 B1 11/2003 Matsen et al.
6,658,981 B2 12/2003 Rochen et al.
6,679,323 B2 1/2004 Vargervik et al.
6,679,327 B2 1/2004 Sloan et al.
6,684,954 B2 2/2004 George
6,708,761 B2 3/2004 George et al.
6,723,709 B1 4/2004 Pressato et al.
6,729,398 B2 5/2004 Ringgenberg et al.
6,736,984 B2 5/2004 Golecki
6,739,914 B2 5/2004 Strandfelt
6,748,843 B1 6/2004 Barker et al.
6,758,124 B2 7/2004 Barker et al.
6,793,017 B2 9/2004 Nguyen et al.
6,820,693 B2 11/2004 Hales et al.
6,823,902 B2 11/2004 Rudesill et al.
6,835,095 B2 12/2004 Chen
6,837,310 B2 1/2005 Martin
6,843,318 B2 1/2005 Yarbro
6,843,320 B2 1/2005 Yarbro
6,845,822 B2 1/2005 Chau
6,851,471 B2 2/2005 Barlow et al.
6,877,561 B2 4/2005 Richard et al.
6,880,637 B2 4/2005 Myers et al.
6,920,933 B2 7/2005 Watson et al.
6,941,627 B2 9/2005 Fritsche et al.
6,944,095 B2 9/2005 Thomas
6,955,217 B2 10/2005 Clark et al.
7,000,699 B2 2/2006 Yang et al.
7,013,977 B2 3/2006 Nardaas et al.
7,016,261 B2 3/2006 Quinn et al.
7,021,375 B2 4/2006 Ringgenberg et al.
7,044,236 B2 5/2006 Iversen et al.
7,066,261 B2 6/2006 Vicente et al.
7,073,579 B2 7/2006 Ringgenberg et al.
7,086,463 B2 8/2006 Ringgenberg et al.
7,114,564 B2 10/2006 Parrott et al.
7,172,023 B2 2/2007 Barker et al.
7,178,213 B2 2/2007 Haas et al.
7,210,524 B2 5/2007 Sloan et al.
7,229,701 B2 6/2007 Madhava et al.
7,231,982 B2 6/2007 Sloan et al.
7,237,486 B2 7/2007 Myers et al.
7,237,487 B2 7/2007 Myers et al.
7,243,725 B2 7/2007 George et al.
7,246,659 B2 7/2007 Fripp et al.
7,266,917 B2 9/2007 Ryan et al.
7,295,491 B2 11/2007 Carstensen
7,299,961 B2 11/2007 Stavig, Jr. et al.
7,303,017 B2 12/2007 Barker et al.
7,308,461 B2 12/2007 Iwatsu
7,322,416 B2 1/2008 Burris, II et al.
7,339,852 B2 3/2008 Gordy et al.
7,342,230 B2 3/2008 Adamski
7,360,487 B2 4/2008 Myers, Jr. et al.
7,387,156 B2 6/2008 Drummond et al.
7,395,987 B2 7/2008 Lindquist et al.
7,409,993 B2 8/2008 Han et al.
7,428,922 B2 9/2008 Fripp et al.
7,431,080 B2 10/2008 Wright et al.
7,526,850 B2 5/2009 Haas et al.
7,540,326 B2 6/2009 Rytlewski
7,556,695 B2 7/2009 Strangman et al.
7,575,702 B2 8/2009 Obrachta
7,581,498 B2 9/2009 Hetz et al.
7,591,212 B2 9/2009 Myers et al.
7,595,633 B2 9/2009 Martin et al.
7,600,568 B2 10/2009 Ross et al.
7,602,827 B2 10/2009 Okuda
7,607,379 B2 10/2009 Rospek et al.
7,610,969 B2 11/2009 Lagrange et al.
7,624,807 B2 12/2009 Vick, Jr.
7,648,740 B2 1/2010 Slaughter
7,650,947 B2 1/2010 Henke et al.
7,665,529 B2 2/2010 Farquhar et al.
7,686,082 B2 3/2010 Marsh

(56) References Cited

U.S. PATENT DOCUMENTS 7,710,545 B2 5/2010 Cramblitt et al.
7,721,649 B2 5/2010 Hetz et al.
7,721,820 B2 5/2010 Hill et al.
7,730,951 B2 6/2010 Surjaatmadja et al.
7,735,578 B2 6/2010 Loehr et al.
7,752,971 B2 7/2010 Loehr
7,757,767 B2 7/2010 Hill et al.
7,762,172 B2 7/2010 Li et al.
7,762,247 B2 7/2010 Evans
7,762,331 B2 * 7/2010 Goodman ..... E21B 43/117 166/299
7,770,662 B2 8/2010 Harvey et al.
7,806,035 B2 10/2010 Kaiser et al.
7,810,552 B2 10/2010 Slaughter
7,828,051 B2 11/2010 Walker
7,829,011 B2 11/2010 Slaughter
7,857,066 B2 12/2010 Difoggio et al.
7,861,609 B2 1/2011 Haggerty et al.
7,861,784 B2 1/2011 Burleson et al.
7,866,372 B2 1/2011 Slaughter
7,866,377 B2 1/2011 Slaughter
7,934,558 B2 * 5/2011 Hales ..... E21B 43/119 166/50
7,942,098 B2 5/2011 Han et al.
7,946,344 B2 5/2011 Braithwaite et al.
7,955,568 B2 6/2011 Ullman et al.
7,980,308 B2 7/2011 Myers et al.
7,980,309 B2 7/2011 Crawford
8,002,035 B2 8/2011 Hales et al.
8,006,427 B2 8/2011 Blevins et al.
8,006,762 B2 8/2011 Burleson et al.
8,028,751 B2 10/2011 Pinto et al.
8,035,370 B2 10/2011 Jackson et al.
8,061,425 B2 11/2011 Hales et al.
8,061,426 B2 11/2011 Surjaatmadja
8,061,431 B2 11/2011 Moore et al.
8,066,083 B2 11/2011 Hales et al.
8,074,737 B2 12/2011 Hill et al.
8,091,638 B2 1/2012 Dusterhoft et al.
8,127,846 B2 3/2012 Hill et al.
8,136,608 B2 3/2012 Goodman
8,143,119 B2 3/2012 Sakoh et al.
8,152,107 B1 4/2012 Toombs
8,181,718 B2 * 5/2012 Burleson ..... E21B 43/119 175/4.51
8,186,259 B2 5/2012 Burleson et al.
8,223,591 B2 7/2012 Chelminski
8,230,946 B2 7/2012 Crawford et al.
8,256,337 B2 9/2012 Hill et al.
8,264,814 B2 9/2012 Love et al.
8,267,172 B2 9/2012 Surjaatmadja et al.
8,276,656 B2 10/2012 Goodman
8,286,697 B2 10/2012 Evans et al.
8,286,706 B2 10/2012 Mccann et al.
8,307,743 B2 11/2012 Hsu
8,307,904 B2 11/2012 Surjaatmadja et al.
8,336,437 B2 12/2012 Barlow et al.
8,347,962 B2 1/2013 Sampson et al.
8,365,376 B2 2/2013 Reid et al.
8,365,814 B2 2/2013 Hill et al.
8,369,063 B2 2/2013 Vicente
8,381,822 B2 2/2013 Hales et al.
8,387,226 B2 3/2013 Weigel, Jr. et al.
8,387,814 B2 3/2013 Zheng
8,393,392 B2 3/2013 Mytopher et al.
8,393,393 B2 3/2013 Rodgers et al.
8,408,285 B2 4/2013 Lian et al.
8,418,764 B2 4/2013 Dusterhoft et al.
8,424,606 B2 4/2013 Zhan et al.
8,439,114 B2 5/2013 Parrott et al.
8,443,886 B2 5/2013 Torres et al.
8,490,686 B2 7/2013 Rodgers et al.
8,540,021 B2 9/2013 Mccarter et al.
8,544,563 B2 10/2013 Bourne et al.
8,549,905 B2 10/2013 Brooks et al.
8,555,764 B2 10/2013 Le et al.
8,576,090 B2 11/2013 Lerche et al.
8,584,763 B2 11/2013 Hales et al.
8,596,378 B2 12/2013 Mason et al.
8,597,076 B2 12/2013 Krienke et al.
8,607,863 B2 12/2013 Fripp et al.
8,672,031 B2 3/2014 Vaynshteyn
8,678,261 B2 3/2014 Lee
8,684,083 B2 4/2014 Torres et al.
8,689,868 B2 4/2014 Lerche et al.
8,695,506 B2 4/2014 Lanclos
8,714,251 B2 5/2014 Glenn et al.
8,714,252 B2 5/2014 Glenn et al.
8,716,627 B2 5/2014 Saunders et al.
8,728,245 B2 5/2014 Dufresne et al.
8,739,673 B2 6/2014 Le et al.
8,740,071 B1 6/2014 Higgs et al.
8,746,331 B2 6/2014 Kash et al.
8,790,587 B2 7/2014 Singh et al.
8,794,326 B2 8/2014 Le et al.
8,794,335 B2 8/2014 Fadul et al.
8,807,003 B2 8/2014 Le et al.
8,807,206 B2 8/2014 Walker
8,807,210 B2 8/2014 Smith et al.
8,807,213 B2 8/2014 Walker et al.
8,831,739 B2 9/2014 Mccreery et al.
8,839,863 B2 9/2014 Hetz et al.
8,839,873 B2 9/2014 Johnson et al.
8,844,625 B2 9/2014 Mhaskar et al.
8,851,160 B2 10/2014 Stolboushkin
8,875,787 B2 11/2014 Tassaroli
8,875,796 B2 11/2014 Hales et al.
8,881,816 B2 11/2014 Glenn et al.
8,884,778 B2 11/2014 Lerche et al.
8,893,605 B1 11/2014 Hester, Jr. et al.
8,893,785 B2 11/2014 Skinner et al.
8,899,322 B2 12/2014 Cresswell et al.
8,899,346 B2 12/2014 Dagenais et al.
8,910,556 B2 12/2014 Umphries et al.
8,910,713 B2 12/2014 Zuklic et al.
8,910,716 B2 12/2014 Newton et al.
8,919,236 B2 12/2014 Bell et al.
8,919,253 B2 12/2014 Sampson et al.
8,919,443 B2 12/2014 Parker et al.
8,931,389 B2 1/2015 Brooks et al.
8,943,943 B2 2/2015 Tassaroli
8,960,288 B2 2/2015 Sampson
8,960,289 B2 2/2015 Zhang et al.
8,963,827 B2 2/2015 Kim et al.
8,965,044 B1 2/2015 Owechko et al.
8,967,257 B2 3/2015 Fadul et al.
8,971,152 B2 3/2015 Chelminski
8,978,749 B2 3/2015 Rodgers et al.
8,985,023 B2 3/2015 Mason
8,985,200 B2 3/2015 Rodgers et al.
8,991,496 B2 3/2015 Bishop
9,004,185 B2 4/2015 Madero et al.
9,021,960 B1 5/2015 Cahayla
9,024,503 B2 5/2015 Schurig et al.
9,027,456 B2 5/2015 Mhaskar
9,038,521 B1 5/2015 Rollins et al.
9,062,534 B2 6/2015 Evans et al.
9,068,411 B2 6/2015 O'Connor et al.
9,068,449 B2 6/2015 Surjaatmadja
9,080,431 B2 7/2015 Bell et al.
9,080,433 B2 7/2015 Lanclos et al.
9,086,085 B2 7/2015 Lubchansky et al.
9,091,152 B2 7/2015 Rodgers et al.
9,115,572 B1 8/2015 Hardesty et al.
9,121,265 B2 9/2015 Myers et al.
9,133,695 B2 9/2015 Xu
9,134,170 B2 9/2015 Mefford et al.
9,145,763 B1 9/2015 Sites, Jr.
9,146,295 B2 9/2015 Jiang et al.
9,147,955 B2 9/2015 Hanson et al.
9,157,718 B2 10/2015 Ross
9,174,381 B1 11/2015 Morales
9,175,553 B2 11/2015 Mccann et al.
9,187,990 B2 11/2015 Xu

(56) References Cited

U.S. PATENT DOCUMENTS 9,200,487 B2 12/2015 Draper et al.
9,206,675 B2 12/2015 Hales et al.
9,217,305 B2 12/2015 Coles et al.
9,222,339 B2 12/2015 Mason et al.
9,238,956 B2 1/2016 Martinez
9,272,337 B2 3/2016 Steppan et al.
9,284,819 B2 3/2016 Tolman et al.
9,284,824 B2 3/2016 Fadul et al.
9,297,228 B2 3/2016 Martinez et al.
9,310,284 B2 4/2016 Graham et al.
9,366,372 B2 6/2016 Nakazono et al.
9,382,783 B2 7/2016 Langford et al.
9,394,767 B2 7/2016 Brooks et al.
9,428,988 B2 8/2016 Lynn et al.
9,441,438 B2 9/2016 Allison et al.
9,446,444 B2 9/2016 Christensen et al.
9,447,678 B2 9/2016 Walter et al.
9,464,508 B2 10/2016 Lerche et al.
9,476,289 B2 10/2016 Wells et al.
9,476,290 B2 10/2016 Umphries et al.
9,488,024 B2 11/2016 Hoffman et al.
9,506,317 B2 11/2016 Craig et al.
9,506,333 B2 11/2016 Castillo et al.
9,518,454 B2 12/2016 Current et al.
9,520,219 B2 12/2016 Lagrange et al.
9,520,249 B2 12/2016 Bonavides et al.
9,523,271 B2 12/2016 Bonavides et al.
9,528,360 B2 12/2016 Castillo et al.
9,530,581 B2 12/2016 Bonavides et al.
9,534,484 B2 1/2017 Wright et al.
9,535,015 B2 1/2017 Isomura et al.
9,540,913 B2 1/2017 Moore et al.
9,540,919 B2 1/2017 Castillo et al.
9,545,697 B2 1/2017 Whinnem et al.
9,557,212 B2 1/2017 Xia et al.
9,562,364 B1 2/2017 Lehr
9,562,421 B2 2/2017 Hardesty et al.
9,562,736 B2 2/2017 Grossnickle et al.
9,581,422 B2 2/2017 Preiss et al.
9,593,548 B2 3/2017 Hill et al.
9,593,560 B2 3/2017 Mailand et al.
9,598,940 B2 3/2017 Rodgers et al.
9,598,941 B1 3/2017 Upchurch et al.
9,605,937 B2 3/2017 Eitschberger et al.
9,606,214 B2 3/2017 Kelchner et al.
9,611,709 B2 4/2017 O'malley et al.
9,617,814 B2 4/2017 Seals et al.
9,625,226 B2 4/2017 Lee et al.
9,631,462 B2 4/2017 Tirado et al.
9,649,682 B2 5/2017 Keener et al.
9,650,857 B2 5/2017 Mailand et al.
9,677,363 B2 * 6/2017 Schacherer ..... E21B 29/02
9,689,223 B2 6/2017 Schacherer et al.
9,689,237 B2 6/2017 Johnson et al.
9,689,238 B2 6/2017 Hardesty et al.
9,689,239 B2 6/2017 Hardesty
9,695,646 B2 7/2017 Grice et al.
9,702,029 B2 7/2017 Fripp et al.
9,708,894 B2 7/2017 Ditzler et al.
9,719,339 B2 8/2017 Richard et al.
9,725,993 B1 8/2017 Yang et al.
9,745,836 B2 8/2017 Zevenbergen et al.
9,745,847 B2 8/2017 Ditzler et al.
9,750,162 B2 8/2017 Szarek
9,752,423 B2 9/2017 Lynk
9,759,049 B2 9/2017 Hardesty et al.
9,759,356 B2 9/2017 Ott et al.
9,765,601 B1 9/2017 Yang et al.
9,776,767 B2 10/2017 Dejesus et al.
9,784,549 B2 10/2017 Eitschberger
9,789,506 B2 10/2017 Kosta et al.
9,803,455 B1 10/2017 Yang et al.
9,810,036 B2 11/2017 Mailand et al.
9,810,047 B2 11/2017 Filyukov et al.
9,816,791 B2 11/2017 Erickson et al.
9,822,618 B2 11/2017 Eitschberger
9,823,053 B1 11/2017 Fink
9,833,838 B2 12/2017 Mazyar et al.
9,839,889 B2 12/2017 Quinto
9,841,253 B2 12/2017 Anthony
9,845,666 B2 12/2017 Hardesty et al.
9,851,191 B2 12/2017 Lerche et al.
9,855,229 B2 1/2018 Khairatkar-Joshi et al.
9,856,411 B2 1/2018 Sadana et al.
9,869,160 B2 1/2018 Onuoha et al.
9,870,048 B2 1/2018 Yamazaki et al.
9,874,062 B2 1/2018 Lajesic et al.
9,879,492 B2 1/2018 Kitzman
9,896,915 B2 2/2018 Balun et al.
9,896,920 B2 2/2018 Holder
9,903,185 B2 2/2018 Ursi et al.
9,914,165 B2 3/2018 Erickson
9,925,628 B2 3/2018 Drexler et al.
9,926,777 B2 3/2018 Rodgers et al.
9,938,789 B2 4/2018 Silva et al.
9,951,589 B2 4/2018 Wilson et al.
9,963,231 B2 5/2018 Chattopadhyay et al.
9,988,898 B2 6/2018 Mccolpin et al.
9,989,512 B2 6/2018 Haggerty et al.
10,035,287 B2 7/2018 Song et al.
10,077,641 B2 9/2018 Rogman et al.
10,352,136 B2 7/2019 Goyeneche
10,458,213 B1 10/2019 Eitschberger et al.
10,584,950 B2 3/2020 Saltarelli et al.
10,598,002 B2 3/2020 Sites
10,689,955 B1 6/2020 Mauldin et al.
10,731,444 B2 8/2020 Wells et al.
10,794,159 B2 10/2020 Eitschberger et al.
10,844,696 B2 11/2020 Eitschberger et al.
10,844,697 B2 11/2020 Parks et al.
11,078,762 B2 * 8/2021 Mauldin ..... E21B 43/1185
11,091,987 B1 * 8/2021 Benker ..... E21B 43/119
11,168,546 B2 * 11/2021 Melhus ..... E21B 43/116
11,255,650 B2 2/2022 Sullivan et al.
11,391,127 B1 7/2022 Hoelscher et al.
11,414,965 B2 * 8/2022 Zhao ..... E21B 43/118
11,624,266 B2 * 4/2023 Mauldin ..... E21B 43/1185 166/299
11,674,371 B1 * 6/2023 Bradley ..... E21B 43/117 89/1.15
11,732,556 B2 8/2023 Eitschberger
11,867,032 B1 1/2024 Parks et al.
11,976,539 B2 * 5/2024 Mauldin ..... E21B 43/117
2003/0047358 A1 3/2003 Bonkowski
2003/0098158 A1 5/2003 George et al.
2004/0144539 A1 7/2004 Smith et al.
2009/0050322 A1 2/2009 Hill et al.
2011/0132607 A1 6/2011 Lahitette et al.
2014/0020896 A1 1/2014 Al-Gouhi et al.
2014/0137723 A1 5/2014 Umphries et al.
2015/0173592 A1 6/2015 Leeflang et al.
2016/0061572 A1 3/2016 Eitschberger et al.
2016/0084048 A1 3/2016 Harrigan et al.
2016/0273902 A1 9/2016 Eitschberger
2016/0333675 A1 11/2016 Wells et al.
2017/0009559 A1 1/2017 Spring et al.
2017/0211363 A1 7/2017 Bradley et al.
2018/0112524 A1 4/2018 Huang et al.
2018/0119529 A1 5/2018 Goyeneche
2018/0299239 A1 10/2018 Eitschberger et al.
2018/0347324 A1 12/2018 Langford et al.
2019/0145216 A1 5/2019 Shampine et al.
2019/0195054 A1 6/2019 Bradley et al.
2019/0212118 A1 7/2019 Saltarelli et al.
2019/0257181 A1 8/2019 Langford et al.
2019/0264548 A1 8/2019 Zhao et al.
2020/0024935 A1 1/2020 Eitschberger et al.
2020/0063537 A1 2/2020 Langford et al.
2020/0157924 A1 5/2020 Melhus et al.
2020/0256168 A1 8/2020 Knight et al.
2020/0392821 A1 12/2020 Eitschberger et al.
2021/0230986 A1 7/2021 Macgillivray
2022/0010660 A1 1/2022 Dyess et al.
2022/0056789 A1 2/2022 LaGrange et al.

(56) References Cited

U.S. PATENT DOCUMENTS

| | | | | |
|---|---|---|---|---|
| 2024/0003200 | A1 | 1/2024 | Knight et al. | |
| 2024/0401441 | A1* | 12/2024 | Anthony | E21B 43/118 |
| 2024/0418061 | A1* | 12/2024 | Bradley | E21B 43/117 |

FOREIGN PATENT DOCUMENTS

| | | | |
|---|---|---|---|
| WO | 2015173592 | A1 | 11/2015 |
| WO | 2016186611 | A1 | 11/2016 |

OTHER PUBLICATIONS

DynaEnergitcs; DynaEnergetics Brochure; 2021 DMC Global Inc.
GEODynamics; GEODynamics Brochure; VaporGun 2¾"; Palenls:www.perf.com/patenls; 2020 GEODynamics.
Canadian Office Action dated Jul. 25, 2022, for Canadian Patent Application No. 3,074,637.
Canadian Office Action dated May 17, 2021, for Canadian Patent Application No. 3,074,637.
*DynaEnergetics Europe GmbH and DynaEnergetics US, Inc*. V. *SWM International, LLC*; Case: IPR2022-01372; Claim Construction Order (W.D. Tex); May 25, 2022.
*DynaEnergetics Europe GmbH and DynaEnergetics US, Inc*. V. *SWM International, LLC*; Case: IPR2022-01372; Decision Granting Institution of Inter Partes Review of U.S. Pat. No. 11,078,762, entered Feb. 15, 2023, 41-pgs.
*DynaEnergetics Europe GmbH and DynaEnergetics US, Inc*. V. *SWM International, LLC*; Case: IPR2022-01372; Declaration of John Rodgers, Ph.D.
*DynaEnergetics Europe GmbH and DynaEnergetics US, Inc*. V. *SWM International, LLC*; Case: IPR2022-01372; Petition for Inter Partes Review of U.S. Pat. No. 11,078,762.
Juvinall, Rolling-Element Bearing Types; Fundamentals of Machine Component Design Second Edition; Canada; 6 pages.
Non-Final Office Action dated Apr. 27, 2020, corresponding to U.S. Appl. No. 16/293,522.
Non-Final Office Action dated Dec. 26, 2019, corresponding to U.S. Appl. No. 16/293,532.
Non-Final Office Action dated Jul. 15, 2020, corresponding to U.S. Appl. No. 16/293,528.
Non-Final Office Action dated Sep. 16, 2020, corresponding to U.S. Appl. No. 16/293,492.
Oberg et al.; Plain Bearings; Machinery's Handbook 28th Edition; Industrial Press, New York 2008; 3 pages.
Schlumberger, "Oilfield Review," Autumn 2014, 68 pgs.
Schlumberger, OrientXact, "Precisely oriented single-trip perforating system," 2 pgs.
Simmons, et al.; Manual of Engineering Drawing to British and International Standards; Second edition; 2004; 308 pages.
*SWM International, LLC* v. *Dynaergetics Europe GmbH, and Dynaenergetics US, Inc*.; (W.D. Tex) Civil Action No. 6:21-cv-00804-ADA; Responsive Claim Construction Brief (W.D. Tex).
*SWM International, LLC* v. *Dynaergetics Europe GmbH, and Dynaenergetics US, Inc*.; (W.D. Tex) Civil Action No. 3 6:21-cv-00804-ADA; Plaintiff SWM International, LLC's Responses and Objections to Dynaergetics Europe GmbH and Dynaenergetics US, Inc.'s; First set of Interrogatories.
US Non-Final Office Action in U.S. Appl. No. 16/809,729 dated Feb. 3, 2022.

* cited by examiner

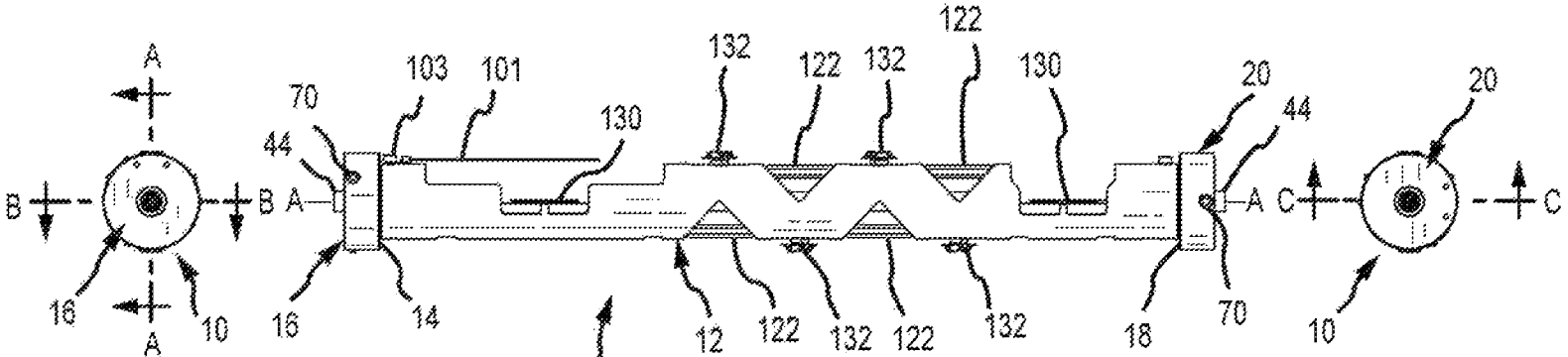
FIG.5A
FIG.5
FIG.5B
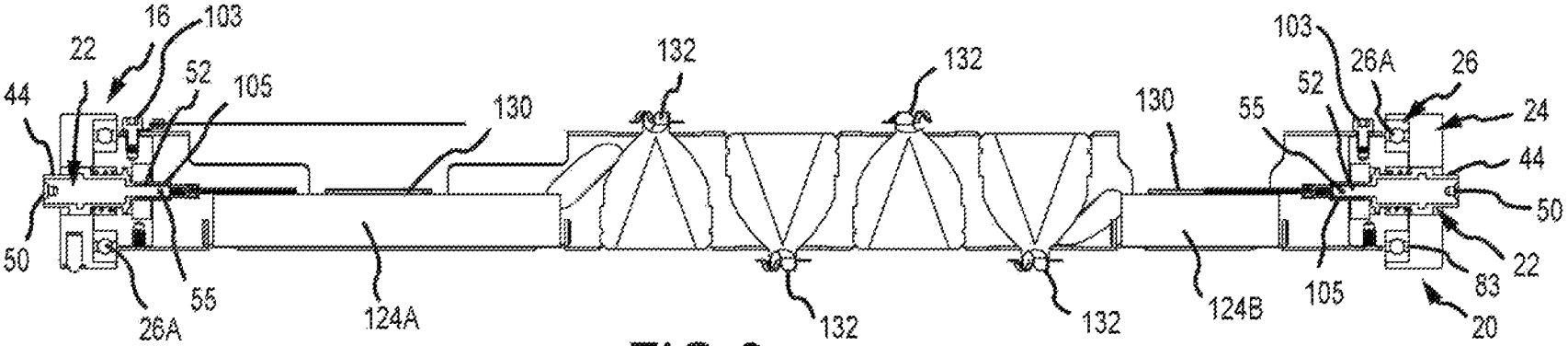
FIG.6

DOWNHOLE PERFORATING GUN SYSTEM

REFERENCE TO RELATED APPLICATIONS

This application claims priority to U.S. application Ser. No. 17/831,900 filed Jun. 3, 2022, which claims priority from provisional U.S. 63/196,922 filed on Jun. 4, 2021, and U.S. application Ser. No. 16/293,508 filed Mar. 5, 2019, now patented as U.S. Pat. No. 11,078,762 issued on Aug. 3, 2021, the entire disclosure of which is incorporated herein by this reference.

TECHNICAL FIELD

The present disclosure relates generally to downhole perforating gun systems, and more particularly to a rotatable perforating gun systems including manufacture, assembly, and methods of operation thereof.

BACKGROUND OF THE INVENTION

In a conventional oil and gas well, the wellbore is cased and cemented to isolate the wellbore from the surrounding formations. However, the surrounding formations are what contain the reservoirs containing oil and gas. Therefore, it is necessary to penetrate the casing and cement at the depth of the producing reservoir to provide a flow path for the oil and gas. This is done through perforating.

Perforations are usually made in the metal casing and concrete using a perforating gun assembly that is generally comprised of a steel carrier, and a charge tube inside of the carrier with shaped charges positioned in the charge tube. The perforating gun is lowered into the wellbore and is typically connected to an electric wireline or other conveyance device until it is at a predetermined position. Then a signal actuates a firing head of the gun, which detonates the shaped charges in the gun. The explosion of the shaped charges perforates the metal casing and concrete to allow fluids to flow from the formation into the wellbore. Typically, multiple perforating guns are connected together to form a string. The perforating string is conveyed downhole with a wireline or tubing string.

Because the perforating guns are explosive, it is important to isolate the guns in a string from each other. This requires the gun string to maintain electrical connectivity with the surface even after some of the guns are detonated. Previously, the guns have been electrically connected with a plurality of wires. This is time consuming for those installing the gun string and results in a failure point for the guns.

Therefore, what is needed is a perforating gun system that addresses one or more of the foregoing issues.

SUMMARY OF THE INVENTION

One or more embodiments of the present disclosure comprises a first cylindrical gun carrier, one or more weights in a cavity of the body, one or more end fittings, and one or more bearings. Gravity acts on the weights, which causes the gun tube to rotate around its longitudinal axis when the gun is horizontally oriented so the one or more weights are adjacent to the bottom of the wellbore. The explosive charges (also called "shape charges"), which are in the gun tube, then point upwards and/or downwards, or in any direction dictated by the position of the one or more weights. The gun tube may include a bearing housing that permit the gun tube body to rotate relative to the end fittings. A bulkhead is disposed proximate to a first end of a gun carrier and comprising a central throughbore, a sealing element disposed within a groove formed on an outer surface of the bulkhead, a feedthrough disposed within the throughbore of the bulkhead,

BRIEF DESCRIPTION OF DRAWINGS

The accompanying drawings, which are included to provide further understanding and are incorporated in and constitute a part of this specification, illustrate disclosed embodiments and together with the description serve to explain the principles of the disclosed embodiments. In the drawings:

FIG. 5 is a side view of the gun tube of FIG. 1.

FIG. 5A is an end view of the gun tube of FIG. 4.

FIG. 5B is an opposite end view of the gun tube of FIG. 4.

FIG. 6 is a cross-sectional side view of the gun tube of FIG. 4 taken along line A-A of FIG. 5A.

FIG. 57 illustrates the uphole end of a perforating gun, in accordance with embodiments of the present disclosure;

FIG. 58 illustrates the switch, in accordance with embodiments of the present disclosure;

FIG. 59 illustrates the switch, in accordance with embodiments of the present disclosure;

FIG. 60 illustrates conductive contacts, in accordance with embodiments of the present disclosure;

FIG. 61 illustrates conductive contacts, in accordance with embodiments of the present disclosure;

FIG. 62 illustrates conductive contacts, in accordance with embodiments of the present disclosure;

FIG. 63 illustrates conductive contacts, in accordance with embodiments of the present disclosure;

FIG. 64 illustrates conductive contacts, in accordance with embodiments of the present disclosure;

FIG. 65 illustrates a cross-sectional view of the uphole end of the perforating gun, in accordance with embodiments of the present disclosure;

FIG. 66 illustrates a cross-sectional view of a shipping plug, in accordance with embodiments of the present disclosure;

FIG. 67 is a cross-sectional side view of the connection of two perforating guns, in accordance with embodiments of the present disclosure;

Figure 68:
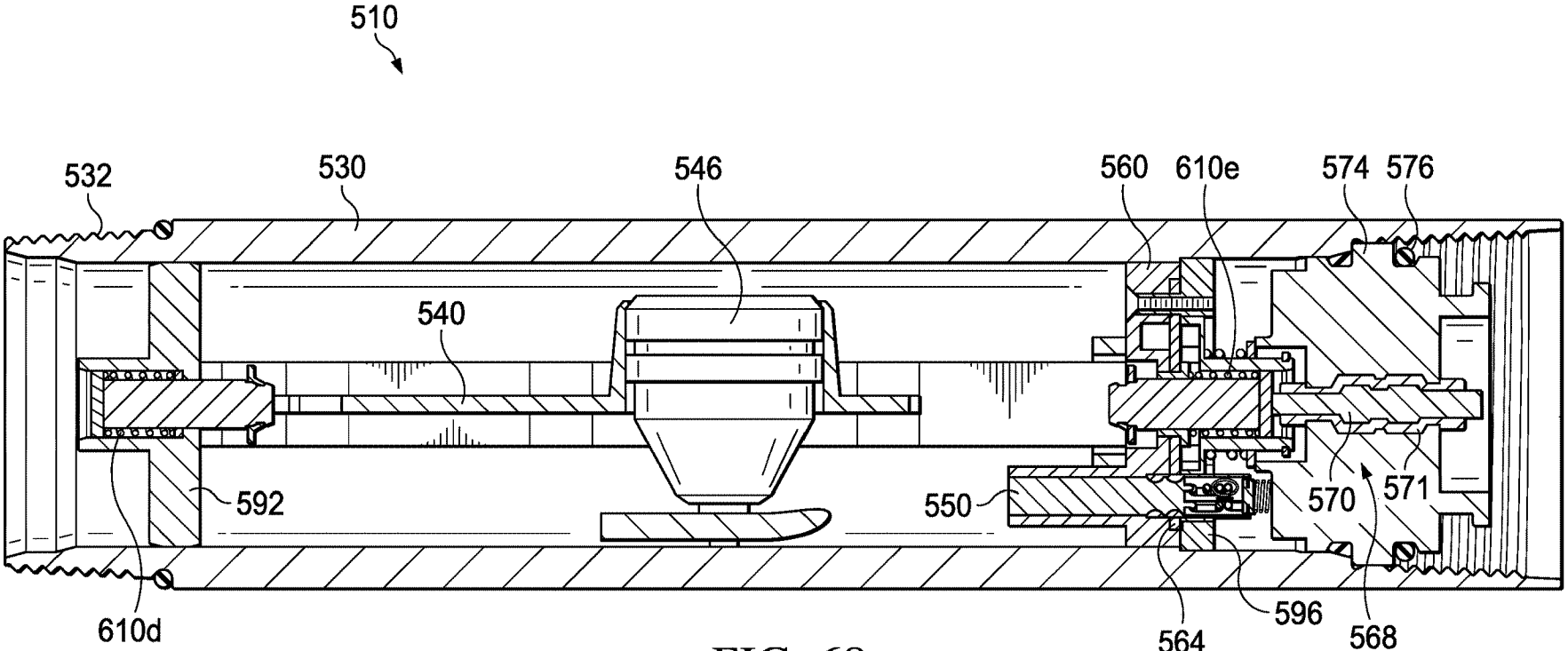
Figure 69:
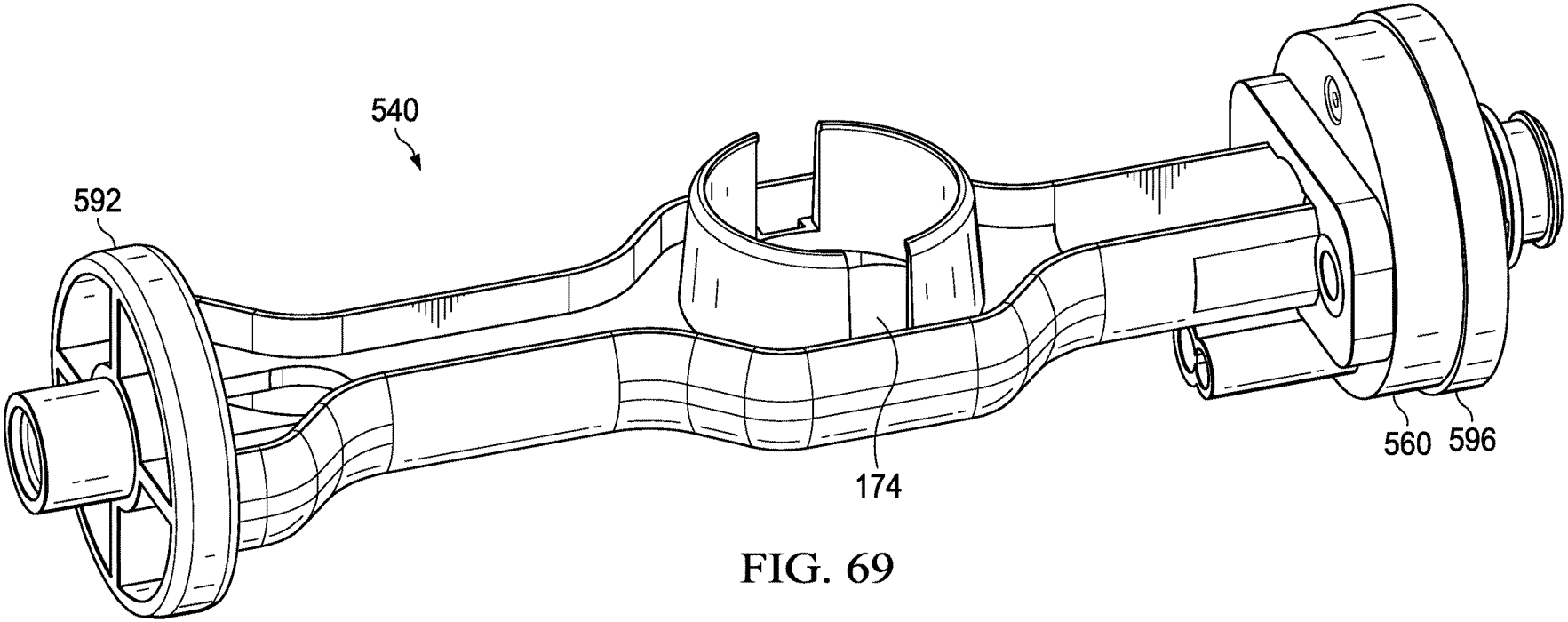
Figure 70:
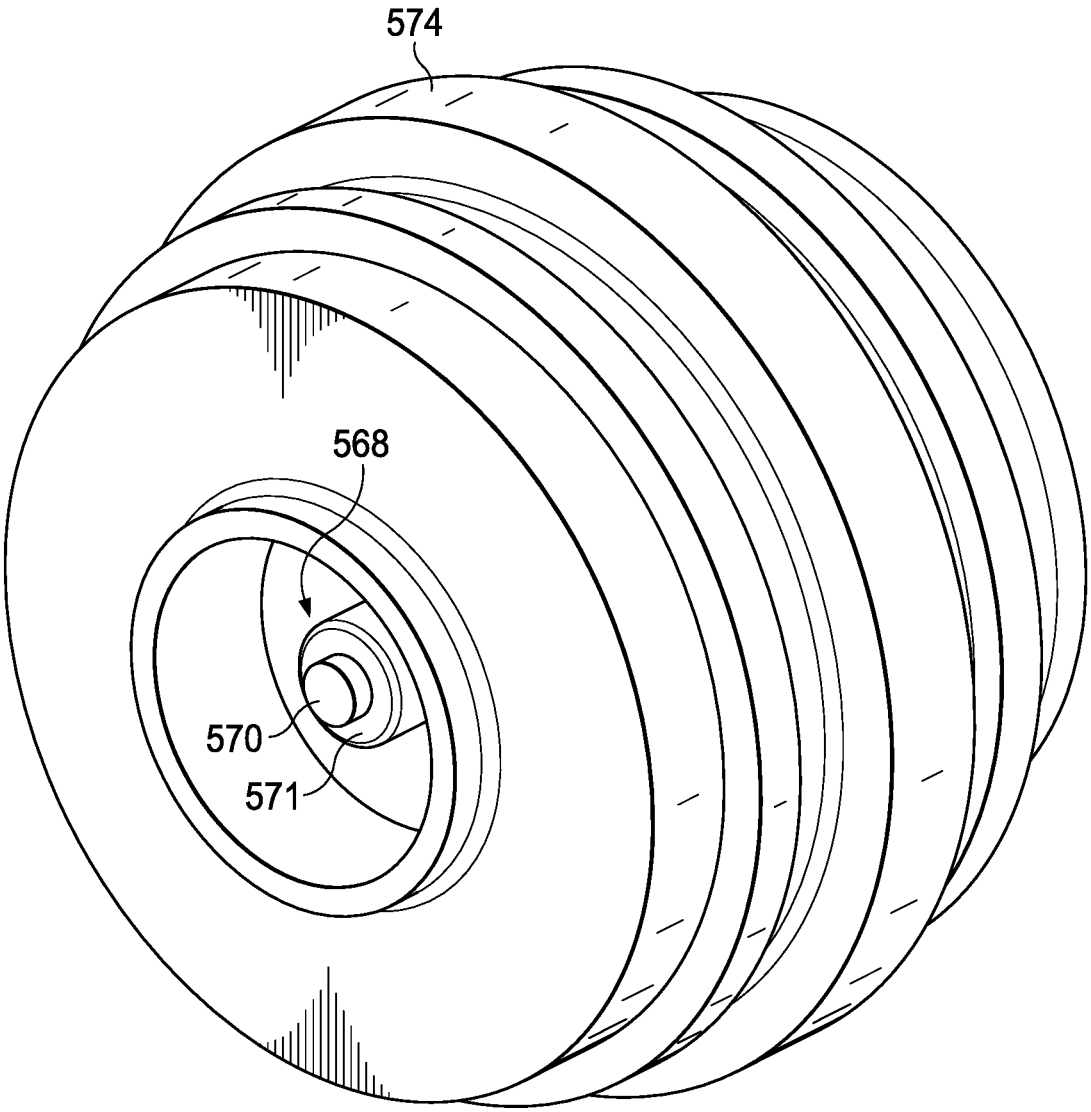
Figure 71:
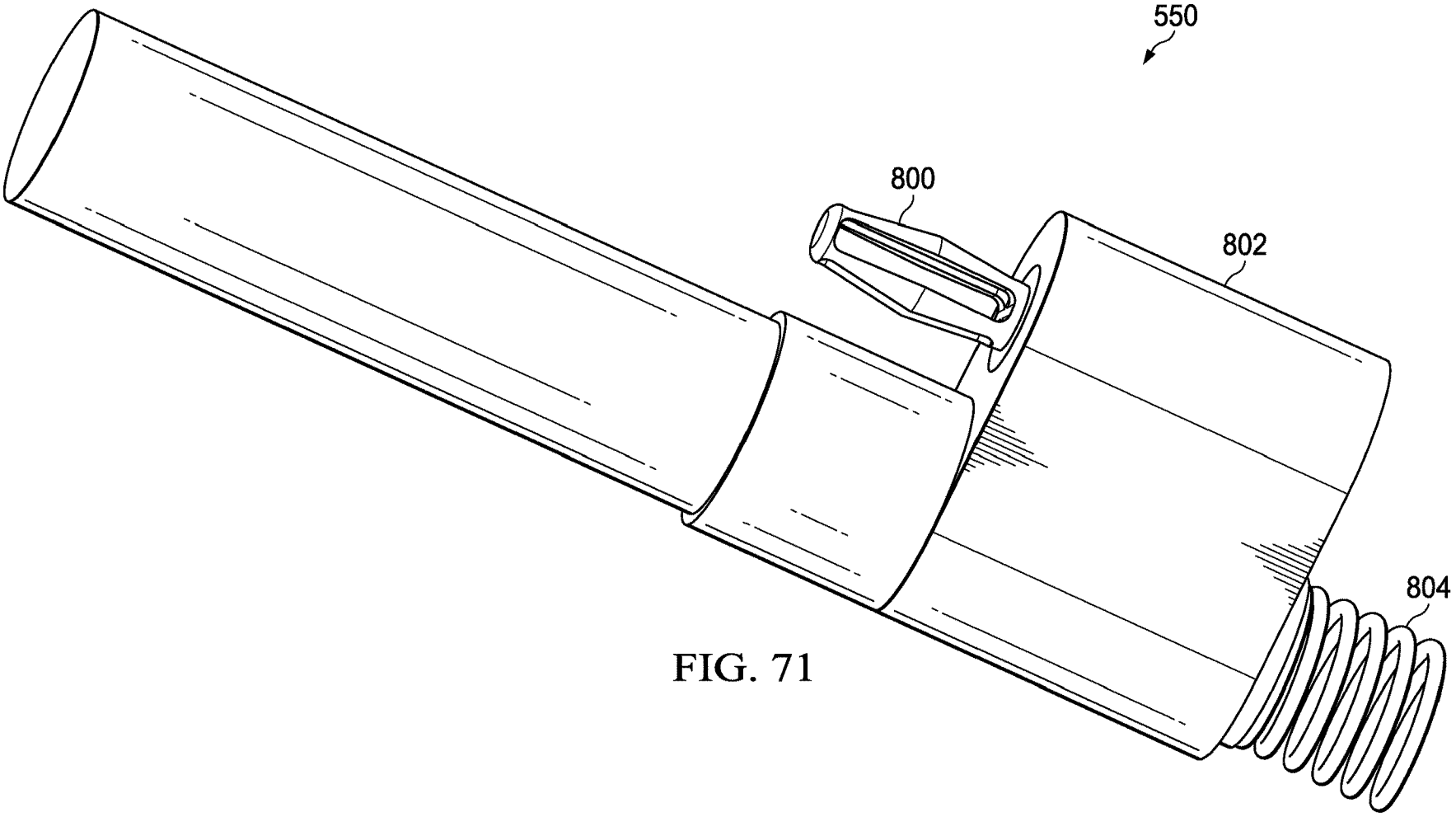
Figure 72:
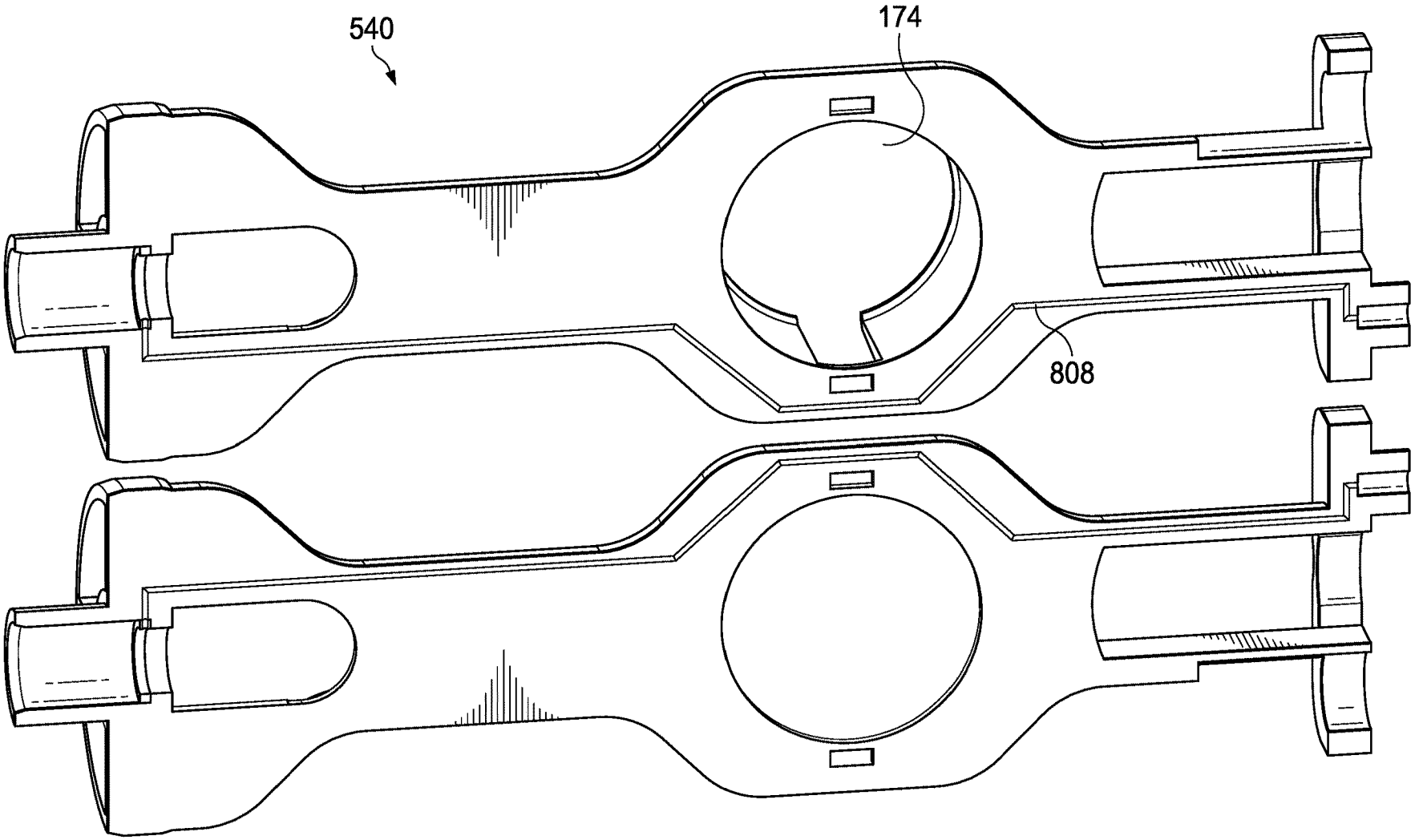
Figure 73:
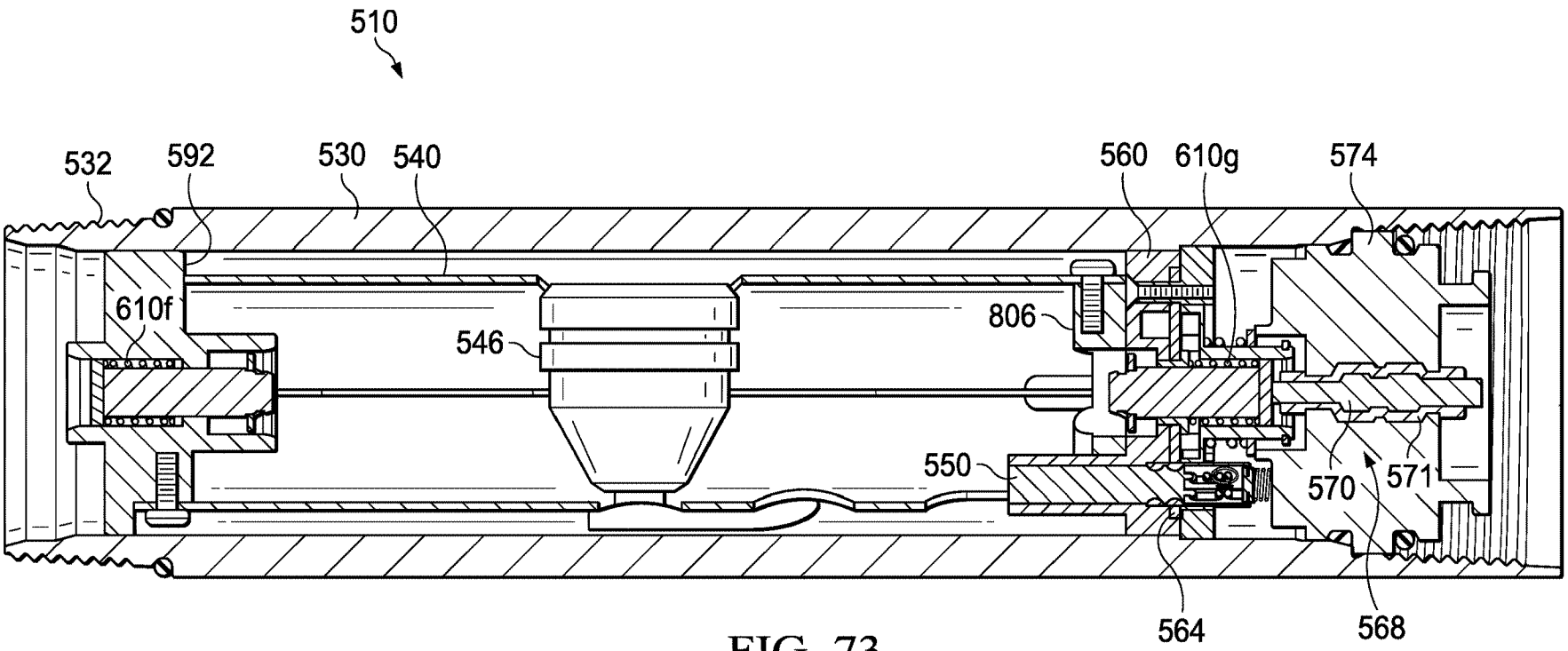
Figure 74A:
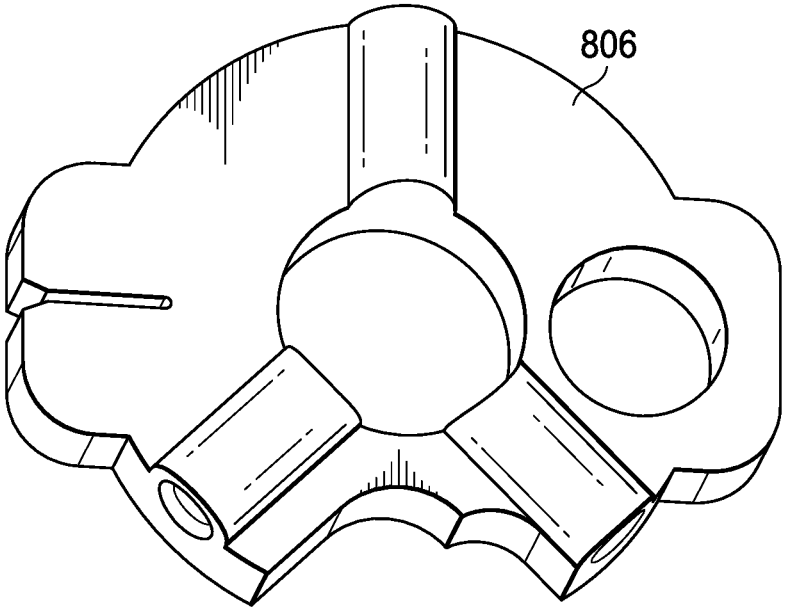
Figure 74B:
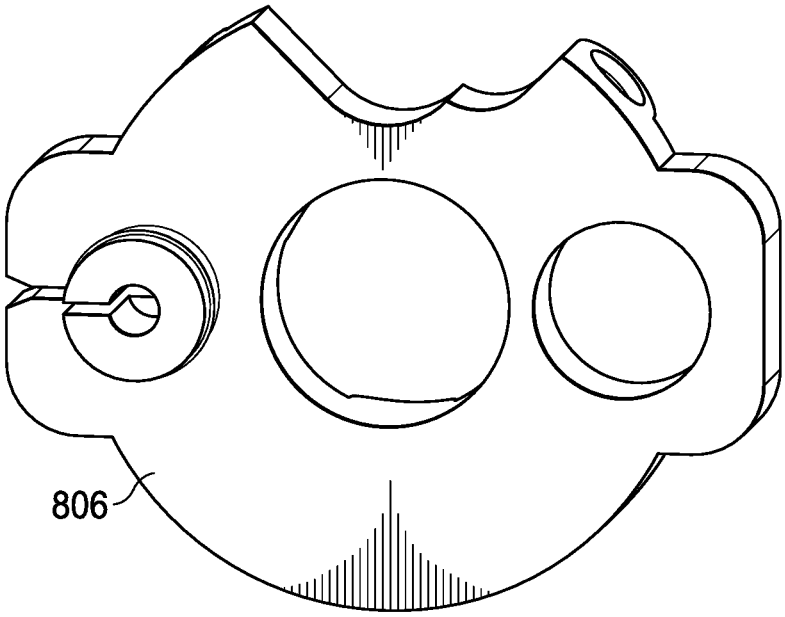

FIG. 68 a cross-sectional side view of a perforating gun in accordance with embodiments of the present disclosure;

FIG. 69 illustrates the charge holder of a perforating gun, in accordance with embodiments of the present disclosure;

FIG. 70 illustrates the bulkhead, in accordance with embodiments of the present disclosure;

FIG. 71 illustrates the detonator, in accordance with embodiments of the present disclosure;

FIG. 72 illustrates a split view of the charge holder, in accordance with embodiments of the present disclosure;

FIG. 73 is a cross-sectional side view of the a perforating gun with the charge tube adapter, in accordance with embodiments of the present disclosure;

FIG. 74A illustrates the charge tube adapter, in accordance with embodiments of the present disclosure;

FIG. 74B illustrates the charge tube adapter, in accordance with embodiments of the present disclosure.

Figure 75:
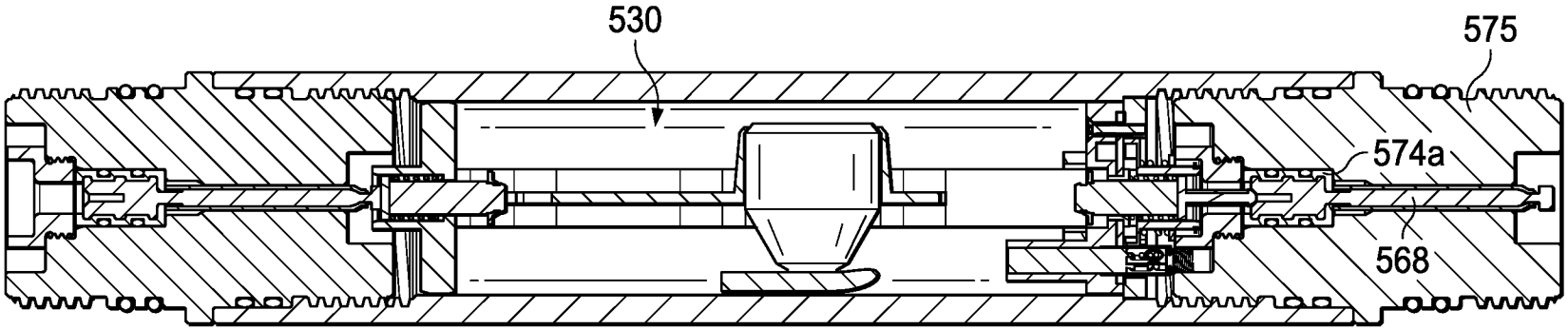

FIG. 75 illustrates an alternate embodiment of a perforating gun system, in which the bulkhead and feedthrough are located in a tandem sub adjacent to the gun carrier.

Figure 76:
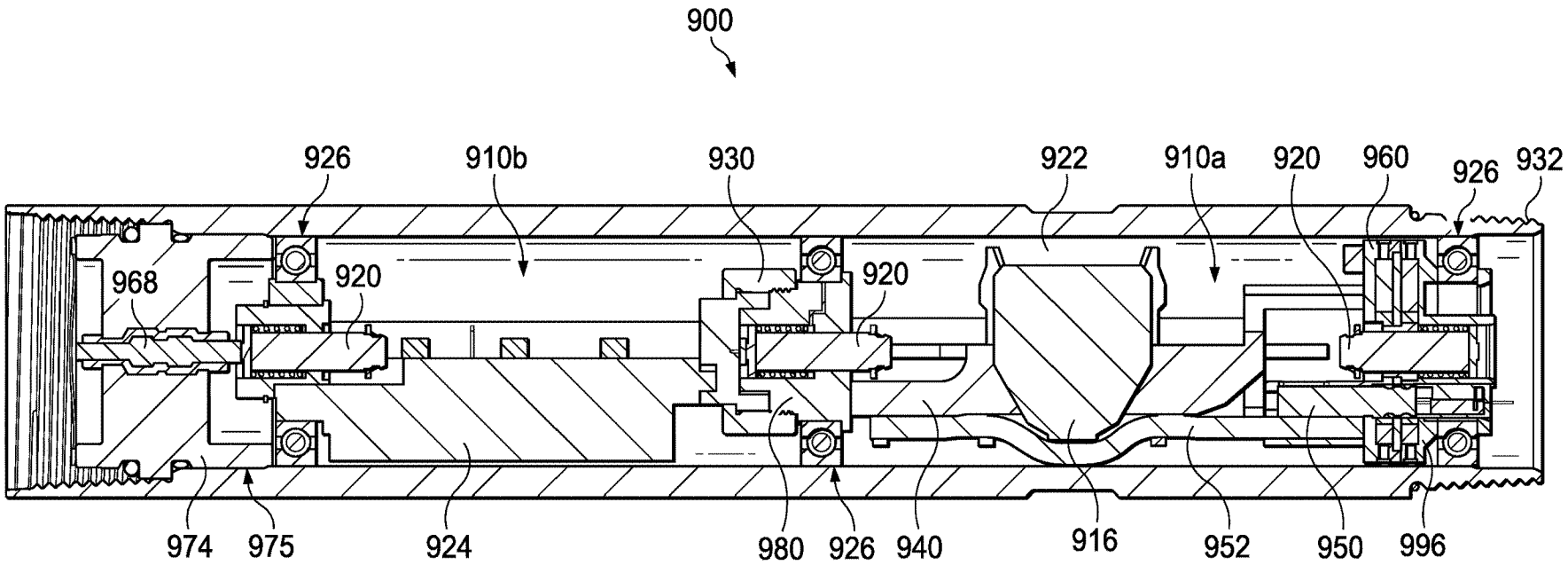
Figure 77A:
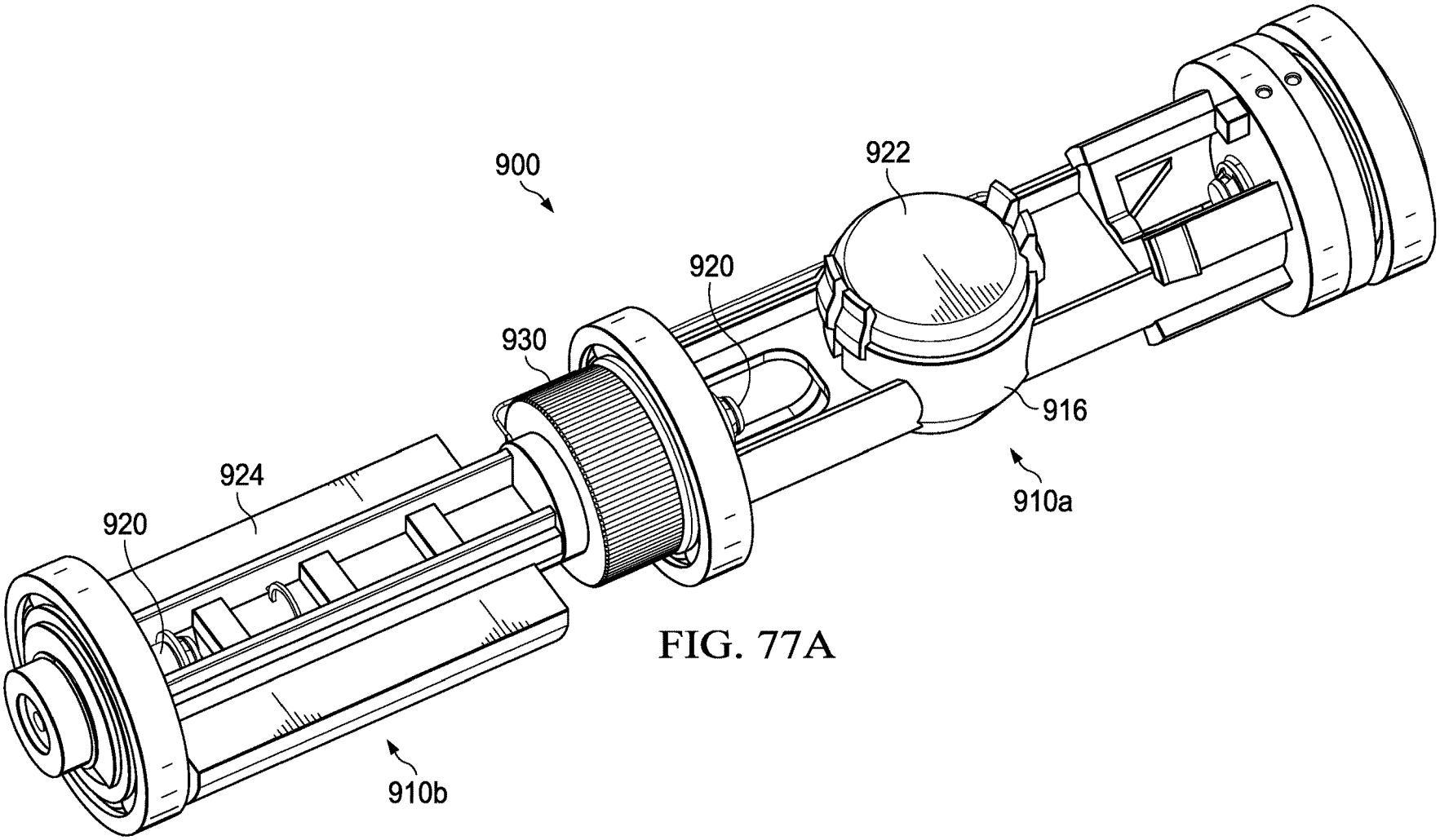
Figure 77B:
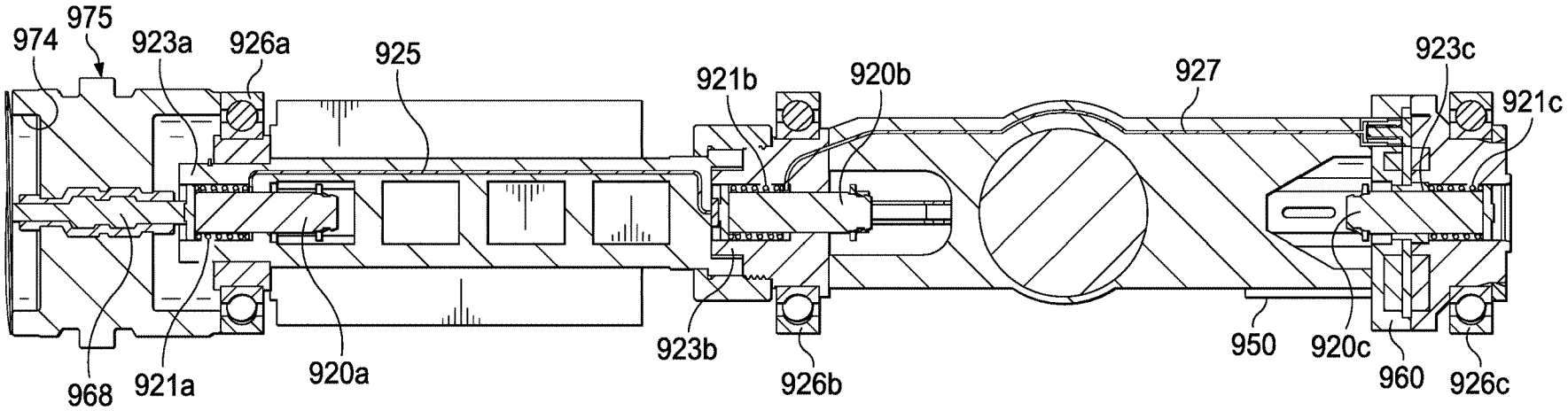
Figure 78:
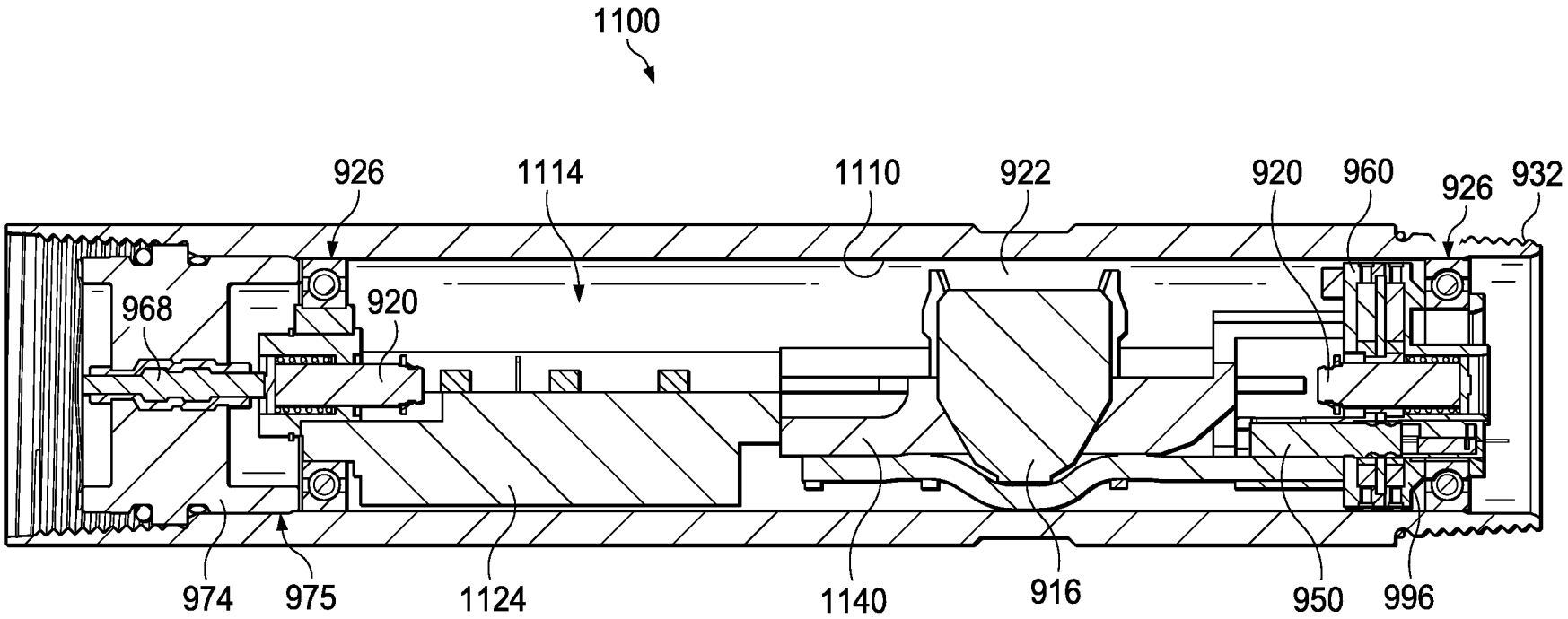
Figure 79:
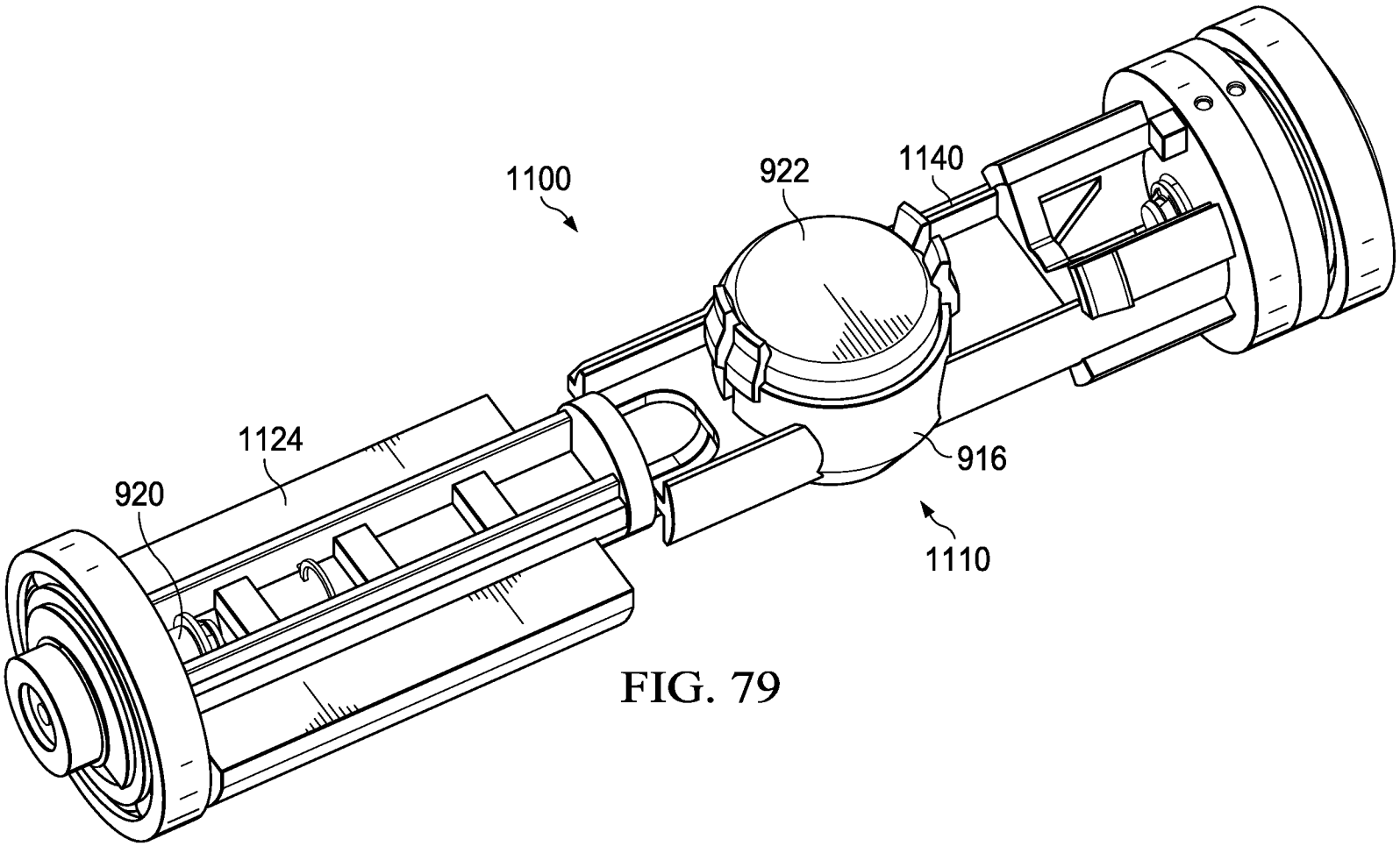
Figure 80:
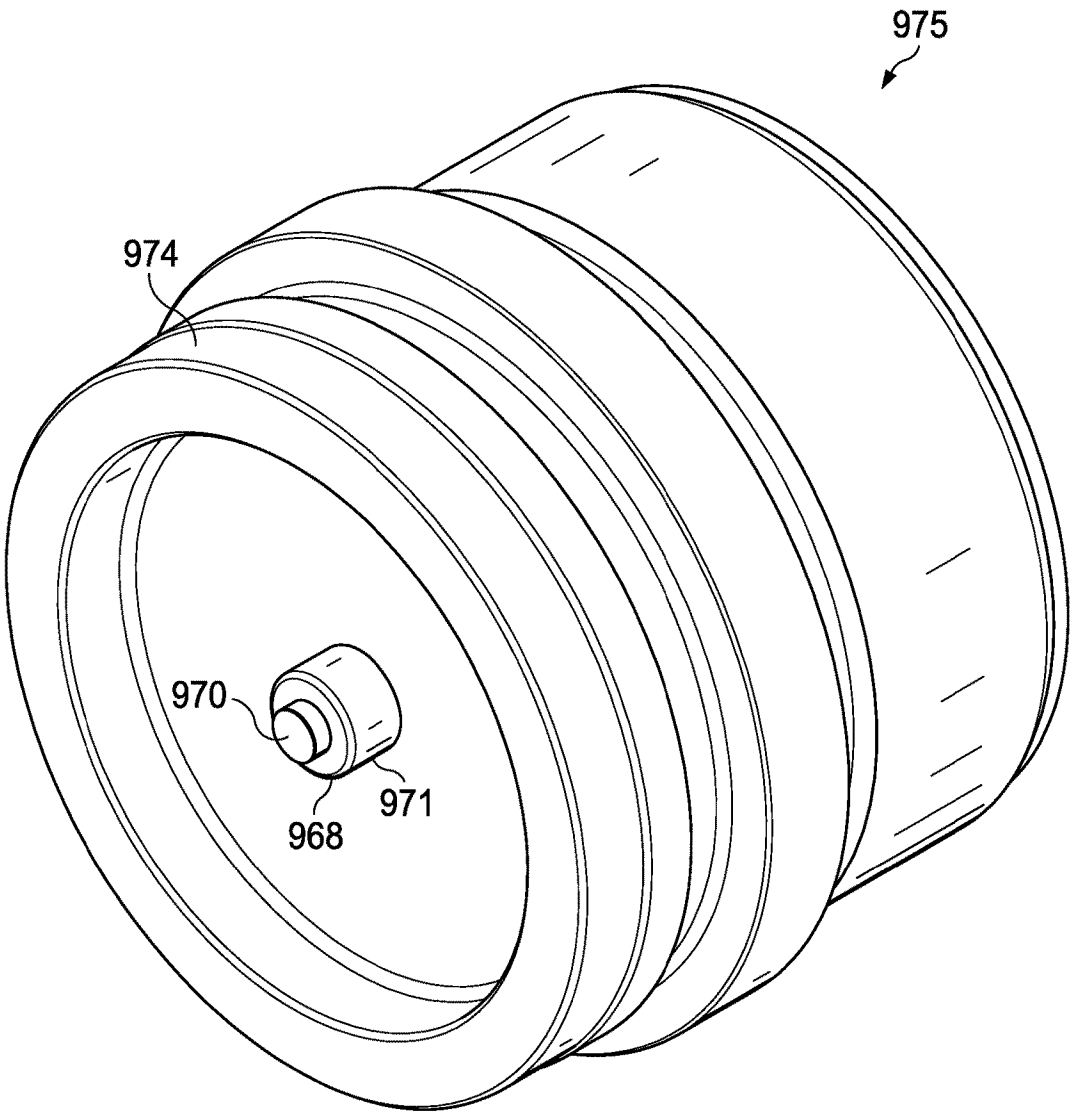
Figure 81:
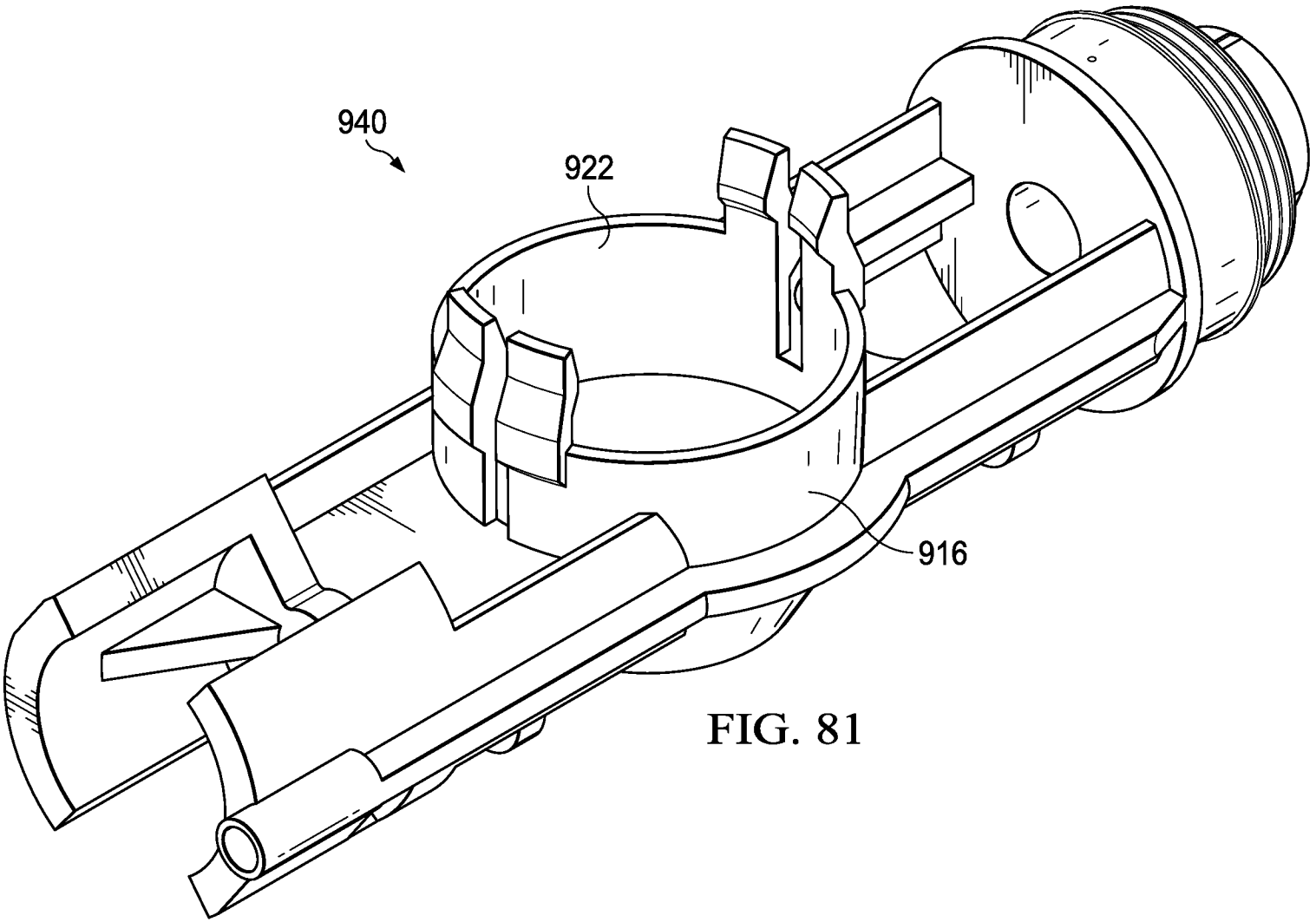
Figure 82:
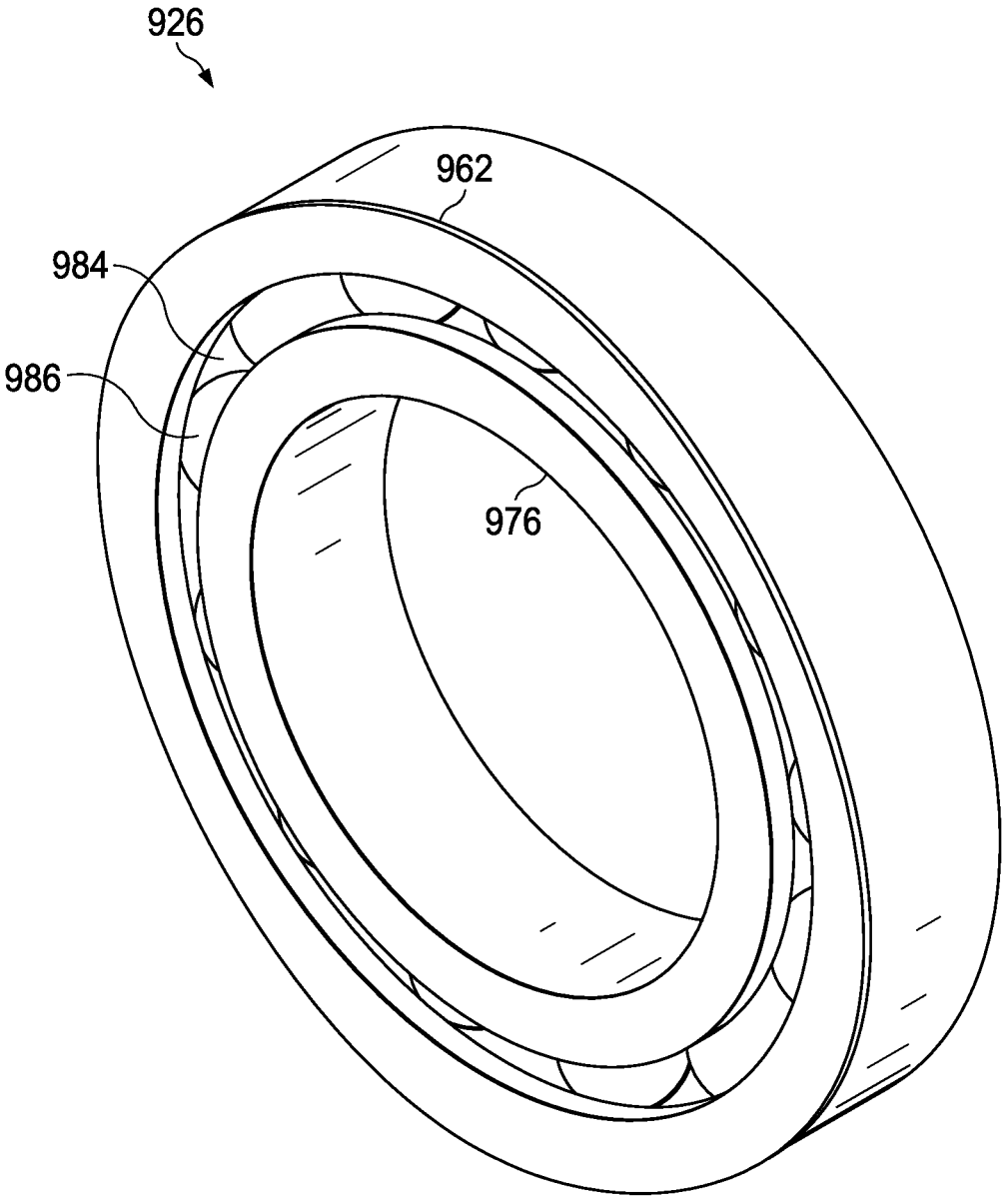
Figure 83:
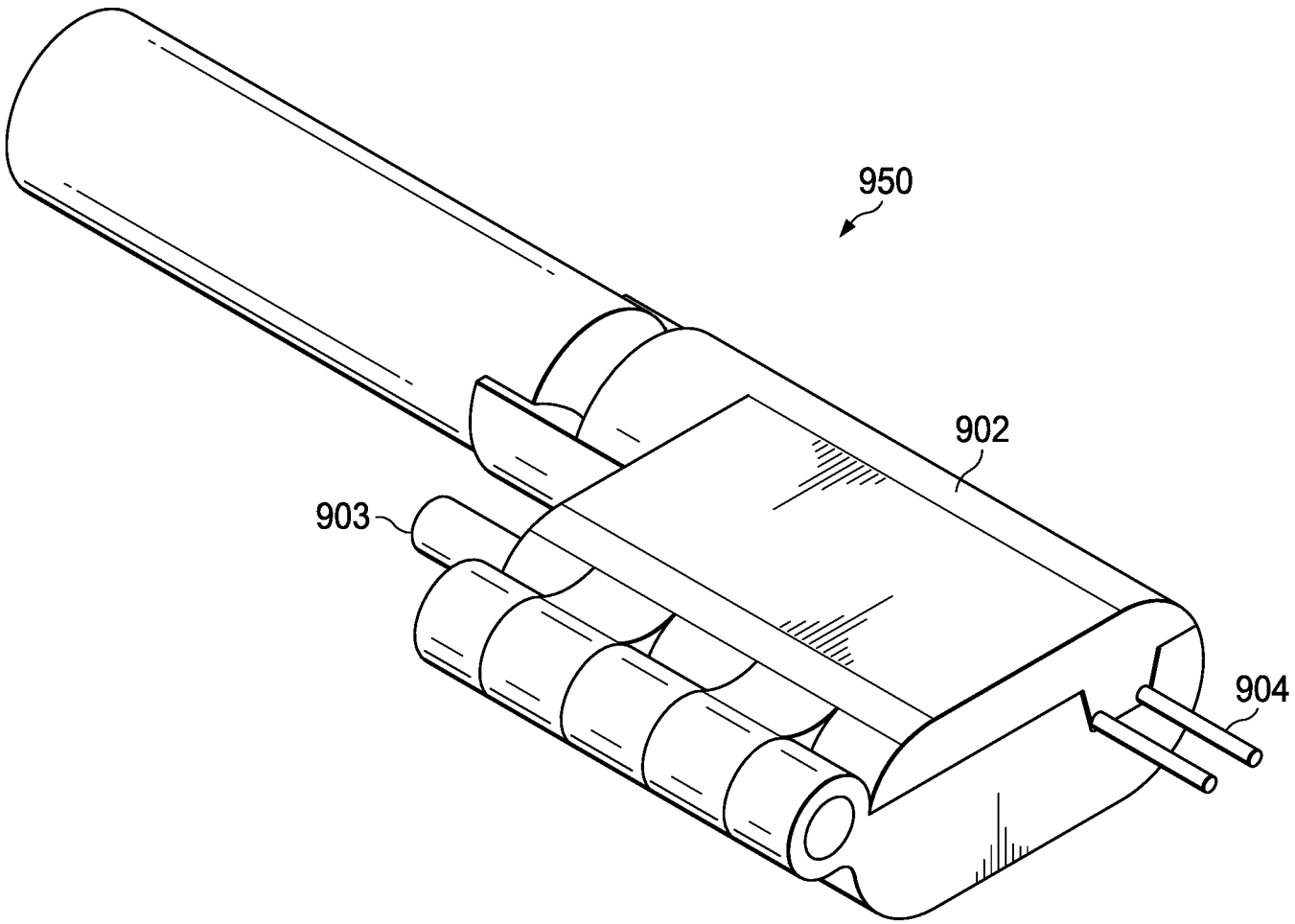
Figure 84:
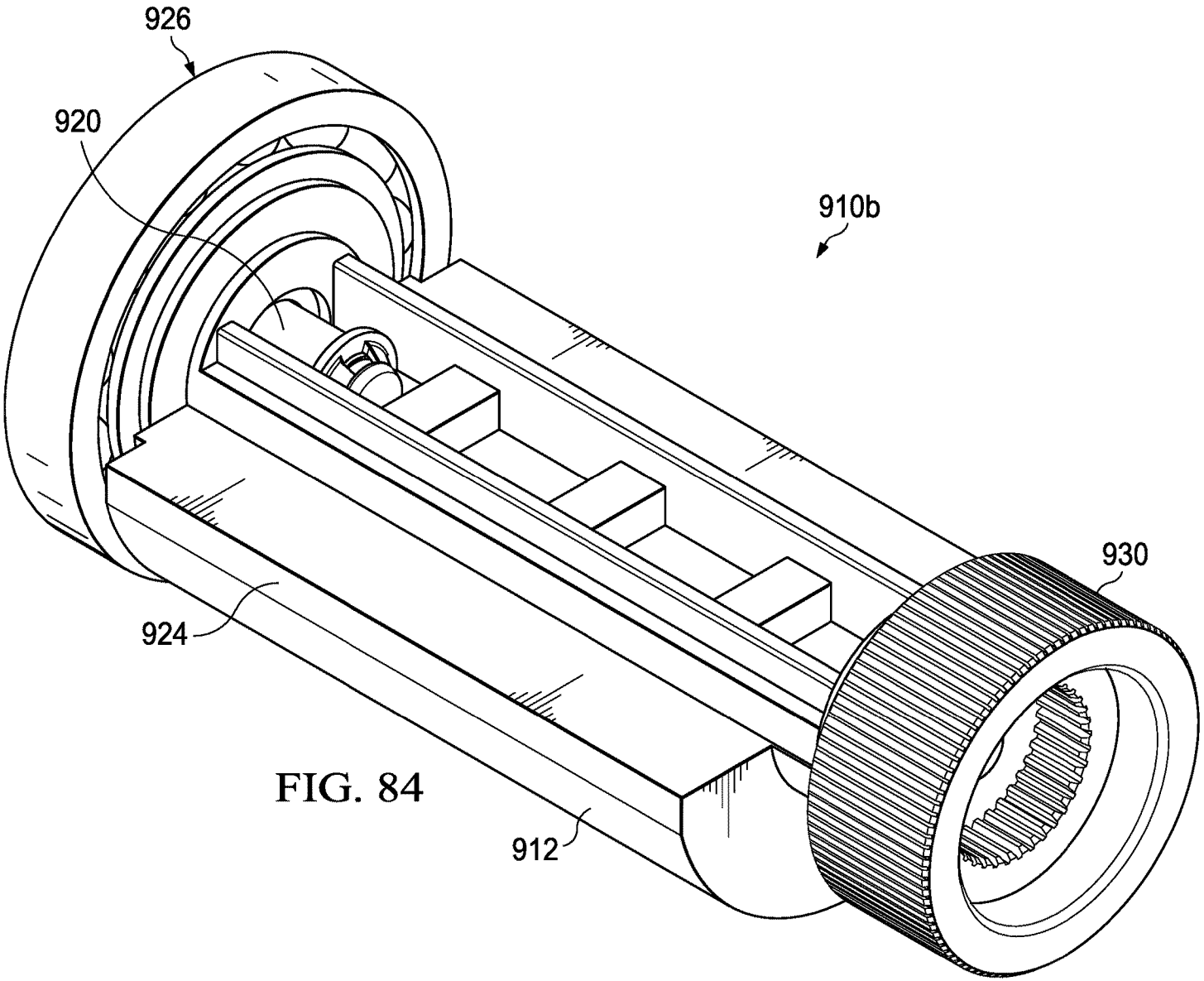
Figure 85:
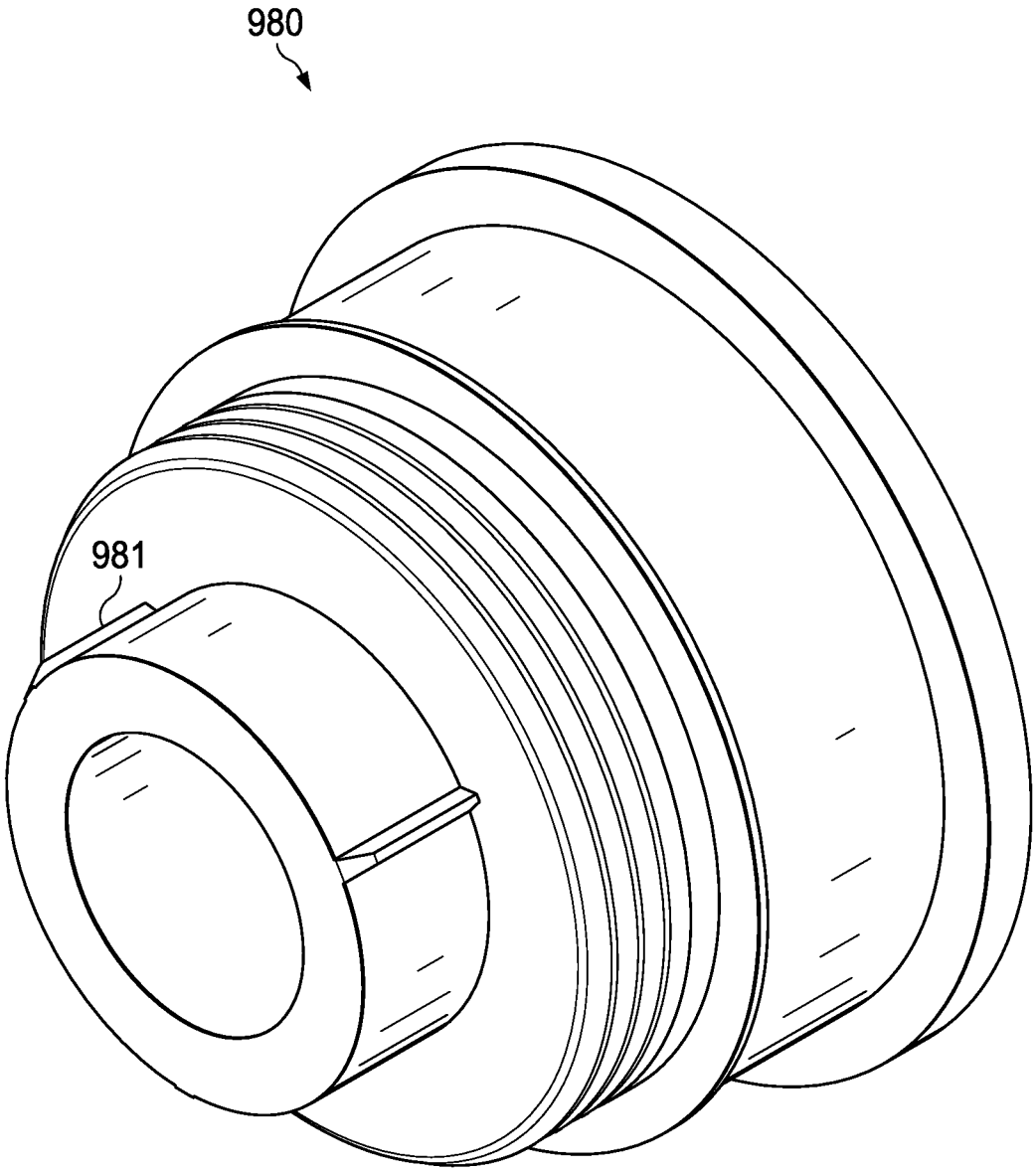
Figure 86:
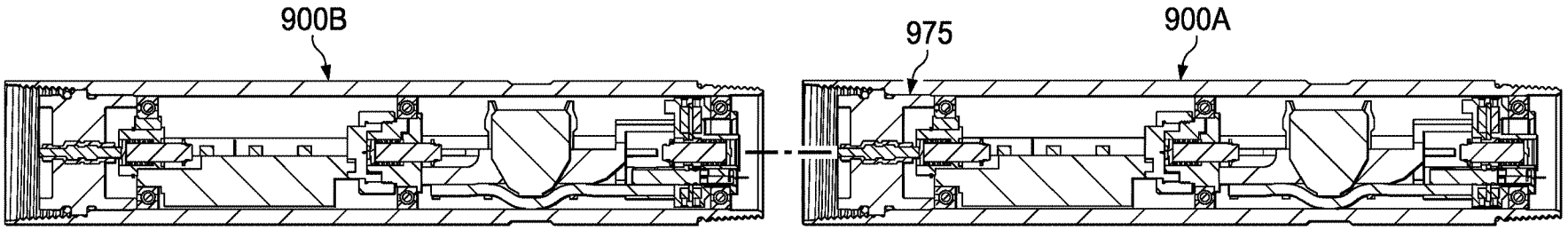
Figure 87:
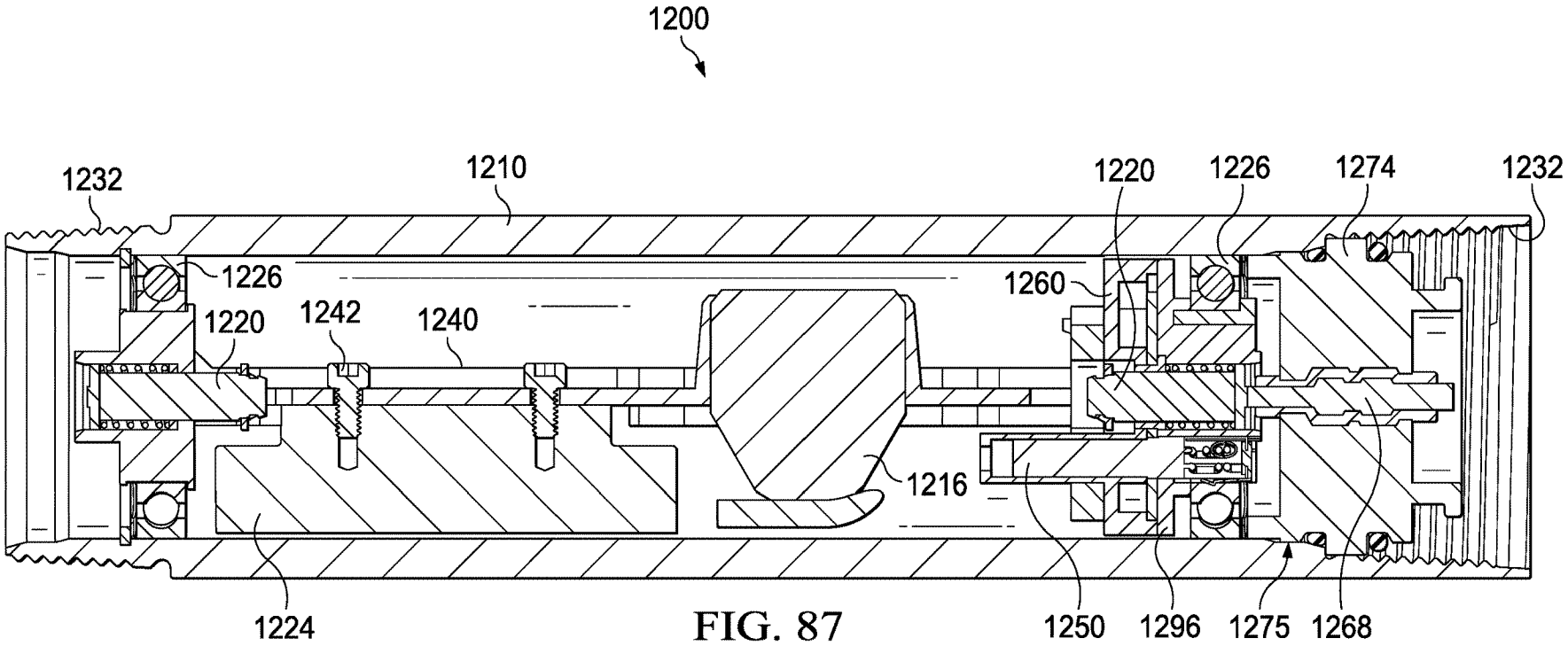
Figure 88:
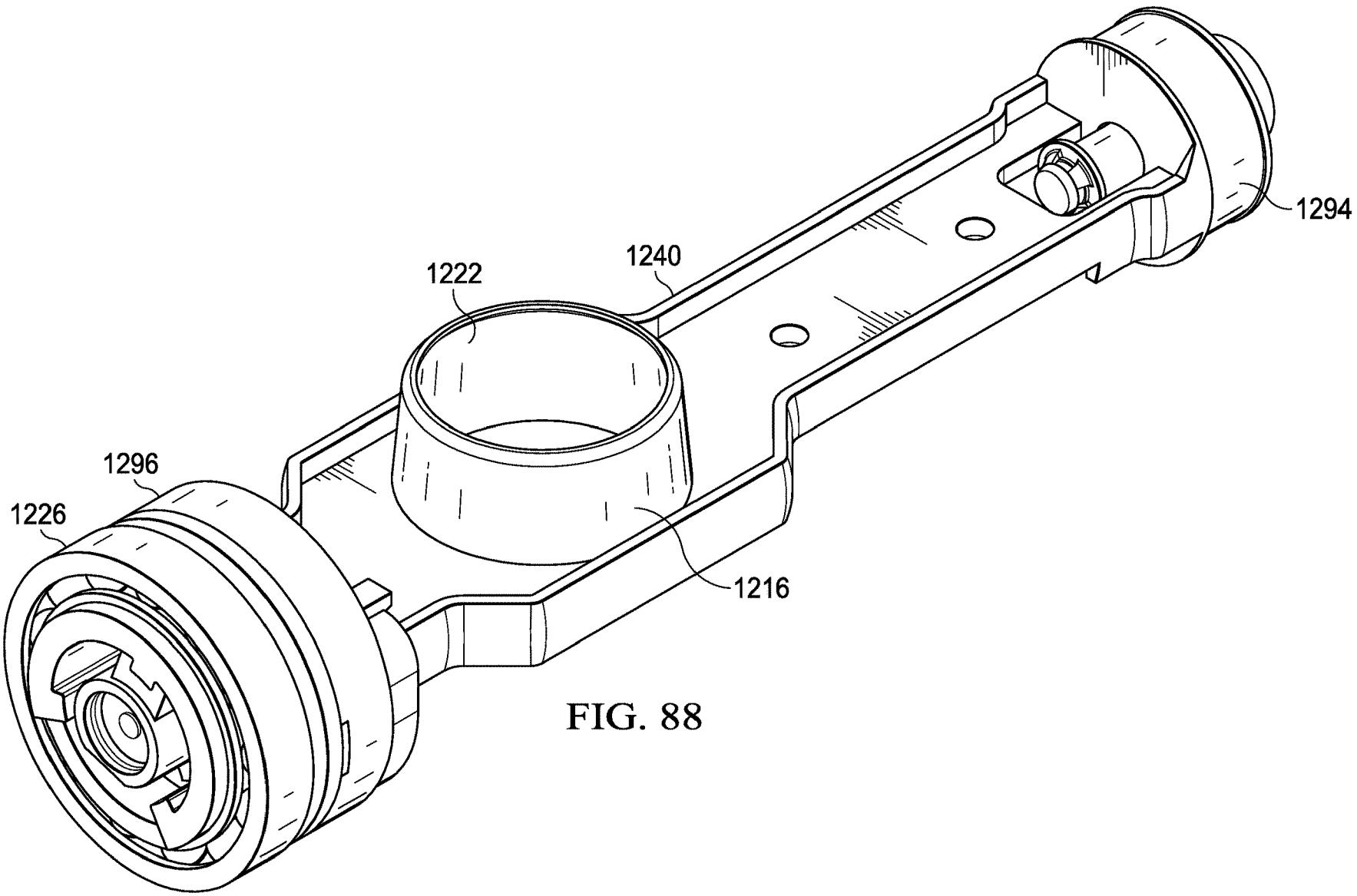
Figure 89:
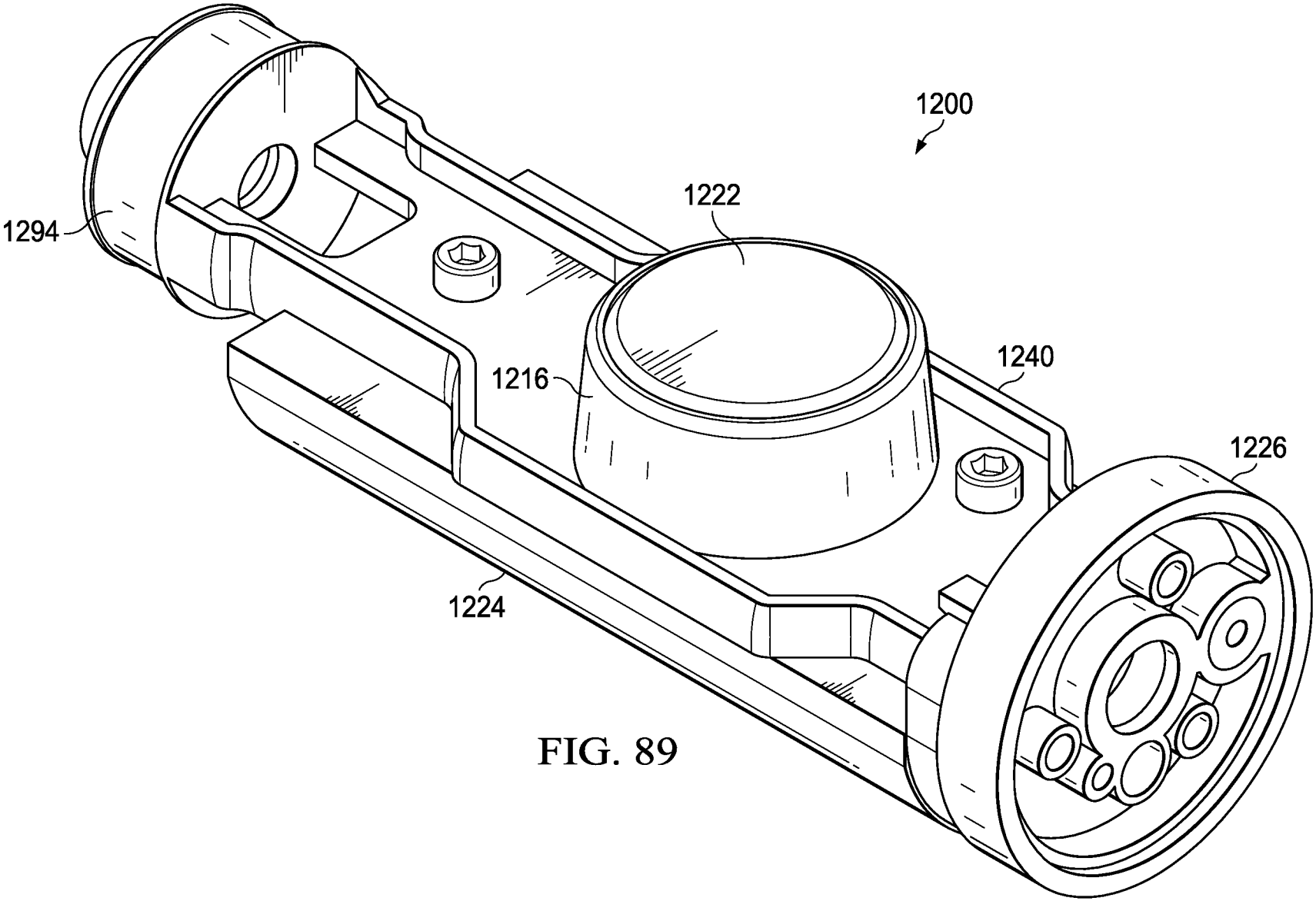
Figure 90:
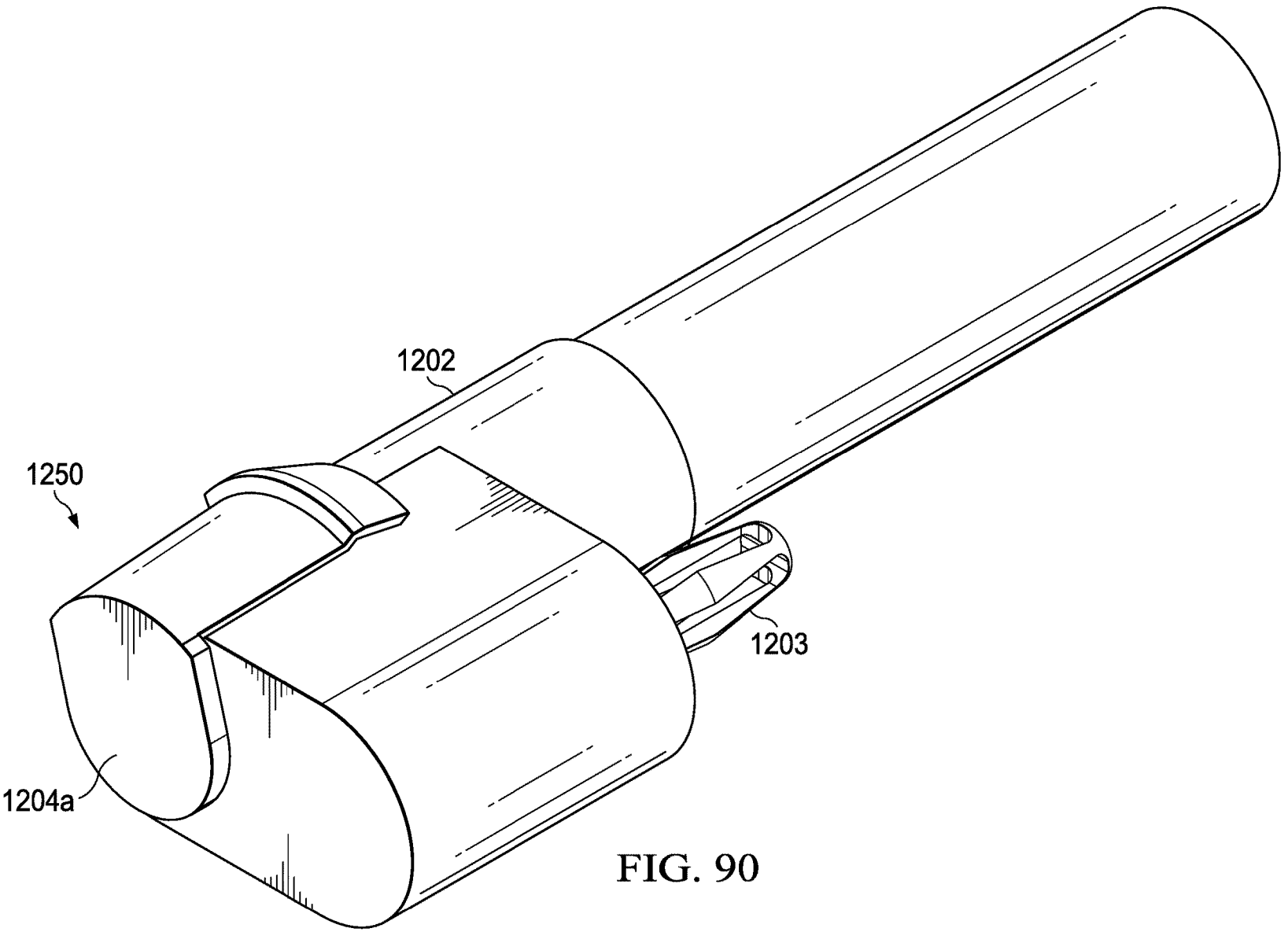
Figure 91:
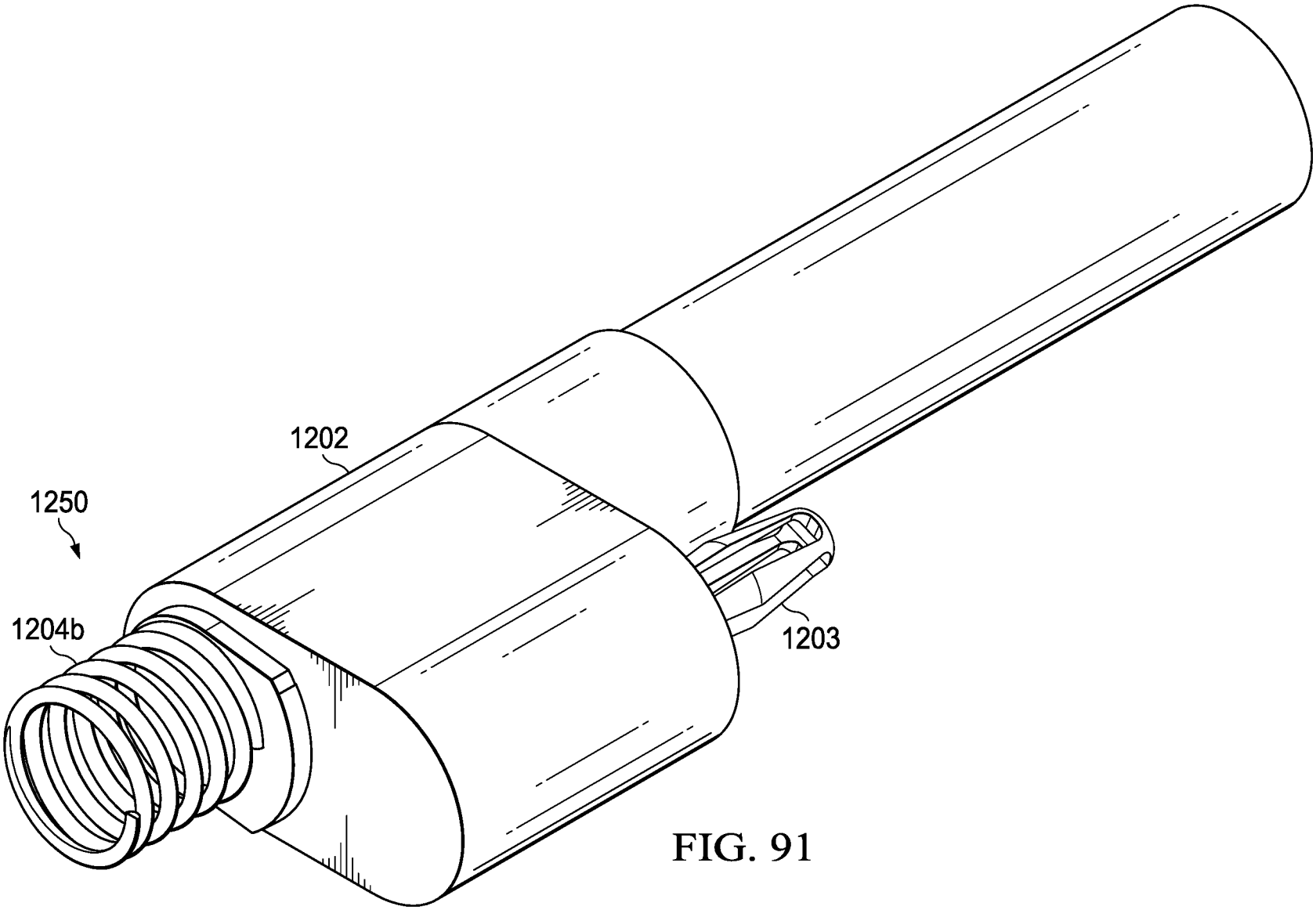

FIG. 76 is a cross-sectional side view of a perforating gun with a modular weight assembly, in accordance with embodiments of the present disclosure;

FIG. 77A illustrates a cross-sectional side view of a modular perforating gun assembly, in accordance with embodiments of the present disclosure;

FIG. 77B is a cross-sectional side view of a perforating gun illustrating the electrical connections, in accordance with embodiments of the present disclosure;

FIG. 78 is a cross-sectional side view of a perforating gun with a weight assembly, in accordance with embodiments of the present disclosure;

FIG. 79 illustrates a cross-sectional side view of a perforating gun assembly, in accordance with embodiments of the present disclosure;

FIG. 80 illustrates a bulkhead, in accordance with embodiments of the present disclosure;

FIG. 81 illustrates a charge holder, in accordance with embodiments of the present disclosure;

FIG. 82 illustrates a bearing assembly, in accordance with embodiments of the present disclosure;

FIG. 83 illustrates a detonator assembly, in accordance with embodiments of the present disclosure;

FIG. 84 illustrates a weight assembly, in accordance with embodiments of the present disclosure;

FIG. 85 illustrates an uphole end of a charge module, in accordance with embodiments of the present disclosure;

FIG. 86 illustrates a cross-sectional side view of a multi-perforating gun assembly, in accordance with embodiments of the present disclosure;

FIG. 87 illustrates a charge holder, in accordance with embodiments of the present disclosure;

FIG. 88 illustrates a side view of a charge holder with a non-modular weight assembly, in accordance with embodiments of the present disclosure;

FIG. 89 illustrates a detonator assembly, in accordance with embodiments of the present disclosure;

FIG. 90 illustrates a detonator assembly, in accordance with embodiments of the present disclosure;

FIG. 91 illustrates a cross-sectional side view of a multi-perforating gun assembly, in accordance with embodiments of the present disclosure.

DETAILED DESCRIPTION OF THE INVENTION

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar components, features and elements are referenced with like or identical reference numerals or are apparent from the figures and/or the description herein. When reference numbers are followed by a lower case letter (e.g. 110*a*, 110*b*), they are each the same type of component (e.g. 110) but have a different location or use. The figures are not necessarily to scale and certain features and certain views of the figures may be shown exaggerated in scale or in schematic in the interest of clarity and conciseness.

As used herein and throughout various portions (and headings) of this patent, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. It should also be noted that the use of "(s)" in reference to an item, component or action (e.g. "surface(s)") throughout this patent should be construed to mean "at least one" of the referenced item, component or act.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ". Further, reference herein and in the appended claims to components and aspects in a singular tense does not necessarily limit the present disclosure or appended claims to only one such component or aspect, but should be interpreted generally to mean one or more, as may be suitable and desirable in each particular instance.

As used herein and in the appended claims, the following terms have the following meanings, except and only to the extent as may be expressly specified differently in a particular claim hereof and only for such claim(s) and any claim(s) depending therefrom:

The term "and/or" as used herein provides for three distinct possibilities: one, the other or both. All three possibilities do not need to be available—only any one of the three. For example, if a component is described as "having a collar and/or a coupling", some embodiments may include a collar, some embodiments may include a coupling and some embodiments may include both. Since the use of "and/or" herein does not require all three possibilities, a claim limitation herein that recites "having a collar and/or a coupling" would be literally infringed by a device including only one or more collars, one or more couplings or both one or more couplings and one or more collars.

The terms "conductor" and variations thereof mean and include anything that could be in the conductor or semiconductor class of materials but not in the insulator class of material.

The terms "conducting," "conductive" and variations thereof mean and refer to being able to conduct electric current.

The terms "conductive contact" and variations thereof mean and include at least one plate, button, tab, pin, ring, sleeve, patch, strip, band, length or track of sufficiently conductive material (e.g. comprising or coated with copper, aluminum, tin, brass, silver, etc.) affixed to, formed, embedded, molded or fit into, carried by or otherwise associated with the referenced component for transmitting electric current to or from the component.

The terms "conductive interface" and variations thereof mean and include one or more points or areas of electrical contact, or connection, formed between two or more adjacent conductive components. Thus, the conductive interfaces 26 are not in and of themselves distinct components.

The terms "conductive trace" and variations thereof mean and include at least one line, strip, band, length or track of sufficiently conductive material affixed to, formed, molded, embedded or fit into, carried by or otherwise associated with one or more referenced components for transmitting electric current in a desired path. The conductive trace could include, for example, uninsulated wire core that is molded, formed or fit into the component(s).

The terms "coupled," "connected," "engaged," and the like, and variations thereof mean and include either an indirect or direct connection or engagement. Thus, if a first device couples to a second device, that connection may be through a direct connection, or through an indirect connection via other devices and connections.

The terms "elongated," and variations thereof as used herein mean and refer to an item having an overall length (during the intended use of the item) that is greater than its average width.

The terms "generally," "substantially," and variations thereof as used herein mean and include greater than 50%.

The terms "modular," and variations thereof mean and refer to including one or more components provided in distinct systems, or modules, that can be independently created and simply and quickly interconnected.

The terms "operator", "assembler" and variations thereof as used herein mean and include one or more humans, robots or robotic components, artificial intelligence-driven components/circuitry, other components and the like.

Any component identified as a "plate" herein includes, but is not limited to, a plate as that term is commonly understood (e.g. a thin, flat sheet or strip of metal or other material), and may have non-planar surfaces or construction, may not be thin per se, may have any other form suitable for use in the particular configuration in which it is used (e.g. may be a curved or curvilinear-shaped member, housing, cone, sleeve, flange, collar, etc.) may be comprised of multiple parts or a combination thereof.

The terms "rigidly coupled," and variations thereof mean connected together in a manner that is intended not to allow any, or more than an insubstantial or minimal amount of, relative movement therebetween during typical or expected operations. In other words, if components A and B are rigidly coupled together, they are not movable relative to one another (more than a minimal or insubstantial amount) during typical or expected operations.

The terms "spring" and variations thereof mean and refer to one or more resilient members (e.g. compression or torsion springs, helical springs, radial wave springs, radial springs, coil springs, Bellville-washers, bow springs, banana springs, leaf springs, disc springs) and/or or non-resilient members (e.g. sleeve, ring, pin, coupling, piston, a conductive ring biased with a banana or bow spring) capable of being biased against, and/or providing biasing forces upon, one or more other members or components. Accordingly, the "spring" may be a spring (in its literal sense) or any other component or combination of components configured to be biased by, or able to spring-bias, one or more other members or components. Moreover, when a component is described herein as "biased" or "spring-biased," the component is arranged to be forced or pressed in one or more directions by one or more springs, and/or other mechanisms or forces (e.g. gas, liquid, power-driven, electronically driven), and in at least some cases can be moved back (in the opposite general direction) upon the application of force(s) to the component sufficient to overcome the pressing forces thereupon. Thus, biasing or spring biasing does not require the use of one or more actual springs to provide the biasing force(s), any desired or suitable mechanism or arrangement of parts may be used, except and only to the extent as may be expressly recited and explicitly required in a particular claim hereof and only for such claim(s) and any claim(s) depending therefrom.

The terms "through-connector" and variations thereof mean and include at least one wire-free conductive trace affixed to, formed, embedded, molded or fit into, carried by or otherwise associated with the charge holder 40 or other component for transmitting electric current in a desired path. The through-connector could, for example, include uninsulated wire-core that is molded, formed or fit into or attached to the charge holder 40 or other component(s).

The terms "wire," "electrical wire," and variations thereof mean and include one or more strands or rods of conductive material (e.g. metal) that has its own self-insulation. For example, wire often has a conductive core with plastic and/or rubber extruded at least partially thereover. Thus, "wire" as used therein, refers to at least partially self-insulated wire. Also, for this patent, "wire" is not limited in any way by the nature, form or details of composition, type or format of its conductive core (e.g. single or multistrand, flexible or solid, braided or not braided) or insulation (e.g. plastic, rubber, other) or format (e.g. cable or wire formats).

Turning now to the drawings, where the purpose is to describe embodiments of this disclosure and not to limit the claims, FIGS. 1-13J show a gun tube 10.

Gun Tube

Gun tube 10 has a tube body 12, a first end 14 with a first end fitting 16, and a second end 18 with a second end fitting 20. Gun tube 10 further includes a cavity 114, charge openings 116, charge clip openings 117, and tabs 130. Gun tube 10 is preferably cylindrical and formed of steel.

Charge openings 116 are configured to retain shape (or explosive) charges 122, best seen in FIGS. 1-8. Charge openings 116 can be of a suitable shape, size, and position to hold a specific type or size of shape charge 122, and point the shape charge 122 outward in a specific direction. Charge clip openings 117 are configured so that clips 132 can be positioned on the outer wall of tube body 12. Clips 132 are attached to wires that connect to the shape charges 122 in a manner known to those skilled in the art.

One or more weights 124 are positioned in cavity 114. As shown, there are two weights 124A, 124B, although only one, or more than two, weights may be used. One or more weights 124 can be of any size, shape, or weight suitable to move gun tube 10 so that the one or more weights 124 cause gun tube 10 to rotate relative to bearing assemblies 26 so the portion of gun tube 10 that retains one or more weights 124 is at the bottom of the wellbore (i.e., closest to the Earth's center) when gun tube 10 is positioned horizontally in a wellbore. Bearing assemblies 26 allow gun tube 10 to rotate around axis A in either direction relative the first end fitting 16 and the second end fitting 20.

Weight 124A as shown is semi-circular, comprised of steel, fills about half of the volume of cavity 114, in which it is positioned, is juxtaposed first end 14 of gun tube 10 and extends about ⅓ of the length of gun tube 10. Weight 124A preferably weighs about 1¾ lbs. at sea level in this embodiment. Weight 124B as shown is semi-circular, comprised of steel, fills about half the volume of cavity 114, in which it is positioned, is juxtaposed second end 18 and extends about ⅕ of the length of gun tube 10. Weight 124B most preferably weighs about 0.8 lbs. at sea level in this embodiment. The size, weight, and configuration of one or more weights 124 can be varied to any suitable amount depending upon the application and diameter or length of gun tube 10.

Gun tube 10 also includes tabs 130 that are used to retain the one or more weights 124 in cavity 114. In the embodiment shown weight 124A and weight 124B are positioned in cavity 114. Then tabs 130 are pressed down against the flat surface of weight 124A to retain weight 124 in cavity 114, and pressed down against the flat surface of weight 124B to retain weight 124B in cavity 114. Thus, the tabs 130 in the Figures are shown in their pressed down position.

Alternatively, one or more weights 124 may be positioned differently relative to shape charges 122 in gun tube 10 than as shown. When positioned as shown, shape charges 122 will basically face straight upwards and straight downwards when gun tube 10 is positioned horizontally in a wellbore, because gravity pulls the one or more weights 124 to the bottom of the wellbore. If an operator instead wanted the shape charges 122 to be positioned and fired outward at an angle, such as 45°, 60°, or 90°, from straight up or straight down, the one or more weights 124 could be positioned differently in the cavity 114. Then, when gravity pulls and orients the one or more weights 124 to the bottom of the horizontal wellbore, the shape charges 122 would be oriented to fire in the desired direction. So, gun tube 10 can have a plurality of tabs 130 sufficient to position the one or more weights 124 at multiple locations within cavity 114. An operator can then select the desired location for the one or more weights within cavity 114 depending on the direction the operator would like shape charges 122 to fire.

End Fittings and End Contacts

First end fitting 16 includes an end contact 22, an outer collar 24, a bearing assembly 26, and a support 28. Second end fitting 20 has the same structure and components as first end fitting 16. Second end fitting 20 includes an end contact 22, an outer collar 24, a bearing assembly 26, and a support 28. Because the respective components of each end fitting 16 and 20 have the same structure, only the components of first end fitting 16 will be described in detail. The same components or structures on second end fitting 20 are designated by the same reference numerals as those for first end fitting 16.

End contact 22 has a body 42 with a first end 44, second end 46, and an annular center 48. First end 44 has an electrical contact 50. A stem 52 extends from second end 46. Stem 52 has an opening 55 to which a wire can be connected. End contact 22 has an internal structure, known to those in the art, that enables electricity to be transmitted from electrical contact 50 to stem 52, at which point electricity is transferred to one or more wires in electrical communication with stem 52.

Body 42 is preferably comprised of an insulating material, such as plastic. One or more frangible elements, which are shown, are two tabs, 54 extend outward from second end 46. As shown, the tabs are rounded and extend outward a maximum of about ⅛" to 5/16", or about ⅛" to ¼", or about ⅛" to 3/16", or about 3/16" to ¼" from body 42. Another structure, such as a continuous or discontinuous annular ridge, or different shaped structures, could be used as the one or more frangible elements. The tabs are about 0.080" to 0.150", or about 0.10" or about 0.110", or about 0.120" thick. Body 42 has a first annular portion 48A, a second annular portion 48B, and a central annular position 48C. A spring 56 is positioned on first annular portion 48A between central annular portion 48C and tabs 54.

The spring 56 used for each end contact 22 can be selected by an operator to be, for example, a high-tension spring, medium-tension spring, low-tension spring, or a spring of any suitable tension for the given application. The spring is selected in a manner known to those in the art, so that it ensures electrical connectivity to a device that electrical contact 50 touches in order to transmit electricity from the device to electrical contact 50. In one embodiment, electrical contact 50 touches the stem of a plunger, which is described below. In another embodiment, the electrical contact 50 touches a mechanical switch (not shown), which is known to those skilled in the art. The spring pressure exerted by spring 56 must be firm enough to bias electrical contact 50 outward to ensure electrical conductivity, but not so firm that it could prematurely begin setting a mechanical switch due to wellbore vibrations or concussive blasts in adjacent guns.

For example, a spring could be selected to have a compression force of any suitable amount between about 2 lbs. and 10 lbs., or about 3 lbs. to 8 lbs., or about 4 lbs. to 7 lbs., or about 4 lbs. to 6 lbs., or about 5 lbs., or any amount from about 2 lbs. to about 15 lbs., or about 5 lbs. to about 15 lbs.

One or more frangible elements, which as shown are two tabs 54 are breakable (or frangible) from body 42 upon the application of an outward force along longitudinal axis A generated by an explosion of shape charges 122. One or more frangible elements 54 could break, for example, upon the application of an explosive outward force of: about 30 lbs. or more, about 40 lbs. or more, about 50 lbs. or more, about 60 lbs. or more, about 70 lbs. or more, about 80 lbs. or more, about 90 lbs. or more, about 100 lbs. or more, or any explosive, outward force from about 30-200 lbs. or more, along axis A. The purpose of one or more frangible elements 54 breaking is so the electrical connection to gun tube 10 is broken when the shape charges 122 are exploded. Any suitable structure on end contact 22 could be used for this purpose.

Outer collar 24 is preferably comprised of metal, such as aluminum. Outer collar 24 has a first end 58, a second end 60 having an opening 61 and an inner bearing surface 63, an annular side wall 62, an opening 64 in first end 58, a cavity 66, and one or more openings 68 in side wall 62. Openings 68 are configured to receive grounding hardware items (such as ball plungers, or a spring and electrically conductive ball staked in place) 70, or hardware, such as fastener 103, attaching a ground wire 101.

Bearing assembly 26 comprises a housing preferably circular in shape and has a first end 72, a second end 74, a body 76 with an outer wall 78 and an inner wall 80, an opening 82 at first end 72, and opening 83 at second end 74, and a cavity 84 that retains ball bearings 26A. Bearing assembly 26 could instead be what persons skilled in the art refer to as a thrust bearing. Any suitable structure to allow the rotation of tube body 12 around axis A may be utilized.

Support 28 is preferably comprised of metal, such as aluminum, and has a first end 86, a second end 88, a first body portion 90 that has a top surface 92 and an annular outer wall 94, a second body portion 96 that has a top surface 98, and an annular outer wall 100, and an opening 102 therethrough. Opening 102 has two wing sections 102A and 102B sized and shaped so frangible elements (shown here as tabs) 54 of end contact 22 can pass therethrough. Top surface 98 has two wing recesses 103A, 103B that are positioned approximately 90° relative wing sections 102A, 102B, wherein the recesses 103A, 103B are configured to receive and retain one or more frangible elements 54 after they pass through wing sections 102A, 102B and end contact 22 is rotated, as described further below. A rib 107 is formed in opening 102, preferably adjacent recesses 103A, 103B.

Figure 13:
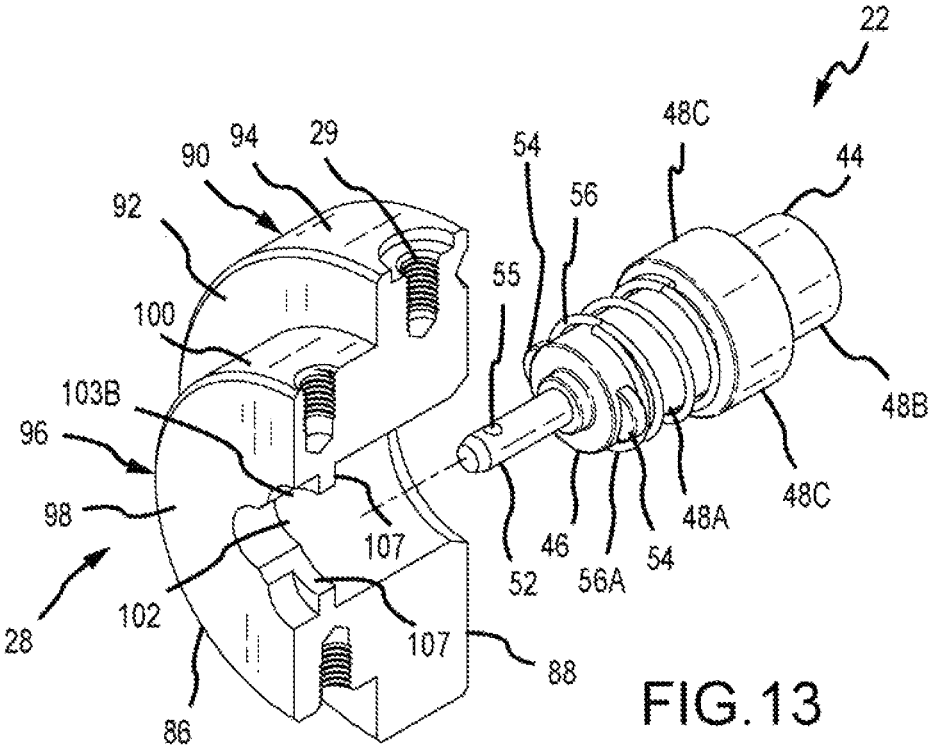
FIG. 13 is a partial, cut-away, perspective view of a support and a side, perspective view of an end connector.
Figure 13A:
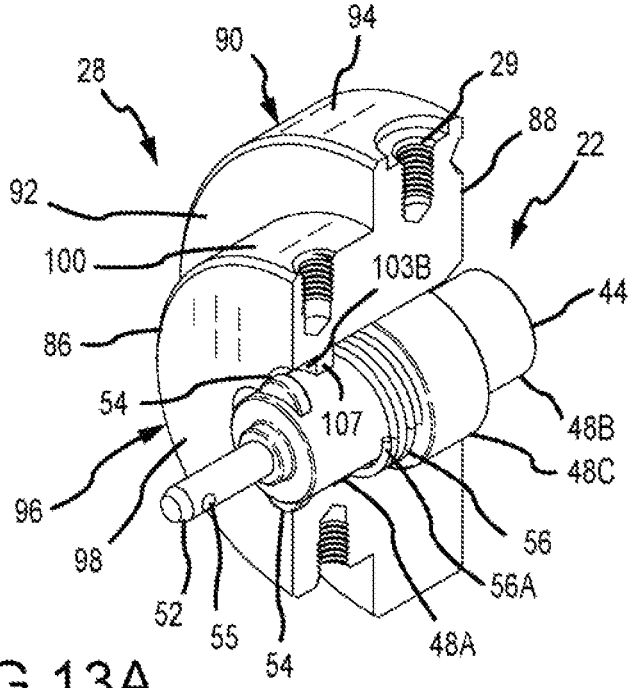
FIG. 13A is a partial, cut-away, perspective view of a support with the end connector of FIG. 13.
Figure 13B:
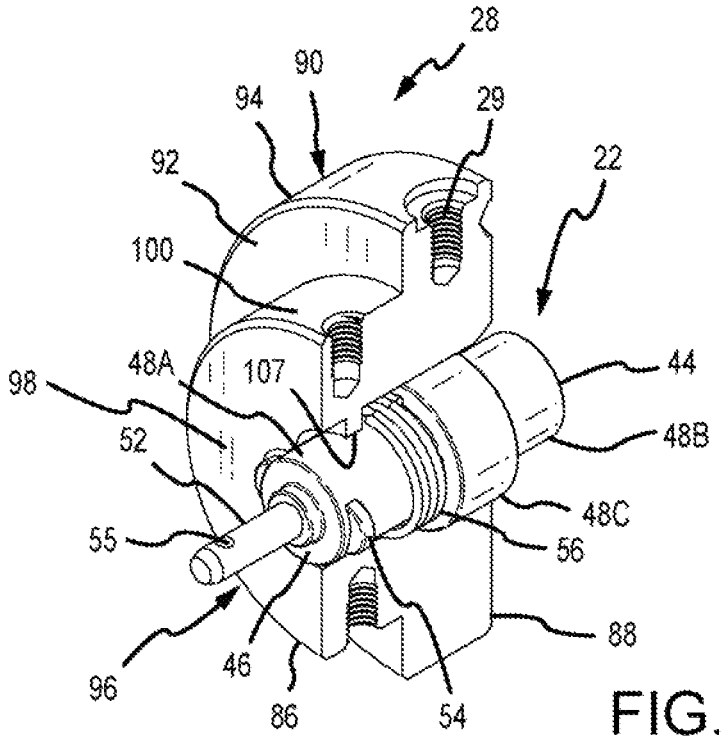
FIG. 13B is an alternate, cut-away, perspective view of a support with the end connector of FIG. 132.
Figure 13C:
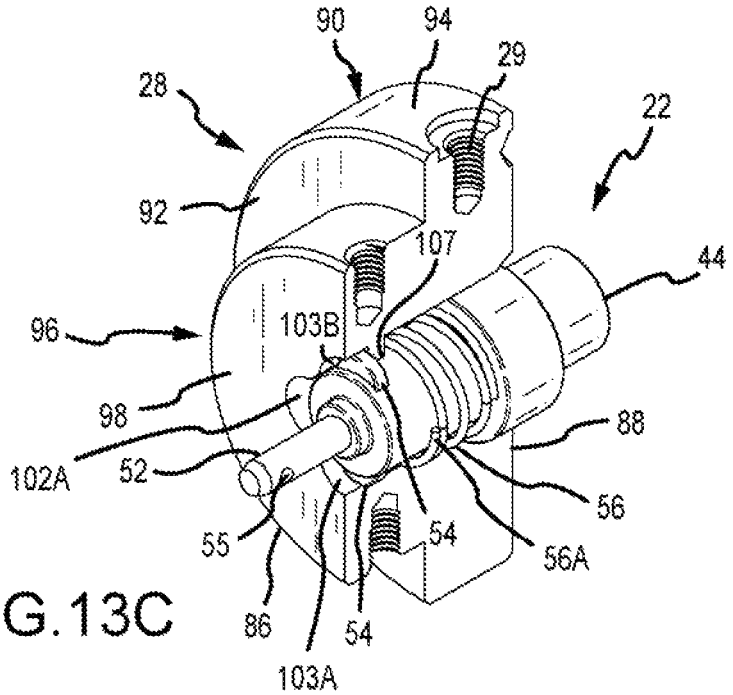
FIG. 13C is an alternate, cut-away, perspective view of a support with the end connector of FIG. 13.
Figure 13D:
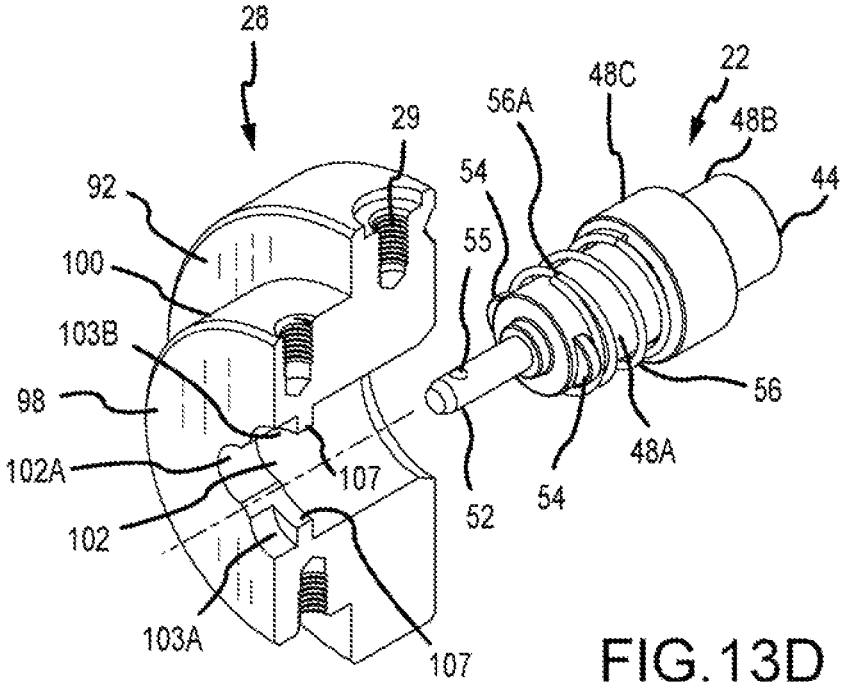
FIG. 13D is a partial, cut-away, side perspective view of a support and a side, perspective view of an end contact.
Figure 13E:
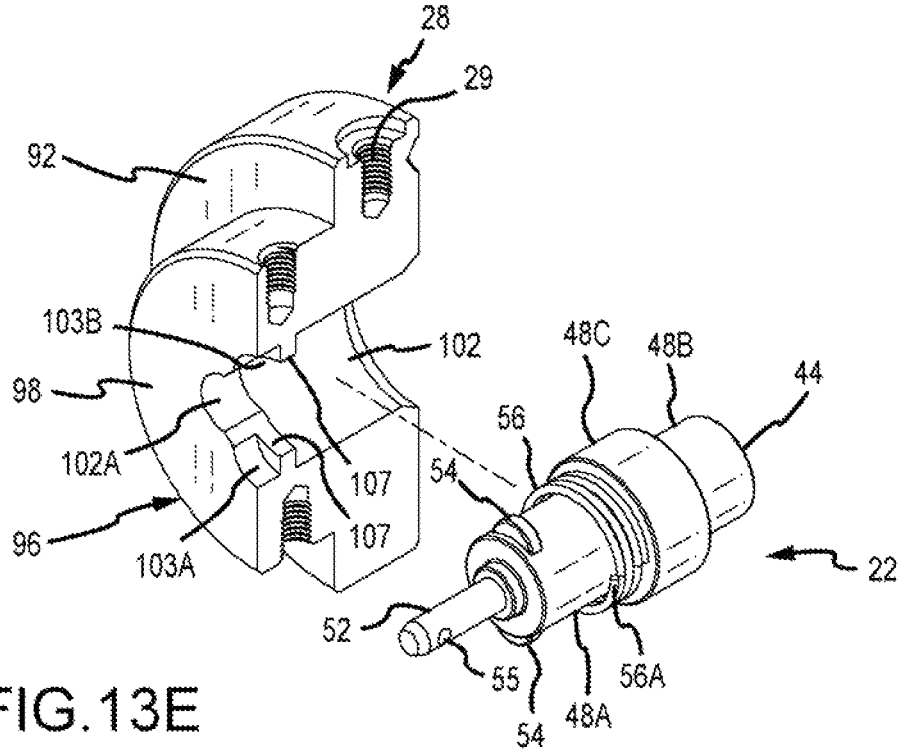
FIG. 13E is an alternate, cut-away, side perspective view of a support and a side, perspective view of an end contact.
Figure 13F:
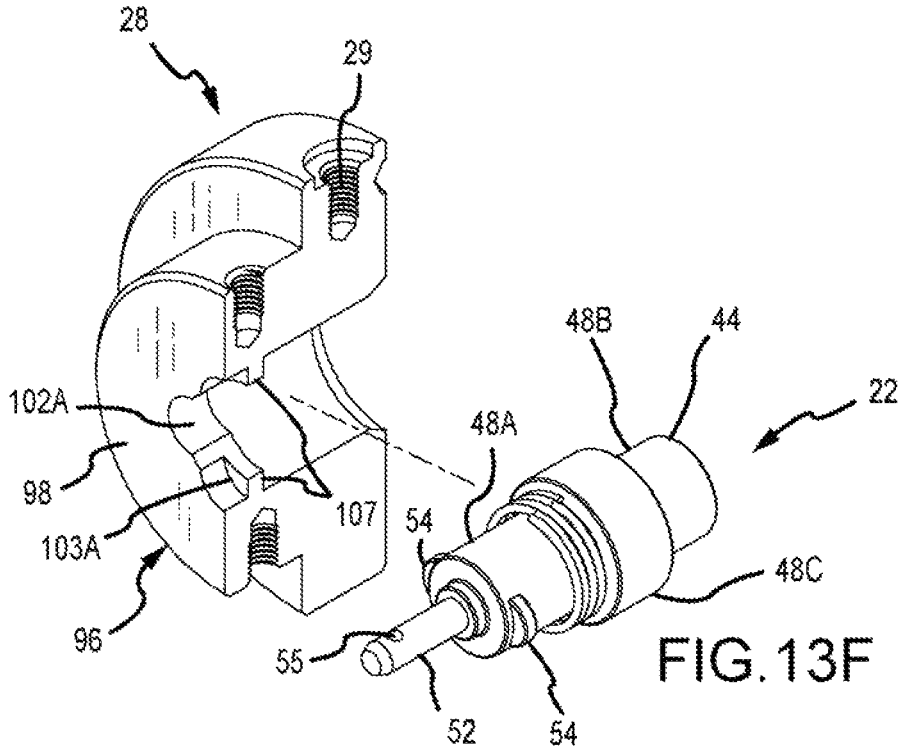
FIG. 13F is an alternate, cut-away, side perspective view of a support and a side, perspective view of an end contact.
Figure 13G:
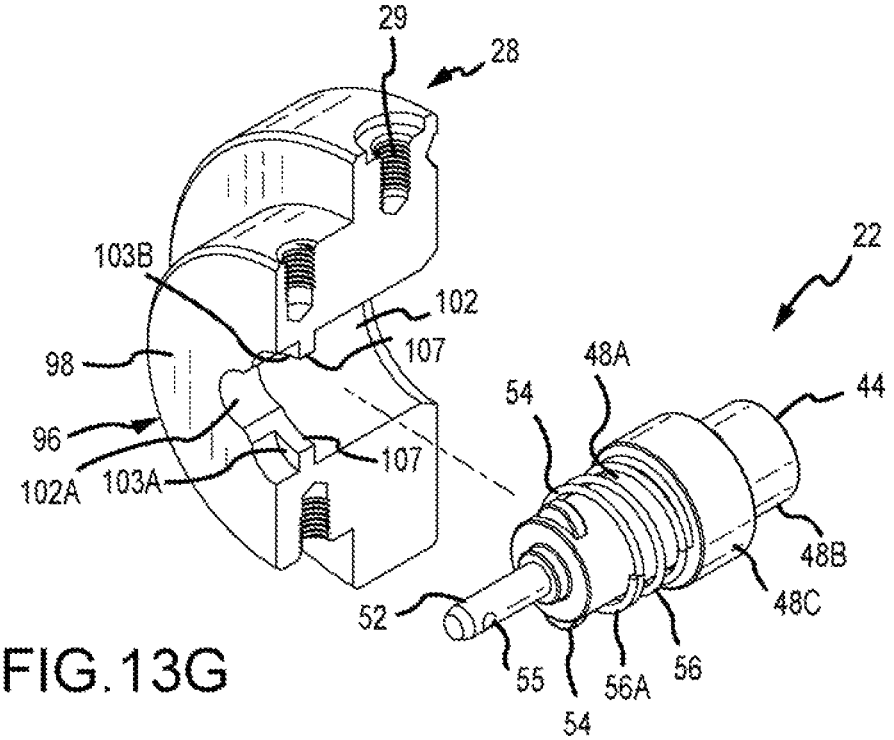
FIG. 13G is an alternate, cut-away, side perspective view of a support and a side, perspective view of an end contact.
Figure 13H:
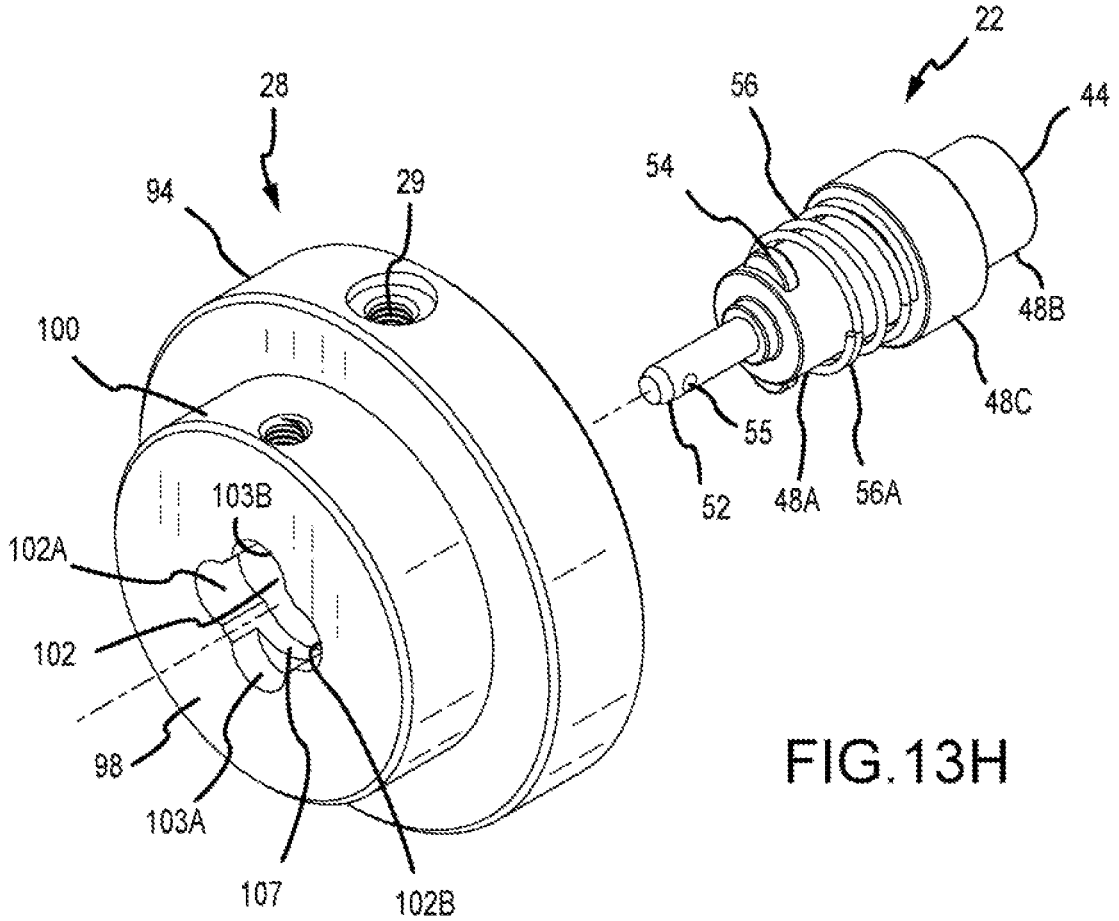
FIG. 13H is a side, perspective view of a support and end connector.
Figure 13I:
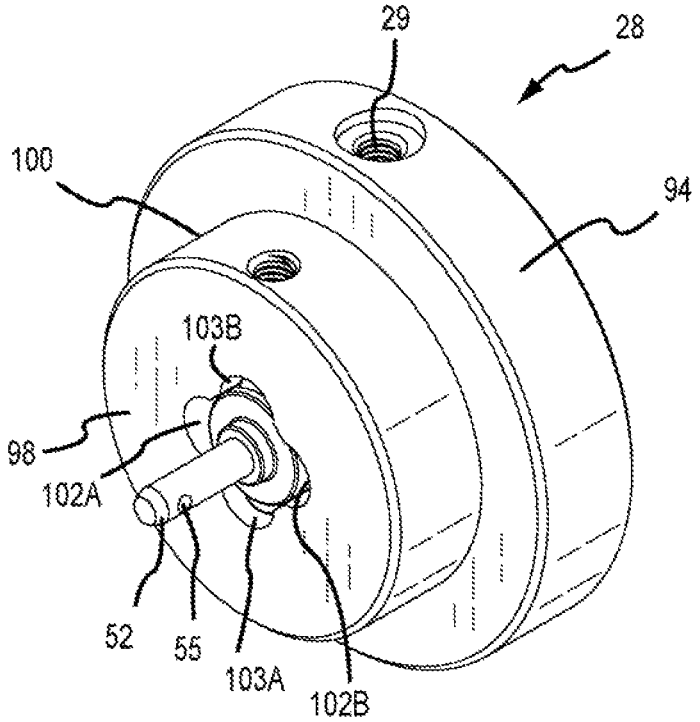
FIG. 13I is a side, perspective view of a support and end connector assembled.
Figure 13J:
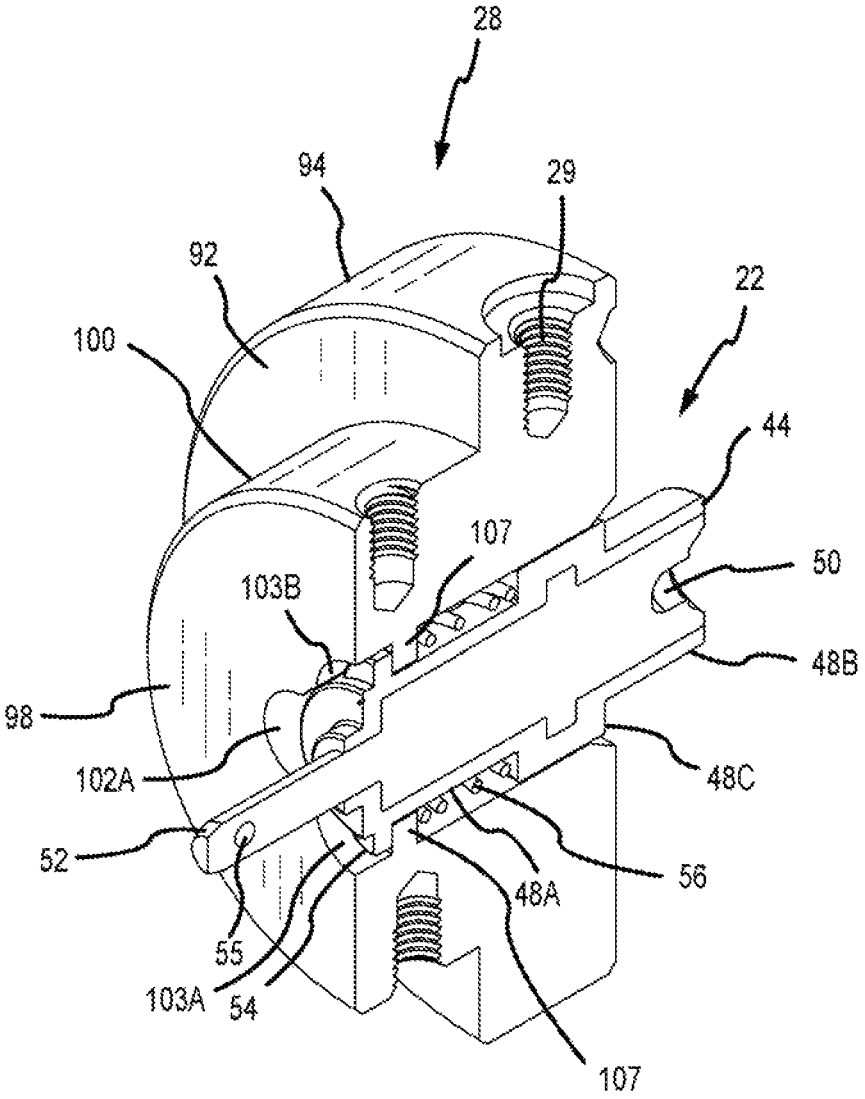
FIG. 13J is a cross-sectional, side perspective view of the support and end connector of FIG. 13I.

First end fitting 16 is assembled by placing spring 56 onto first annular portion 48A of end contact 22 between one or more frangible elements 54 and central annular portion 48C. Then end contact 22 is pressed through opening 102 of support 28 from second end 88, as best seen in FIGS. 13-13J. The one or more frangible elements 54 are aligned with and pushed through wing sections 102A, 102B and end contact 22 is then rotated (preferably about 90°) so the one or more frangible elements 54 align with wing recesses 103A, 103B. Pressure is released by the assembler and the one or more frangible elements 54 are then received and retained in wing recesses 103A, 103B, and end contact 22 is thus connected to support 28 without the use of tools or fasteners.

When tabs 54 are pressed through wing sections 102A, 102B, first end 56A (adjacent one or more frangible elements 54) of spring 56 presses against rib 107 inside opening 102 of support 28. When the one or more frangible elements 54 are retained in wing recesses 103A, 103B, spring 56 is retained between rib 107 and central annular portion 48C. Outward pressure (i.e., towards second end 88 and towards first end 14 of gun tube 10) is applied by spring 56 to end contact 22, which biases end contact 22 and electrical contact 50 to the first, extended position.

Bearing assembly 26 is positioned over second body portion 96 so that second end 74 and opening 83 are juxtaposed top surface 92 of first body portion 90.

Outer collar 24 is positioned over end contact 22, bearing assembly 26 and support 28, so that electrical contact 50 extends through opening 61 of outer collar 24, most preferably by any amount from about 1/16" to about 5/16". First end 72 and opening 82 of bearing assembly 26 are then juxtaposed inner bearing surface 63 of outer collar 24.

One or more grounding hardware items 70 are positioned in one or more openings 68 and are preferably press fit into place and staked. The hardware items 70 are preferably either a ball plunger unit, or a combination of spring and electrically conductive ball bearing staked in place.

A ground wire 101 is connected to support 28 by a screw 103 being passed through lead 101A and being threaded into opening 29. An electrical lead 105 may then be positioned over stem 52 by pressing it on where it remains because of a pressure fit electrical lead 105 is preferably comprised of a flexible material such as elastomer. Electrical lead 105 is attached to one or more wires to receive electricity passing through end contact 22. An advantage of electrical lead 105, which is an insulative protective sheath with wires already attached, is ease and speed of use, and creating a reliable connection. Presently, wires are placed by hand through opening 55 of stem 52 and then wrapped around stem 52, and have a silicone tubing sleeve manually placed over the wire wrapping to provide electrical insulation and to keep stem 52 electrically isolated from the gun tube body 12.

End contact 22 has a first position at which spring 56 biases it away from second end 88 of support 28, and outward from first end fitting 16, as shown, e.g., in FIGS. 1-8. End contact 22 has a second, contracted position at which spring 56 is fully compressed. The distance between the first position and the second position is at least 0.150", or at least ⅜", or at least ½", or at least ⅝", or at least ¾" or at least 1", or any amount from 0.150" to 1", or from 0.150" to 1.250". Known end caps do not compress, or may compress only slightly (e.g., about ⅛" or less). The advantage of the outward biasing and travel of the end contact 22 and electrical contact 50 is better reliability in maintaining an electrical connection. When a string of gun tubes 10 are placed in a wellbore as part of an assembly including sub-assemblies 200 (discussed below), stresses on the assembly can create gaps between gun tubes 10 and sub-assemblies 200. Further, stresses, including downstream shape charges exploding, can cause upstream contacts to press against one another, which can lead to breakage and a gap where there is no electrical contact, or broken components that will no longer function. The outward bias and compressibility of the end contacts 22 help alleviate these problems.

Gun Tube with Indexing Weights

In an alternate embodiment shown in FIGS. 28-35, a plate 600 or similar structure may be used to index one or more weights 124' to different positions in cavity 114' of gun tube 10'. This allows an operator the flexibility to move one or more weights to a desired location, and when gravity acts upon the weights they are moved to be juxtaposed the bottom of the wellbore in which the gun tube 10' is positioned. The end fittings 16' and 20' in this embodiment again have a rotatable portion that enables the gun tube 10' to rotate around its longitudinal axis A' so that shape charges 122 are oriented properly.

In this embodiment, gun tube 10' is in all respects the same as gun tube 10 except as described herein and as shown in the figures. Pins 602 and indexing apertures 125, 125A retain weights 124A', 124B' in position, as explained below. Gun tube 10' preferably does not include tabs, such as tabs 130 in gun tube 10. Optionally, tabs 130 could be utilized to help retain weights 124A' and 124B' in position in the manner previously described.

As shown, each weight 124A' and 124B' in this embodiment have a semi-cylindrical, concave center portion 124I', although each may be of any suitable size, material, and configuration. Each weight 124A and 124B has a first end 126 having a plurality of indexing apertures 125A. Weight 124A' as shown has a semi-circular outer surface, is comprised of steel, fills about half of the volume of cavity 114', in which it is positioned, is juxtaposed first end 14' of gun tube 10' and extends about ⅓ of the length of gun tube 10'. Weight 124A' preferably weighs about 1¾ lbs. at sea level in this embodiment. Weight 124B' as shown has a semi-circular outer surface, is comprised of steel, fills about half the volume of cavity 114', in which it is positioned, is juxtaposed second end 18' and extends about ⅕ of the length of gun tube 10'. Weight 124B' most preferably weighs about 0.8 lbs. at sea level in this embodiment. The size, weight, and configuration of one or more weights 124' can be varied to any suitable amount depending upon the application and diameter or length of gun tube 10'.

Each of one or more plates 600 is preferably comprised of steel about ¼" to ½" thick, preferably circular, and has a diameter slightly less than the inner diameter of tube body 12'. Plate 600 is connected to the wall of cavity 114 (i.e., the inner wall of tube body 12') by any suitable means, such as soldering or mechanical fastening. If, for example, weights 124A', 124B' were utilized, one of the plates 600 would be juxtaposed weight 124A at first end 14' of tube body 12' and another plate 600 would be juxtaposed weight 124B at second end 18' of tube body 12'. An operator could then rotate each of the weights 124A', 124B' to a desired location in cavity 114 depending on the direction the operator would like the shape charges 122 to fire, and retain the one or more weights 124' in the desired location using a pin 602.

In this example, utilizing two weights, the weights 124A', 124B' would be moved by rotating each to the same relative position in cavity 114' and then using a pin 602 to fit through openings 24P' in each end fitting 16' and 20', through an indexing aperture 125 of each plate 600, and into an aligned indexing aperture 125A in weight 124A' and 124B'. This retains each weight 124A', 124B' at the desired position in cavity 114' of gun tube 10'.

If two plates are used, each plate 600 preferably has the same number of indexing apertures 125 at the same relative locations as the other plate 600. The indexing apertures 125 preferably include indicia visible on the inner surface 601 (i.e., the surface facing away from an end 14' or 18' of gun tube 10' and towards its center) to identify each indexing aperture 125, so the same indexed position for each plate 600 could be readily identified by an operator using the indicia. For example, each plate 600 may have eight indexing apertures 125 equally, radially spaced about all or part of the outer portion of the plate 600 (although a plate 600 may include any suitable number of apertures at any suitable locations). To make sure weights 124A', 124B' are the same relative positions in cavity 114', the respective apertures on each plate 600 would have the same indicia to designate indexing apertures 125 at the same relative position in cavity 114'.

For example, if each plate 600 had eight apertures, the apertures could be designated by numerals 1-8. In this example, each weight 124A', 124B' would be at the same radial position in cavity 114' if a pin 602 was positioned in an indexing aperture 125 designated by the same indicia (such as numeral "4") on each plate 600. The indexing apertures 125A in each weight 124A', 124B', could also include indicia. For example, if each weight 124' has eight indexing apertures 125A, these apertures could also be designated by numerals 1-8. Using that example, an operator would know that weights 124A', 124B' would be the same relative position in cavity 114' if the indexing aperture 125A designated by the same indicia (such as numeral "4") for each weight 124A', 124B' was aligned with the indexing aperture 125 designated the same indicia (such as numeral "3") in each plate 600. A pin 602 would then be positioned through opening 24P' in each end fitting 16' and 20', through the indexing aperture 125 designated as "3" in each plate 600, and into the indexing aperture 125A designated as "4" in each weight 124A' and 124B'.

First end fitting 16' is the same as first end fitting 16 except as described here and shown in the figures. Second end fitting 20' is the same as second end fitting 20 except as described here and shown in the drawings.

Bearing assembly 26' comprises a housing is preferably circular in shape and has a first end 72', a second end 74', a body 76' with an outer wall 78' and an inner wall 80', an opening 82' and a cavity 84' that retains ball bearings 26A. Bearing assembly 26' could instead be what persons skilled in the art refer to as a thrust bearing. Any suitable structure to allow the rotation of tube body 12 around axis A' may be utilized. Bearing assembly 26' has a smaller diameter than previously described bearing assembly 26 in order to provide space for pin 602.

Support 28' is preferably comprised of metal, such as aluminum, and has a first end 86', a second end 88', a body portion 90' that has a front surface 92', an annular outer wall 94', and an opening 102' therethrough. Part of opening 24P' is formed through support 28'. Opening 102' has two wing sections that are the same as previously described wing sections 102A and 102B. The wing sections are sized and shaped so frangible elements (shown here as tabs) 54 of end contact 22 can pass therethrough. Support 28' fits inside of bearing assembly 26' and rotates inside of outer collar 24.

An opening 24P' is formed in the various components of end fitting 16' and/or 20' to permit insertion of a pin 602 through the end fitting 16' and/or 20', through an indexing aperture 125 in a plate 600, and into an indexing aperture 125A of a weight 124'.

Sub-Assembly and Plunger

FIGS. 16-18E show a sub-assembly 200 having a first end 202 with outer threads 202A and opening 202B, a second end 204 with outer threads 204A and opening 204B, a central portion 206, and a central bore 208 with a first threaded end 208A, and a second end 208B. Central bore 208 extends through sub-assembly 200 from opening 202B to opening 204B.

The sub-assembly 200 is known in the art and is used to connect two gun tubes 10, as generally shown in FIGS. 23-26. Also known in the art is outer casing or carrier 700, usually comprised of steel, that fits over each gun tube 10. Outer casing or carrier 700 protects gun tube 10 as it is moved into and through a wellbore. Each outer casing 700 has a first end 702 with internal threads 702A, a second end 704 with internal threads 704A, and a bore 708 extending therethrough. Each of the ends 702, 704 threadingly connects to an outwardly-threaded end 202 or 204 of a respective sub-assembly 200, as generally shown in FIGS. 23-26. In this manner, a string of connected gun tubes 10 is produced.

Figure 14:
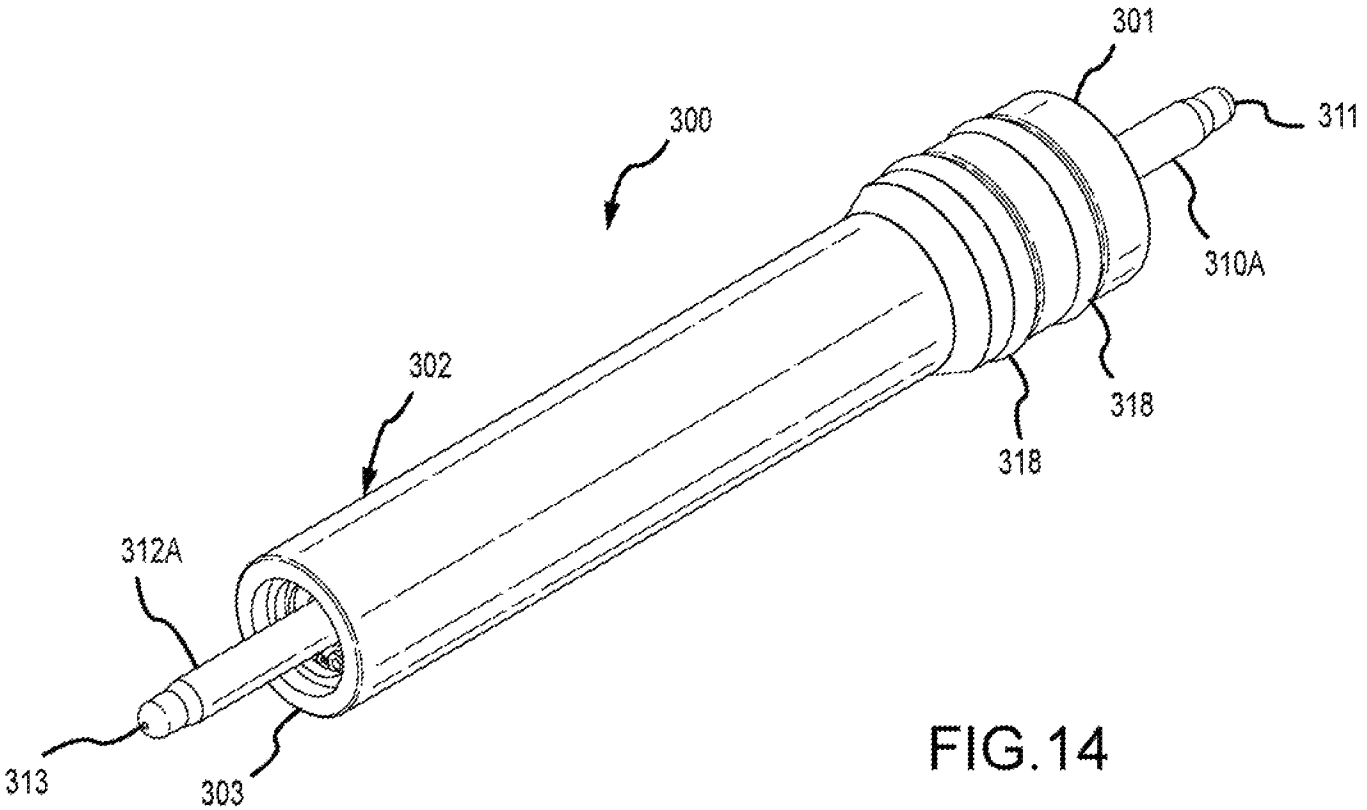
FIG. 14 is a side, perspective view of a plunger.
Figure 14A:
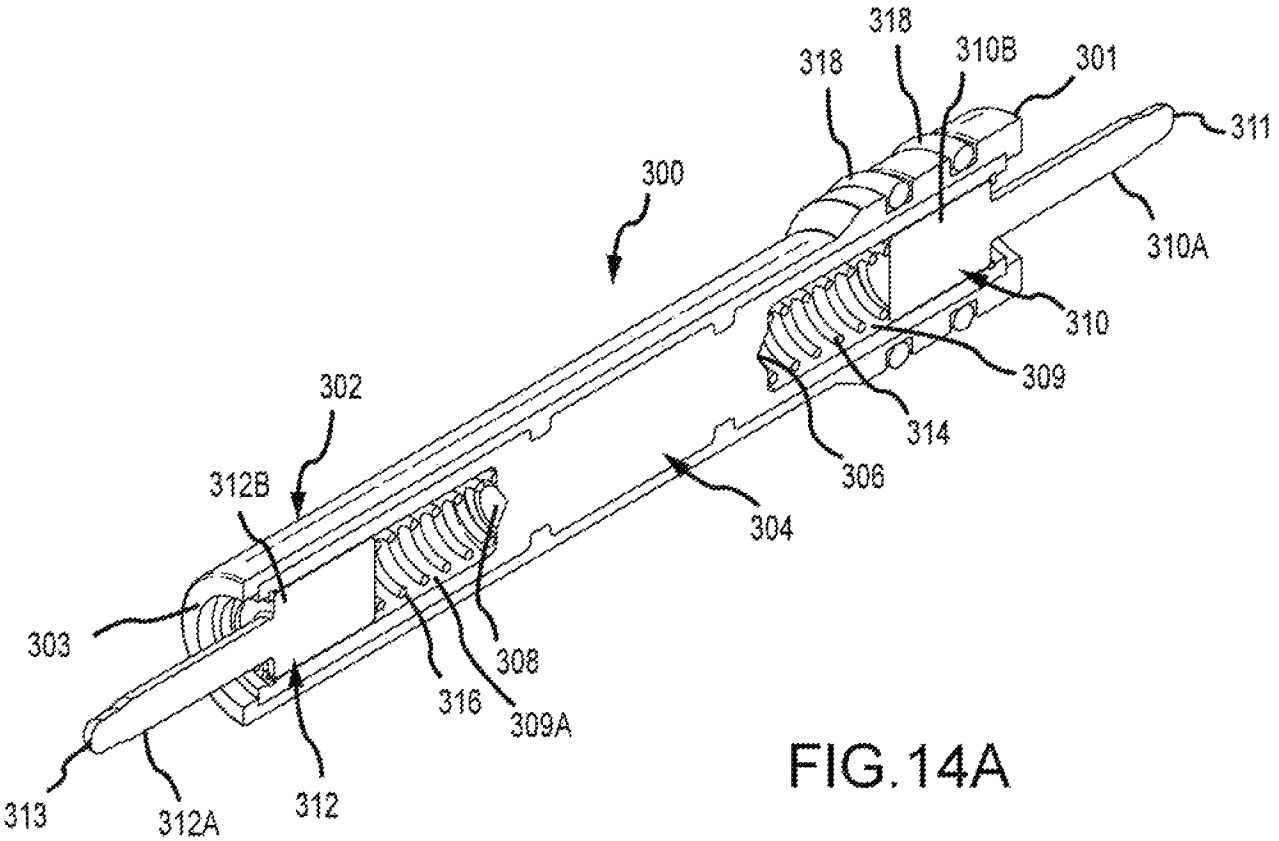
FIG. 14A is a side, perspective, cross-sectional view of the plunger of FIG. 14.
Figure 14D:
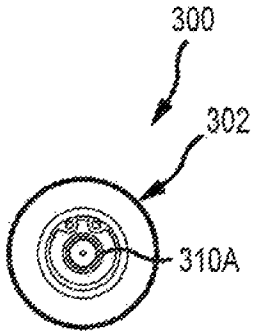
FIG. 14D is an alternate end view of the plunger of FIG. 14.
Figure 14B:
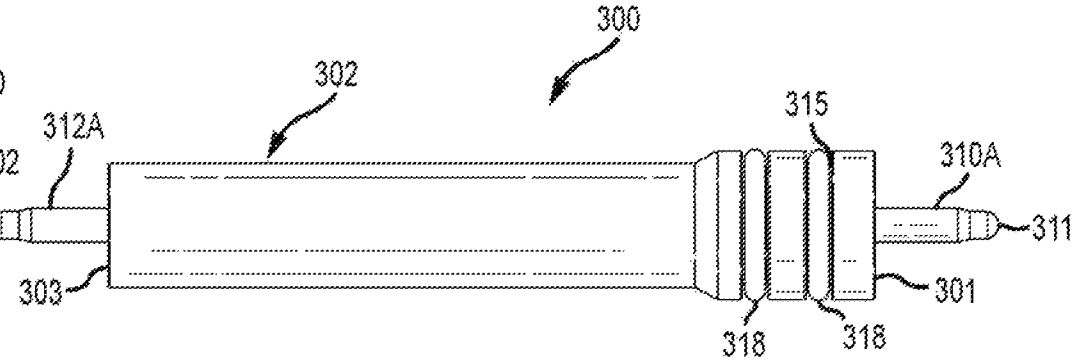
FIG. 14B is a side view of the plunger of FIG. 14.
Figure 14C:
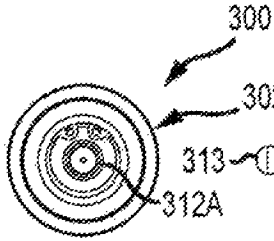
FIG. 14C is an end view of the plunger of FIG. 14.
Figure 14E:
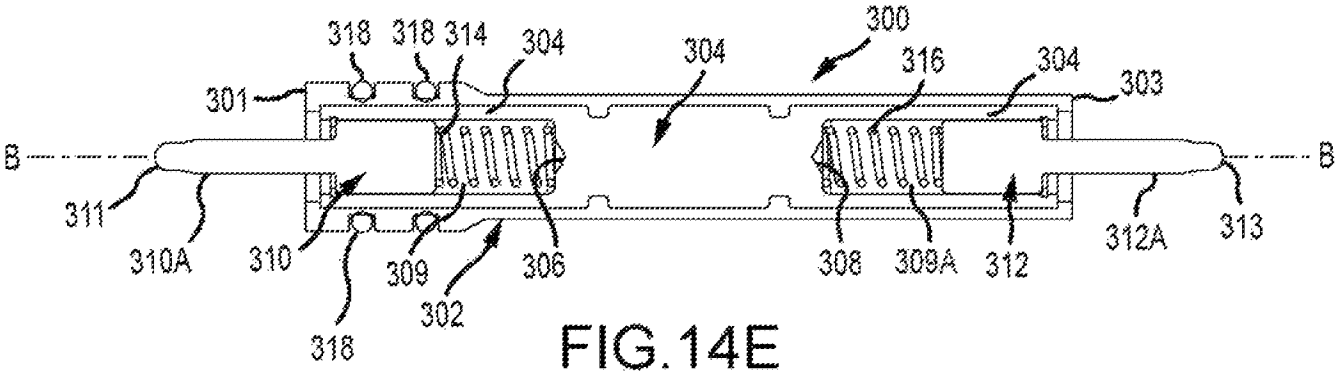
FIG. 14E is a perspective, side view of the plunger of FIG. 14.
Figure 14F:
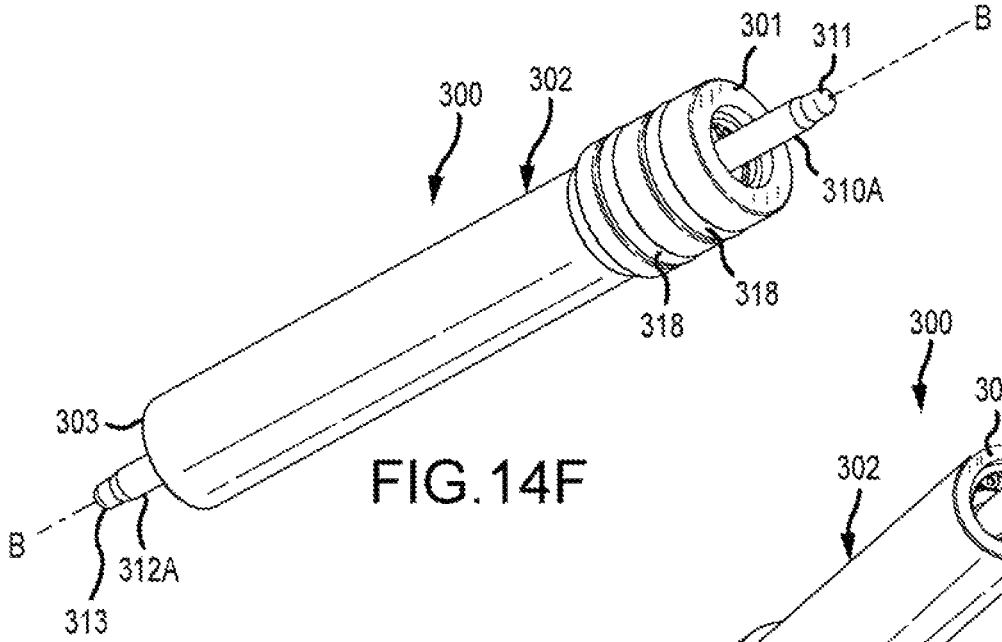
FIG. 14F is a perspective, end view of the plunger of FIG. 14.
Figure 14G:
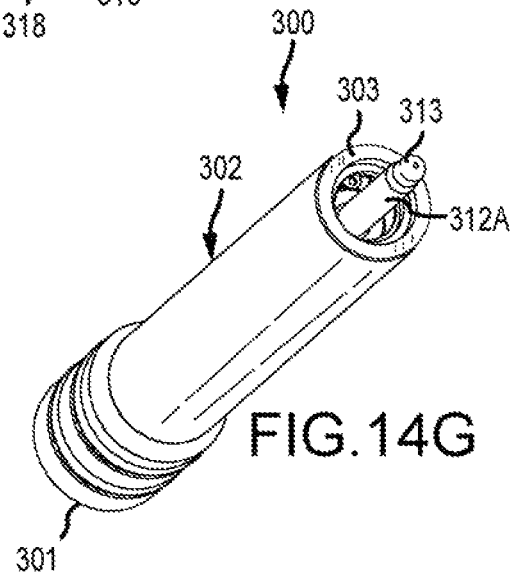
FIG. 14G is an opposite, perspective, end view of the plunger of FIG. 14.
Figure 14H:
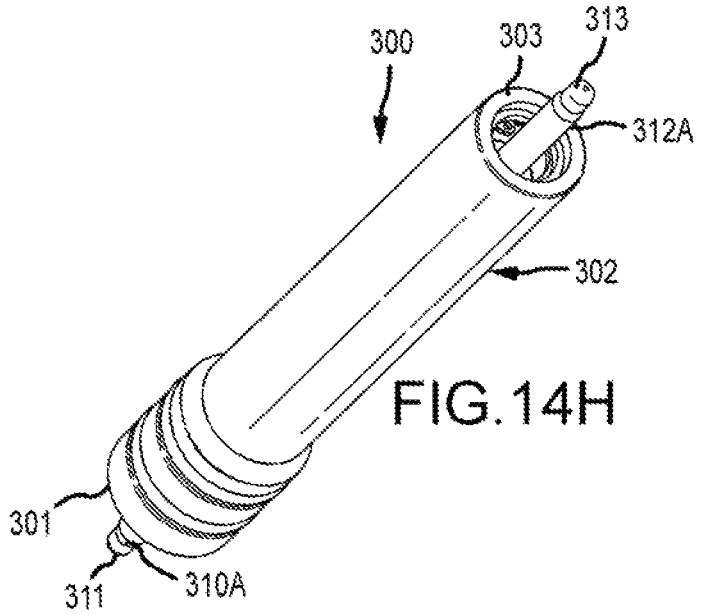
FIG. 14H is a perspective, end view of the plunger of FIG. 14.

Sub-assembly 200 requires a device to provide an electrical connection through it from one gun tube 10 to another gun tube 10. One such a device is referred to herein as a plunger. In FIGS. 14-14H a plunger 300 is shown. In use, plunger 300 is received in central bore 208 of sub-assembly 200 as shown in FIGS. 16-18E. Plunger 300 has an outer casing 302 preferably made of insulating material, the outer casing 302 having a first end 301 and a second end 303, an electrically conductive core 304 with a first stop 306 and a second stop 308, a first conductive stem structure 310 with a first stem 310A and a first cylinder 310B that has a diameter greater than the diameter of the first stem 310A, a second conductive stem structure 312 with a second stem 312A and a second cylinder 312B that has a diameter greater than the diameter of the second stem 312A, preferably a first spring or other biasing structure 314 between first conductive stem structure 310 and first stop 306, and a second spring or other biasing structure 316 between second conductive stem structure 312 and second stop 308. First stem 310A has a first distal tip 311 and second stem 312A has a second distal tip 313. Electrically-conductive core 304 has a first cavity 309 in which spring 314 is positioned and a second cavity 309A in which spring 316 is positioned.

Outer casing 302 as shown has an annular outer surface with one or more (and as shown, two) annular grooves 315 juxtaposed first end 301. Each groove 315 includes an o-ring 318. O-rings 318 can be selected of varying durometers or materials for the environment in which they are used. O-rings 318 create an interference fit in central bore 208 to prevent wellbore liquid from entering central bore 208. Outer casing 302 at first end 301 has a greater diameter that the rest of outer casing 302. The increased diameter is any amount from about 0.100" to 0.300", and the purpose is to create a snug fit in central bore 208.

As shown, plunger 300 has two stem structures 310, 312 that are moveable between a first, extended, position and a second, contracted position, but plunger 300 (or plunger 300') could have only one such structure and the other could stem structure could have just one position.

Springs 314, 316 each permit from about 0.150" to about 1.250" of travel along longitudinal axis B, of respectively, first conductive stem structure 310 and second conductive stem structure 312. As shown, each stem structure 310, 312 has a first, extended position (shown in the figures), and a second, compressed position in which respective springs 314, 316 are compressed. Each stem structure 310, 312 can move independently of the other. Springs 314, 316 can be selected by an operator to have a compressive force suitable for the particular condition to which plunger 300 will be subjected. For example, a spring 314, 316 may have any compressive force or spring rate between about 2 lbs. and about 40 lbs., such as about 2 lbs. to about 40 lbs., about 2 lbs. to about 15 lbs., about 2 lbs. to about 10 lbs., about 4 lbs. to about 15 lbs., or about 4 lbs. to about 10 lbs., or any force from about 10 lbs. to about 50 lbs., such as about 15 lbs., about 20 lbs., about 25 lbs., about 30 lbs., about 35 lbs., about 40 lbs., about 45 lbs., or about 50 lbs.

The purpose of biasing, moveable stem structures 310, 312 outward, and to permit their travel along axis B between a first, extended position and a second, compressed position, is to help ensure that an electrical connection is maintained when a string of gun assemblies 10 and sub-assemblies 200 are positioned in a wellbore. The string can be subject to stresses that push the respective components together, which can damage electrical connections if they cannot compress, and thus can move the respective electrical connections apart. The biasing of the stems outward to an extended position, and the ability of the stems to compress without breaking, helps to alleviate this problem. This structure permits play between the electrical connections, as opposed to a rigid connection that can more easily be damaged.

Plunger 300 could also include exterior grounding arms having the same configuration as exterior grounding arms 414 for DWG 400, which are shown in the Figures and described below.

Figure 15:
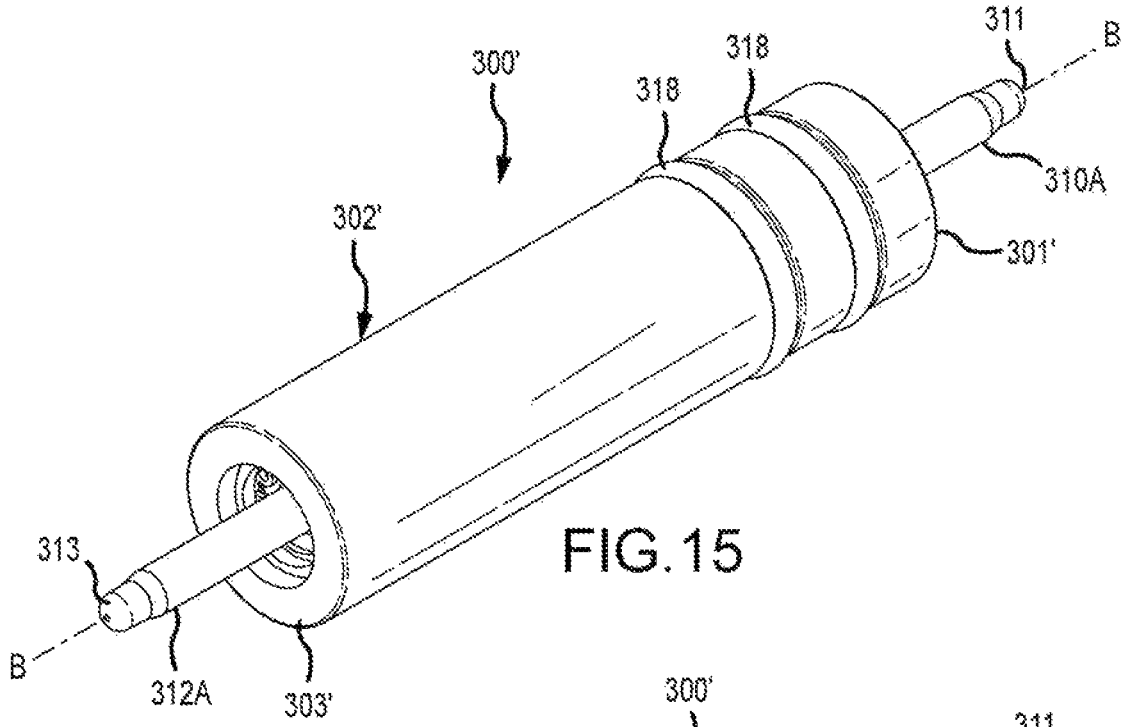
FIG. 15 is a side, perspective view of an alternate plunger.
Figure 15A:
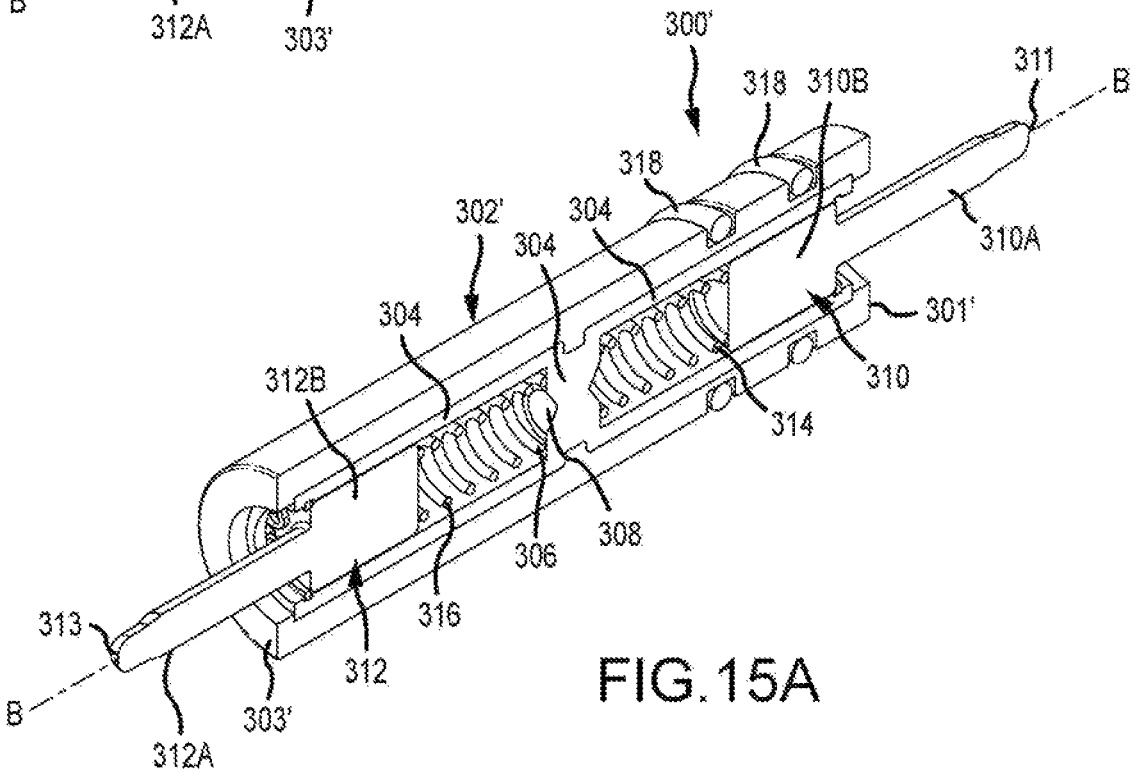
FIG. 15A is a side, cross-sectional view of the plunger of FIG. 15.

Alternately, a plunger 300', as shown in FIGS. 15-15A may be utilized. Plunger 300' is in all respects the same as plunger 300 except that outer casing 302' has a uniform outer diameter, so the portion of outer casing 302' juxtaposed first end 301' would have the same diameter as the portion juxtaposed second end 303'.

Figure 16:
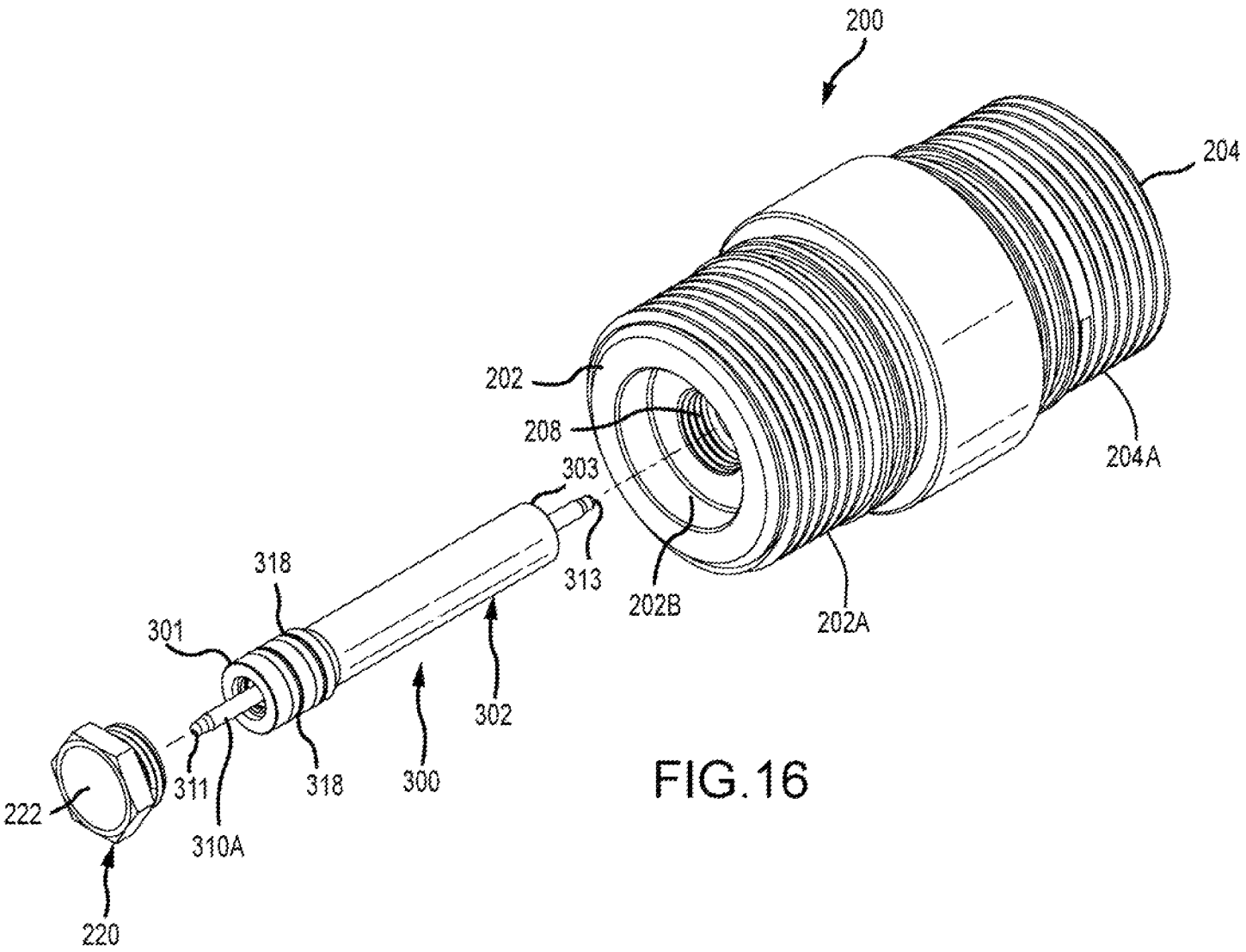
FIG. 16 is an exploded, perspective view of the plunger of FIG. 14 and a sub-assembly.
Figure 16A:
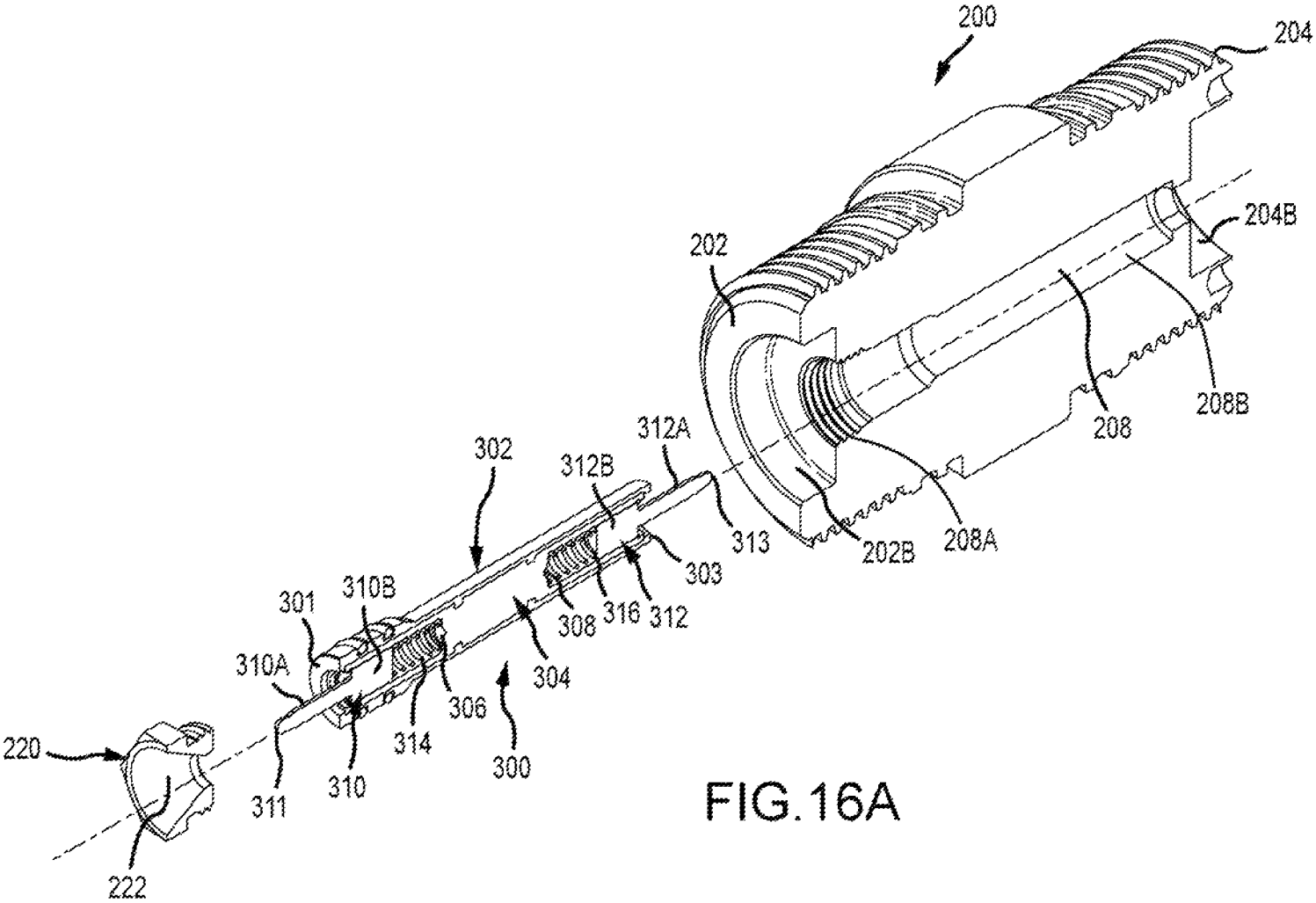
FIG. 16A is an exploded, cross-sectional view of the plunger and a sub-assembly of FIG. 16.

A metal retainer nut 220 may be screwed into central bore 208 to retain plunger 300 or 300', as shown in FIGS. 16, 16A, which helps retain plunger 300 in central bore 208. Retainer nut 220 has a central opening 222 in which first stem 310A is positioned.

Dart Retainer

Each end 202, 204, or only one end 202 or 204, of a sub-assembly 200 may include a dart retainer 250 or 380. Further, a dart retainer 250 or 380 may be used with a double wire through with ground, which is described below. If a dart retainer is used, it would be in place of a metal retainer nut 220.

Figure 17A:
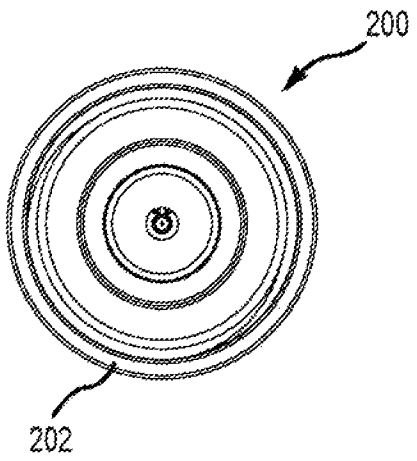
FIG. 17A is an end view of the sub-assembly of FIG. 17.
Figure 17:
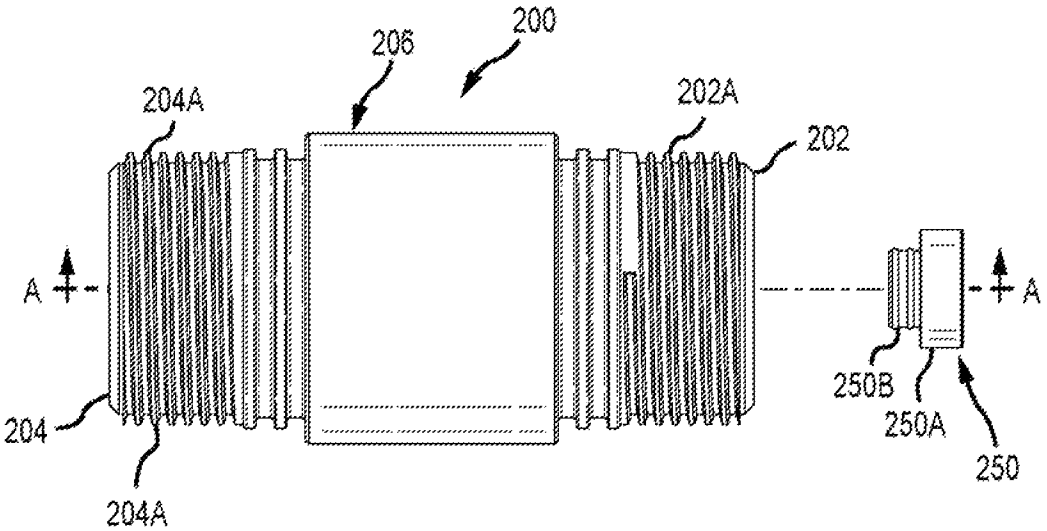
FIG. 17 is a side view of a sub-assembly with a plunger and small dart retainer.
Figure 17B:
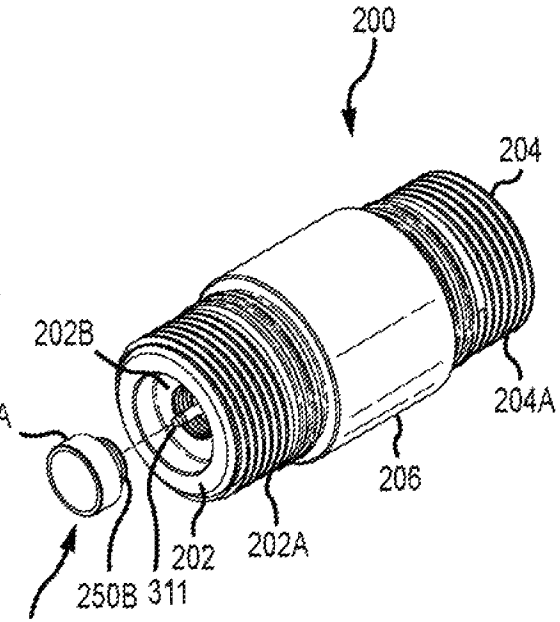
FIG. 17B is a side, perspective view of the sub-assembly of FIG. 17.
Figure 17C:
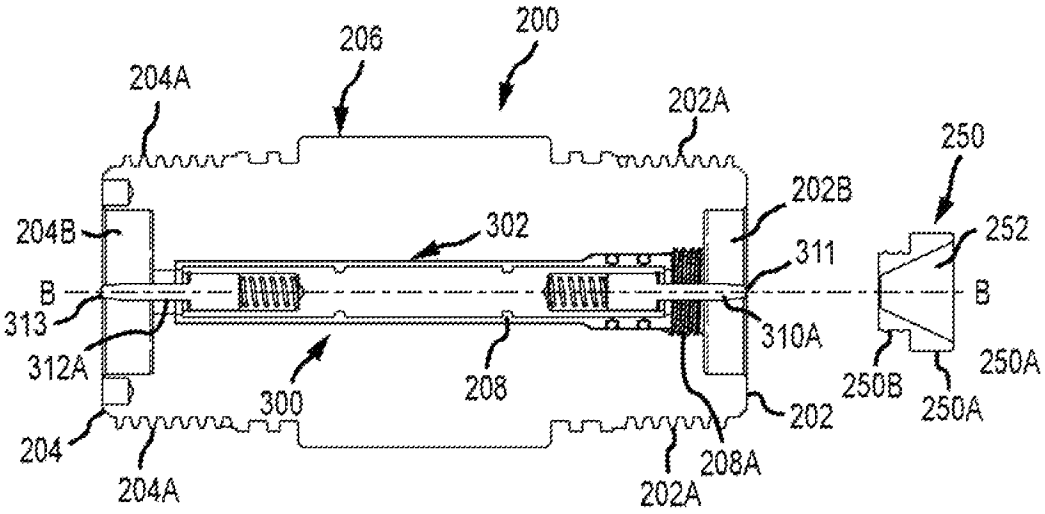
FIG. 17C is a side, cross-sectional view of the sub-assembly of FIG. 17.
Figure 17D:
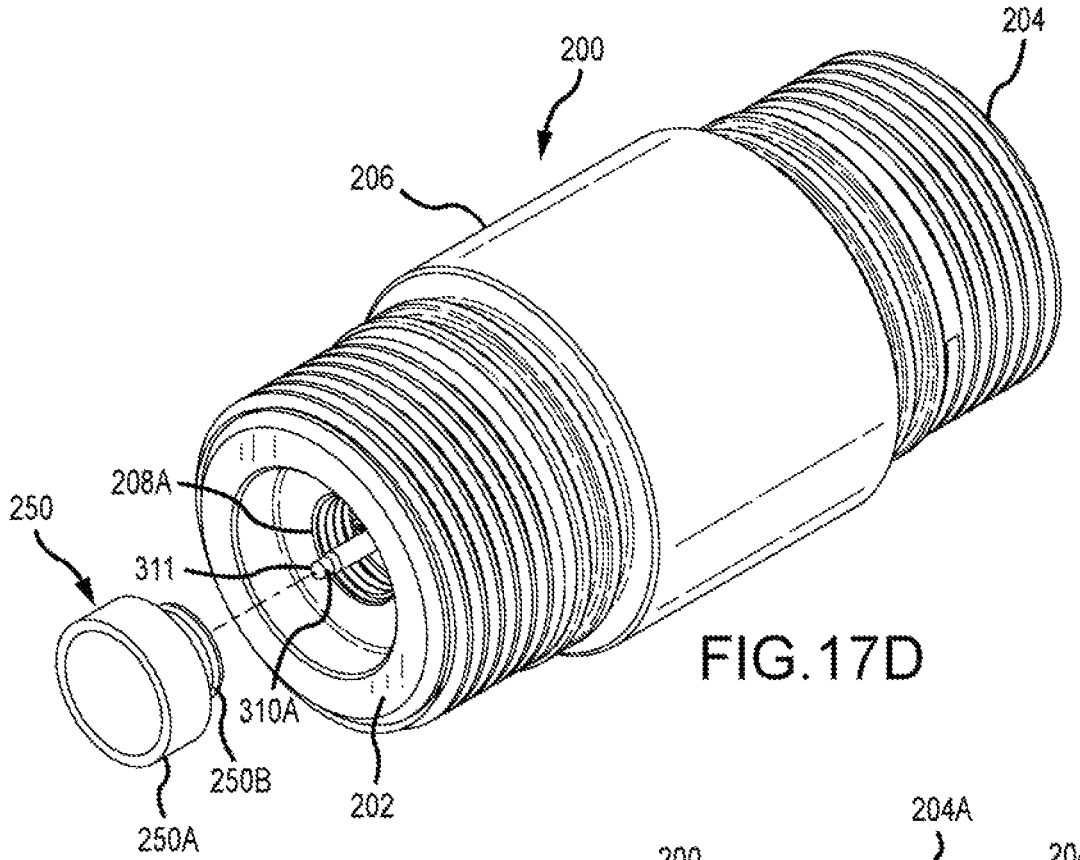
FIG. 17D is a side, perspective view of the sub-assembly of FIG. 17.
Figure 17E:
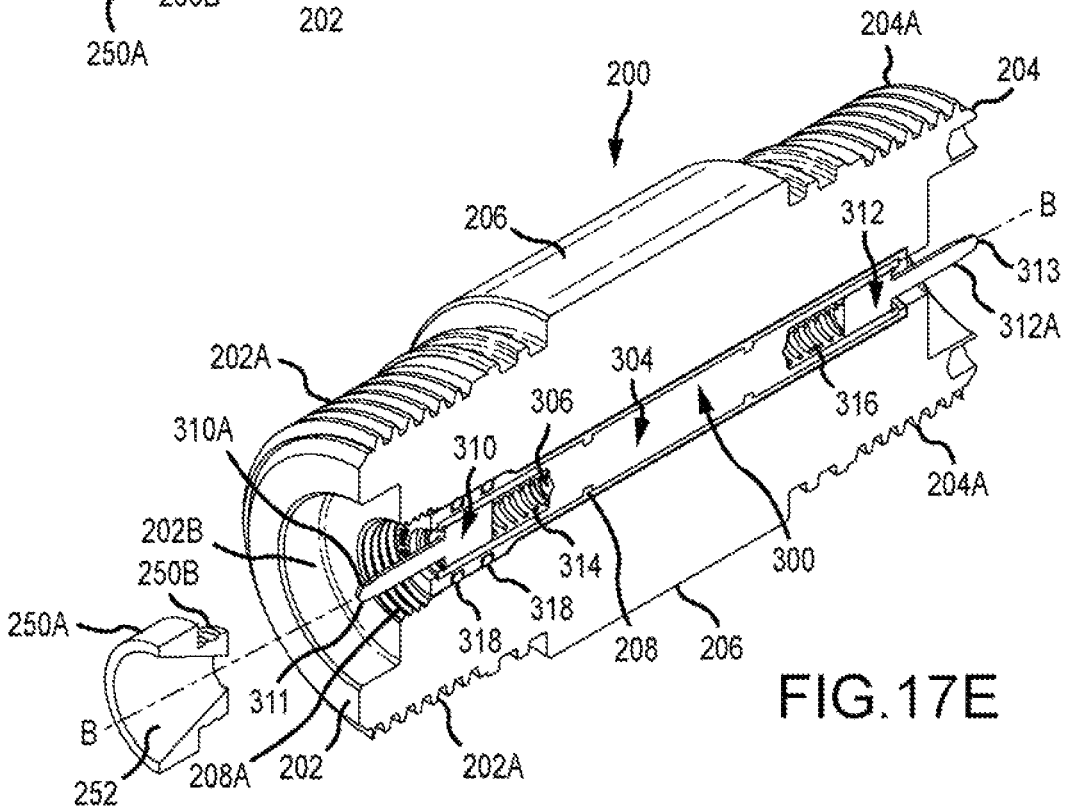
FIG. 17E is a side, perspective, cross-sectional view of the sub-assembly of FIG. 17.

As shown in FIGS. 17-17E, a small dart retainer 250 is an insulating sheath that is preferably comprised of rubber or elastomer, such as silicone rubber. It helps prevent short circuits by a loose wire touching sub-assembly 200. Only one dart retainer 250 shall be described because if a sub-assembly 200 utilizes two, the second dart retainer 250 would be utilized in the same manner, but be at second end 208B of sub-assembly 200 with second stem 312A.

Dart retainer 250 has a first portion 250B with a first diameter, a second portion 250A with a second diameter, and an opening 252 therethrough. Dart retainer 250 is preferably configured so first portion 250B fits in first threaded end 208A of central bore 208 and opening 252 at least partially surrounds first stem 310A of plunger 300.

Figure 18A:
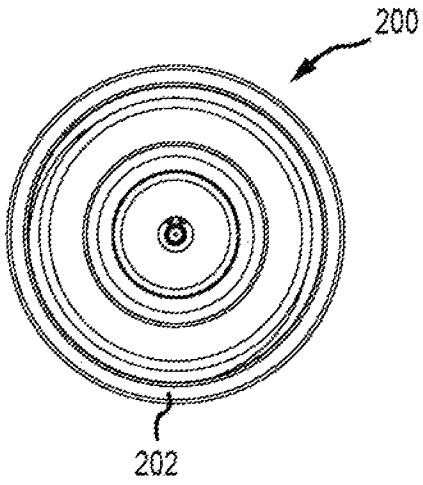
FIG. 18A is an end view of the sub-assembly of FIG. 18.
Figure 18:
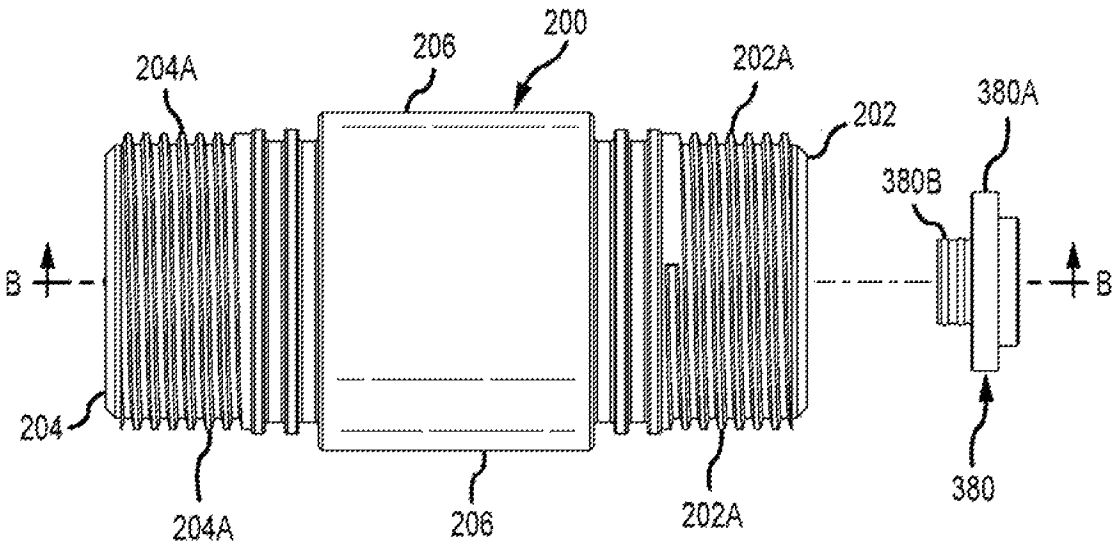
FIG. 18 is a side view of a sub-assembly with a plunger and large dart retainer.
Figure 18B:
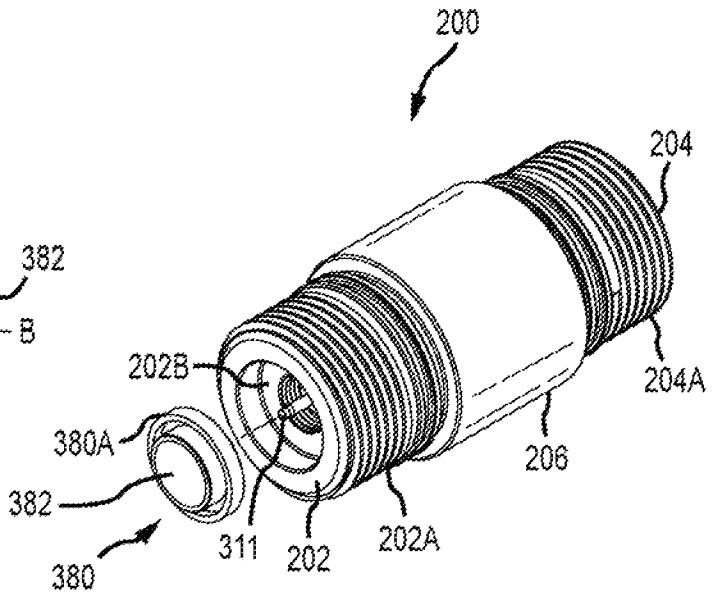
FIG. 18B is a side, perspective view of the sub-assembly of FIG. 18.
Figure 18C:
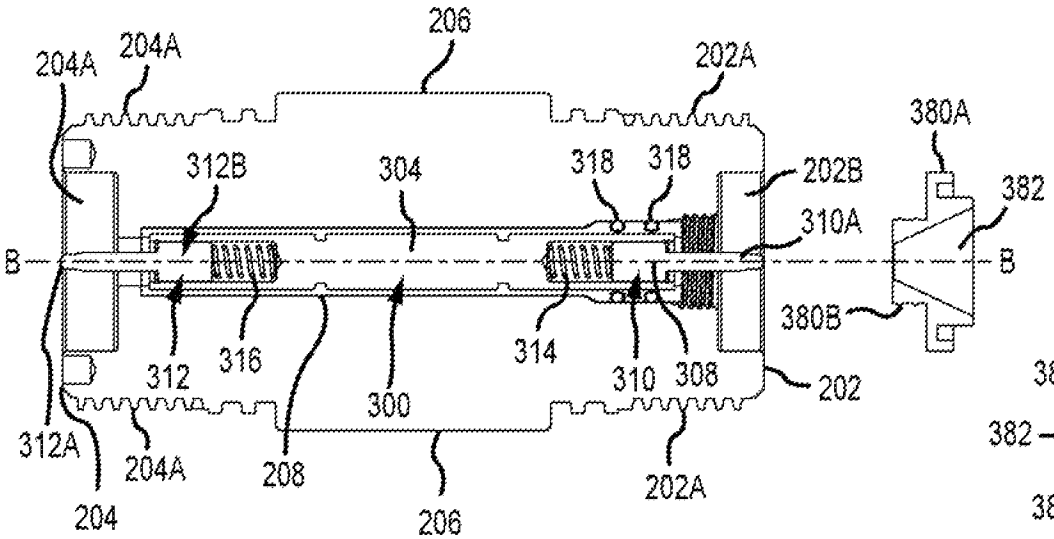
FIG. 18C is a side, cross-sectional view of the sub-assembly of FIG. 18.
Figure 18D:
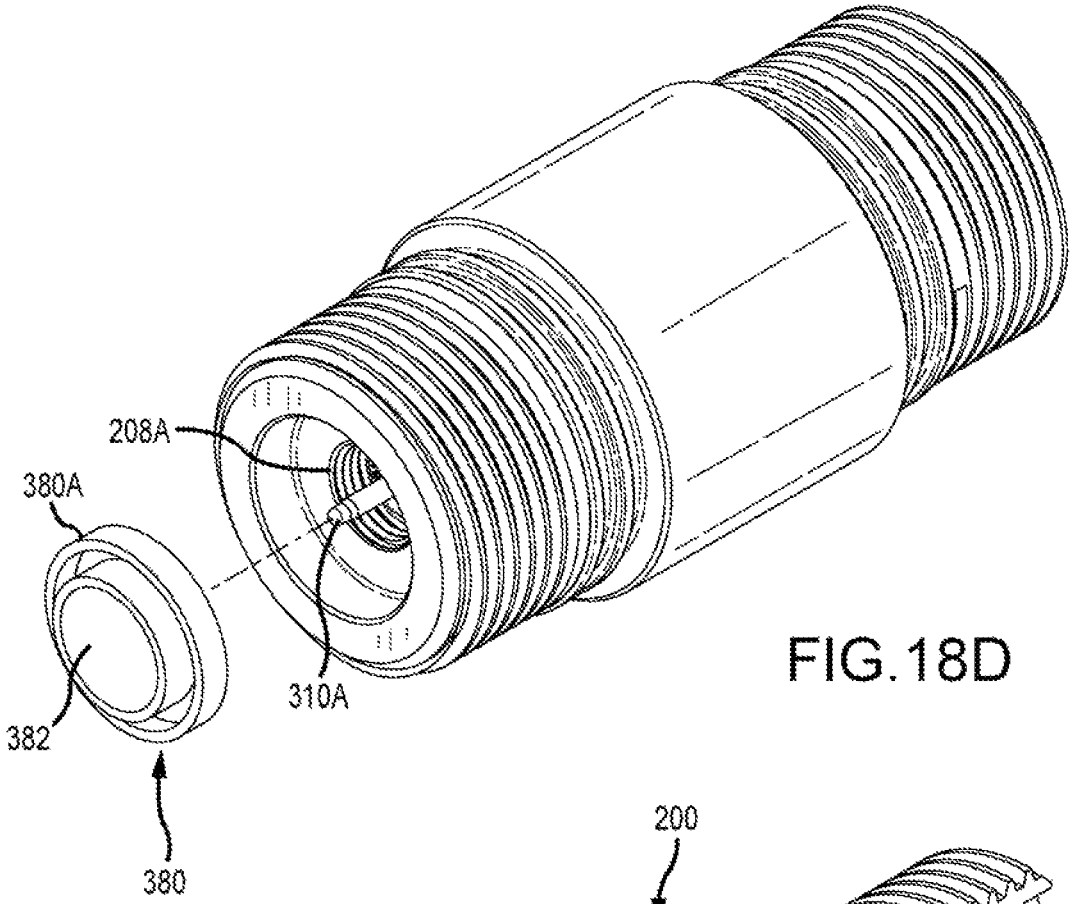
FIG. 18D is a perspective, side view of the sub-assembly of FIG. 18.
Figure 18E:
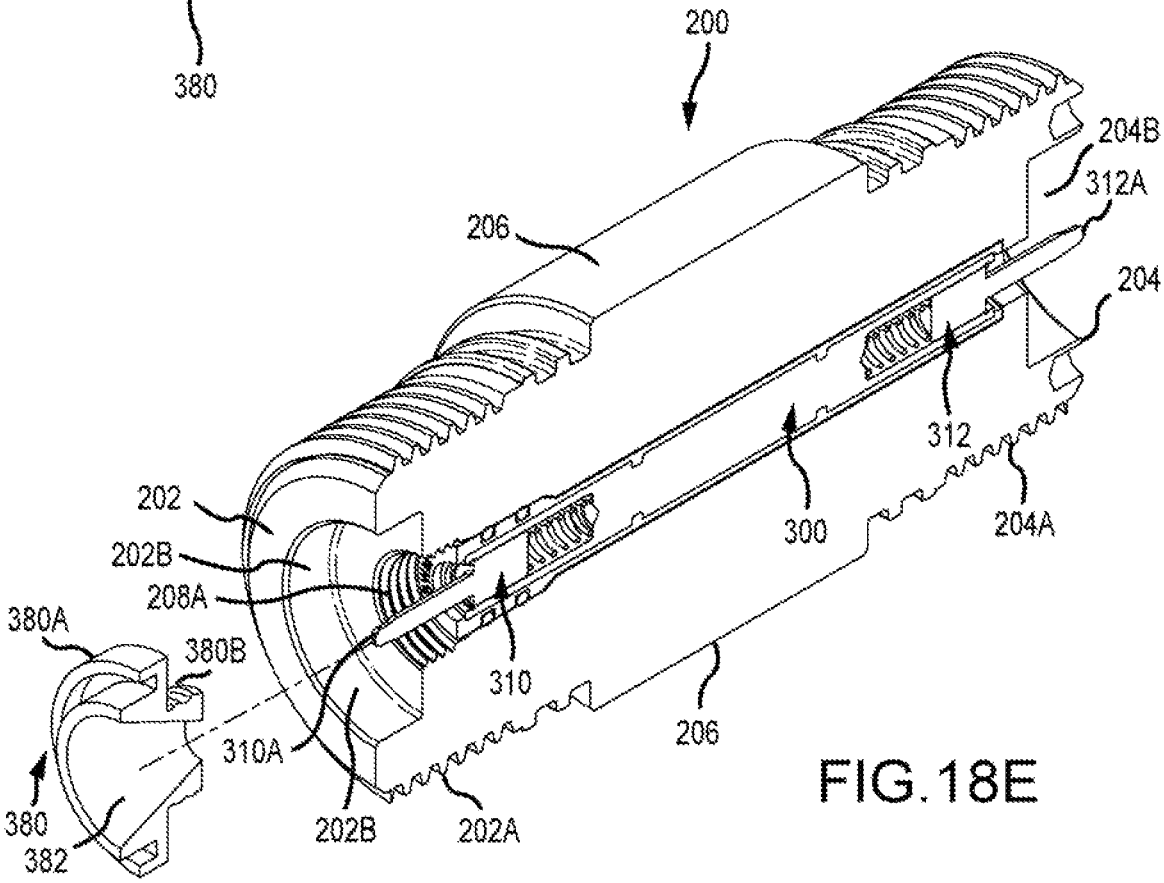
FIG. 18E is a perspective, side, cross-sectional view of the sub-assembly of FIG. 18.
Figure 19:
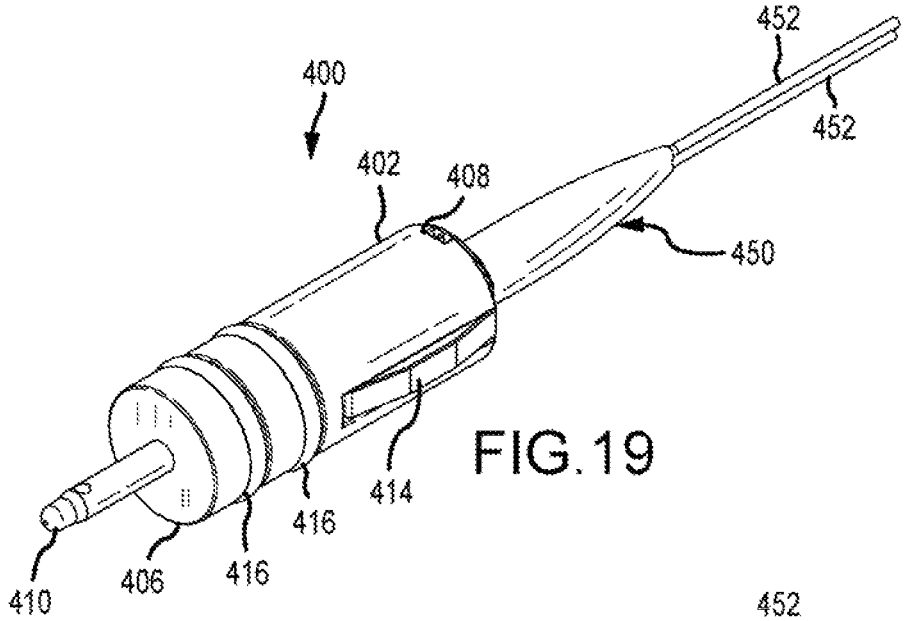
FIG. 19 is a perspective, side view of a double wire feed through with ground.
Figure 20:
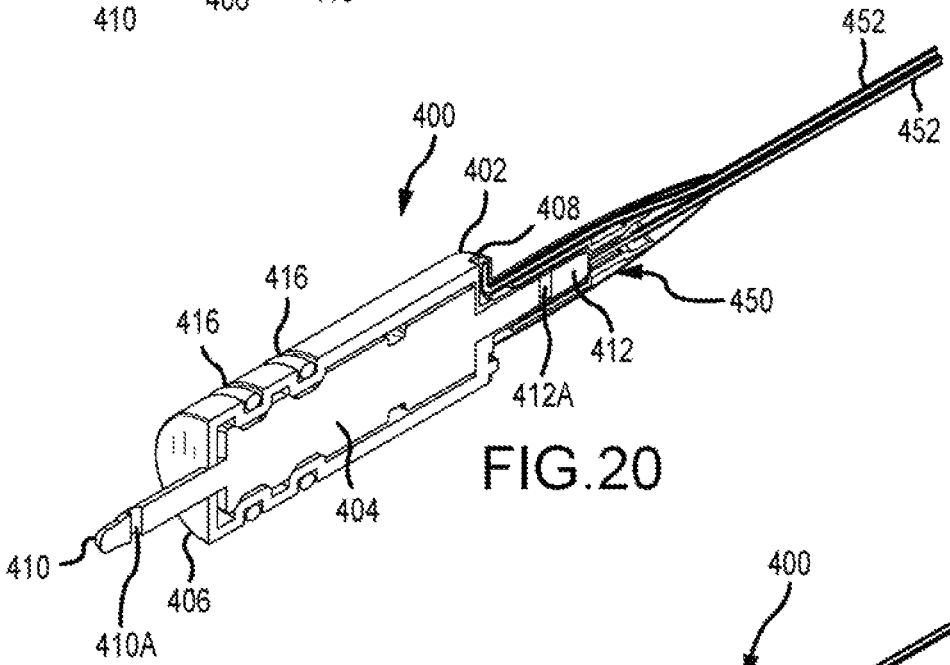
FIG. 20 is a side, perspective, cross-sectional view of the double wire feed through with ground of FIG. 19.
Figure 20A:
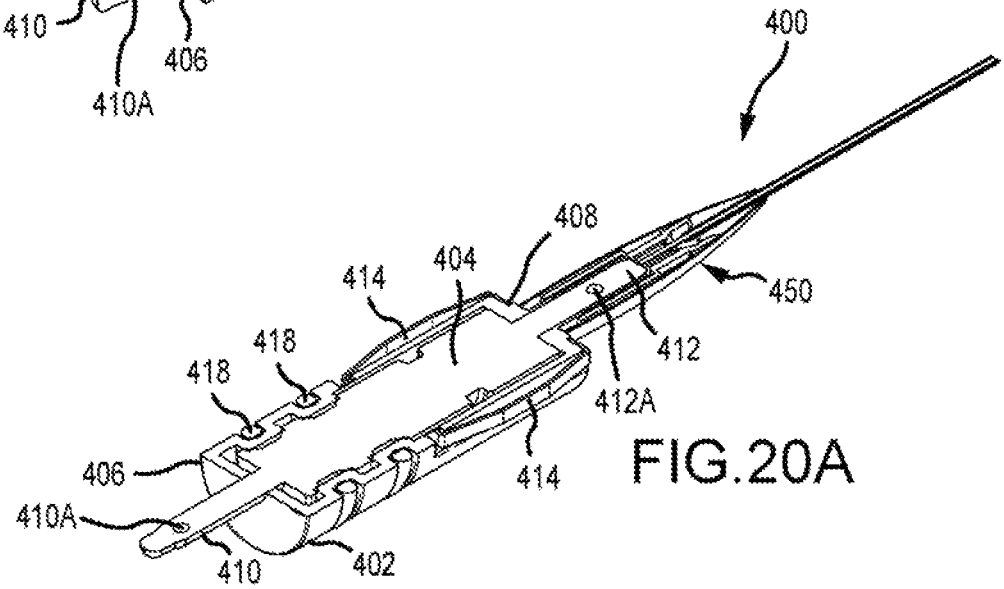
FIG. 20A is a top, perspective, cross-sectional view of the double wire feed through with ground of FIG. 19.
Figure 21:
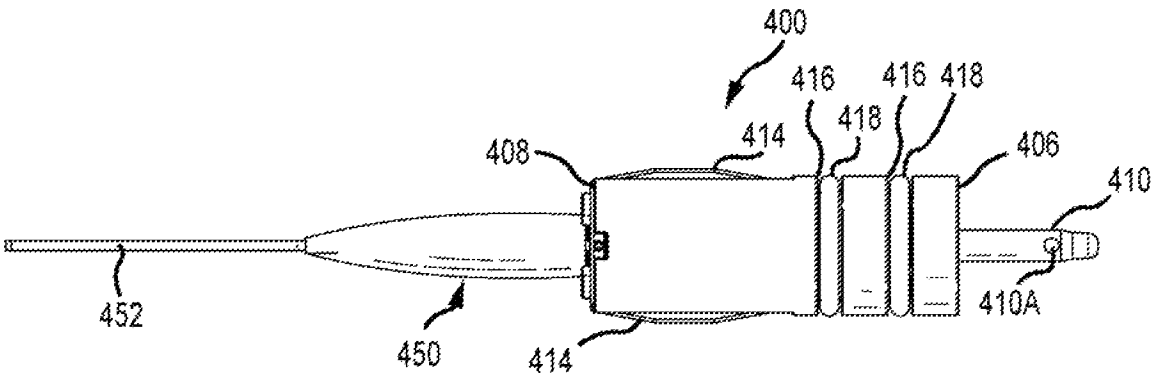
FIG. 21 is a side view of the double wire feed through with ground of FIG. 19.
Figure 21C:
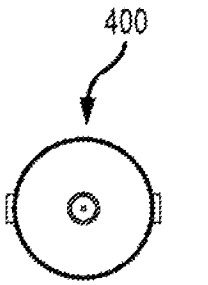
FIG. 21C is an alternate view of the double wire feed through with ground of FIG. 21A.
Figure 21A:
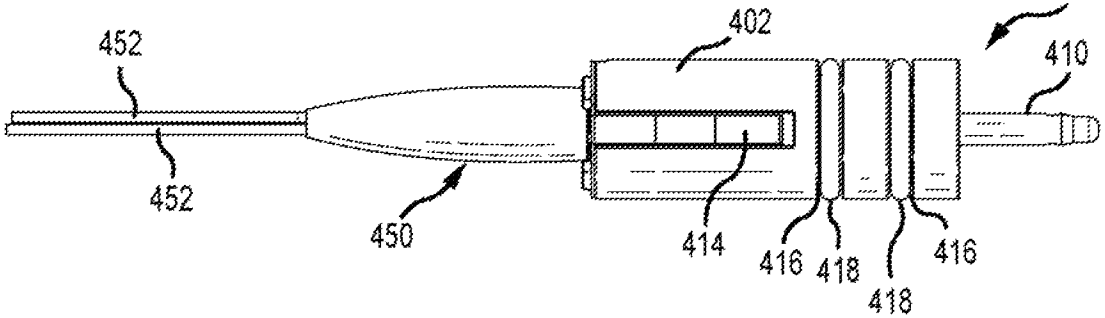
FIG. 21A is an alternate side view of the double wire feed through with ground of FIG. 18.
Figure 21B:
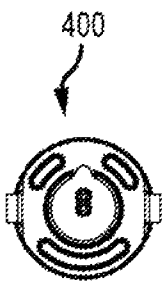
FIG. 21B is an end view of the double wire feed through with ground of FIG. 21A.
Figure 21D:
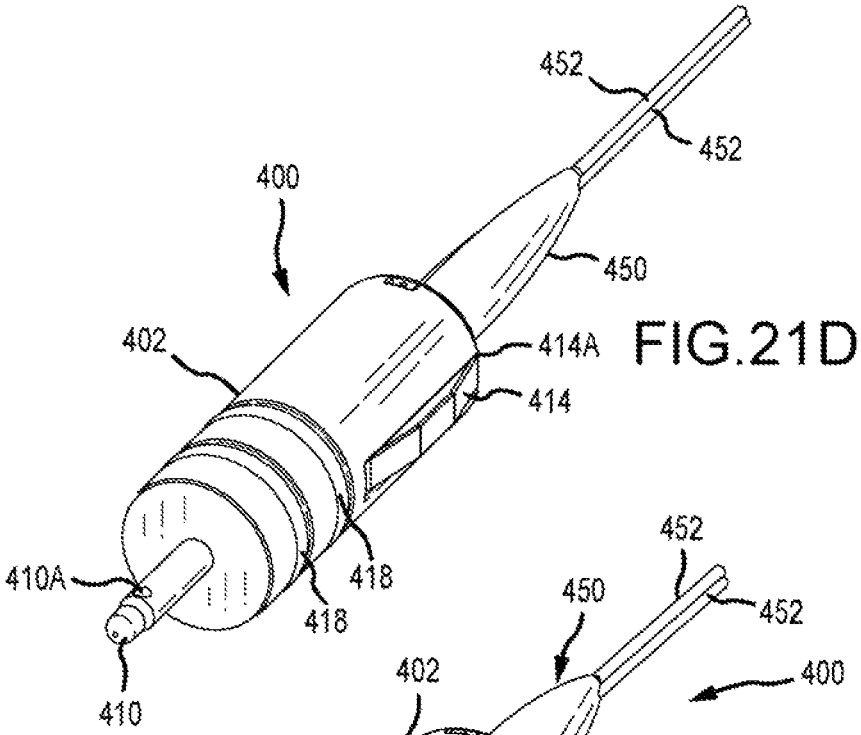
FIG. 21D is a side, perspective view of the double wire feed through with ground of FIG. 21.
Figure 21E:
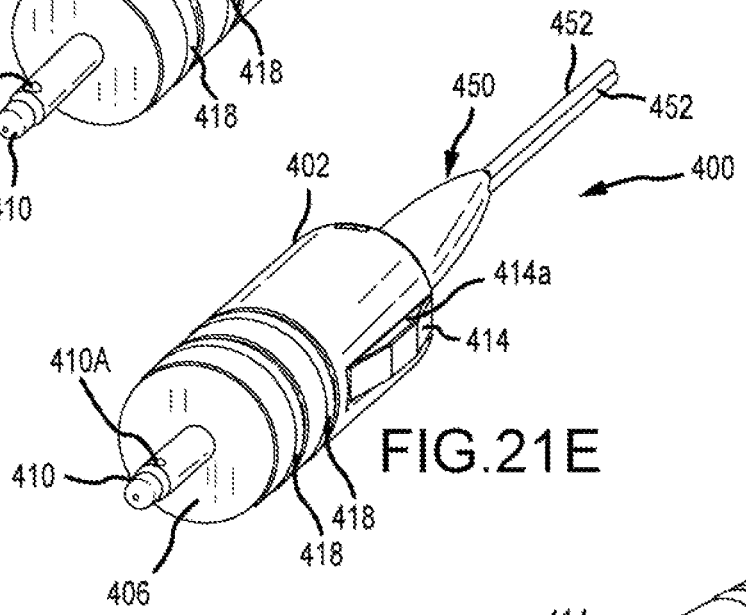
FIG. 21E is an alternate view of the double wire feed through with ground of FIG. 21.
Figure 21F:
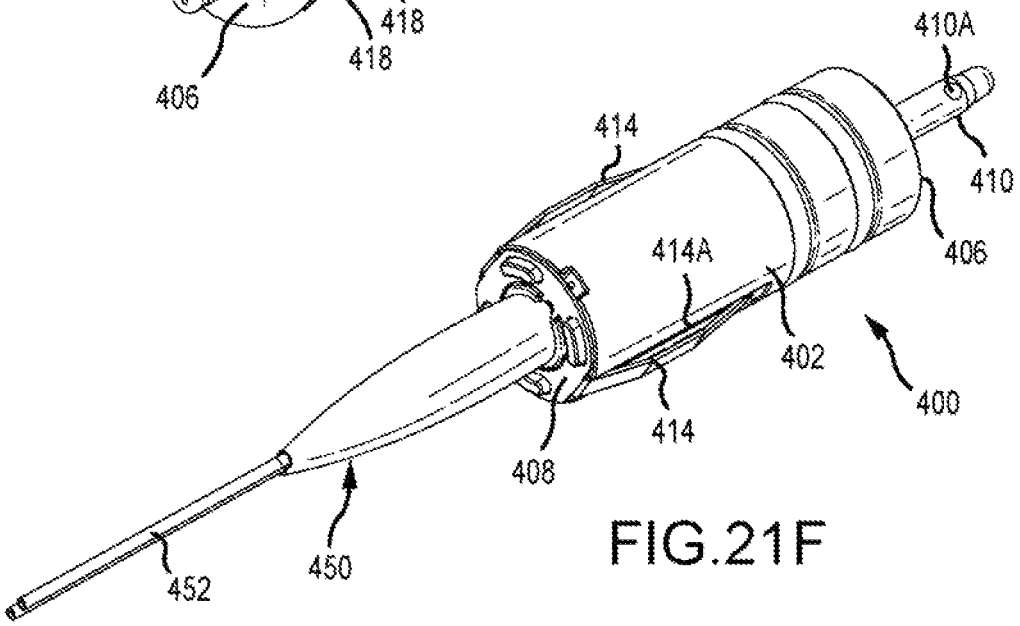
FIG. 21F is a perspective, side view of the double wire feed through with ground of FIG. 21.
Figure 22B:
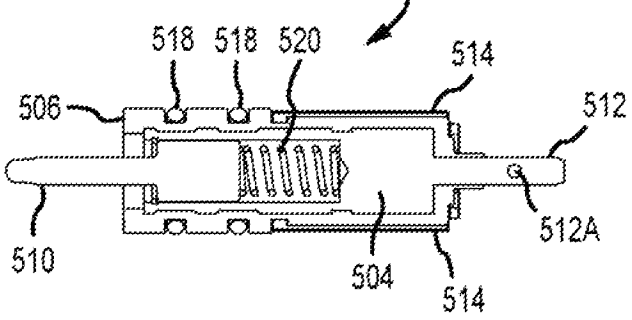
FIG. 22B is a bottom view of the double wire feed through with ground of FIG. 22 taken through line B-B.
Figure 22A:
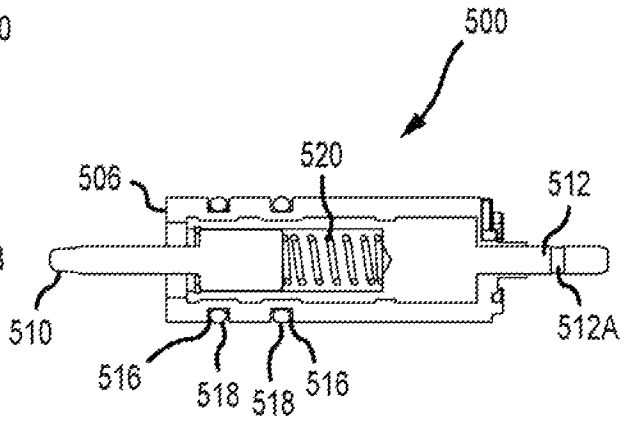
FIG. 22A is a cross-sectional side view of the double wire feed through with ground of FIG. 22 taken through line A-A.
Figure 22:
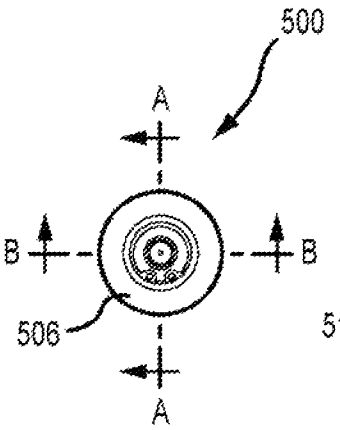
FIG. 22 is an end view of an alternate double wire feed through with ground.
Figure 22C:
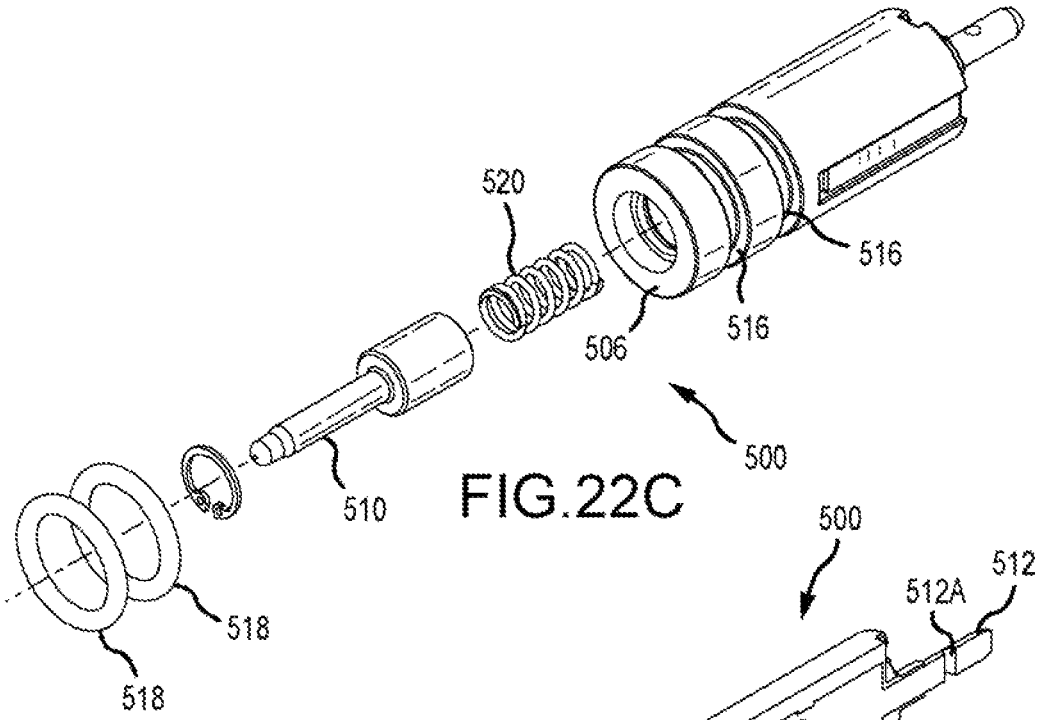
FIG. 22C is an exploded, perspective view of the double wire feed through with ground of FIG. 22.
Figure 22D:
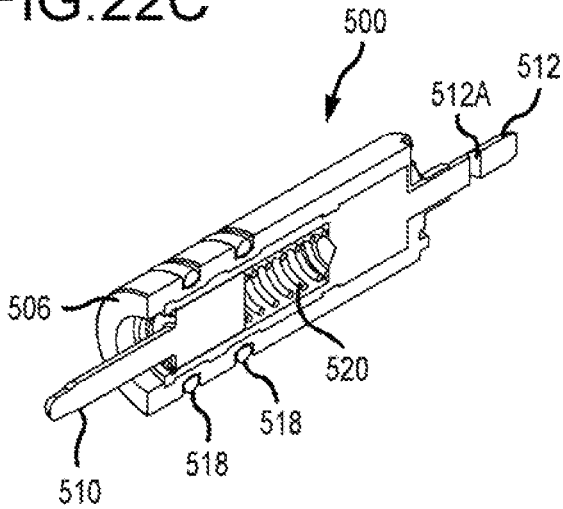
FIG. 22D is a perspective, cross-sectional side view of the double wire feed through with ground of FIG. 22.
Figure 22E:
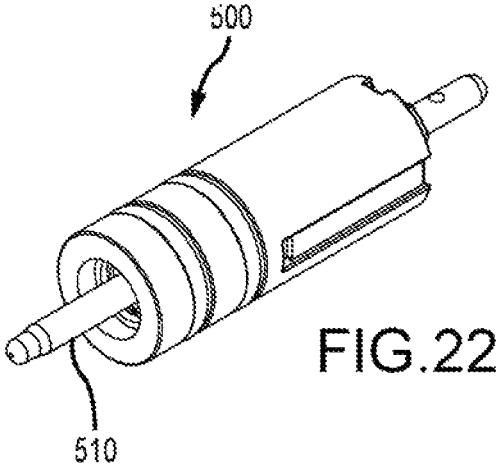
FIG. 22E is a side, perspective view of the double wire feed through with ground of FIG. 22.
Figure 22F:
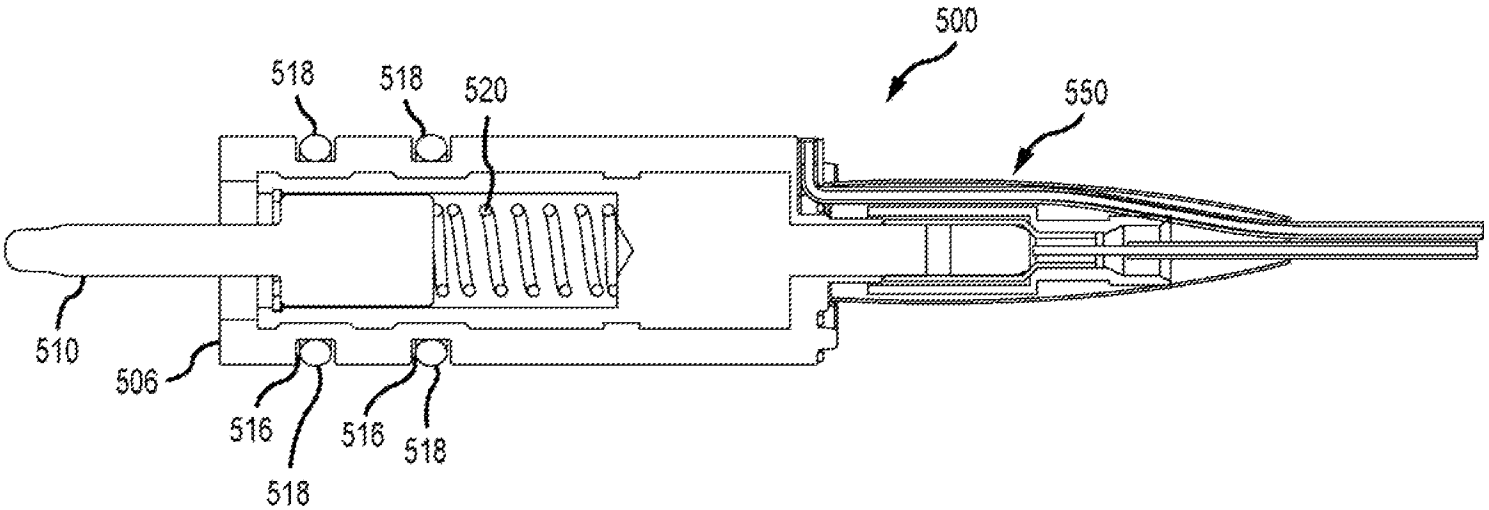
FIG. 22F is a close-up, partial cross-section view of the double wire feed through with ground of FIG. 22 with wires attached.
Figure 22G:
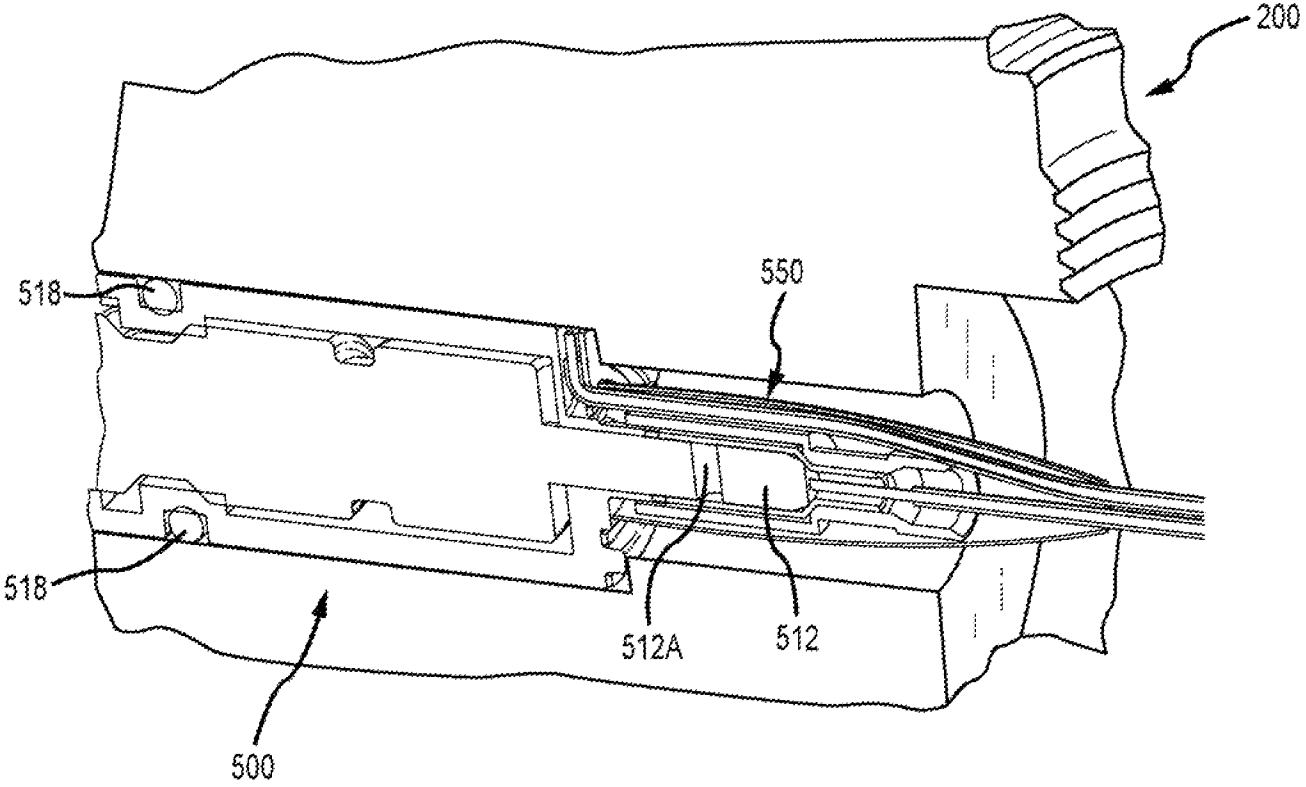
FIG. 22G is a partial, cross-sectional side view of the double feed through with ground of FIG. 22F positioned in a sub-assembly.
Figure 23:
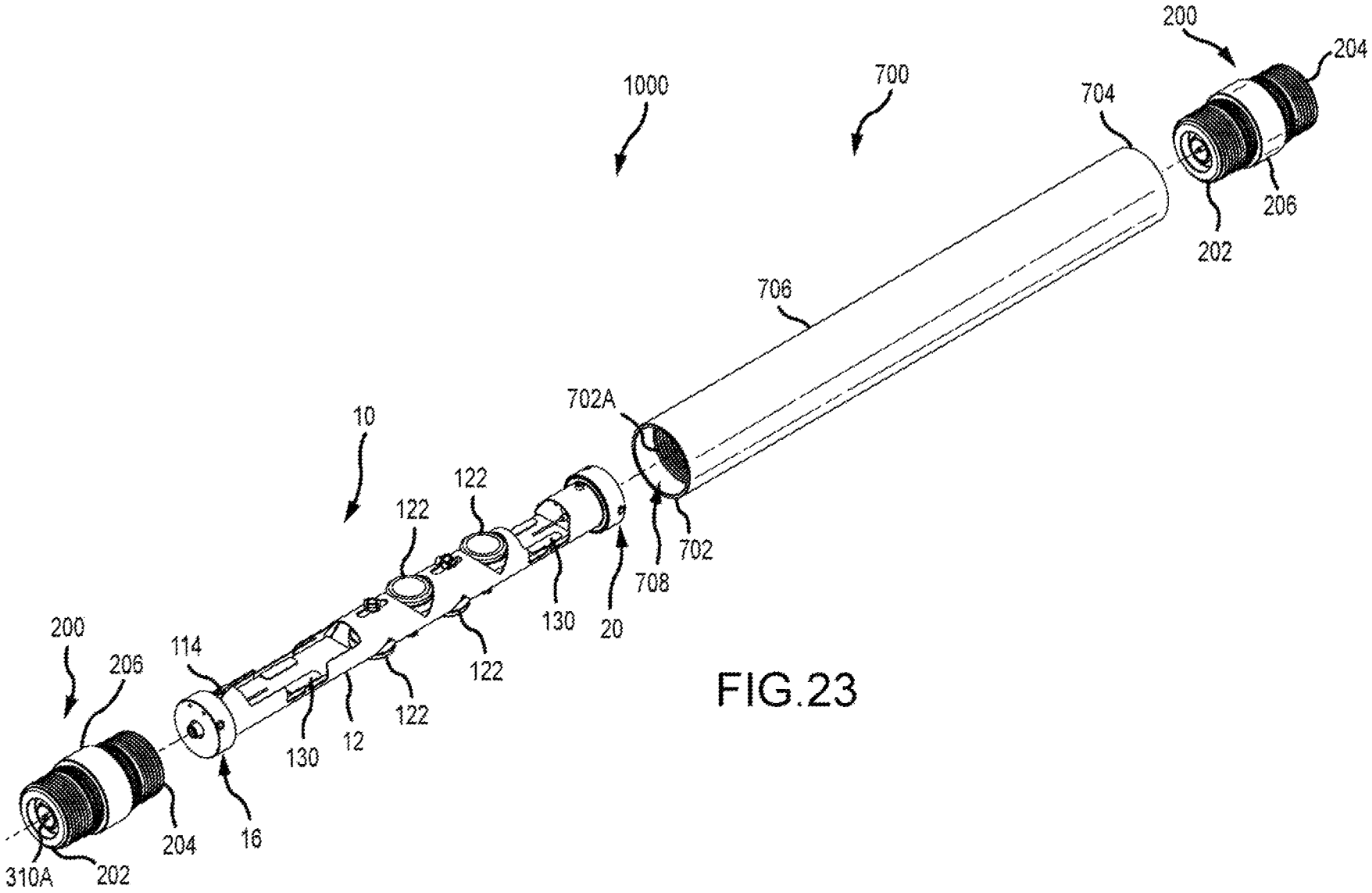
FIG. 23 is an exploded, side perspective view of a gun assembly including an outer casing and two sub-assemblies.
Figure 24:
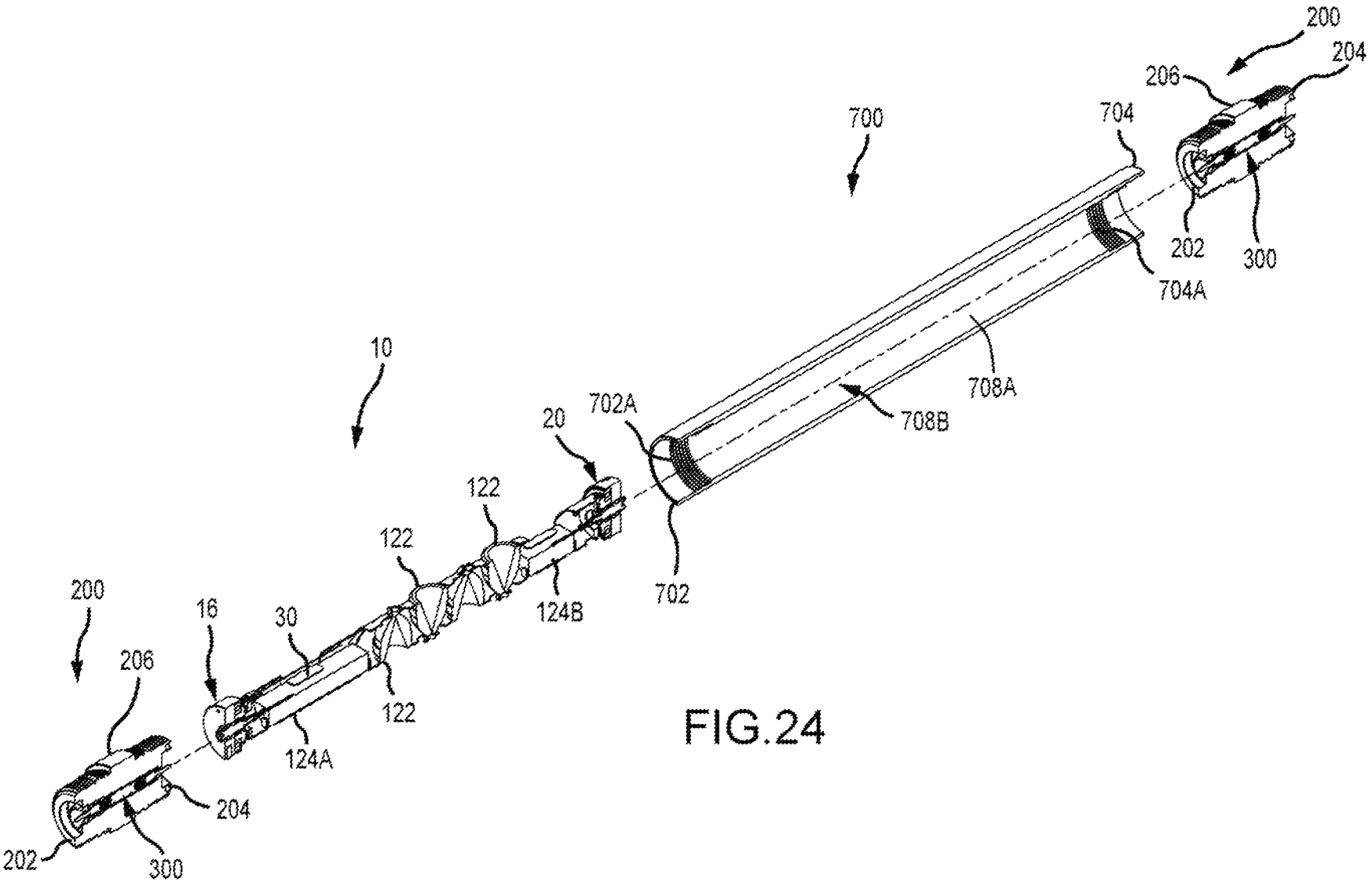
FIG. 24 is a cross-sectional, side, perspective view of the gun assembly of FIG. 23.
Figure 25:
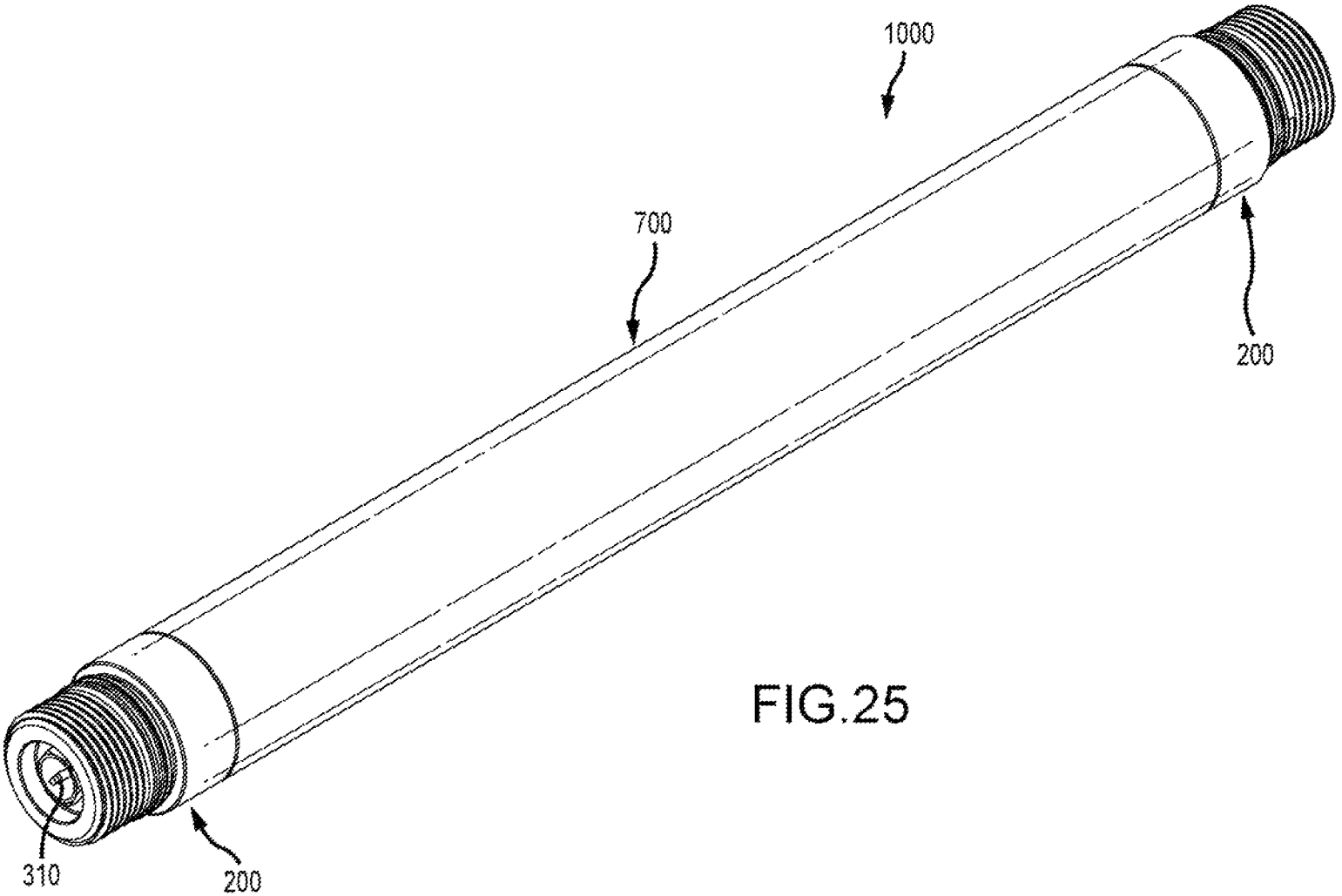
FIG. 25 is a side, perspective, assembled view of the gun assembly of FIG. 23.

Alternatively, as shown in FIGS. 18-18E, a large dart retainer 380 is an insulating sheath that is preferably comprised of rubber or elastomer, such as silicone rubber. It helps prevent short circuits by a loose wire touching sub-assembly 200, and also helps prevent shrapnel from damaging the surface of central bore 208. Only one dart retainer 380 shall be described because if a sub-assembly 200 utilizes two, the second dart retainer 380 would be utilized in the same manner, but be at second end 208B of sub-assembly 200 with second stem 312A.

Dart retainer 380 has a first portion 380B with the same first diameter as first portion 250B, a larger second portion 380A with a diameter greater than that of second portion 250A, and an opening 382. First portion 380B is configured to be positioned in first threaded end 208A of central bore 208 and opening 382 at least partially surrounds first stem 310A of plunger 300. Second portion 380A is sized to fit against the wall of opening 202B in order to provide protection and help prevent shorts.

Double Wire Feed Through with Ground

FIGS. 19-22G show a double wire with ground ("DWG") 400 and 500. The DWG 400 could be used instead of a dual plunger in a sub-assembly 200 to transmit electricity to a gun tube 10.

If a DWG is used, end contacts 22 are not required in the end fittings 16, 20 of gun tube 10 because electricity is conducted through wires that are in contact with second conductive stem 412 and with the shape charges 122. Alternatively, a DWG could be used with an end contact 22.

DWG 400 is configured to be received in central bore 208 of sub-assembly 200. DWG 400 has an outer housing 402 preferably made of insulating material, an electrically conductive core 404, a first end 406, a second end 408, a first conductive stem 410, a second conductive stem 412, and optionally a spring or other biasing structure between first conductive stem 410 and electrically conductive core 404.

DWG 400 also preferably has one or more exterior grounding arms 414 to securely ground to the central bore 208 of the sub-assembly 200. An insulative protective sheath, which may be heat shrink tubing 450, can be manually placed or affixed over second conductive stem 412 of the DWG 400 for secure attachment of wires 452, instead of having to connect wires to second conductive stem 412.

One or more annular groves 416 are preferably formed on the outer surface of outer housing 402. Each groove preferably receives an o-ring (or gasket) of varying durometer 418 that pressure fits into central bore 208 of sub-assembly 200.

One or more exterior grounding arms 414 are positioned adjacent grooves 414A on outer housing 402. When DWG 400 is pressed into central bore 208 of sub-assembly 200, one or more exterior grounding arms 414 press against the annular wall of central bore 208 to help ensure the grounding of DWG 400.

Intelligent Gun Tube

Figure 27:
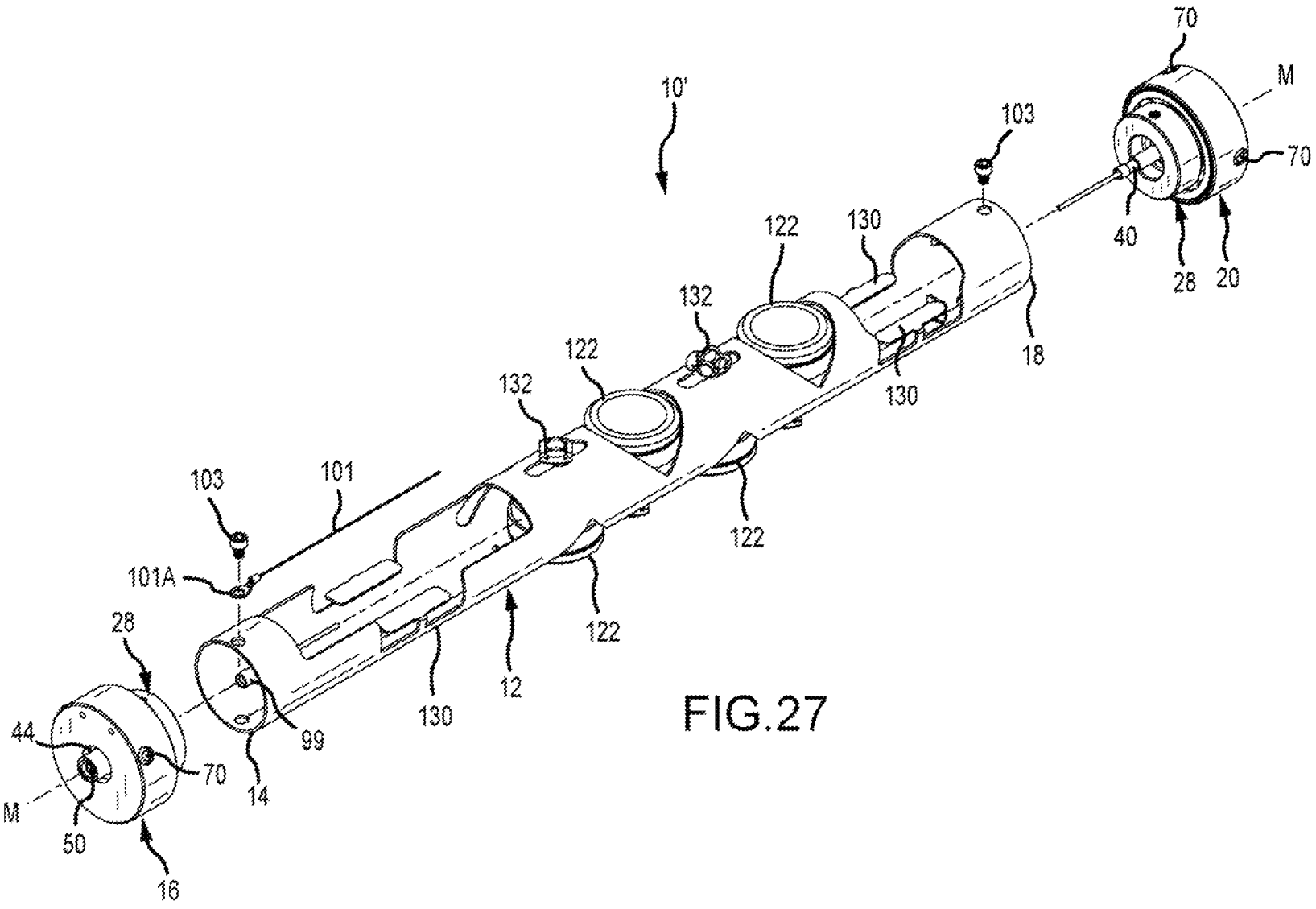
FIG. 27 is a perspective, side view of an alternate gun tube in accordance with aspects of the invention.
Figure 28:
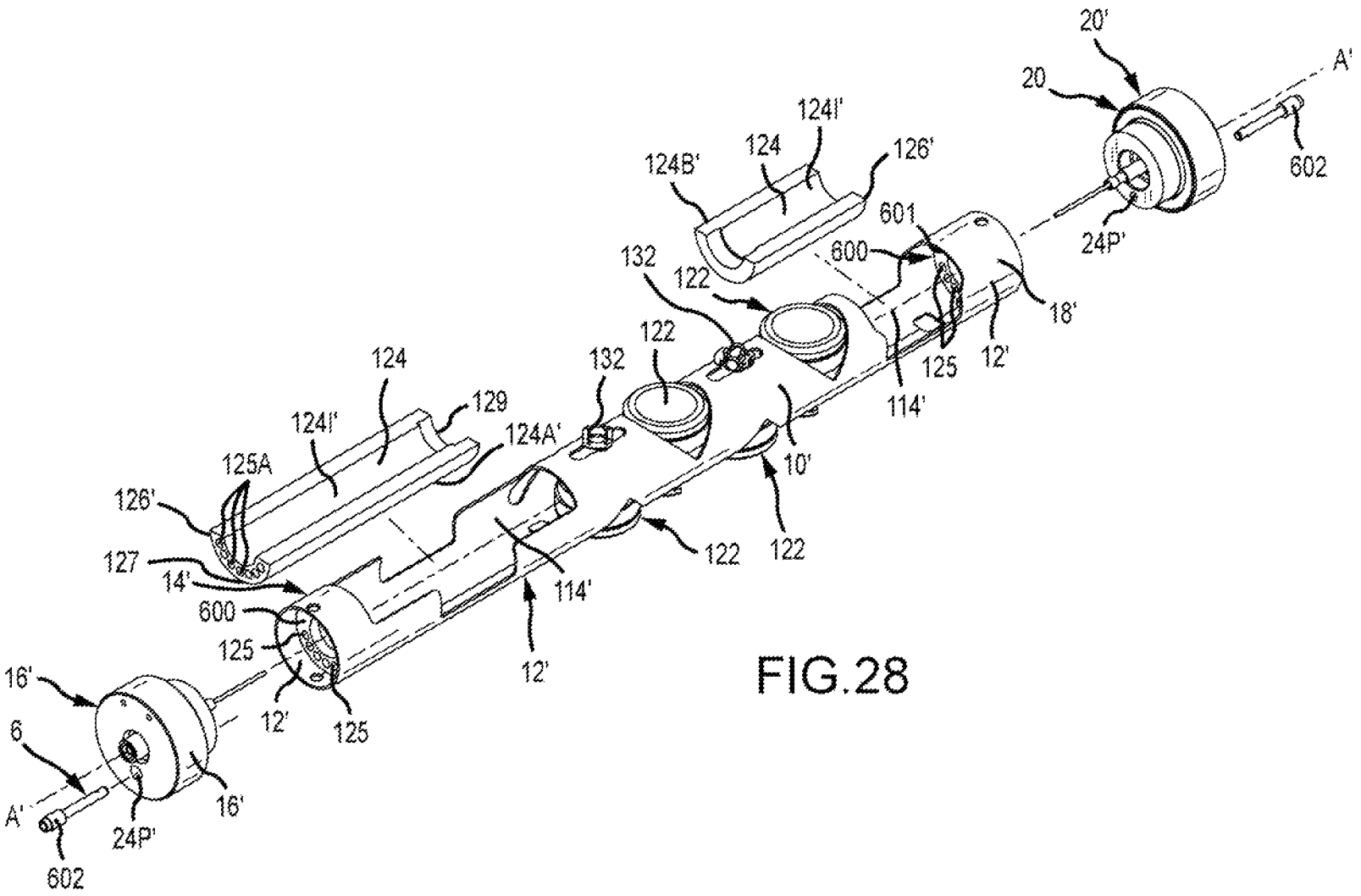
FIG. 28 is a perspective, partially-exploded side view of an alternate gun tube in accordance with aspects of the invention.
Figure 28A:
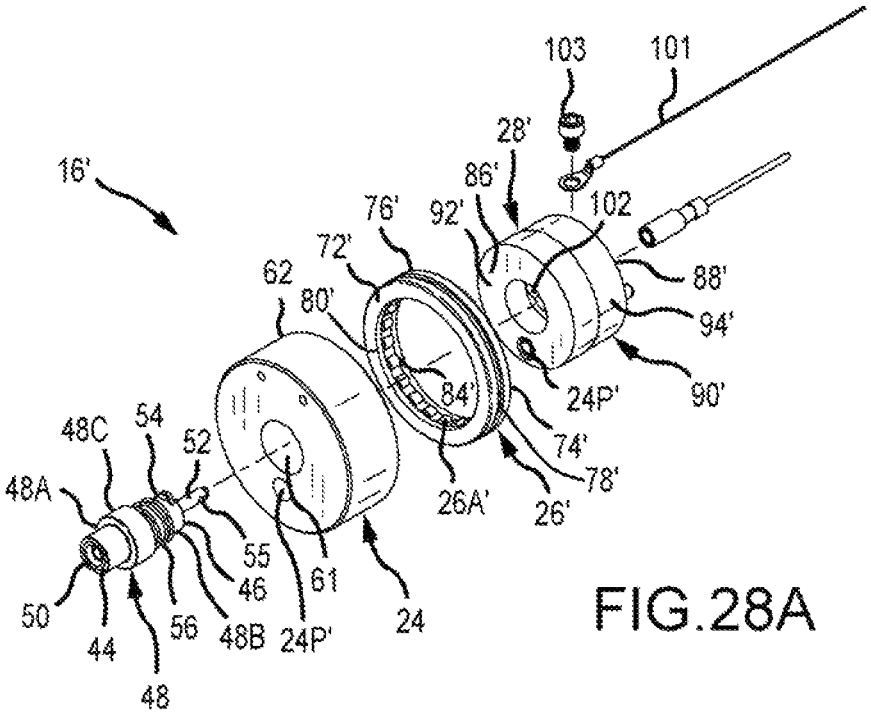
FIG. 28A is an exploded, perspective side view of a first end cap of the gun tube of FIG. 28.
Figure 28B:
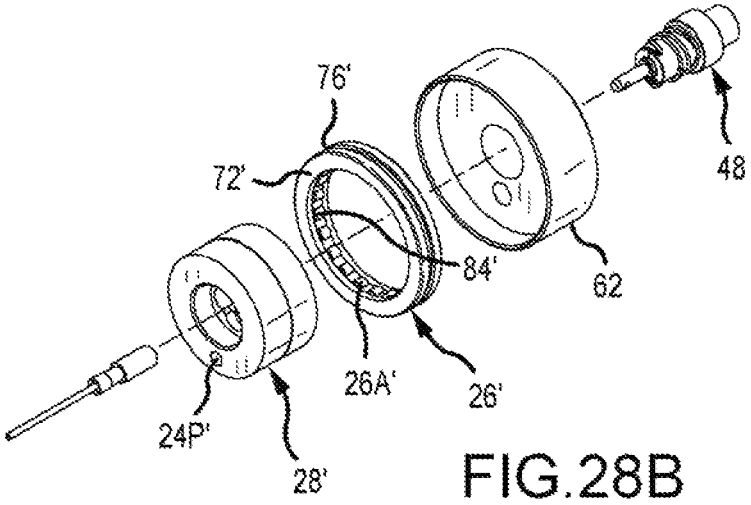
FIG. 28B is an exploded, perspective side view of a second end cap of the gun tube of FIG. 28.
Figure 29B:
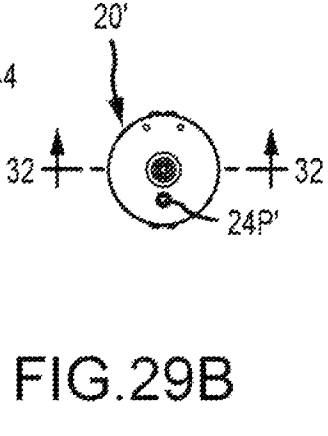
FIG. 29B is an opposite end view of the gun tube of FIG. 29.
Figure 29:
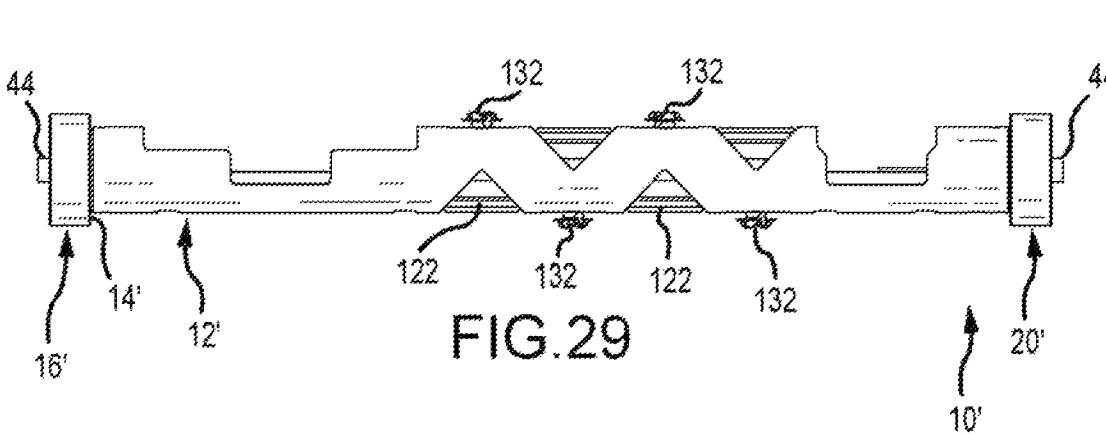
FIG. 29 is a side view of the gun tube of FIG. 28.
Figure 29A:
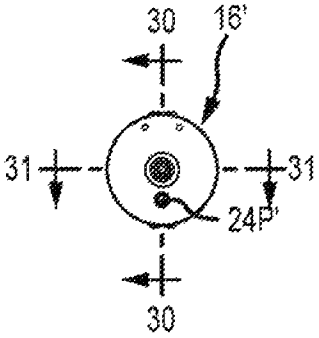
FIG. 29A is an end view of the gun tube of FIG. 29.
Figure 30:
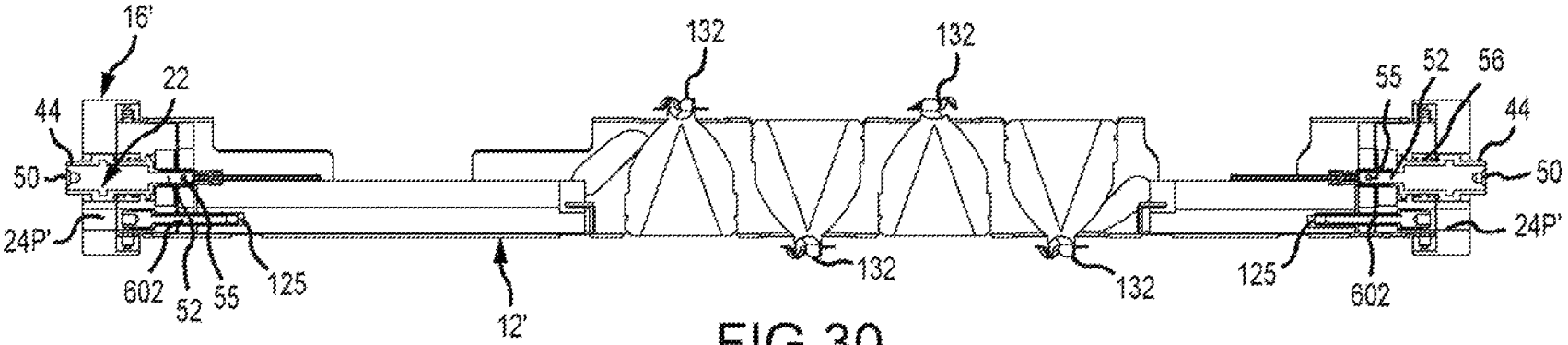
FIG. 30 is a cross-sectional side view of the gun tube of FIG. 29 taken along line 30-30 of FIG. 29A.
Figure 31:
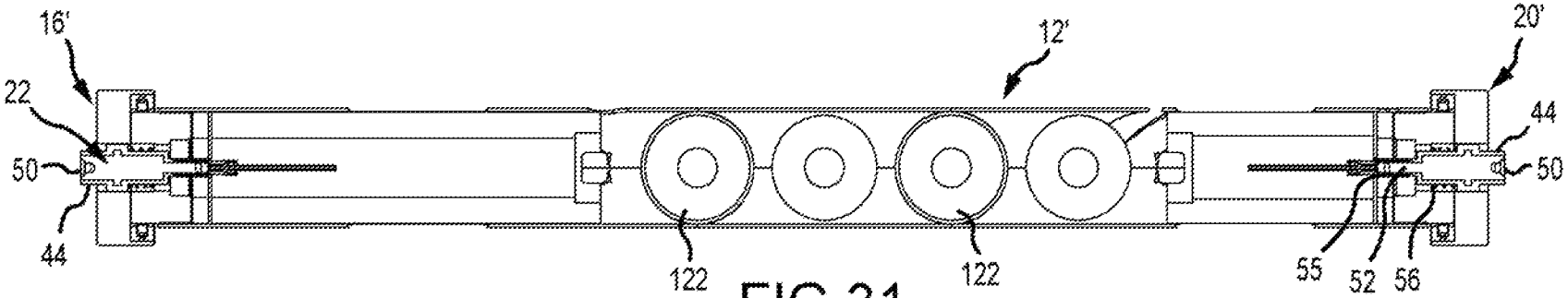
FIG. 31 is a cross-sectional top view of the gun tube of FIG. 29 taken along line 31-31 of FIG. 29A.
Figure 32:
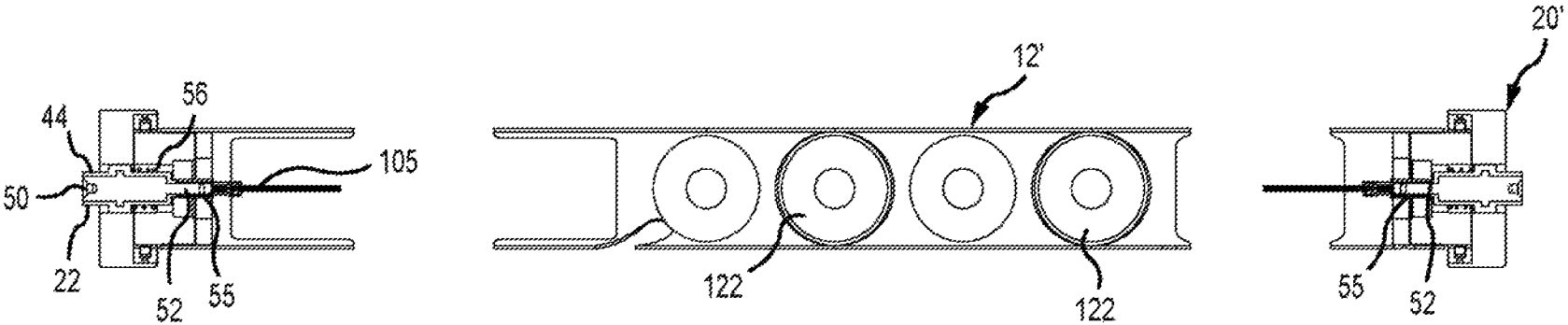
FIG. 32 is a cross-sectional top view of the gun tube of FIG. 29 taken along line 32-32 of FIG. 29B.
Figure 33:
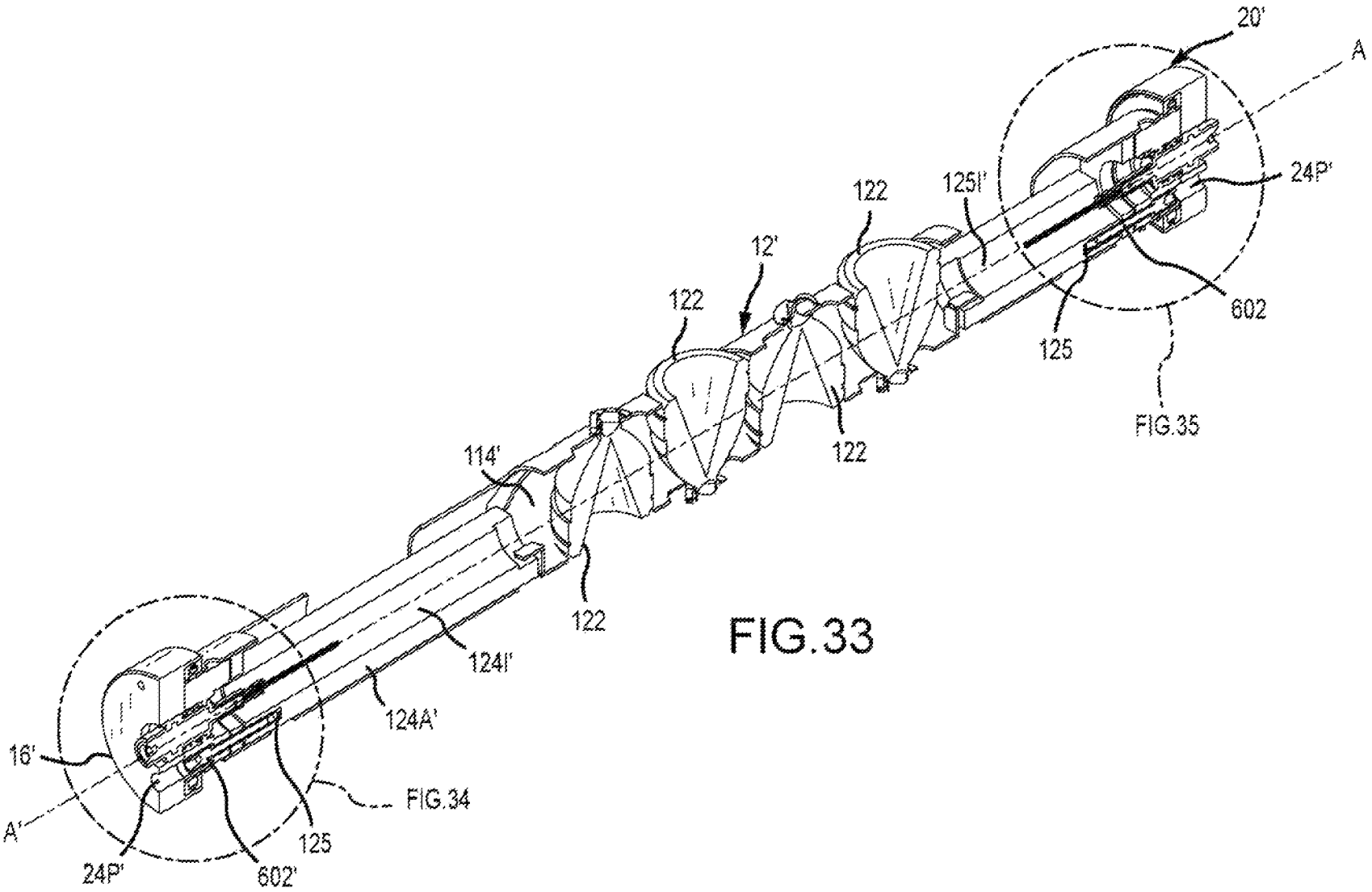
FIG. 33 is a break-away, side perspective view of the gun tube of FIG. 28.
Figure 34:
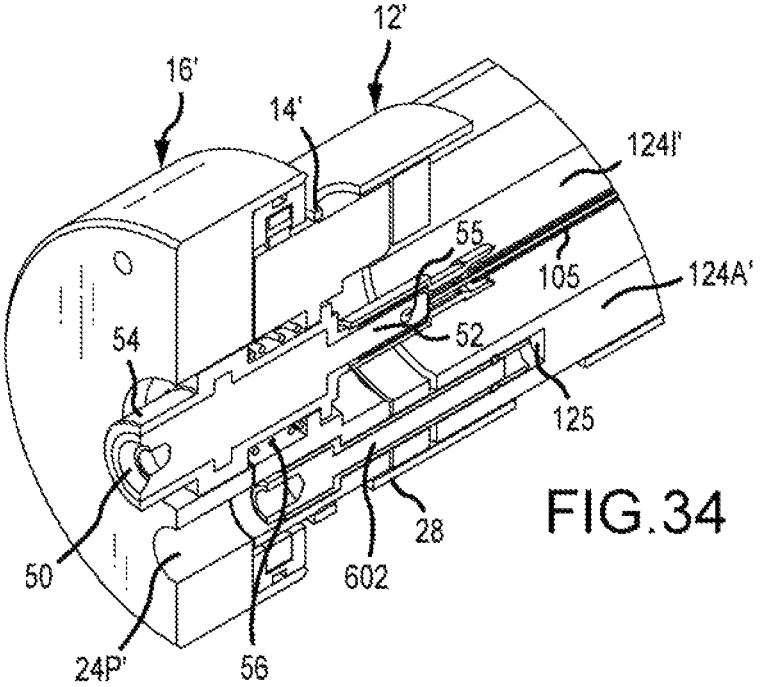
FIG. 34 is a close-up, side, perspective view showing detail D of FIG. 33.
Figure 35:
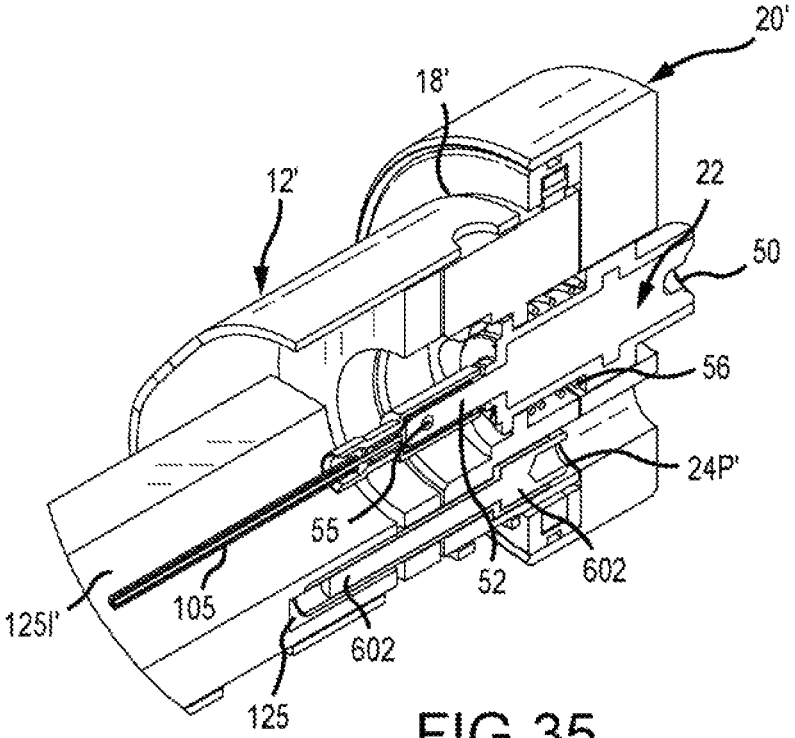
FIG. 35 is a close-up, side, perspective view showing detail E of FIG. 33.

As shown in FIG. 27, gun tube 10' is a smart assembly that is the same in all respects as gun tube 10 except it does not require one or more weights 124 (although it may still include them), and it includes a motor M on first end 14 and/or on second end 18. A motor M may be attached to end fitting 16 and/or 20. An accelerometer or other sensor (e.g., 3-axis (magnetometer), 6 axis (magnetometer plus accelerometer) or 9 (magnetometer plus accelerometer plus gyroscope), degree of freedom ("DOF") device may be used to detect the relative rotational position of gun tube 10' in a wellbore. The sensor can thus assist an operator in determining the position of the shape charges 122 in the wellbore. The operator can then control the one or more motors to rotate gun tube 10' and position the shape charges 122 where the operator wants them before firing them. A signal could be sent wirelessly, or by a wired connection, from the sensor to the operator who can use a controller (such as a computer or cell phone) to directly or indirectly operate the one or more motors to orient the gun tube 10'.

Perforating Gun Assembly

FIGS. 23-26 show a perforating gun assembly 1000. Gun assembly 1000 includes previously-described gun tube 10, a previously-described sub-assembly 200, each of which include a plunger 300. Alternatively, one or both sub-assemblies could include a previously-described DWG 400 at respective ends 204 of each sub-assembly 200. In that case, end contacts 22 need not be used. Wires could extend from first conductive stem 410 through cavity 114 of tube body 12 and be connected to wires 452 at second conductive stem 412 of DWG 400 in the downstream sub-assembly 200.

In this embodiment, gun tube 10 is pressed into outer casing 700. Outer casing 700 has a first end 702 with internal threads 702A, a second end 704 with internal threads 704A, an outer surface 706 and an internal cavity 708B with an inner surface 708A. When gun tube 10 is pressed into internal cavity 708B, grounding hardware items 70, which may be ball plungers, are compressed to their second compressed position, and they bias back to the first, extended position when they align with grooves (not shown) on inner surface 708A that have a slightly larger diameter than the rest of internal cavity 708B. In that manner, gun tube 10 is affixed in position in outer casing 700.

Figure 26:
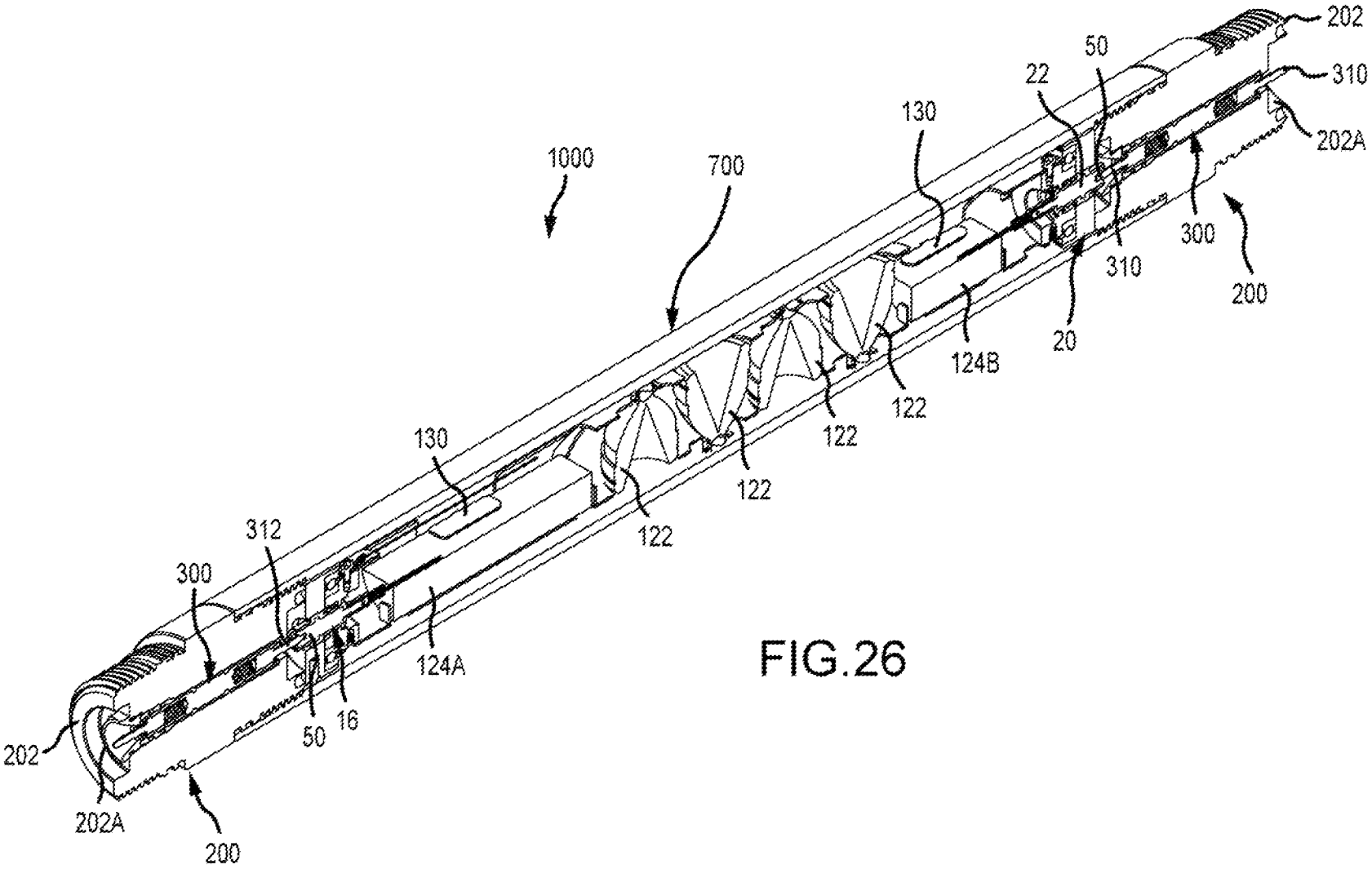
FIG. 26 is a cross-sectional, side, perspective view of the gun assembly of FIG. 25.

After gun tube 10 is positioned, sub-assemblies 200 are screwed onto each end 702, 704 of outer casing 700. As best seen in FIG. 26, when assembled, second conductive stem structure 312 of plunger 300 in forward sub-assembly 200 is in contact with electrical contact 50 of first end fitting 16. First conductive stem structure 310 of plunger 300 in rear sub-assembly 200 contacts electrical contact 50 of second end fitting 20.

Some non-limiting examples of embodiments of this disclosure follow:

Example Set 1

Example 1: A plunger configured to fit in a central bore of a sub-assembly for a wellbore perforating gun assembly, the plunger comprising: an outer casing comprised of insulating material and having a first end; a first end portion comprised of electrically conductive material and including a first conductive stem, the first conductive stem having a first, extended position, and a second, contracted position.

Example 2: The plunger of example 1, wherein the outer casing further comprises a second end; and the plunger further comprises a second end portion comprised of electrically conductive material and including a second conductive stem, the second conductive stem having a first, extended position and a second, contracted position.

Example 3: The plunger of example 1 or 2, wherein the distance between the first, extended position of the first conductive stem and the second, contracted position of the first conductive stem is from 0.150" to 1.250".

Example 4: The plunger of example 2, wherein the difference between the first, extended position of the second conductive stem and the second, contracted position of the second conductive stem is from 0.150" to 1.250".

Example 5: The plunger of example 1 or 4, wherein the distance between the first, extended position of the first conductive stem and the second, contracted position of the first conductive stem is from 0.150" to 1.250".

Example 6: The plunger of any of examples 1-5, wherein the first end portion further includes a first cylinder connected to the first conductive stem and positioned inside of the outer housing, wherein the first cylinder has a diameter that is greater than a diameter of the first conductive stem.

Example 7: The plunger of any of examples 2 or 4-6, wherein the second end portion further includes a second cylinder connected to the second conductive stem and positioned inside of the outer housing, wherein the second cylinder has a diameter that is greater than a diameter of the second conductive stem.

Example 8: The plunger of any of examples 1-7, wherein the first conductive stem has a first distal tip that is positioned past the first end of the outer casing when the first conducive stem is in its first, extended position.

Example 9: The plunger of any of examples 2 or 4-6, wherein the second conductive stem has a second distal tip that is positioned past the second end of the outer casing when the second conductive stem is in its first, extended position.

Example 10: The plunger of any of examples 1-9 that further comprises a first spring that biases the first conductive stem to its first, extended position, wherein the spring is compressed when the first conductive stem is in its second, contracted position.

Example 11: The plunger of any of examples 2, 4-6, or 9 that further comprises a second spring that biases the second conductive stem to its second, extended position, wherein the spring is compressed when the second conductive stem is in its second, contracted position.

Example 12: The plunger of example 11 that further comprises a first spring that biases the first conductive stem to its first, extended position, wherein the spring is compressed when the first conductive stem is in its second, contracted position.

Example 13: The plunger of example 12, wherein the first spring and the second spring each has a compressive force from 5 lbs. to 15 lbs.

Example 14: The plunger of example 12, wherein the first spring and the second spring each has a compressive force from 2 lbs. to 20 lbs.

Example 15: The plunger of example 12, wherein the first spring and the second spring each has a compressive force from 5 lbs. to 30 lbs.

Example 16: The plunger of any of examples 1-15 that has an outer casing length of between 2" and 12".

Example 17: The plunger of any of examples 1-16 that has an outer casing length of between 2" and 5".

Example 18: The plunger of any of examples 1-17, wherein the insulating material is plastic.

Example 19: The plunger of any of examples 1-18, wherein the outer casing has an outer surface and at least one annular groove on the outer surface, and an o-ring in the at least one annular groove.

Example 20: The plunger of any of examples 1-19 that has two annular grooves on the outer surface, and an o-ring in each of the two annular grooves.

Example 21: The plunger of example 6, wherein the first cylinder is integrally formed with the first conductive stem.

Example 22: The plunger of example 10 that further comprises a conductive inner core and the first end portion further includes a first cylinder, the first cylinder being positioned inside of the outer housing, and the first spring being positioned between the conductive inner core and the first cylinder.

Example 23: The plunger of example 11 that further comprises a conductive inner core, and the second end portion further includes a second cylinder, the second cylinder being positioned inside of the outer housing, and the second spring being between the conductive inner core and the second cylinder.

Example 24: The plunger of example 7, wherein the second cylinder is integrally formed with the second conductive stem.

Example 25: The plunger of any of examples 1-24, wherein the first end is configured to be rotated by a tool.

Example 26: The plunger of example 25, wherein the first end has a shape selected from the group consisting of one of the following: hexagonal, Torx, quadrangle, Allen head, Star drive, and other driving configuration.

Example 27: A sub-assembly having a first end with a first opening, a second end with a second opening, and a central bore between the first opening and the second opening, and the plunger of example 2 positioned in the central bore and configured so the first, conductive stem is positioned at least partially in the first opening.

Example 28: The sub-assembly of example 27, wherein the first opening has a surface, and the central bore has a surface, and that further includes a dart retainer that surrounds at least part of the first conductive stem and contacts the surface of the central bore.

Example 29: The sub-assembly of example 28, wherein the dart retainer has a first section with a first diameter, a second section with a second diameter, and an opening therethrough, and the first conductive stem is positioned in the opening, and the first section contacts the surface of the central bore, and the second section contacts the surface of the first opening.

Example 30: The sub-assembly of example 29, wherein the dart retainer is comprised of silicone rubber.

Example 31: The sub-assembly of any of examples 27-30 that further comprises a second conductive stem having a second distal tip that is positioned outside of the central bore and positioned in the second opening.

Example 32: The sub-assembly of any of examples 27-31, wherein the first conductive stem has a first distal tip that is positioned outside of the central bore and positioned outside of the first opening.

Example 33: The sub-assembly of any of examples 27-32 that further comprises a second conductive stem having a distal tip that is positioned outside of the central bore and positioned outside of the second opening.

Example 34: The sub-assembly of example 28, wherein the second conductive stem is positioned at least partially in the second opening, and that further includes a dart retainer that surrounds at least part of the first second conductive steam and contacts the surface of the central bore.

Example 35: The sub-assembly of example 34, wherein the dart retainer has a first section with a first diameter, a second section with a second diameter, and an opening therethrough, and the second conductive stem is positioned in the opening, and the first section contacts the surface of the central bore, and the second section contacts the surface of the second opening.

Example Set 2

Example 1: A gun tube comprising: a body having a first end, a second end, a cavity, and a longitudinal axis; one or more weights in the cavity, the one or more weights configured to rotate the body around the longitudinal axis based on gravity acting on the one or more weights; and a first end fitting attached to the first end of the body, the first end fitting rotationally connected to the body.

Example 2: The gun tube of example 1, wherein the first end fitting includes a first bearing housing.

Example 3: The gun tube of example 1 or 2 that further includes a second end fitting attached to the second end of the body, the second end fitting rotationally connected to the body.

Example 4: The gun tube of example 3, wherein the second end fitting includes a second bearing housing.

Example 5: The gun tube of any of examples 1-4, wherein the first end fitting further comprises a first end contact having a first, extended position and a second, contracted position.

Example 6: The gun tube of any of examples 3-4, wherein the second end fitting comprises a second end contact having a first, extended position and a second, contracted position.

Example 7: The gun tube of any of examples 1-6, wherein the one or more weights comprises two separate weights, a first weight and a second weight.

Example 8: The gun tube of example 7, wherein the first weight is juxtaposed the first end of the tube body and the second weight is juxtaposed the second end of the tube body.

Example 9: The gun tube of any of examples 1-8, wherein each of the one or more weights has a semi-cylindrical shape.

Example 10: The gun tube of example 7, wherein the first weight weighs ⅞ lbs. at sea level and the second weight weighs 1¾ lbs. at sea level.

Example 11: The gun tube of example 7, wherein the second weight is at least twice as heavy as the first weight.

Example 12: The gun tube of any of examples 1-11, wherein the one or more weights collectively weigh from 2 lbs. to 8 lbs. at sea level.

Example 13: The gun tube of any of examples 1-12, wherein the one or more weights are comprised of steel.

Example 14: The gun tube of any of examples 1-13, wherein the one or more weights is collectively one of the following percentages of the weight of the gun tube without the weight: at least 15%, at least 20%, at least 30%, at least 40%, and at least 50%.

Example 15: The gun tube of example 7, wherein the first weight is 2"-3" in length and the second weight is 3"-8" in length.

Example 16: The gun tube of any of examples 1-15, wherein the at least first end fitting comprises: an outer collar; a bearing housing that includes ball bearings and a central opening; and a support having a first portion with a first diameter and a second portion with a second diameter that is greater than the first diameter, wherein the bearing housing is positioned on the first portion and the central opening surrounds at least part of the first portion, and the outer collar is fastened to the support.

Example 17: The gun tube of any of examples 1-16 that further comprises one or more charge openings configured to receive an explosive charge.

Example 18: The gun tube of example 17 that further comprises one or more explosive charges in the one or more charge openings.

Example 19: The gun tube of example 17 that further comprises one or more clip openings configured to receive charge clips.

Example 20: The gun tube of example 19 that comprises one or more clips in the one or more clip openings.

Example 21: The gun tube of example 16, wherein the first end fitting further includes a first end contact having a first, extended position and a second, contracted position, and that also comprises a second end fitting having a second end contact including a first, extended position and a second, extended position.

Example 22: The gun tube of example 16, wherein the outer collar has one or more openings, wherein at least one of the one or more openings contains grounding hardware biased to a first, extended position, and that also has a second, contracted position.

Example 23: The gun tube of any of examples 1-22, wherein the first end fitting comprises an end contact having a first end that comprises a stem, the stem being positioned inside of the cavity, and the end contact having a second end, the second end comprising an electrical contact that is positioned outside of the body.

Example 24: The gun tube of example 23, wherein the end contact is configured to transmit electricity therethrough.

Example 25: The gun tube of any of examples 1-24, wherein the first end fitting comprises a first end contact that includes a housing and one or more frangible elements extending outwardly from the housing.

Example 26: The gun tube of example 25 that further comprises a second end fitting that includes a second end contact having a housing and one or more frangible elements extending outwardly from the housing.

Example 27: The gun tube of example 25 or 26, wherein the housing and frangible elements are comprised of plastic and the frangible elements are configured to break away from the housing upon the application of explosive, outward axial force caused by explosion of one or more explosive charges in the gun tube.

Example 28: The gun tube of example 5, wherein the first end contact is biased towards the first, extended position.

Example 29: The gun tube of example 6, wherein the second end contact is biased towards the first, extended position.

Example 30: The gun tube of example 28 that further includes a spring on a housing of the first end contact, the spring configured to bias the first end contact to the first, extended position, and the spring configured to compress when the first end contact moves to its second, contracted position.

Example 31: The gun tube of example 29 that further includes a spring on a housing of the second end contact, the spring configured to bias the first end contact to the first, extended position, and the spring configured to compress when the first end contact moves to its second, contracted position.

Example 32: The gun tube of example 5, wherein the end fitting includes an opening in which the first end contact is positioned.

Example 33: The gun tube of any of examples 25-27, wherein the first end fitting further includes a support that has an opening configured to receive the one or more frangible elements, and wherein the first end contact has a first rotated position in which the one or more frangible elements fit through the opening and a second rotated position in which the one or more frangible elements do not fit through the opening.

Example 34: The gun tube of example 27, wherein the one or more frangible elements are configured to break away from the housing when about 30 lbs. or more of explosive, outward longitudinal axial force is applied to them.

Example 35: The gun tube of example 5, wherein the first end contact comprises a stem that includes a through hole, the through hole configured to receive one or more wires.

Example 36: The gun tube of example 6, wherein the second end contact comprises a stem that includes a through hole, the through hole configured to receive one or more wires.

Example 37: The gun tube of any of examples 1-36, wherein the body further comprises a plurality of tabs for retaining the one or more weights.

Example 38: The gun tube of any of examples 1-37 that further includes tabs at different positions on the body to maintain the one or more weights at different, respective positions within the cavity.

Example 39: The gun tube of any of examples 1-38, wherein the body further comprises tabs that have a first, open position, and a second, closed position in which the tabs retain the one or more weights in the cavity.

Example 40: The gun tube of any of examples 1-39 that further includes an outer casing positioned over and around the body, the outer casing having a first end and a second end.

Example 41: The gun tube of example 39 that further comprises a sub-assembly connected to one end of the outer casing.

Example 42: The gun tube of example 39 that further comprises a first sub-assembly connected to the first end of the outer casing and a second sub-assembly connected to the second end of the outer casing.

Example 43: The gun tube of example 41, wherein the sub-assembly is threadingly connected to the outer casing.

Example 44: The gun tube of example 42, wherein the first sub-assembly is threadingly connected to the first end of the outer casing and the second sub-assembly is threadingly connected to the second end of the outer casing.

Example 45: The gun tube of example 41 that further comprises a plunger in the sub-assembly.

Example 46: The gun tube of example 45, wherein the plunger has a longitudinal axis and an electrical connection running through it.

Example 47: The gun tube of example 45 that further includes an electrically insulating outer casing around at least part of the plunger and the outer casing has a first end and a second end.

Example 48: The gun tube of example 47, wherein the electrically insulating casing is comprised of plastic.

Example 49: The gun tube of example 43, wherein the plunger has a body, a cavity, a first end, and a second end, a first conductive stem, and a second conductive stem, wherein the first contact stem extends past the first end of the outer casing, and the second contact stem extends past the second end of the outer casing.

Example 50: The gun tube of example 49, wherein the first conductive stem has a first, extended position and a second, contracted position.

Example 51: The gun tube of example 50, wherein the second conductive stem has a first, extended position and a second, contracted position.

Example 52: The gun tube of example 50, wherein the distance between the first, extended position and the second, contracted position of the first conductive stem is between 0.150" and 1.250".

Example 53: The gun tube of example 51, wherein the distance between the first, extended position and the second, contracted position of the second conductive stem is between 0.150" and 1.250".

Example 54: The gun tube of example 50, wherein the first conductive stem is part of a first conductive stem structure that includes a first cylinder that is positioned in a cavity of the outer casing.

Example 55: The gun tube of example 51, wherein the second conductive stem is part of a first conductive stem structure that includes a second cylinder that is positioned in a cavity of the outer casing.

Example 56: The gun tube of example 54, wherein the cavity includes a conductive core and a spring is positioned between the first conductive stem structure base and the conductive core.

Example 57: The gun tube of example 56, wherein the cavity includes a conductive core and a spring is positioned between the second conductive stem structure base and the conductive core.

Example 58: The gun tube of example 45, wherein the plunger has an outer casing and a compressible metal clip positioned on the outside surface, the metal clip configured to provide an electrical ground for the plunger.

Example 59: The gun tube of example 45, wherein there is a through hole in the first conductive stem.

Example 60: The gun tube of example 45, wherein there is a through hole in the second conductive stem.

Example 61: The gun assembly of example 45 or 51 that further includes an insulating barrel connector mounted to the second stem.

Example 62: The gun tube of example 45, wherein the plunger further comprises an outer casing and a driver head on a first end or a second end of the outer casing.

Example 63: The gun tube of example 16, wherein the collar includes one or more apertures and each aperture includes a grounding mechanism to ground the gun tube when positioned inside of an outer casing.

Example 64: The gun tube of example 63, wherein each of the grounding mechanisms is a ball and plunger unit.

Example 65: The gun tube of example 63, wherein each grounding mechanism has a first, outwardly-biased position and a second, contracted position.

Example 66: The gun tube of example 65, wherein the distance between the first, outwardly-biased position and the second, contracted position from 0.010" to 0.080".

Example 67: The gun tube of example 1 that includes at least one rotatable end plate that is rotatable to a plurality of indexed positions, wherein the end plate is attached to one of the one or more weights.

Example 68: The gun tube of example 67 that includes one end plate at the first end of the gun tube.

Example 69: The gun tube of example 68 that includes a second rotatable end plate that is rotatable to a plurality of indexed positions, wherein the second end plate is attached to the one or more weights.

Example 70: The gun tube of example 69, wherein the first rotatable plate includes a plurality of indexed positions, and the second rotatable plate includes the same plurality of indexed positions.

Example Set 3

Example 1: A double-wire feed through with ground (DWG) comprising: an outer casing comprised of insulating material, the outer casing having a first end and a second end; a first conductive stem extending outward from the first end of the outer casing, the first conductive stem having a first, extended position and a second, contracted position.

Example 2: The DWG of example 1 that further comprises one or more grounding legs attached to and extending outward from the outer casing.

Example 3: The DWG of example 2 that includes two grounding legs, a first grounding leg and a second grounding leg.

Example 4: The DWG of example 3, wherein the first grounding leg is on one side of the outer casing and the second grounding leg is on the opposite side of the outer casing.

Example 5: The DWG of example 1 or 2, wherein the outer casing further comprises one or more recesses, and each of the one or more recesses is configured to receive a grounding leg when the grounding leg is compressed.

Example 6: The DWG of any of examples 1-5 that further includes a second conductive stem opposite the first conductive stem and an insulating sheath that connects one or more wires to the second conductive stem.

Example 7: The DWG of any of examples 1-6 that further includes a conductive core and a spring between the conductive core and the first conductive stem, wherein the spring is configured to bias the first conductive stem to its first, extended position.

Example 8: The DWG of example 7 that further includes a second conductive stem opposite the first conductive stem and an insulating sheath that connects one or more wires to the second conductive stem.

Example 9: The DWG of any of examples 1-8, wherein the distance between the first, extended position and the second, contracted position is from 0.150" to 1.250".

Example 10: The DWG of example 7, wherein the spring has a compressive force from 5 lbs. to 15 lbs.

Example 11: The DWG of example 7, wherein the spring has a compressive force from 2 lbs. to 20 lbs.

Example 12: The DWG of example 7, wherein the spring has a compressive force from 5 lbs. to 30 lbs.

Example 13: A double-wire feed through with ground (DWG) comprising: an outer casing comprised of insulating material, the outer casing having a first end and a second end; a first conductive stem extending outward from the first end of the body, and a second conductive stem opposite the first conductive stem; and one or more grounding legs attached to and extending outward from the outer casing.

Example 14: The DWG of example 13 that includes two grounding legs.

Example 15: The DWG of example 13 that further includes an insulating sheath that connects one or more wires to the second conductive stem.

Example 16: The DWG of example 1, wherein the insulating material comprises plastic.

Example 17: The DWG of example 13, wherein the insulating material comprises plastic.

Example 18: The DWG of example 2, wherein each of the one or more grounding legs extends outward from the outer casing by 0.050" to 0.250".

Example 18: The DWG of example 13, wherein each of the one or more grounding legs extends outward from the outer casing by 0.050" to 0.250".

Example 20: A sub-assembly having a first end with a first opening, a second end with a second opening, and a central bore between the first opening and the second opening, and the DWG of example 1 positioned in the central bore and configured so the first, conductive stem is positioned at least partially in the first opening.

Example 21: The sub-assembly of example 20, wherein the first opening has a surface, and the central bore has a surface, and that further includes a dart retainer that surrounds at least part of the first conductive stem and that contacts the surface of the central bore.

Example 22: The sub-assembly of example 21, wherein the dart retainer has a first section with a first diameter, a second section with a second diameter, and a retainer opening therethrough, and the first stem is positioned in the retainer opening, and the first section contacts the surface of the central bore, and the second section contacts the surface of the first opening.

Example 23: The sub-assembly of example 21 or 22, wherein the dart retainer is comprised of silicone rubber.

Example 24: A sub-assembly having a first end with a first opening, a second end with a second opening, and a central bore between the first opening and the second opening, and the DWG of example 13 positioned in the central bore and configured so the first, conductive stem is positioned at least partially in the first opening.

Example 25: The sub-assembly of example 24, wherein the first opening has a surface, and the central bore has a surface, and that further includes a dart retainer that surrounds at least part of the first conductive stem and contacts the surface of the central bore.

Example 26: The sub-assembly of example 25 or 26, wherein the dart retainer has a first section with a first diameter, a second section with a second diameter, and a retainer opening therethrough, and the first stem is positioned in the retainer opening, and the first section contacts the surface of the central bore, and the second section contacts the surface of the first opening.

Example 27: The sub-assembly of example 25, wherein the dart retainer is comprised of silicone rubber.

Example Set 4

Example 1: An end fitting comprising: a first end and a second end; a bearing housing that includes ball bearings, the bearing housing having a bearing opening; a support having a first portion with a first diameter and a second portion with a second diameter that is greater than the first diameter, wherein the bearing housing is positioned on the first portion with the bearing opening surrounding at least part of the first portion; and an end contact comprising a housing, a first end having a conductive stem, and a second end that comprises an electrical contact, the second end having a first, extended position and a second, contracted position.

Example 2: The end fitting of example 1, wherein the end contact is biased to the first, extended position.

Example 3: The end fitting of example 1 or 2, wherein electricity can be conducted through the end contact.

Example 4: The end fitting of any of examples 1-3, wherein the end contact further comprises a housing and one or more frangible elements extending outwardly from the housing.

Example 5: The end fitting of example 4, wherein the housing and the one or more frangible elements are comprised of plastic.

Example 6: The end fitting of example 4 or 5, wherein the one or more frangible elements are a plurality of tabs.

Example 7: The end fitting of example 6, wherein the one or more frangible elements are two tabs.

Example 8: The end fitting of example 6, wherein each of the plurality of tabs extend outward from the body by 0.070" to 0.125".

Example 9: The end fitting of example 6, wherein each of the plurality of tabs is from 0.010" to 0.080" thick.

Example 10: The end fitting of example 8, wherein each of the plurality of tabs is from 0.010" to 0.080" thick.

Example 11: The end fitting of example 2 that further includes a spring on the end contact.

Example 12: The end fitting of example 11, wherein the spring is on a first portion of the end contact.

Example 13: The end fitting of example 12, wherein the support further includes one or more frangible elements and the spring is retained between a central portion of the end contact and the one or more frangible elements.

Example 14: The end fitting of example 6, wherein the support has an opening that receives an end of the end contact housing that includes the plurality of tabs, and wherein the end contact has a first position in which the tabs fit through the opening and a second position in which they do not fit through the opening.

Example 15: The end fitting of example 4, wherein the one or more frangible elements break when 30 lbs. or more of explosive, outward, longitudinal, axial force is applied to them.

Example 16: The end fitting of example 4, wherein the one or more frangible elements break when 50 lbs. or more of explosive, outward, axial force is applied to them.

Example 17: The end fitting of any of examples 1-16, wherein the conductive stem includes a through hole, wherein the through hole is configured to receive one or more wires.

Example 18: The end fitting of any of examples 1-17 that further includes a wire harness assembly attached to the conductive stem, the wire harness assembly comprising an insulated wire and an insulated circular connector.

Example 19: The end fitting of example 18, wherein the insulated circular connector is a barrel crimp connector.

Example 20: An end fitting for a gun tube that comprises an end contact with a first end that includes an electrical contact having a first extended position and a second, contracted position.

Example 21: The end fitting of example 20, wherein the end contact further includes one or more frangible elements configured to break when 30 lbs. or more of explosive, outward longitudinal, axial, force is applied.

Example 22: The end fitting of example 21, wherein the one or more frangible elements are a plurality of tabs.

Example 23: The end fitting of example 22, wherein the one or more frangible elements are two tabs.

Example 24: The end fitting of any of examples 1-23 that further comprises an outer collar having an opening therethrough.

Example 25: The end fitting of example 24, wherein the electrical contact is positioned from 1/16" to 5/16" outside of the opening when the second end of the end contact is in its first, extended position.

Example 26: The end fitting of example 4, wherein the housing and one or more frangible elements are integrally formed.

Example Set 5

Example 1: A gun tube comprising: a body having a cavity, a longitudinal axis, a first end, and a second end; a motor connected to the first end, the motor configured to rotate the body around the longitudinal axis.

Example 2: The gun tube of example 1 that further comprises a first end fitting attached to the first end of the body.

Example 3: The gun tube of example 2 that further comprises a second end fitting attached to the second end of the body.

Example 4: The gun tube of example 1 that further comprises a sensor configured to detect the location of the explosive charges.

Example 5: The gun tube of example 3, wherein the sensor comprises an accelerometer.

Example 6: The gun tube of example 3, wherein the sensor comprises one or more of an accelerometer, a magnetometer, and gyroscope.

Example 7: A system comprising the gun tube of example 6 and a motor control remote to the gun tube, the motor control configured to operate the motor.

Example 8: The system of example 7, wherein the motor control is one of a computer and a cell phone.

Example 9: The system of example 7 that further includes a receiver for receiving transmissions sent by the sensor.

Example 10: The system of a claim 7, wherein the motor control is configured to be operated by a human operator.

Example 11: The system of a claim 7, wherein the motor control is configured to be operated by a machine operator.

Example 12: The gun tube of example 1, wherein the at least first end fitting comprises: an outer collar; a bearing housing that includes ball bearings and a central opening; and a support having a first portion with a first diameter and a second portion with a second diameter that is greater than the first diameter, wherein the bearing housing is positioned on the first portion and the central opening surrounds at least part of the first portion, and the outer collar is fastened to the support.

Example 13: The gun tube of any of examples 1-12 that further comprises one or more charge openings configured to receive an explosive charge.

Example 14: The gun tube of example 13 that further comprises one or more explosive charges in the one or more charge openings.

Example 15: The gun tube of any of examples 1-14 that further comprises one or more clip openings configured to receive charge clips.

Example 16: The gun tube of example 15 that comprises one or more clips in the one or more clip openings.

Example 17: The gun tube of example 2, wherein the first end fitting includes a first end contact having a first, extended position and a second, contracted position, and that also comprises a second end fitting having a second end contact including a first, extended position and a second, extended position.

Example 18: The gun tube of example 12, wherein the outer collar has one or more openings, wherein at least one of the one or more openings contains grounding hardware biased to a first, extended position, and that also has a second, contracted position.

Example 19: The gun tube of example 2 or 17, wherein the first end fitting comprises an end contact having a first end that comprises a stem, the stem being positioned inside of the cavity, and the end contact having a second end, the second end comprising an electrical contact that is positioned outside of the body.

Example 20: The gun tube of example 19, wherein the end contact is configured to transmit electricity therethrough.

Example 21: The gun tube of example 2, wherein the first end fitting comprises a first end contact that includes a housing and one or more frangible elements extending outwardly from the housing.

Example 22: The gun tube of example 21 that further comprises a second end fitting that includes a second end contact having a housing and one or more frangible elements extending outwardly from the housing.

Example 23: The gun tube of example 21, wherein the housing and frangible elements are comprised of plastic and the frangible elements are configured to break away from the housing upon the application of explosive, outward axial force caused by explosion of one or more explosive charges in the gun tube.

Example 24: The gun tube of example 17, wherein the first end contact is biased towards the first, extended position.

Example 25: The gun tube of example 24, wherein the second end contact is biased towards the first, extended position.

Example 26: The gun tube of example 24 that further includes a spring on a housing of the first end contact, the spring configured to bias the first end contact to the first, extended position, and the spring configured to compress when the first end contact moves to its second, contracted position.

Example 27: The gun tube of example 26 that further includes a spring on a housing of the second end contact, the spring configured to bias the first end contact to the first, extended position, and the spring configured to compress when the first end contact moves to its second, contracted position.

Example 28: The gun tube of example 17, wherein the distance between the first, extended position and the second, contracted position of the first end contact is between 0.150" and 1.250".

Example 29: The gun tube of example 28, wherein the distance between the first, extended position and the second, contracted position of the second end contact is between 0.150" and 1.250".

Figure 36:
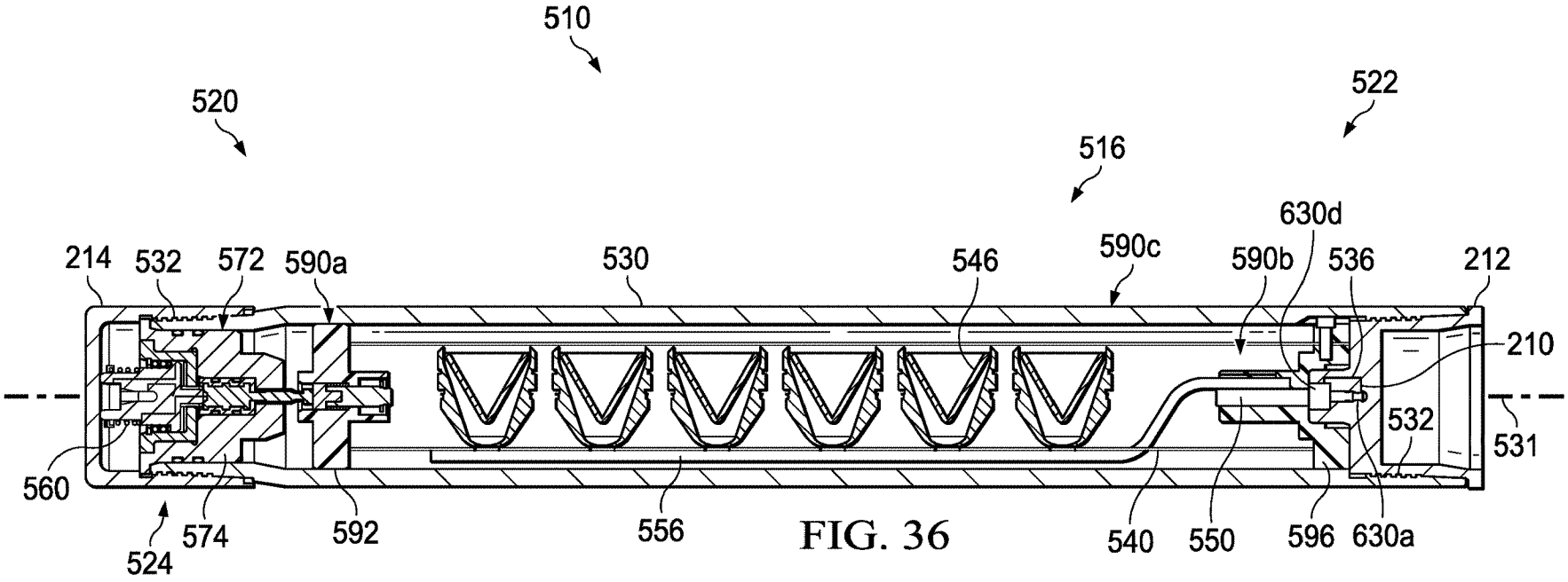
FIG. 36 is a cross-sectional side view of a perforating gun string, in accordance with embodiments of the present disclosure.
Figure 37:
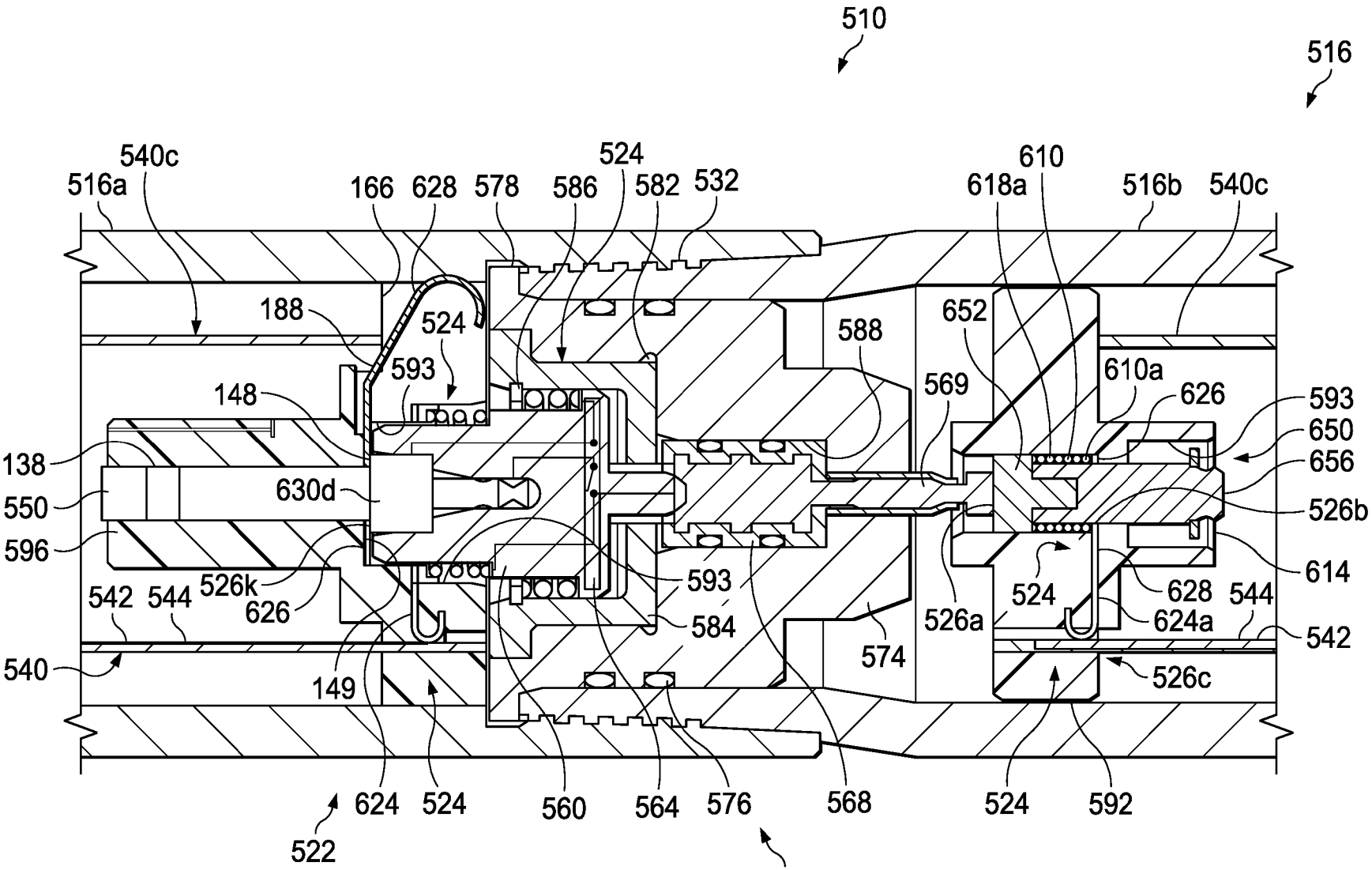
FIG. 37 is a cross-sectional side view of the connection of two perforating guns, in accordance with embodiments of the present disclosure.

Referring initially to FIGS. 36 & 37, an exemplary perforating gun string, or system, 510 may include one or more perforating guns 516. In this embodiment, a first gun 516*a* is shown uphole of an interconnected second gun 516*b*. When more than one gun 516 is included, the guns 516 are typically included in a string, or line, of components for deployment to the desired position in the underground borehole. Traditionally, an intermediate (a.k.a. tandem or reusable) sub (not shown) is used to connect adjacent guns 516.

Each exemplary gun 516 has an upper, or uphole, end 520 and a lower, or downhole, end 522. In the illustrated system 510, each gun 516 includes, among other things, (i) an outer body, outer casing, or carrier, 530 having a central axis 531 extending axially therethrough, (ii) an inner body, gun tube, or charge holder, 540 configured to carry one or more explosives (e.g. shaped-charges) 546 and (iii) one or more detonators 550 for igniting the explosives 546 as desired, such as through one or more detonation cords 556. The detonator 550 of each gun 516 is actuated by a dedicated controller (a.k.a. the switch or switch assembly) 560, which may include one or more printed circuit boards (PCB) 564 configured to provide electrical signals to the detonator 550 to set off the explosives 546.

Electric current sufficient to ultimately ignite the explosives 546 is normally provided downhole to the gun system 510 from the surface, such as via a wireline, and then through each gun 516 to its associated switch(es) 560 and detonator(s) 550 and to the next successive downhole gun 516 (or other tool or component), if any, via multiple conductive electrical components 524 in the gun system 510 at various conductive interfaces 526 formed therebetween. For example, electric current is typically provided to each switch 560 via one or more inner body conductor 542 associated with the charge holder 540 that is immediately uphole of the switch 560 and which often comprises multiple insulated electrical wires (not shown) wrapped around the (typically metal, cylindrical) charge holder. Electric current is then typically provided to the next successive downhole gun 516 via a feedthrough 568.

However, the exemplary perforating gun system 510 may have more, less or other components than those described above and, when included, any of the above components may have any suitable form. Thus, the present disclosure is not limited to any of the above details.

Referring still to FIGS. 36 & 37, in accordance with various distinct independent aspects of the present disclosure, one or more of the electrical components 524 in each gun 516, the conductive interfaces 526 formed therebetween and the electric current flow paths formed thereby may be non-wired. In some embodiments (such as those described and shown herein), the entire gun 516 may be wire-free. This may, for example, eliminate the need for connecting or soldering wires and the jumbled birds-nest of wires typically needed in many conventional perforating guns and the potential reliability, poor connection and other problems associated therewith, reduce the time, effort and other concerns in manufacturing, assembling and using such conventional gun systems, for any other purposes or a combination thereof.

For example, one or more pairs of non-wired electrical components 524 may abut one another to form the desired conductive interfaces 526, have non-wired, (e.g. audio) plug-jack or ball-socket, type electrical connections or any other suitable arrangement of parts to create one or more non-wired interfaces 526. In some embodiments, a ball-socket type electro-mechanical can be preferred, for example, to allow one or both interconnected components to rotate relative the other and tolerate or accommodate some misalignment or tilt. Accordingly, any suitable configuration, combination and type of electrical components 524 can be used to achieve the desired wire-free arrangement. Moreover, the present disclosure is not limited to the particular components and methods described herein and shown in the appended figures for providing a wire-free gun 516 or a gun having one or more wire-free electrical components 524, conductive interfaces 526 and/or electric current flow paths.

Still referring to FIGS. 36 & 37, in accordance with various distinct independent aspects of the present disclosure, if desired, one or more components of the gun system 510 may be provided, or assembled, in distinct modules to provide a modular system 510. For example, the illustrated gun system 510 includes multiple easily and quickly interconnectable wire-free distinct modules, including, without limitation, the switch assembly 560, a bulkhead assembly 572, uphole and downhole end fitting assemblies 590*a*, 590*b* and a charge holder assembly 590*c*. The modular gun system 510 can allow quick and easy assembly and arming of each gun 516 and quick and easy disassembly and replacement of any of the modules (e.g. upon component failure). If desired, the gun 516 may be designed not to require any tools to assemble each gun 16 or interconnect multiple guns 516 together.

In the present embodiments, the detonator 550 and switch 560 are not provided in the same module of the gun system 510 and need not be interconnected until the gun 516 is ready for use at the work site. If desired, the gun 516 may be configured so that the exemplary switch 560 and other electrical components 524 may be tested without the presence of the detonator 550, allowing these components be inspected, tested and replaced independent of one another. Further, the detonator 550 and switch 560 may be sourced from different suppliers, providing greater equipment acquisition and management flexibility. In some embodiments, separating of the detonator 550 and switch 560 from the same module can allow the switch 560 to be designed with a shorter length and greater width than conventional guns 516, saving room in the length of the gun 516 and improving related efficiencies (reducing cost and storage, transportation, manpower and related needs, allowing more axial space in the gun for additional explosives 546 and/or other components and in the borehole for additional guns 516 and/or other components).

Referring to FIG. 37, in accordance with other independent aspects of the present disclosure, in some embodiments, adjacent guns 516 may be directly releasably interconnected together without the use of any intermediate subs therebetween. This may be done to reduce complexity in the manufacturing, supplier sourcing, shipping, handling and assembly of perforating gun systems, reduce on-site assembly and disassembly time, manpower needs, assembly equipment, points of failure and safety concerns, increase space in the component string, for any other reasons or a combination thereof. Thus, the present disclosure is not limited by the particular reason(s) for directly interconnecting adjacent guns 16 together.

Any suitable techniques and components may be used to directly interconnect adjacent guns 516 together without the use of intermediate subs therebetween. For example, the lower end 522 of the uphole gun 516*a* and the upper end of the next successive gun 16*b* may be formed with mateable respective tapered threads 532. The tapered threads may meet API, OCTG, NPT or BSPT pipe thread standards or take any other suitable form. The general use of tapered threads is discussed in publicly available documents, such as https://www.industrialspec.com/about-us/blog/detail/tapered-pipe-threads-standards-intro, the entire contents of which are hereby incorporated by reference herein in its entirety; however, the present disclosure is in no way limited by or to the contents of this reference.

Still referring to FIG. 37, in this embodiment, the carrier 530 at the lower end 522 of the uphole gun 516*a*, or "box end" of the gun, is formed with female tapered threads 532 around its ID, while the carrier 530 at the upper end of the downhole gun 516*b*, or "pin end" of the gun, is formed with male tapered threads 532 around its OD. The respective guns 516*a*, 516*b* are thus threadably engageable. Such arrangement is sometimes referred to herein as a "tapered pin-by-box connection" or variations thereof. Various electrical components 524 of the exemplary gun 516 may be configured (e.g. as described below and shown in the appended figures) to be electrically connected upon the threaded connection of adjacent guns 516*a*, 516*b* and without any further actions (e.g. without connecting any wires).

In some instances, the tapered pin-by-box connection may provide sufficient sealing (e.g. pressure and liquid seals) between the interconnected carriers 530 by the metal-to-metal contact therebetween, eliminating the need for any separate seal members (e.g. O-ring seals) across the threads 532. Thus, if desired, the tapered pin-by-box connection may be used without any separate seal members at or across the connection of the adjacent carriers 530.

A tapered pin-by-box connection may be provided for any suitable reason. For example, this arrangement may provide improved bending strength, tolerance and performance as compared to straight-thread connections. The tapered threads may be stronger in tension, bending and torsion than straight-thread connections because a tapered thread arrangement is thicker where the stress risers of those forces would be and tapers to thinner (e.g. it is thicker where thickness matters, and thinner where it does not matter). The concentric grooves in the connection may provide tensile strength that results in a connection stronger than the individual carriers 530 and with a dual metal-to-metal seal. For another example, the tapered pin-by-box connection may allow the adjacent guns 16 to be interconnected quicker (e.g. with less rotations) than with straight-thread connections. For yet another example, the absence of separate seal members across or at the tapered pin-by-box connection eliminates additional points of failure of such seals.

Still referring to FIG. 37, in accordance with other distinct independent aspects of the present disclosure, in some embodiments, various components of the gun system 510 may be carried by or provided in one or more bulkheads 574 configured to be inserted into one end 520 or 522 of each gun 516. The bulkheads 574 may be useful, for example, when intermediate subs are not employed between adjacent guns 516, optimize the use of space in each gun 516, for any other reason or a combination thereof.

When included, the bulkhead 574 may have any suitable form, configuration, components and operation. In the present embodiments, the bulkhead 574 is formed in a generally cylindrical, or barrel-like, shape (e.g. FIG. 56) and which can be pushed into, threaded or otherwise and secured in the upper end 520 of each illustrated gun 516. For example, the bulkhead 574 may be removably, friction-fit into and sealing engaged with the corresponding carrier 530 with the use of one or more seals 576 (e.g. O-rings) disposed between the bulkhead 574 and ID of the carrier 530. However, in other embodiments, the bulkhead 574 may not be cylindrical or barrel-shaped and may be secured to the carrier 530 or other component in any other suitable manner (e.g. threadable engagement).

Still referring to FIG. 37, the exemplary bulkhead 574 may include multiple interconnected cavities for at least partially housing various other components of the associated gun(s) 516. Any desired configuration of cavities may be included. For example, a switch cavity 582 formed in the uphole end of the bulkhead 574 may at least partially house the switch 560 that actuates the detonator 550 located in the immediately preceding uphole gun 516*a*. A feedthrough cavity 588 in communication with the switch cavity 582 may be formed in the downhole end of the exemplary bulkhead 574 to at least partially house the feedthrough 568. However, the switch 560 and/or feedthrough 568 may be housed in any other desired components. For example, the switch 560 may be housed at least partially in the downhole fitting 596.

Figure 1:
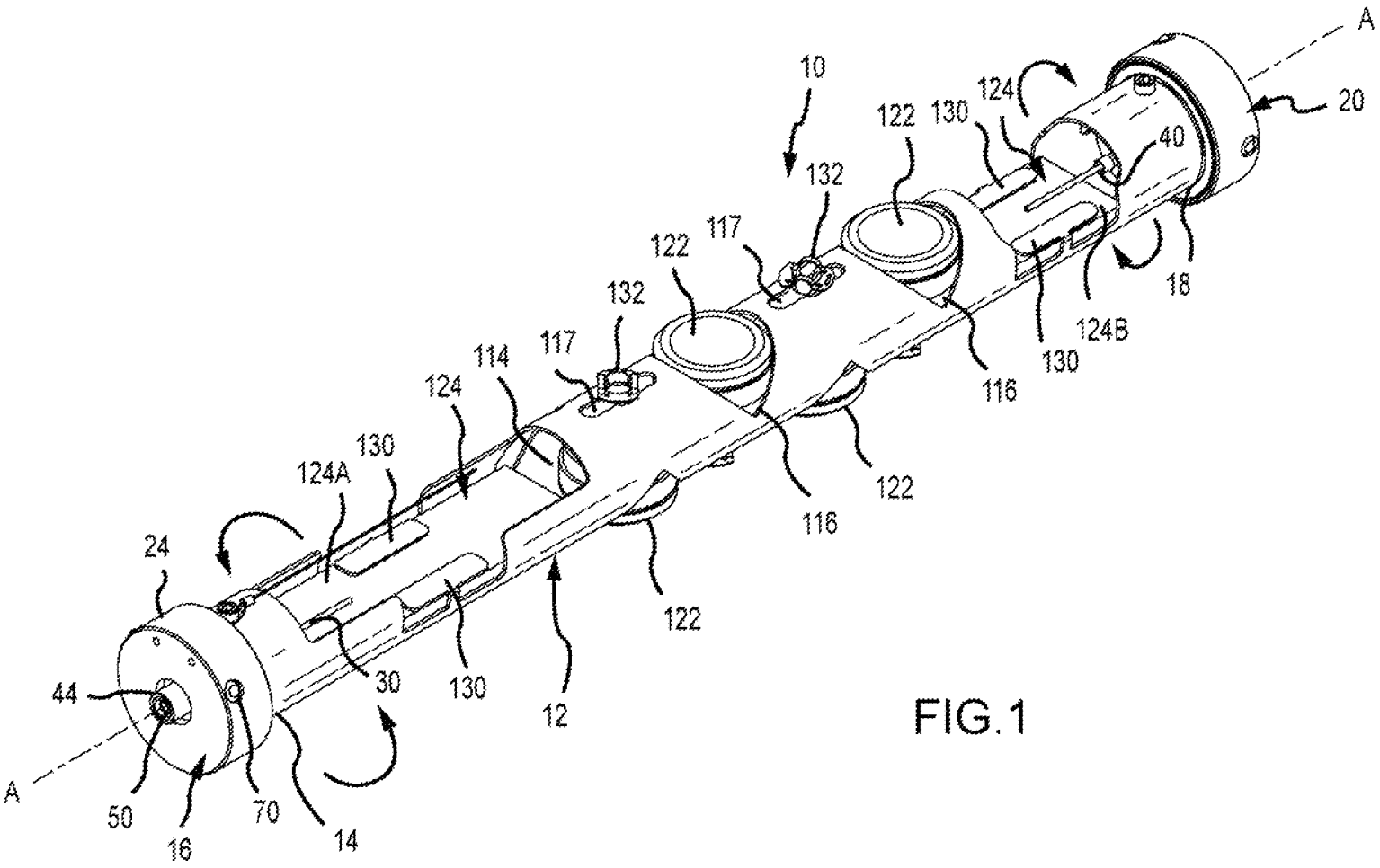
FIG. 1 is a perspective, side view of a gun tube in accordance with aspects of the invention.
Figure 2:
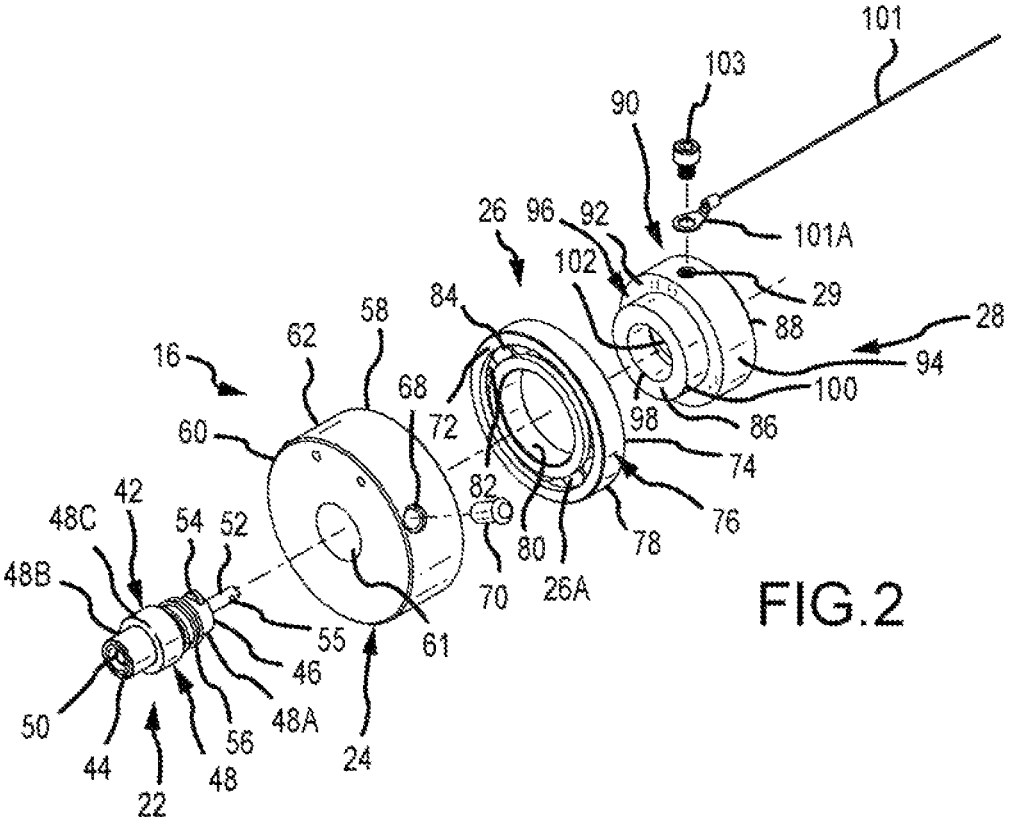
FIG. 2 is an exploded, perspective side view of a first end cap of the gun tube of FIG. 1.
Figure 3:
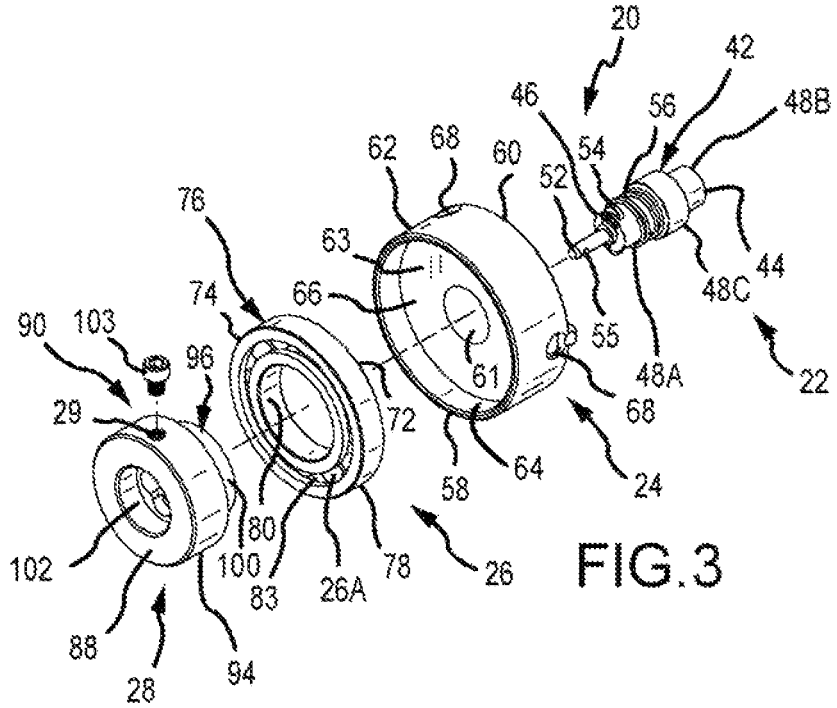
FIG. 3 is an exploded, perspective side view of a second end cap of the gun tube of FIG. 1.
Figure 4:
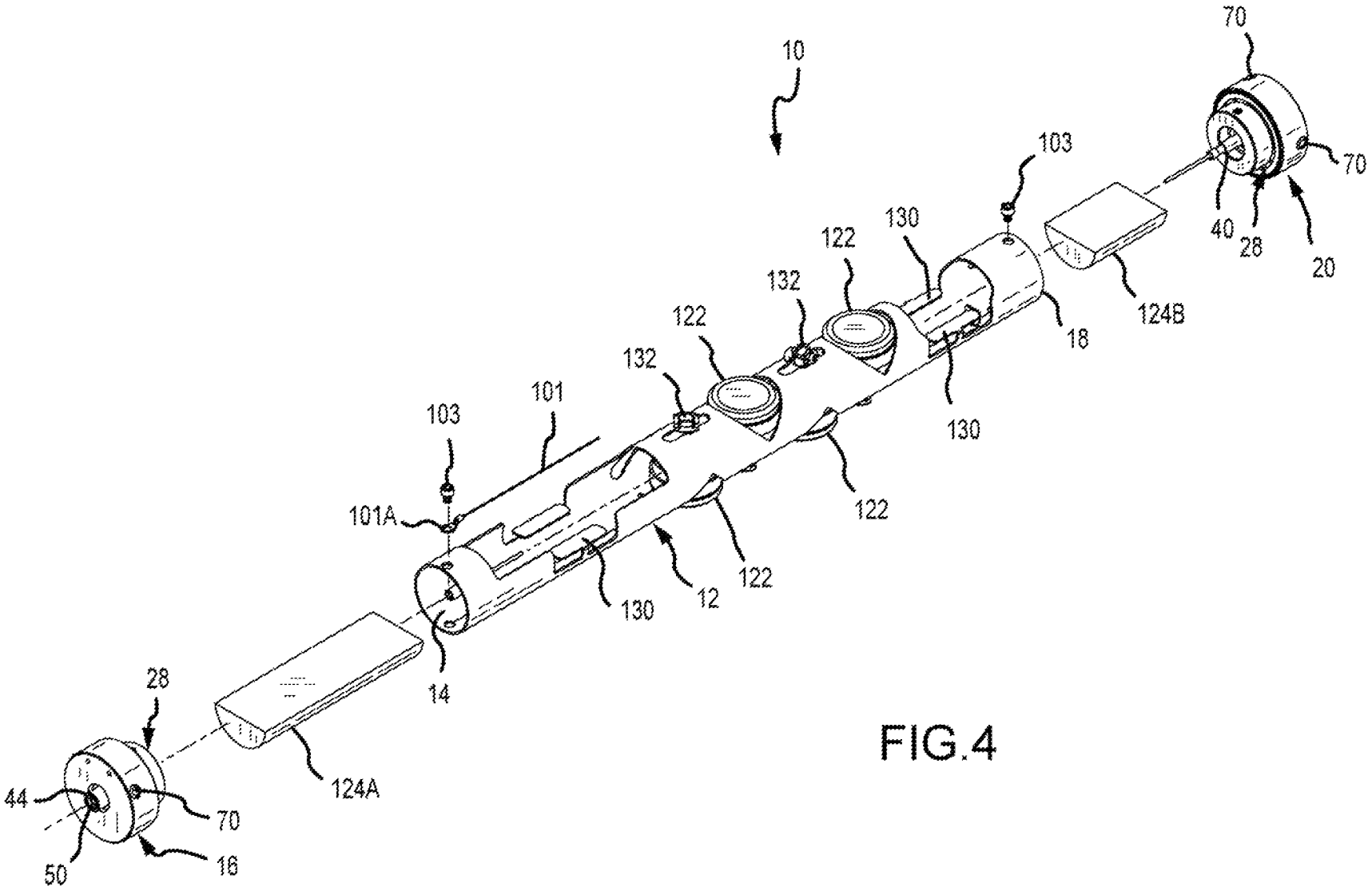
FIG. 4 is a partially exploded, perspective side view of the gun tube of FIG. 1.
Figure 7:
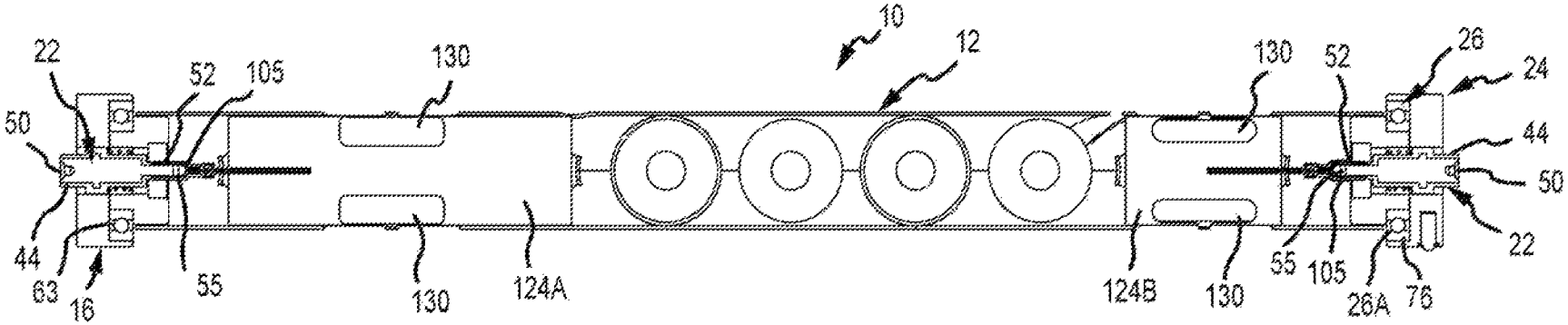
FIG. 7 is a cross-sectional top view of the gun tube of FIG. 4 taken along line B-B of FIG. 5A.
Figure 8:
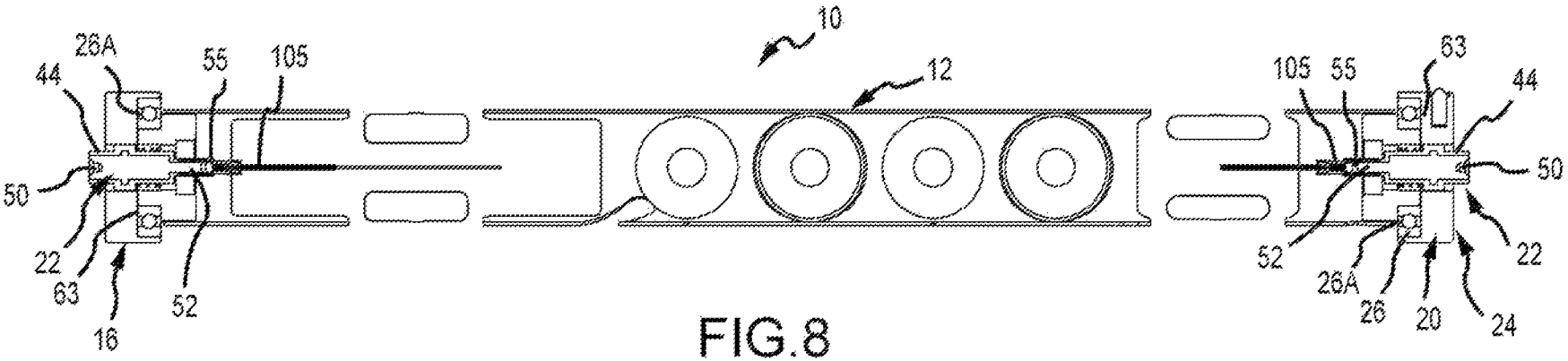
FIG. 8 is a cross-sectional top view of the gun tube of FIG. 4 taken along line C-C of FIG. 5B.
Figure 9:
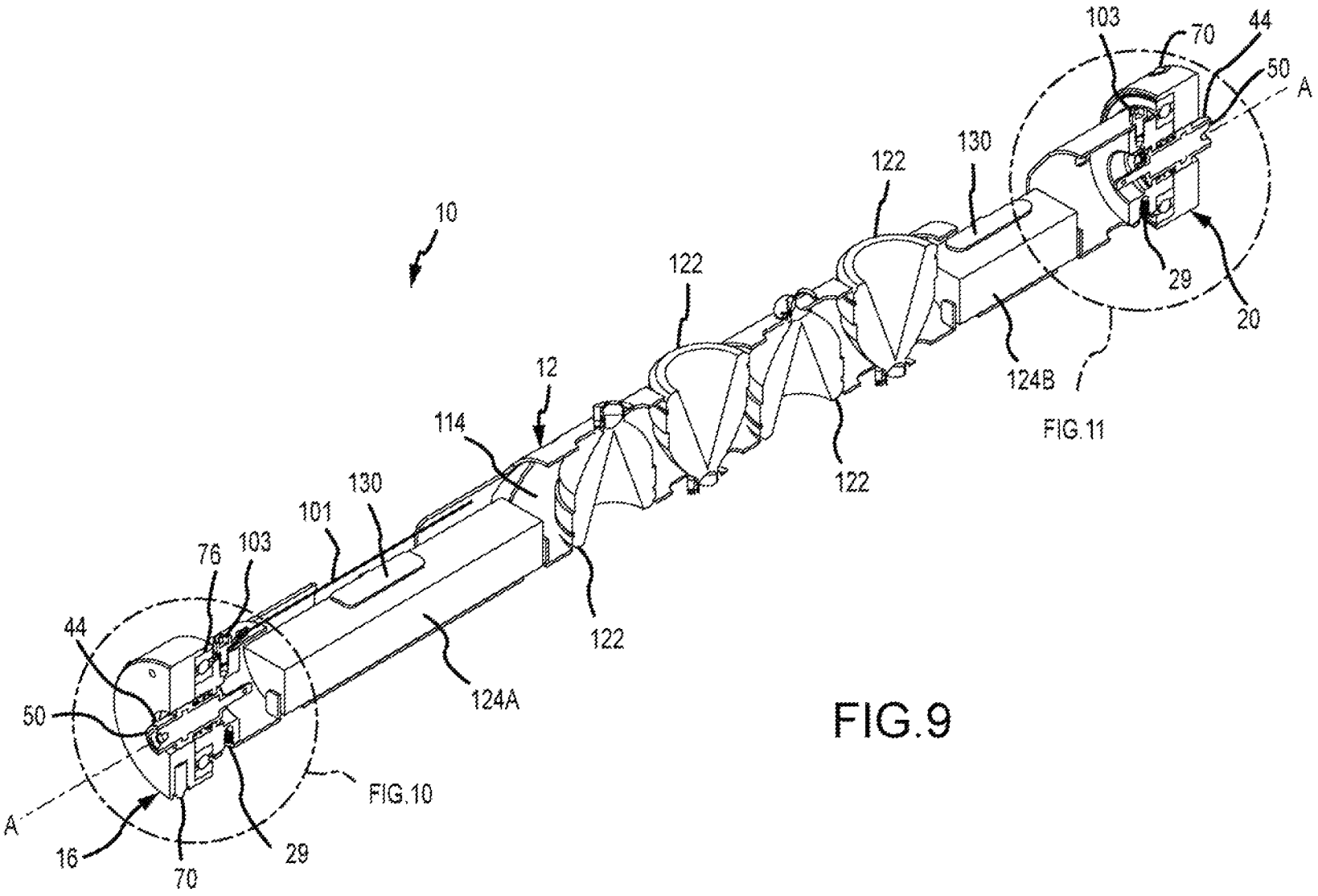
FIG. 9 is a break-away, side perspective view of the gun tube of FIG. 1.
Figure 10:
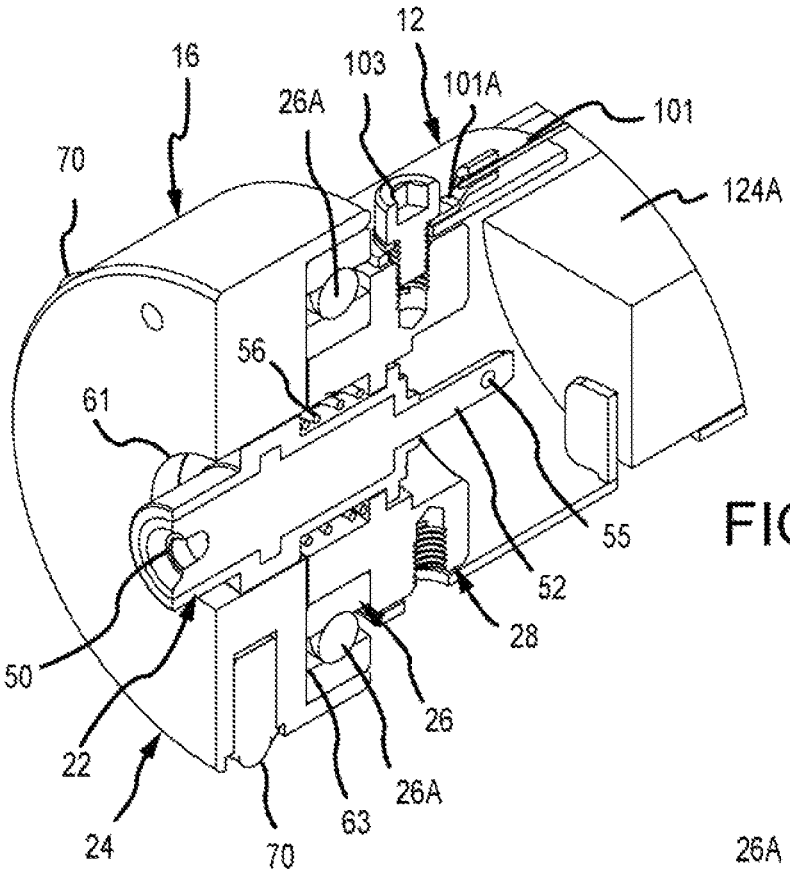
FIG. 10 is a close-up, side, perspective view showing detail D of FIG. 9.
Figure 11:
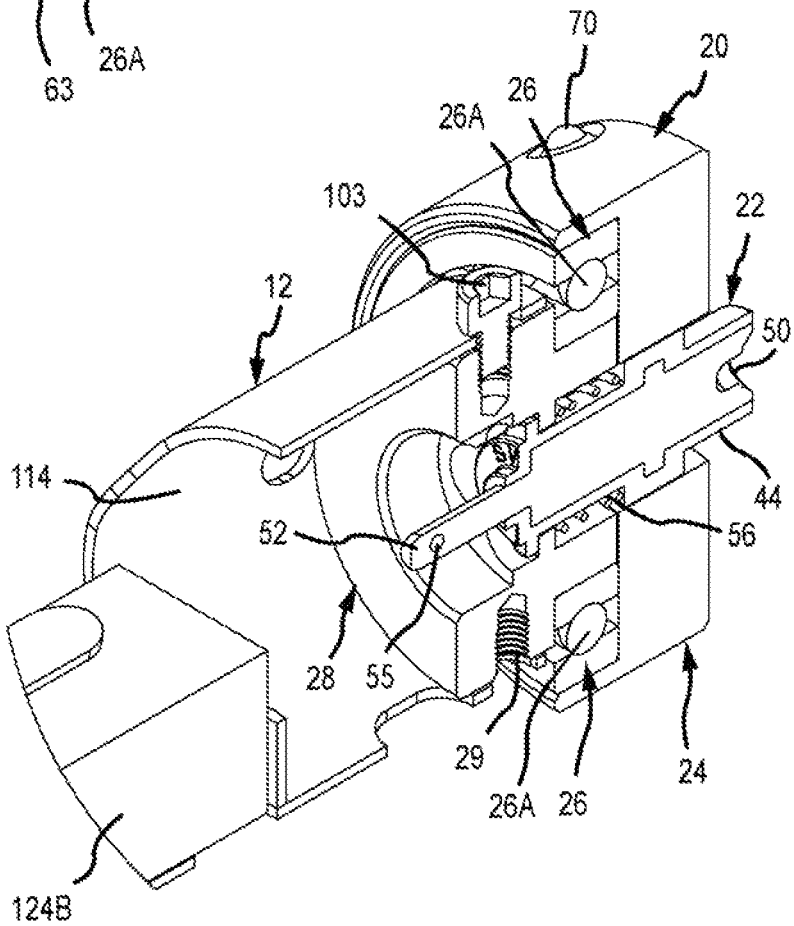
FIG. 11 is a close-up, side, perspective view showing detail E of FIG. 9.
Figure 12:
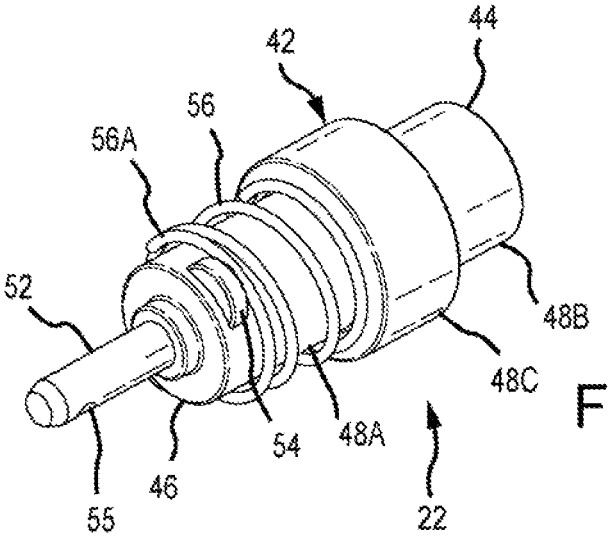
FIG. 12 is a side, perspective view of an end connector in accordance with an embodiment of the invention.
Figure 12A:
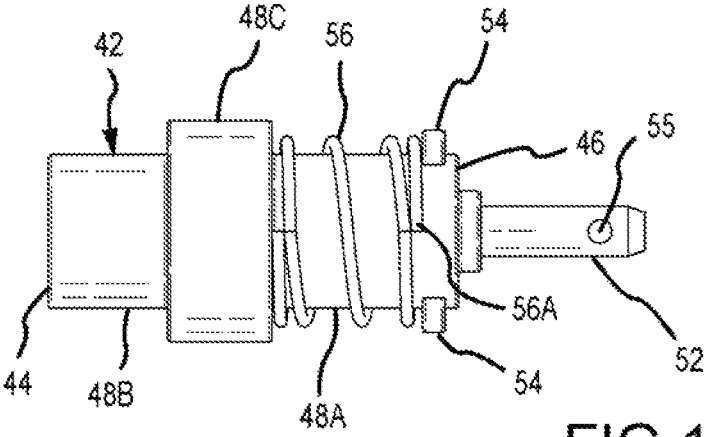
FIG. 12A is a side view of the end connector of FIG. 12.
Figure 12B:
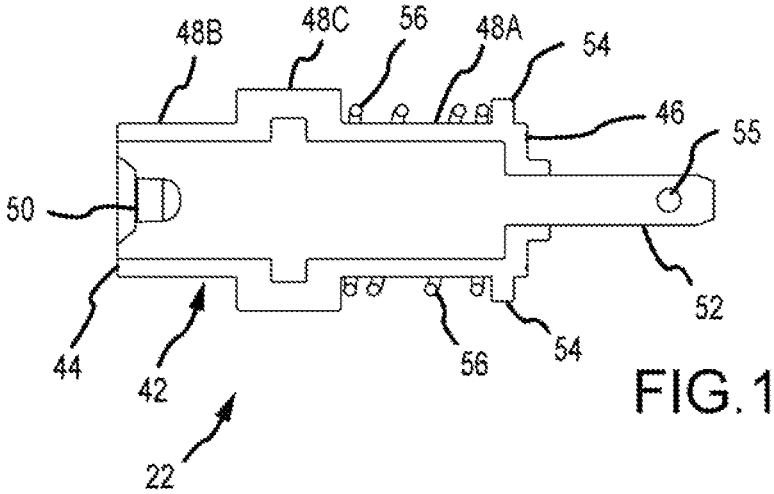
FIG. 12B is a cross-sectional, side view of the end connector of FIG. 12A.
Figure 12D:
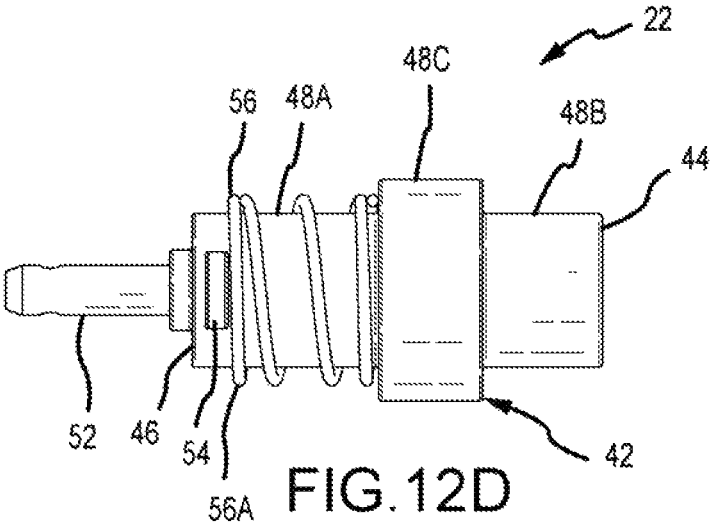
FIG. 12D is an alternate, side view of the end connector of FIG. 12.
Figure 12E:
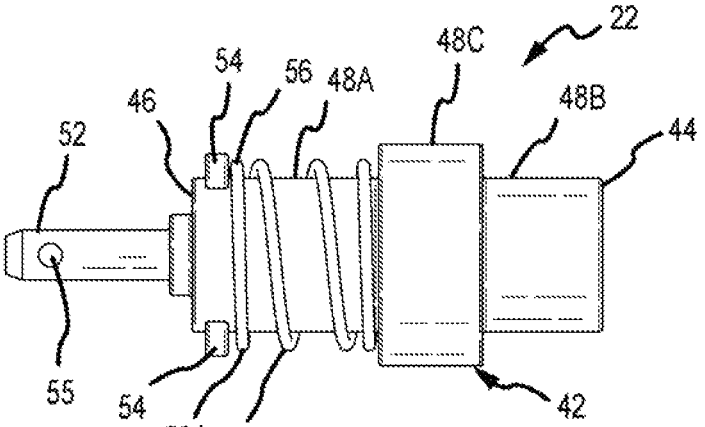
FIG. 12E is a rotated, alternate side view of end connector of FIGS. 12 and 12D.
Figure 12C:
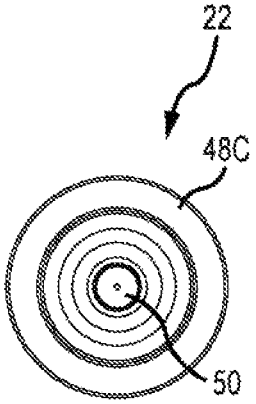
FIG. 12C is an end view of the end connector of FIG. 12A.
Figure 12F:
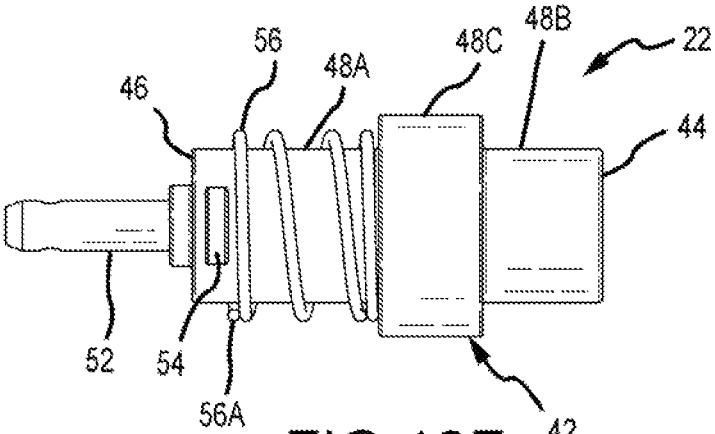
FIG. 12F is a rotated, alternate side view of end connector of FIGS. 12 and 12D.
Figure 12G:
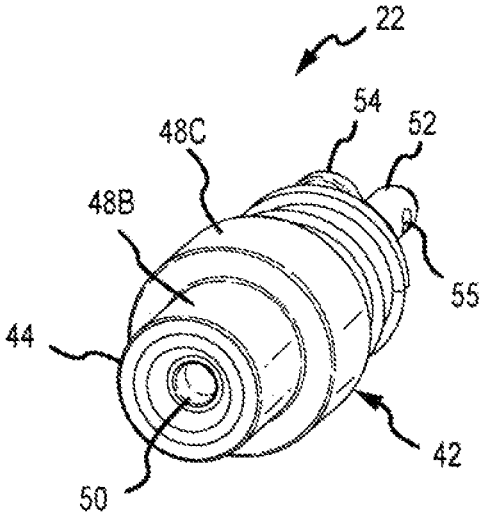
FIG. 12G is a perspective, front end connector view of FIG. 12.
Figure 12H:
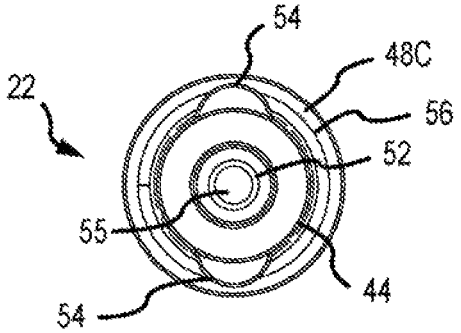
FIG. 12H is an end view of the end connector of FIG. 12E.
Figure 12I:
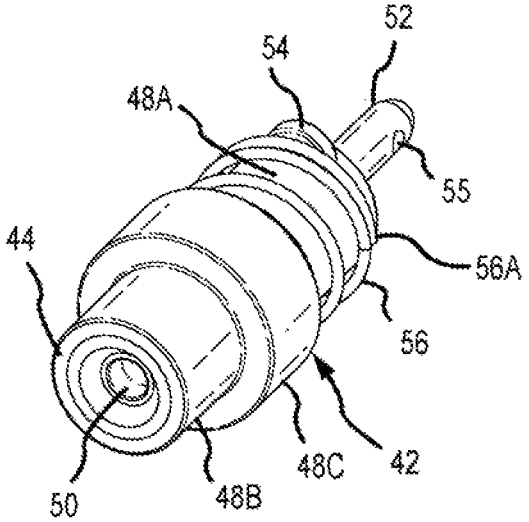
FIG. 12I is an alternate, side perspective view of the end connector of FIG. 12.

If desired, one or more retainers 584 may be associated with the bulkhead 574 to secure one or more other components thereto. The retainer 584 may have any suitable form, construction, configuration, location and operation. In the embodiment of FIG. 2, the cup-shaped retainer 584 is releasably engaged in the switch cavity 582 from the uphole end of the bulkhead 574 (e.g. via mating threads, snap-fit, friction-fit, etc.) and configured to at least partially carry the switch 560 therein and secure it to the bulkhead 574. For example, one or more retainer rings 586 (or other components) may be used to releasably secure the switch to the retainer 584. The illustrated retainer 584 is constructed at least partially of conductive material (e.g. low-alloy steel), such as to form part of the grounding path of the switch 560 and/or detonator 550, for any other purpose or a combination thereof. In other embodiments, the retainer 584 may be constructed of non-conductive material.

In other embodiments, (e.g. FIGS. 55 & 56), instead of positioning the retainer 584 radially outwards of the switch 560 in the switch cavity 582 (e.g. FIG. 57) to secure the switch 560 to the bulkhead 574, the retainer 584, when included, may be located elsewhere to free-up the annual space around the switch 560, allow the use of a wider/thinner switch 560 or for any other suitable purpose. In such instances, a different feature may be provided to secure the switch 560 to the bulkhead 574, such as one or more retainer rings 586 (or other components). In this embodiment, the retainer 584 is generally cylindrically shaped and releasably coupled to the bulkhead 574 (e.g. via mating threads, snap-fit, friction-fit, etc.) at or proximate to its downhole end and configured to secure the feedthrough 568 in the feedthrough cavity 588. However, the retainer 584 may be non-cylindrical, may not secure the feedthrough 568 in the cavity 588 and may be coupled to the bulkhead 574 or other component in any other manner or be integral thereto.

In at least some embodiments, the exemplary bulkhead 574 may include a shoulder 578 configured to be captured between adjacent interconnected carriers 530 in the assembled gun system 510. The shoulder 578 may be included for any suitable purpose(s). For example, the shoulder 578 may assist in maintaining the desired position of the bulkhead 574 in relation to the carriers 530 during use of the gun system 510. For another example, the shoulder 578 may receive and absorb some of the kick forces upon ignition of the explosives 546 in the gun 516*b*.

The bulkhead 574 may be constructed at least partially of electrically conductive material to serve as part of the grounding circuit for one or more other components of the gun system 510, for any other purpose or a combination thereof. In this illustrated embodiments, the bulkhead 574 is constructed of metal and is useful for grounding the associated switch 560 and detonator 550 (e.g. to the carrier 530).

Figure 38:
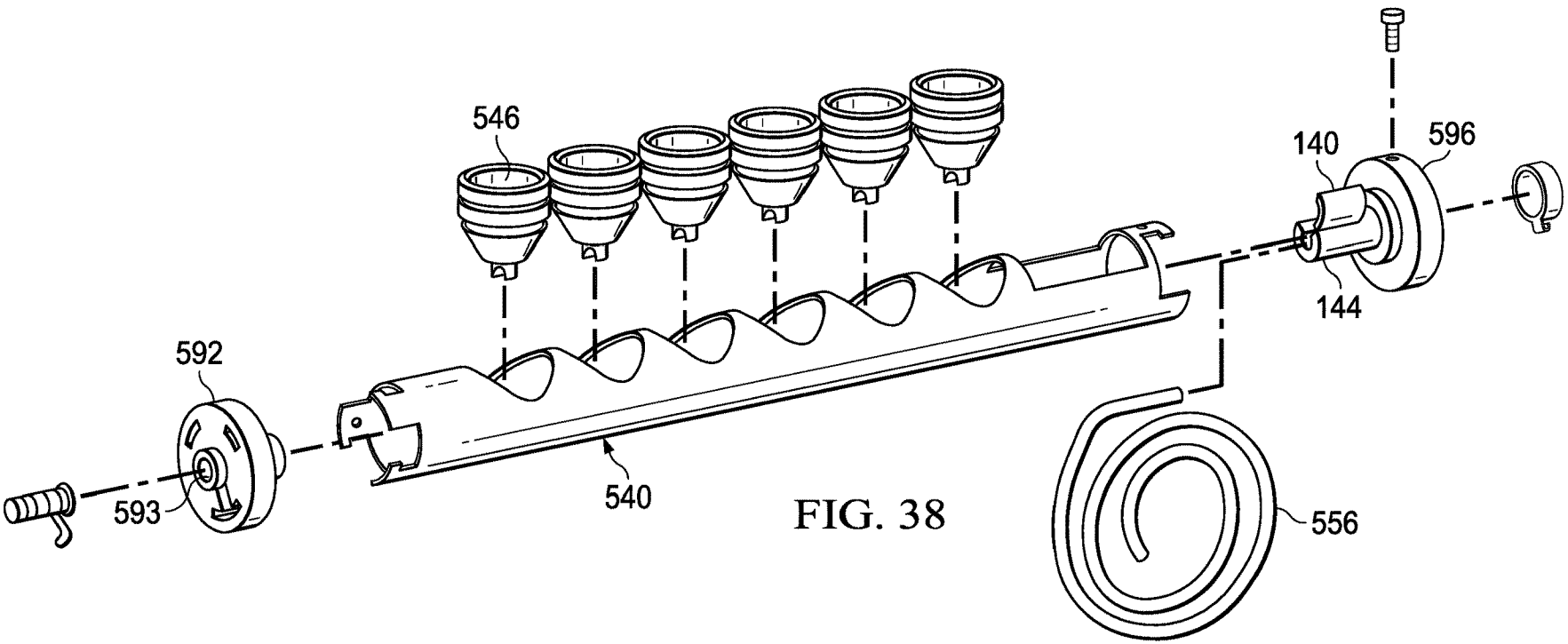
FIG. 38 is an exploded view of a perforating gun string, in accordance with embodiments of the present disclosure.

Referring now to FIGS. 36-38, in accordance with other distinct independent aspects of the present disclosure, the charge holder 540 may be secured in the gun 516 in any suitable manner. For example, the charge holder 540 may be releasably, mechanically engaged with and carried by one or more uphole end fittings 592 at or proximate to its upper end, and one or more downhole end fittings 596 at or proximate to its lower end.

Figure 52:
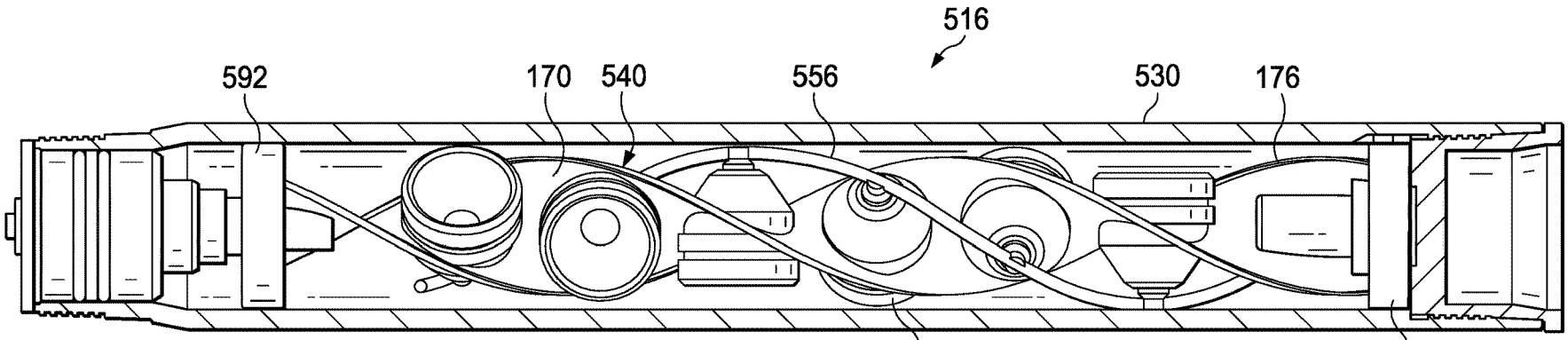
FIG. 52 is a cross-sectional view of a perforating gun with a curved charged holder, in accordance with embodiments of the present disclosure.

The end fittings 592, 596, when included, may have any suitable form configuration, construction and operation. In the present embodiments, each end fitting 592, 596 each has a generally cylindrical shape, includes at least one (e.g. circular) central bore 593 extending axially therethrough, at least partially houses one or more other components of the gun 516 and is configured to be slid into the carrier 530 during assembly (e.g. FIGS. 45 & 52). For example, the end fitting 592, 596 may centralize the charge holder(s) 540 in the carrier 530 and hold one or more electrical components 524. The exemplary end fittings 592, 596 are constructed of plastic but could be constructed of any other suitable materials(s). However, in other embodiment, the end fittings 592, 596 may have one or more different or additional purposes and any other configuration. For example, either or both end fittings 592, 596 may be non-cylindrical (e.g. include fins), be part of, or integrated with, the charge holder 540 (e.g. as a single component that includes end fittings 592, 596 and charge holder 540). It should also be noted that, in some embodiments, the uphole end fitting 592 and components associated there with may be used at the downhole end 522 of the gun 516 and the downhole end fitting 596 and associated components may be at the uphole end 520 of the gun 516. For example, the illustrated embodiments of gun 516 could be flipped 180°.

Referring again to FIG. 37, the exemplary uphole end fitting 592 may at least partially house any suitable gun components that help facilitate the communication of electric current from the immediately preceding uphole gun 516*a* (e.g. through the feedthrough 568) down to the gun 516*b*. For example, the central bore 593 of the uphole end fitting 592 may at least partially house a plunger 650 that electrically contacts one or more feedthrough conductors 569 extending from the illustrated feedthrough 568 (or conductive contacts (not shown) provided in, or on the feedthrough 568).

When included, the plunger 650 may have any suitable form, configuration, components, construction and operation. In the present embodiments, the plunger 650 includes a conductive contact button 652 rigidly (and selectively releasably) carried by a nonconductive insulator 656. The exemplary contact button 652 and insulator 656 may have any suitable form, configuration, construction and operation. For some non-limiting examples, the contact button 652 may be metallic, at least partially coated with conductive material, include one or more conductive contacts (not shown), and the insulator 656 is elongated and plastic. However, in other embodiments, the insulator 656 may take any other form (non-elongated) or not included and any other component(s) may help insulate the contact button 652 (if desired). For example, the contact button 656 could be self-insulated or insulated by a different component (e.g. the end fitting 592).

In the present embodiments, the contact button 652 and insulator sleeve 656 are capable of concurrently sliding back and forth in the central bore 593 of the uphole end fitting 592 and configured to be spring-biased in the uphole direction to force the contact button 652 into electrical contact with the feedthrough conductor 569 at a first conductive interface 526*a* and allow the transmission of electric current therebetween. Any suitable components may be used to bias the contact button 652 into sufficient contact with the feedthrough conductor 569. For example, a spring 610 may bias the contact button 652 (and insulator sleeve 656) as desired. In the present embodiments, the spring 610 is a helical, or coil, spring but may take any other form (e.g. radial wave spring, biased sleeve). However, in other embodiment, only the contact button 652 slides back and forth without the insulator sleeve 656.

Still referring to FIG. 2, if necessary, the plunger 650 may include one or more retention clips 614 or other components configured to prevent the contact button 652 and insulator sleeve 656 from falling or popping out the uphole end of the central bore 593, at least during assembly of the gun 516. Electric current may be communicated from the exemplary contact button 652 (or other component) to the inner body conductor 542 of the gun 516*b* in any suitable manner. For example, the spring 610 (a.k.a. the first contact spring 610*a*) may be constructed at least partially of conductive material and serve as an intermediate conductor 618 (a.k.a. the first intermediate conductor 618*a*) to communicate electric current from the contact button 652 to the inner body conductor 542.

In the present embodiments, the spring 610 is axially-oriented in the gun 516 (e.g. inside the central bore 593 of the end fitting 592) and radially inwards of the inner body conductor 542. The exemplary spring 610 electrically contacts the contact button 652 and an intermediate electrical connector 624 (a.k.a. the first intermediate electrical connector 624*a*), which electrically contacts the inner body conductor 542. For example, the spring 610 may be biased between the contact button 652 and connector 624*a*. However, in other embodiments, the spring 610 could be oriented differently, directly electrically contact the inner body conductor 542 or have any other configuration. Also, different or additional electrical components 524 (e.g. one or more spring retainers) could be included at any desired location(s) in the electric flow path between the feedthrough 568 and inner body conductor 542. Moreover, the first intermediate conductor 618*a* could have any other form, configuration and operation.

Figure 53:
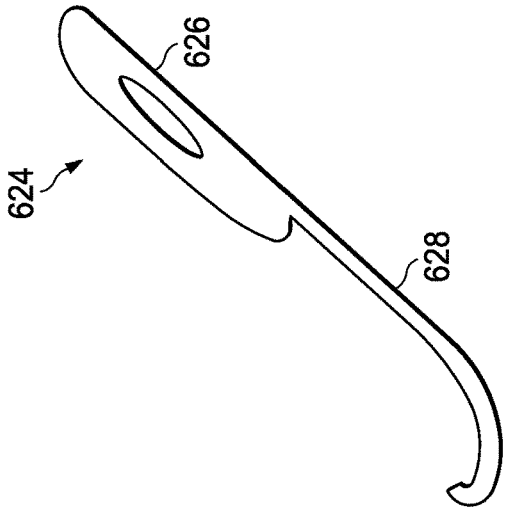
FIG. 53 illustrates a spring-biasable arm, in accordance with embodiments of the present disclosure.

Referring again to FIG. 37, when included, the intermediate electrical connector 624 may have any suitable form, configuration, location and operation. In this example, the intermediate electrical connector 624 is electrically conductive, carried in the end fitting 592 and extends between the spring 610 and the inner body conductor 542 at respective second and third conductive interfaces 526*b*, 526*c*. The illustrated intermediate electrical connector 624 (e.g. ring terminal) includes a base, or ring, 626 (e.g. FIG. 53) configured to extend around the insulator sleeve 656 (or other component) and electrically contact the spring 610. At least one arm spring-biasable arm 628 is shown extending generally radially outwardly from the illustrated base 626 (e.g. through a slot 629*a* formed in the end fitting 592, FIGS. 42-43A-B) and configured to electrically contact the inner body conductor 542. If desired, the arm 628 may be spring-biased radially outwardly to ensure effective electrical contact with the inner body conductor 542. This particular form of intermediate electrical connector 624 is sometimes referred to as a "shepherds-hook" due to the general shape of the arm 628. For example, when the exemplary charge holder assembly 590*c* (e.g. end fittings 592, 596, charge holder 540, explosives 546, det-cord 556, FIG. 45) is pushed into the carrier 530, the illustrated arm 628 may engage the inner body conductor 542 under friction to deflect it radially inwardly against its outward spring tension and thus assist in providing a robust and reliable electrical connection therebetween.

However, the first intermediate electrical connector 624*a* can have any other form (e.g. a piston and helical spring) and location. And in other embodiments, the above-mentioned electrical components 524 may be not be provided in or associated with the uphole end fitting 592, but instead carried by or associated with any other component(s) of the gun system 510.

Still referring to FIG. 37, if desired, all, or any combination, of the feedthrough conductor 569, contact button 652, first intermediate conductor 618*a*, first intermediate electrical connector 624*a* may be non-wired and form wire-free conductive interfaces 526 therebetween. In the present embodiments, they are all wire-free. However, any other combination, configuration and location of components may be used to help facilitate the communication of electric current into the upper end 520 of each gun 516. For example, in some embodiments, the entire gun 516 or any desired part thereof may be wired (e.g. include one or more electrical components 524 having wire(s) and/or conductive interfaces 526 formed with one or more wires).

Figure 39:
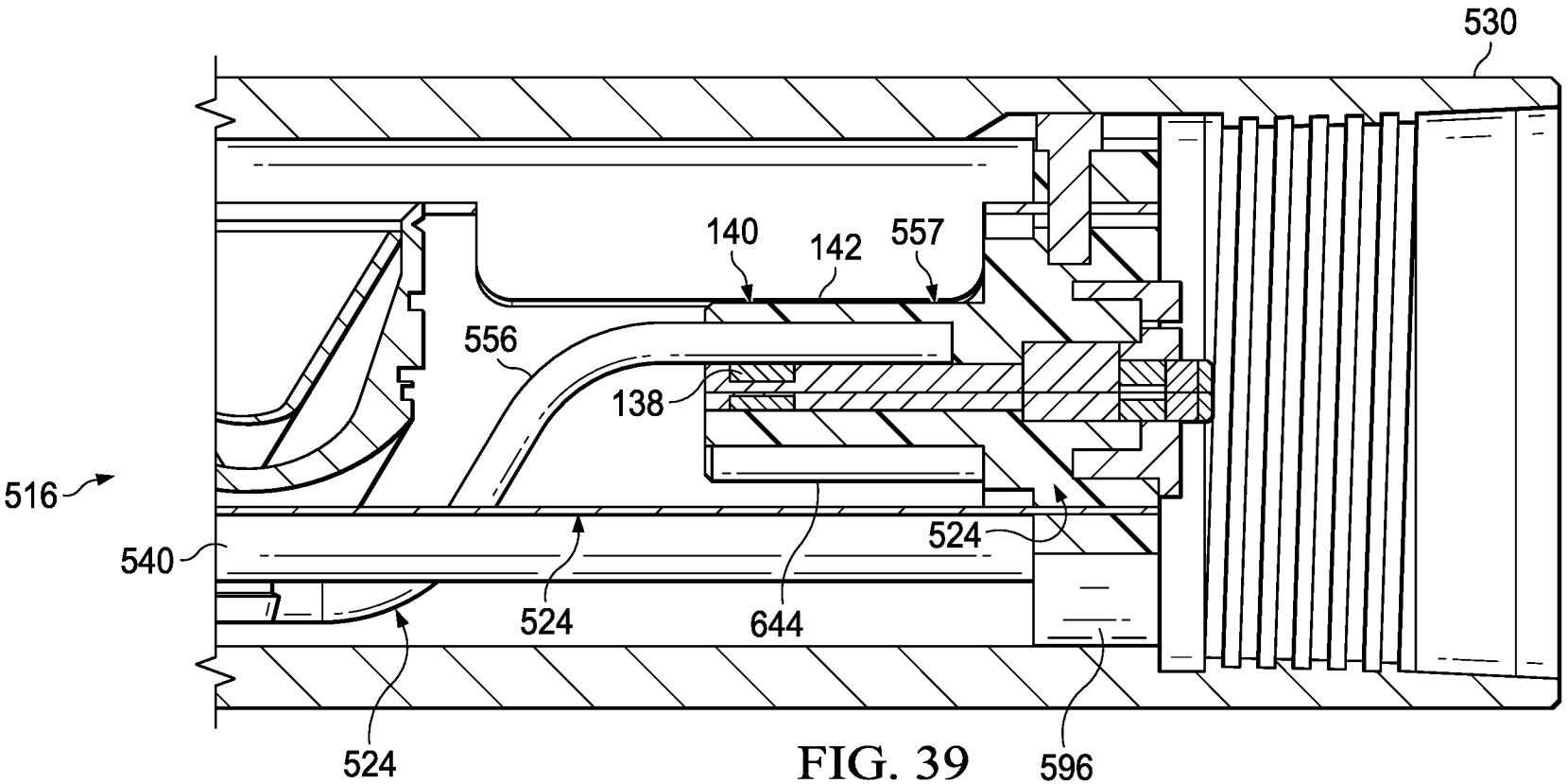
FIG. 39 is a cross-sectional side view of the downhole end of the perforating gun, in accordance with embodiments of the present disclosure.
Figure 40A:
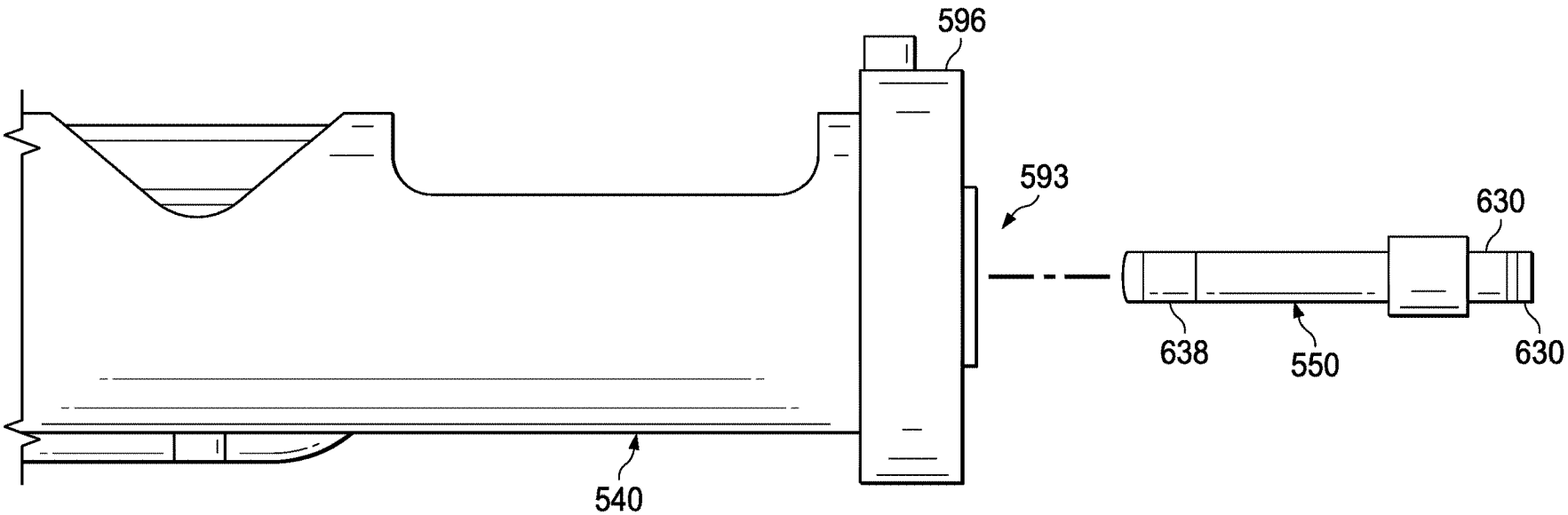
FIG. 40A is an exploded view of a perforating gun charge holder and detonator, in accordance with embodiments of the present disclosure.
Figure 40B:
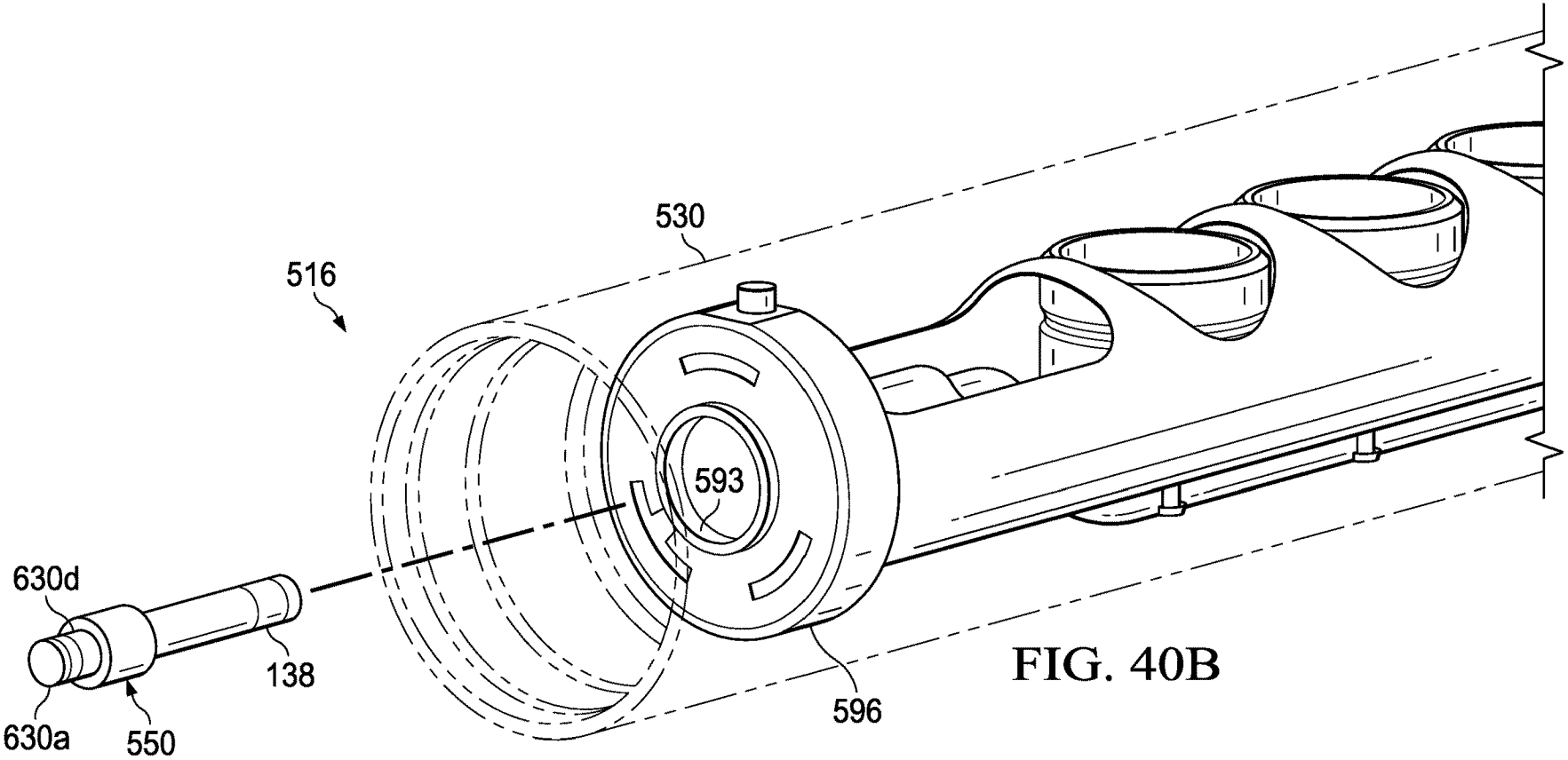
FIG. 40B is an exploded view of a perforating gun charge holder and detonator, in accordance with embodiments of the present disclosure.
Figure 41:
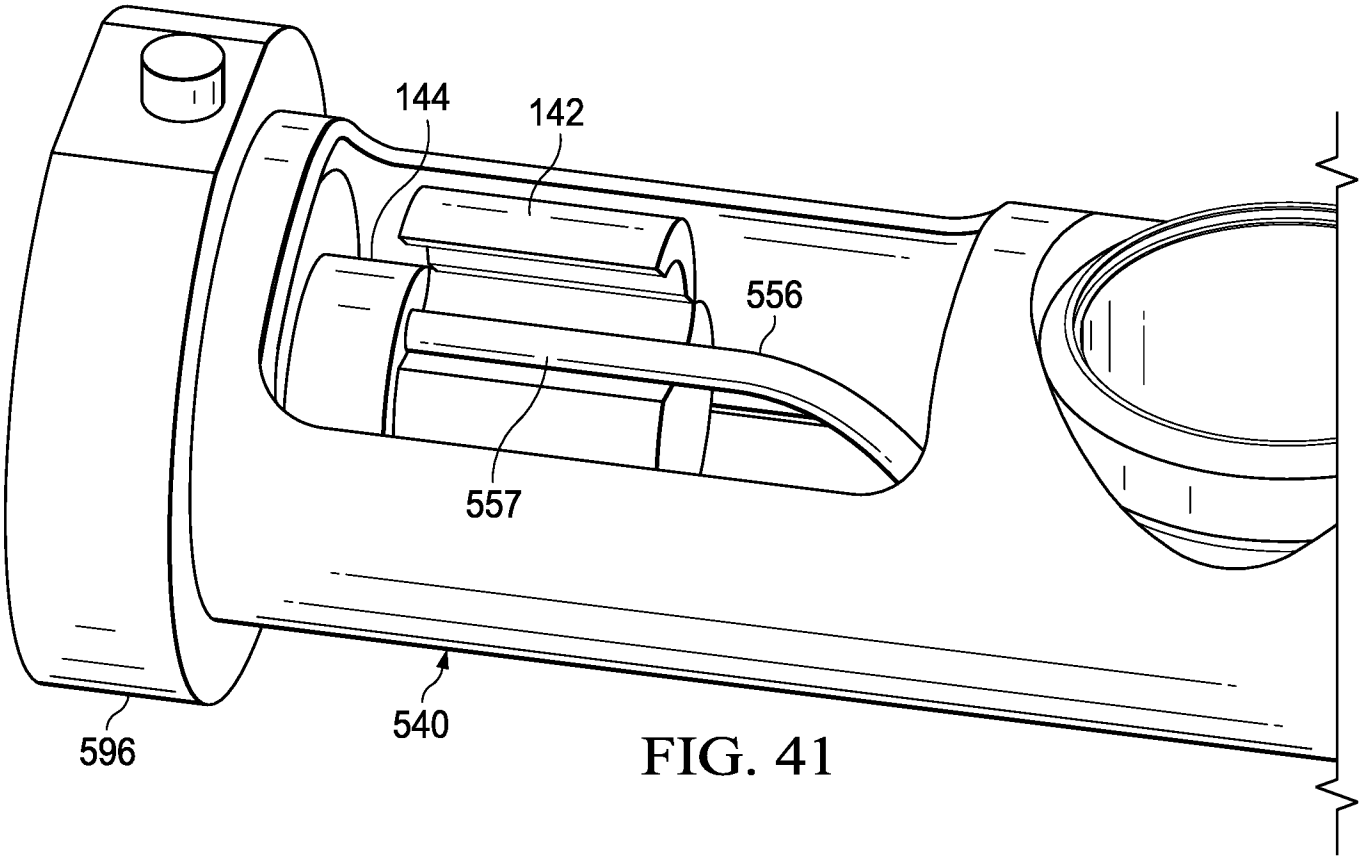
FIG. 41 is a cut-away view of the downhole end of the perforating gun, in accordance with embodiments of the present disclosure.

Now referring to FIGS. 39-41, in accordance with various distinct independent aspects of the present disclosure, the exemplary downhole end fitting 596 may be configured to at least partially seat, or house, the detonator 550, switch 560 (FIG. 36), one or more other electrical components 524 associate with the gun 516, other components or a combination thereof. In other embodiments, such components may be housed or carried in any other suitable component.

In some instances, the downhole end fitting 596 may be equipped with a det-cord clamp 140 configured to secure the lower end 557 of the det-cord 556 in a desired position in the gun 516 and relative to the detonator 550 to receive ignition signals therefrom. If desired, the det-cord clamp 140 may be integral, or rigidly coupled, to the end fitting 596. In the present embodiments, the det-cord clamp 140 is formed in or associated with an (e.g. elongated) detonator sleeve 144 extending uphole from the downhole end fitting 596. The det-cord clamp 140 (and detonator sleeve 144, if included) may be provided to save the time, effort and need for the gun assembler to find a conventional separate det-cord clip (which can be easily lost or disengaged) and use it to manually couple the end of the det-cord 556 to the detonator 550, for any other benefit or a combination thereof. For example, many current perf guns require an assembler to manually insert his/her fingers into a window formed in the charge holder 540 to make that tedious, delicate connection.

The det-cord clamp 140 may have any suitable form, configuration and operation. In the present embodiments, the det-cord clamp 140 includes a hinged door 142 that can be opened to allow placement of the end 557 of the det-cord 556 into the desired position in the end fitting 596 and thereafter closed to secure that position. When the exemplary detonator 550 is inserted into the bore 593 of the end fitting 596 (e.g. from the downhole end of the fitting 596), one or more explosive interface 138 formed, or provided, on or in, or extending from the detonator 550 will abut the det-cord 556 sufficient to transmit desired ignition signals through the det-cord 56 to the explosives 546. In the illustrated embodiments (e.g. FIGS. 39 & 40A-B), the explosive interface 138 of the detonator 550 includes one or more ring, or band, extending at least partially around the detonator 550, but could take any other suitable form.

Figure 42:
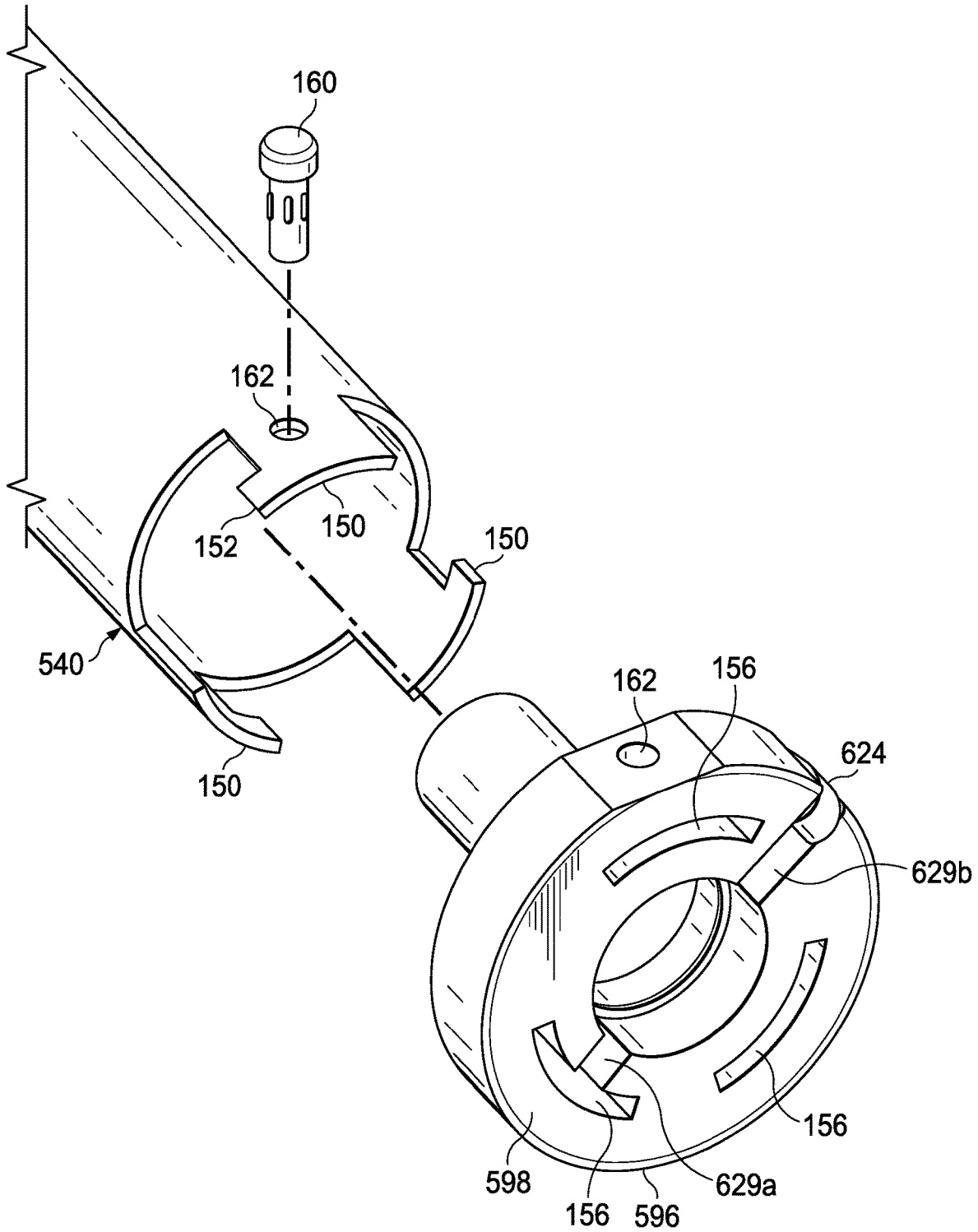
FIG. 42 is an exploded view of a perforating gun string with a twist-lock connection, in accordance with embodiments of the present disclosure.
Figure 43A:
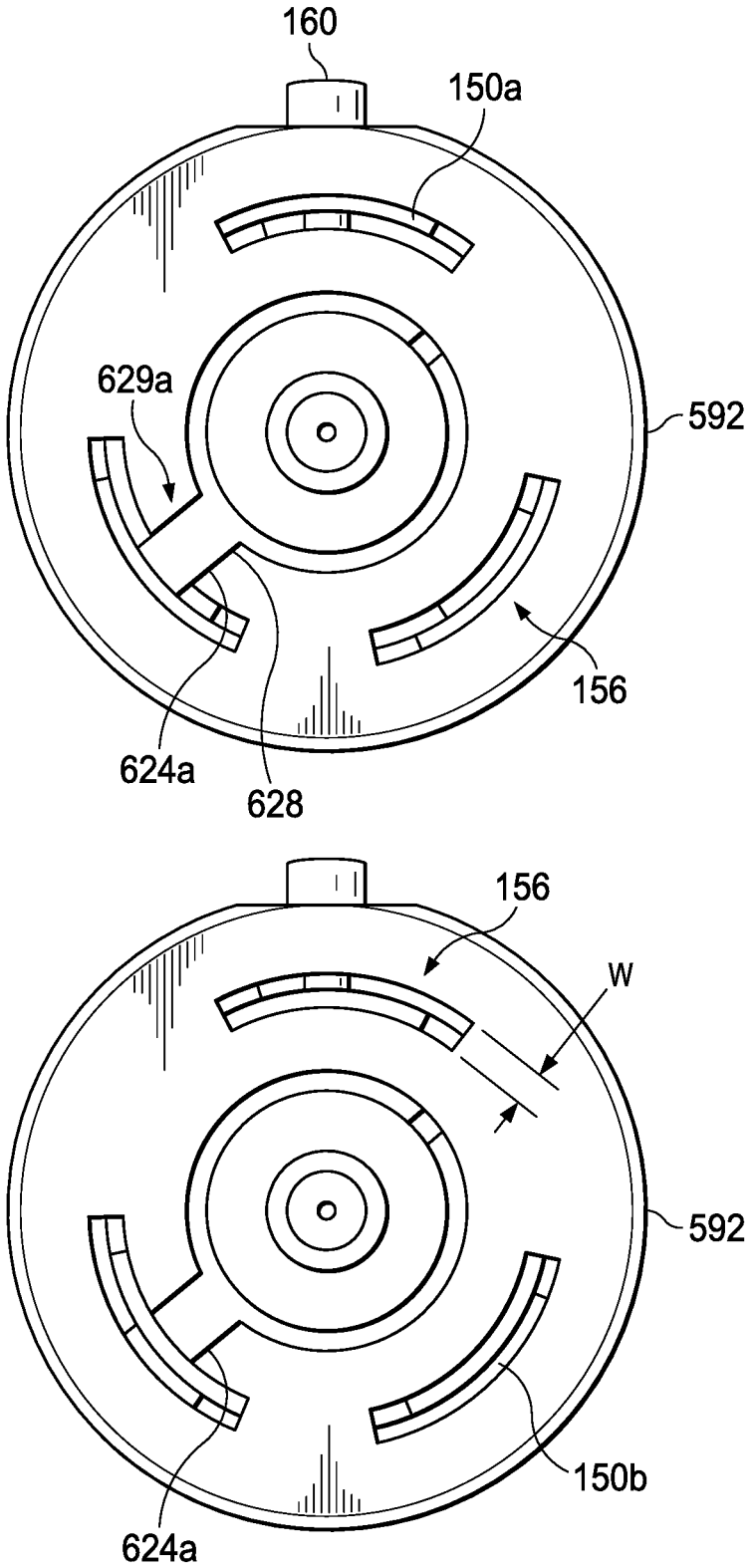
FIG. 43A illustrates an end fitting in accordance with embodiments of the present disclosure.
Figure 43B:
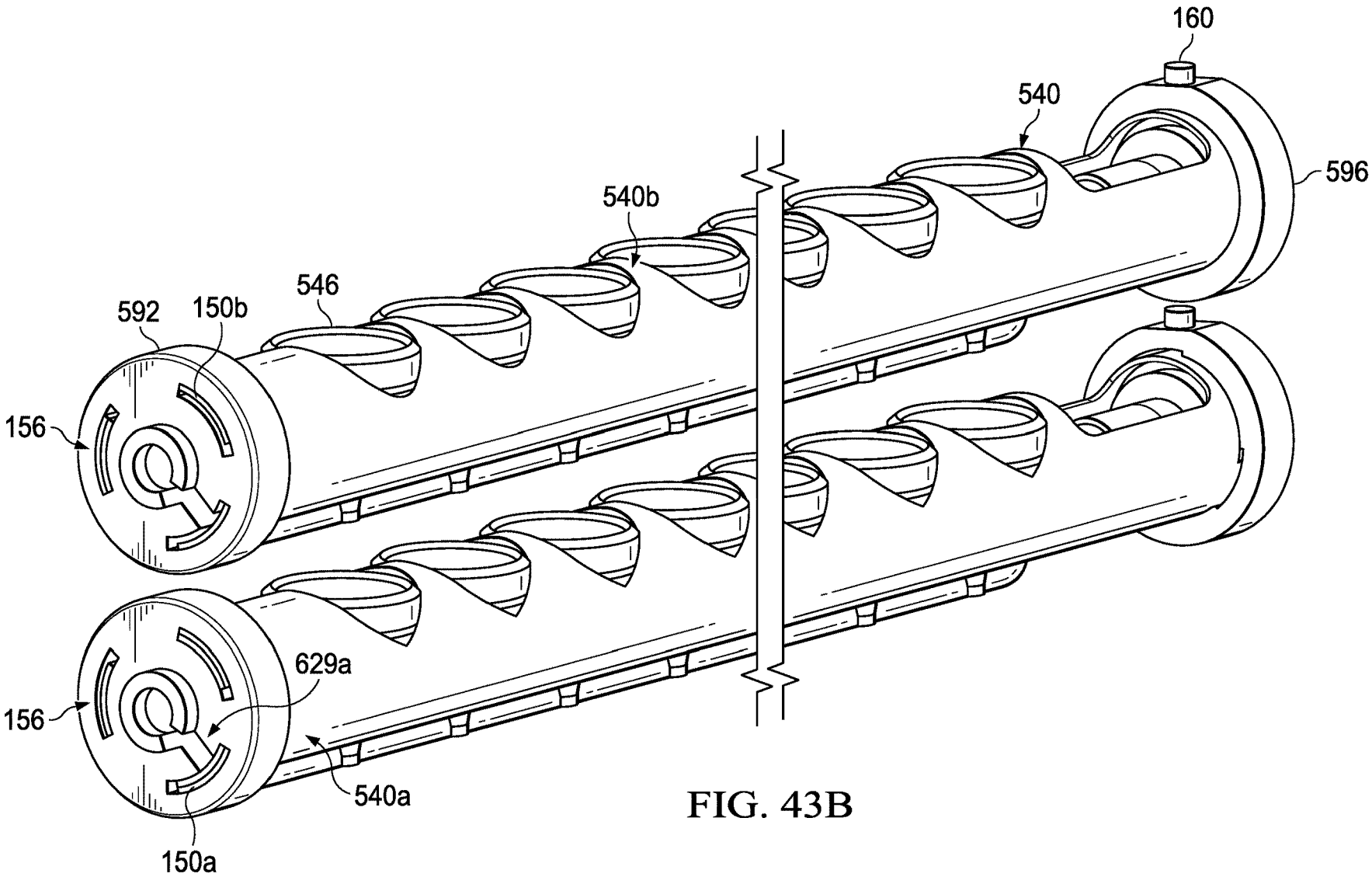
FIG. 43B illustrates a side view of a charge holder with the end fittings, in accordance with embodiments of the present disclosure.

Referring now to FIGS. 42-43B, in accordance with other distinct independent aspects of the present disclosure, the charge holder 540 may be associated with the end fittings 592, 596 (or other component(s)) in any suitable manner. For example, they may be formed integrally as one component (e.g. 590*c*, FIG. 67). For another example, a twist-lock connection may be employed between the charge holder 540 and one or more of the end fittings 592, 596. As shown in FIG. 42, the illustrated charge holder 540 includes at least one finger 150 (e.g. three) at each end thereof that is slidable at least partially through, and is rotatable relative to, a receiving slot 156 formed in the corresponding end fitting 592, 596 (and vice versa). For example, after the receiving slots 156 of an exemplary end fitting 592, 596 are slid over the corresponding fingers 150 and the end fitting 592, 596 is rotated or twisted (or vice versa), a tab 152 extending from the finger 150 will abut the outer face 598 of the end fitting 592, 596 to prevent the charge holder 540 from backing out. In the present embodiments, proper seating (e.g. and tight engagement) of the charge holder 540 in the exemplary end fittings 592, 596 should align the respective first and second intermediate electrical connectors 624*a*, 624*b* (e.g. FIG. 37) with the inner body connector 542 (e.g. the through-connector 544, as described below) to form reliable electrical interfaces therebetween.

Referring again to FIGS. 42-43B, if desired, one or more releasable mechanical connectors 160 may be engaged in corresponding aligned holes 162 in one or more corresponding fingers 150 (or any other part) of the charge holder 540 and the end fitting 592, 596 to help secure them together. The connector 160 may have any suitable form and operation. In this embodiment, the connector 160 is a pin with helically cut teeth so it can be pushed into locking engagement and screwed out for disengagement. In other embodiments, the connector 160 may be a screw, snap or other mechanism. In yet other embodiments, any other configuration of components and/or features may be used to couple or associated the charge holder 540 and end fittings 592, 596 or otherwise secure the charge holder 540 in the carrier 530. In the present embodiments, a single connector 160 secures each end of each charge holder 540 in position.

When included, the end fittings 592, 596 may be designed to receive different sizes of charge holders 540. This sort of "universal" end fitting 592, 596 may be beneficial, for example, to be able to use the same type of end fittings 592, 596 in the assembly of different perforating guns 516 requiring differing arrangements of explosives 546. Referring to FIGS. 43A-B, each receiving slot 156 in the illustrated end fittings 592, 596 may have a width W that will accommodate fingers 150 extending from different sized charge holders 540. For example, when the charge holders 540 are cylindrical in shape, they can be formed having different diameters (e.g. to provide different explosive arrangements). A first (smaller) charge holder 540*a* may have an outer diameter (e.g. 1¾") that is smaller than the outer diameter (e.g. 1⅞") of a second (larger) charge holder 540*b*. To accommodate both (or any desired) sizes of charge holders 540, the width W of each receiving slot 156 in the exemplary end fittings 592, 596 may be formed to accept a finger 150 of either type of charge holder 540. In this embodiment, each finger 150*a* of the exemplary smaller charge holder 540*a* is shown abutting the inner surface that forms the corresponding receiving slot 156, while each finger 150*b* of the larger charge holder 540*b* is shown abutting or hugging the outer surface that forms the respective corresponding receiving slot 156. However, any configuration of components and features may be used to accommodate different shapes, sizes and types of charge holders 540.

Figure 44:
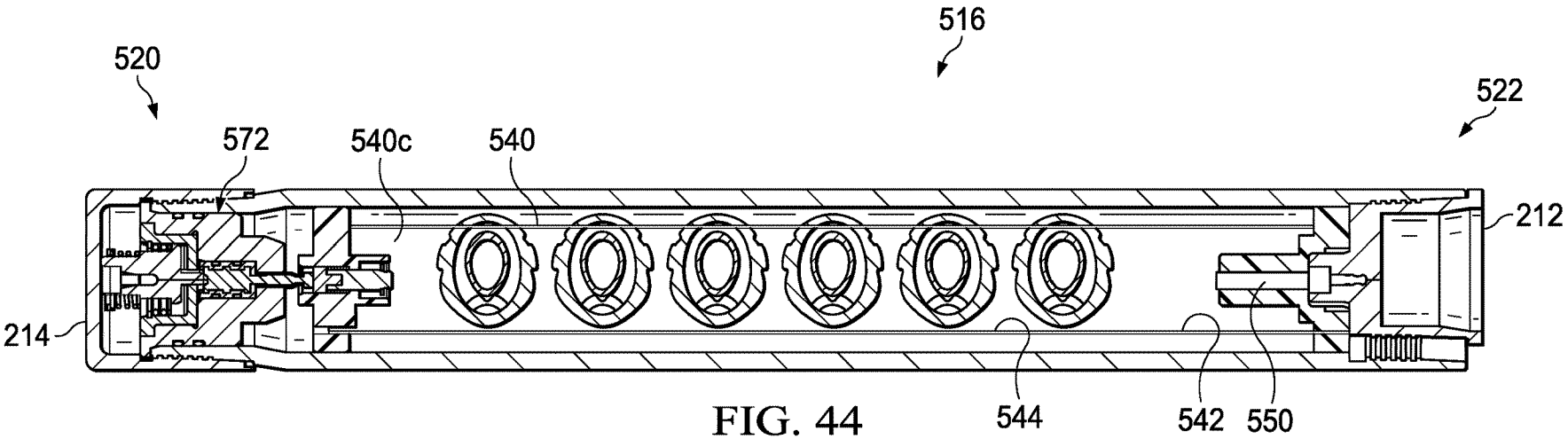
FIG. 44 is a cross-sectional side view of a perforating gun, in accordance with embodiments of the present disclosure.

In accordance with other distinct independent aspects of the present disclosure, the charge holder 540 may have any suitable form, configuration, components, construction and operation. Referring now to FIGS. 37 & 44, for example, the charge holder 540 may be constructed at least partially of insulative material (e.g. which cannot conduct the voltage required to provide the necessary explosive ignition) that can withstand the elevated temperatures expected in use of the perforating system 510. This sort of charge holder 540 is sometimes referred to herein as non-conductive, or insulator, charge holder 540*c*. Non-limiting and non-exclusive examples of non-conductive charge holders 540*c* may be constructed at least partially of cardboard, nylon, plastic, rubber, silk, non-conductive fabric or fibrous material, or variations or combinations thereof. Insulator charge holders 540*c* may be used to simplify manufacturing, transportation, handling, assembly, cost and/or safety concerns associated with metal charge holders 540, insulate electrical through-connectors 544 (as described below) that may be associated with the charge holder 540, allow the use of a non-wired or non-insulated inner body conductors 542 (e.g. through-connectors 544) therewith, for any other purpose(s) or a combination thereof.

The charge holder 540 may have any suitable shape, form, construction and configuration. In this embodiment, for example, the charge holder 540 has a general cylindrical shape. In some other embodiments, such as those shown in FIGS. 45-47, the charge holder 540 may take the form of, or include, one or more plates 170 (a.k.a. the charge plate) configured to carry the explosives 546 in a desired orientation. However, the charge holder 540 may have any other desired shape.

Figure 45:
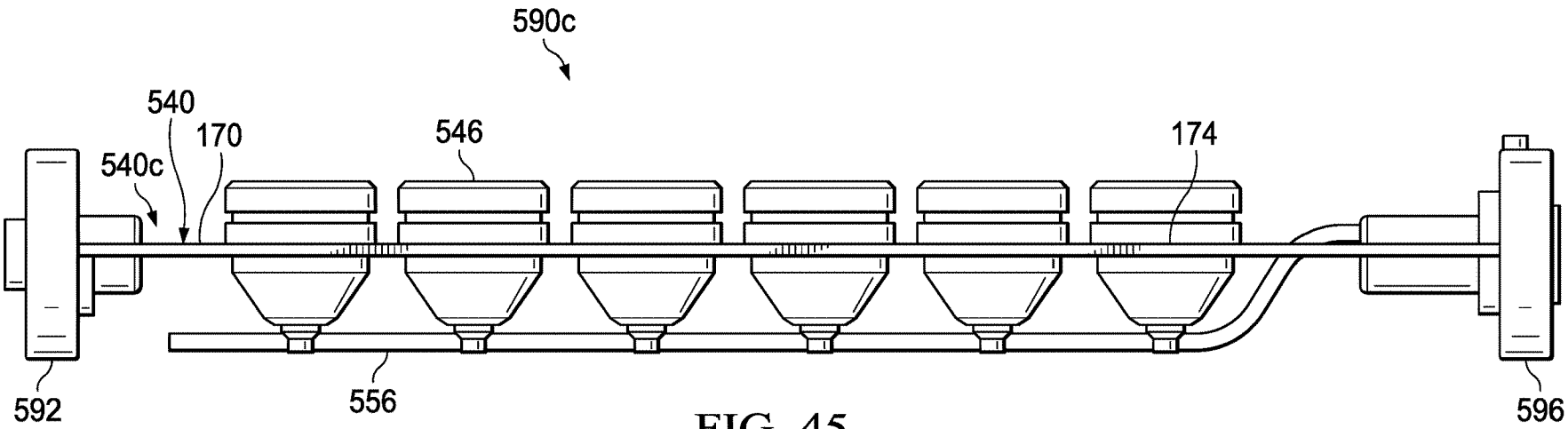
FIG. 45 illustrates a side view of the shaped charges within the charge holder, in accordance with embodiments of the present disclosure.
Figure 46:
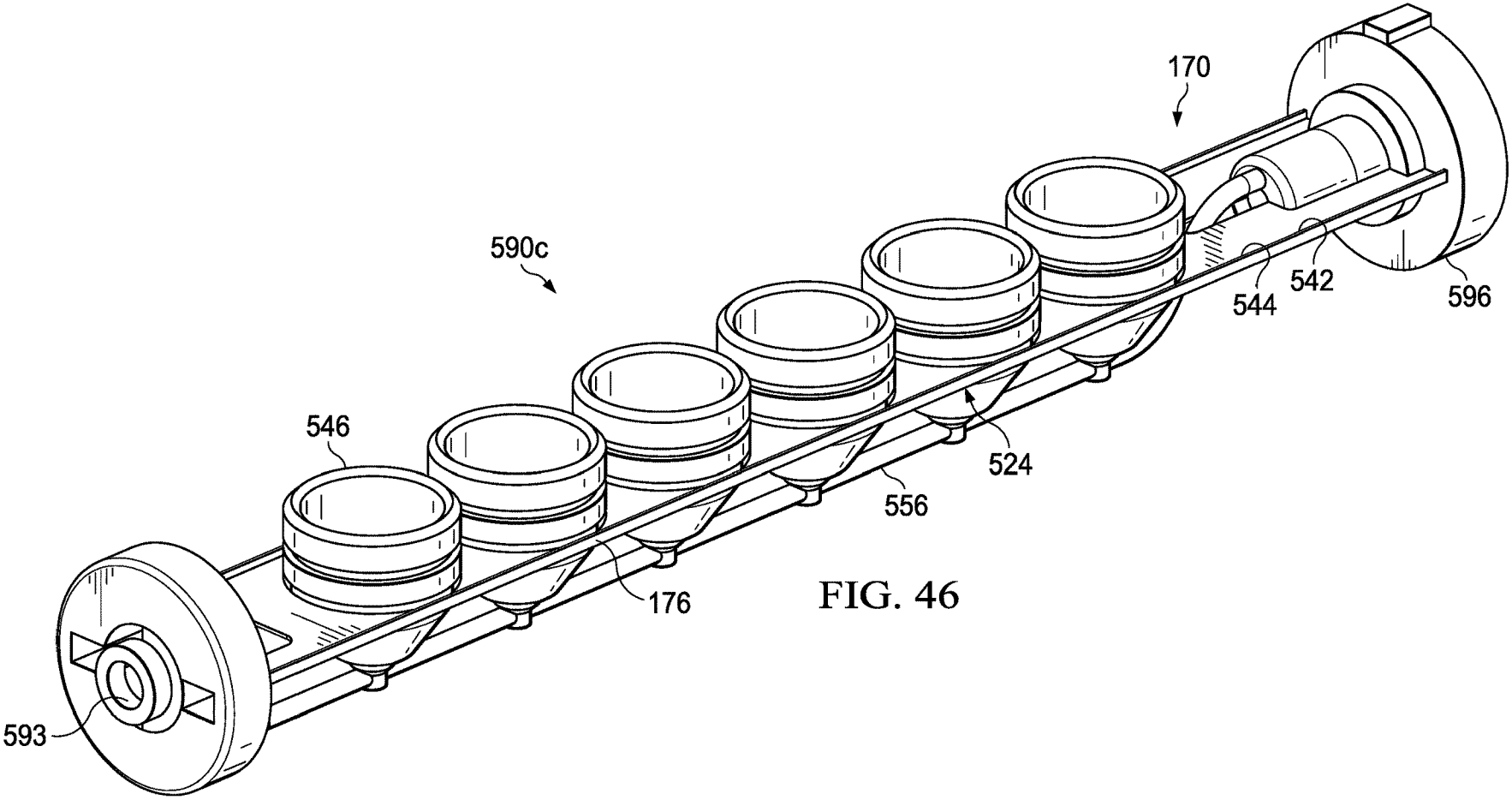
FIG. 46 illustrates shaped charges within a charge holder, in accordance with embodiments of the present disclosure.
Figure 47:
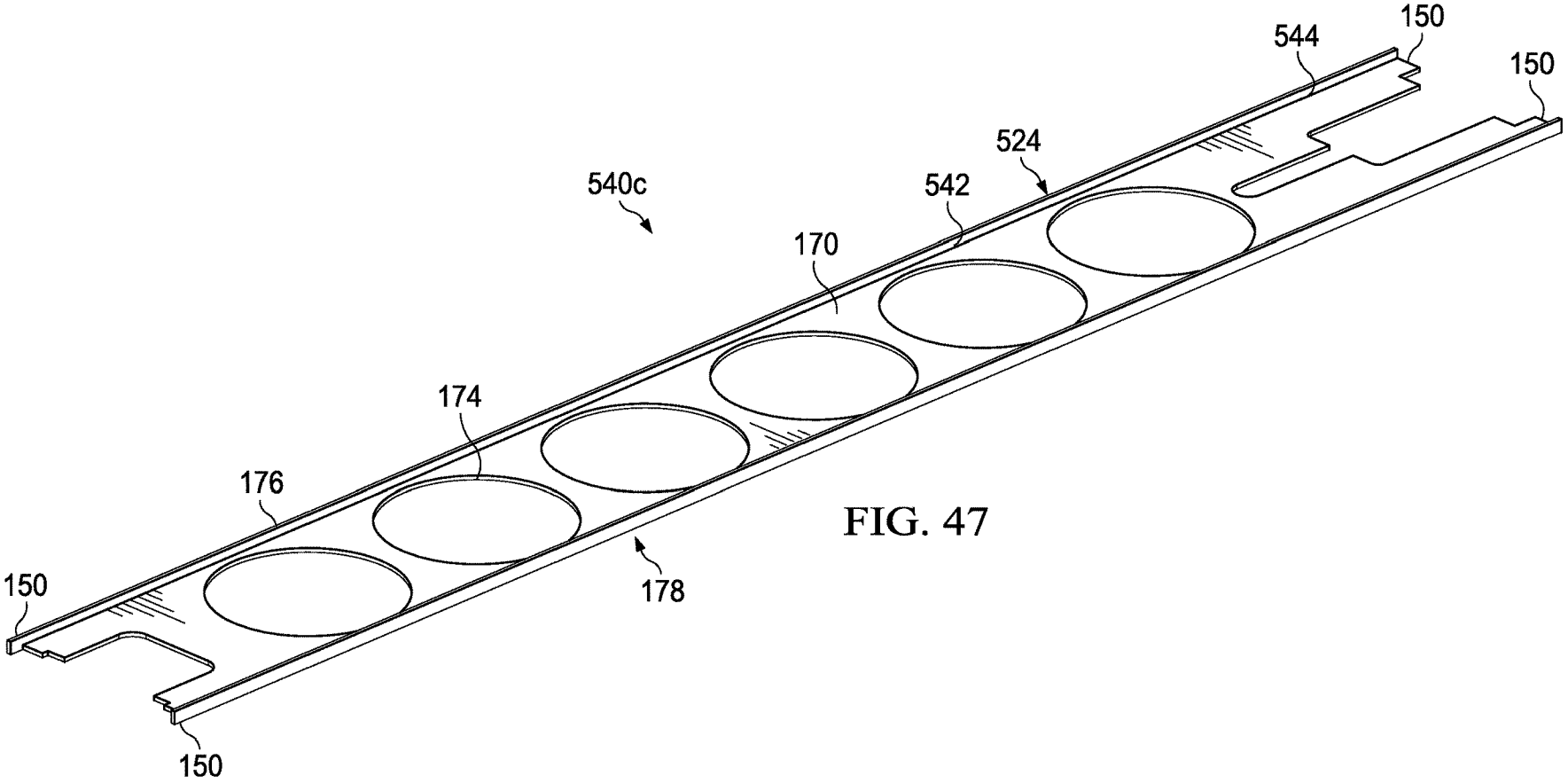
FIG. 47 illustrates a charge holder, in accordance with embodiments of the present disclosure.

Still referring to FIGS. 45-47, the charge plate 170 may have any suitable form, configuration and components. For example, the charge plate 170 may be pre-formed at a desired length, or custom cut-to-size as needed, such as from a large (e.g. 50'-100' long, etc.) roll or sheet of plate material (e.g. similar to the uses of extruded aluminum and Unistrut material in other industries). Likewise, the charge plate 170 may be pre-formed with charge holes 174, or custom-perforated as-needed to provide the desired number and location of charge holes 174.

Figure 50:
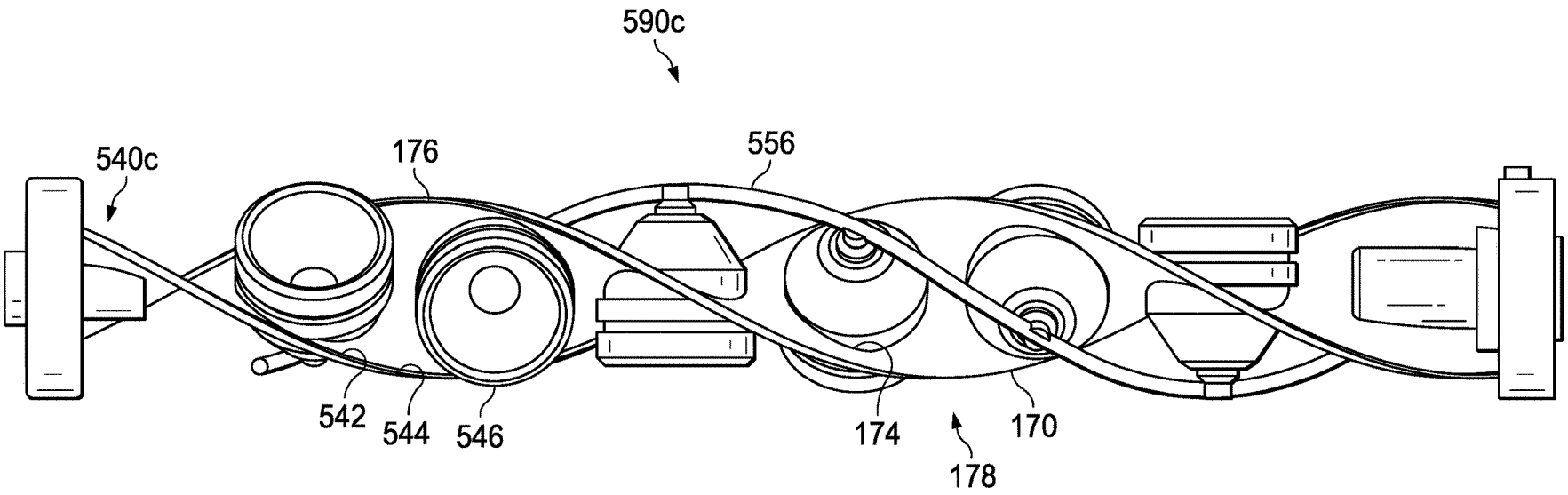
FIG. 50 illustrates a loaded curved charged holder, in accordance with embodiments of the present disclosure.
Figure 51:
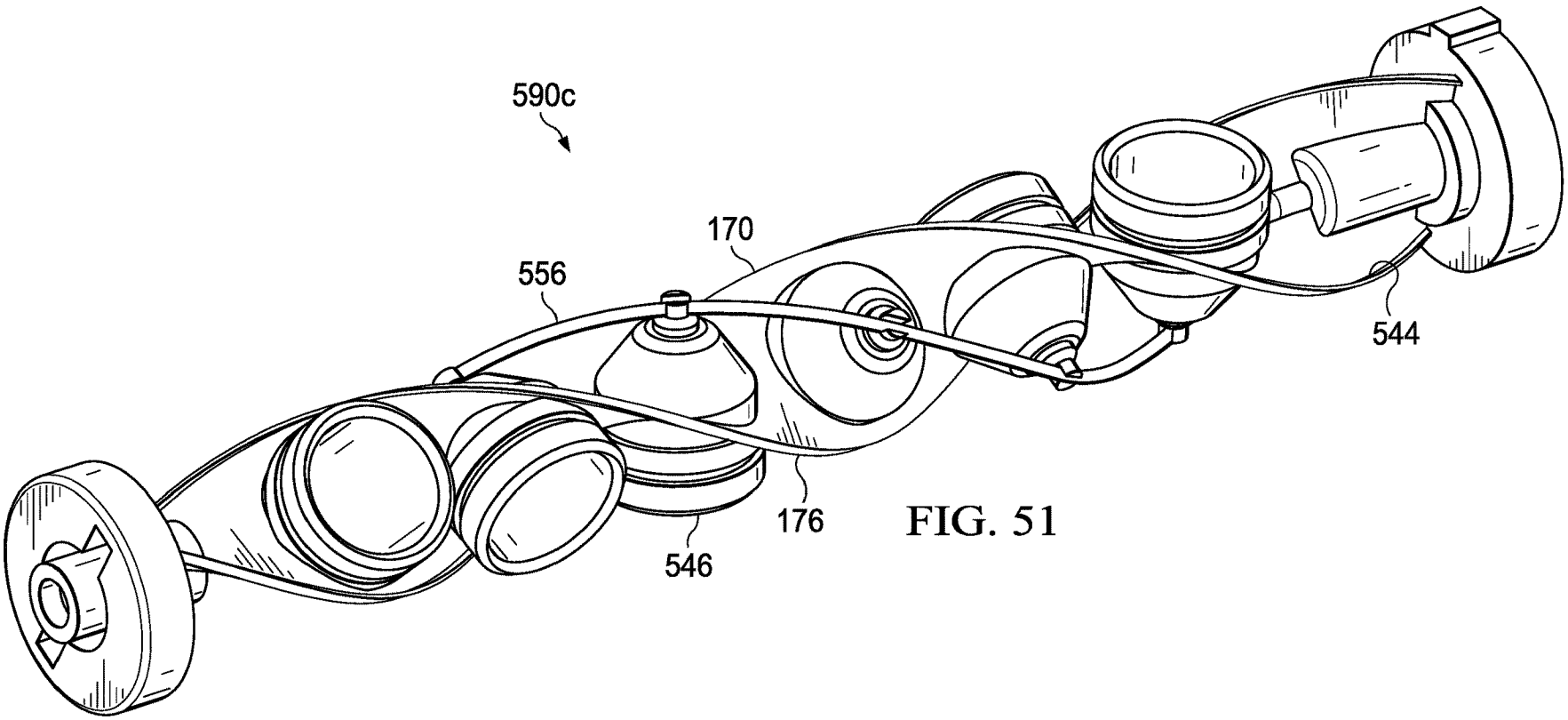
FIG. 51 a loaded curved charged holder, in accordance with embodiments of the present disclosure.

The charge plate 170 may also have any desired shape. In the present embodiment, the charge plate 170 has a rectangular, tray-like shape and includes an inwardly facing lip 176 extending down each side edge 178. The exemplary charge plate 170 may be flat (e.g. FIGS. 45-47), such as to position the explosives 546 to be carried thereby in the same plane, or curved (e.g. FIG. 50-52), such as to position the explosives 546 carried thereby at different angles and/or orientations).

Figure 48:
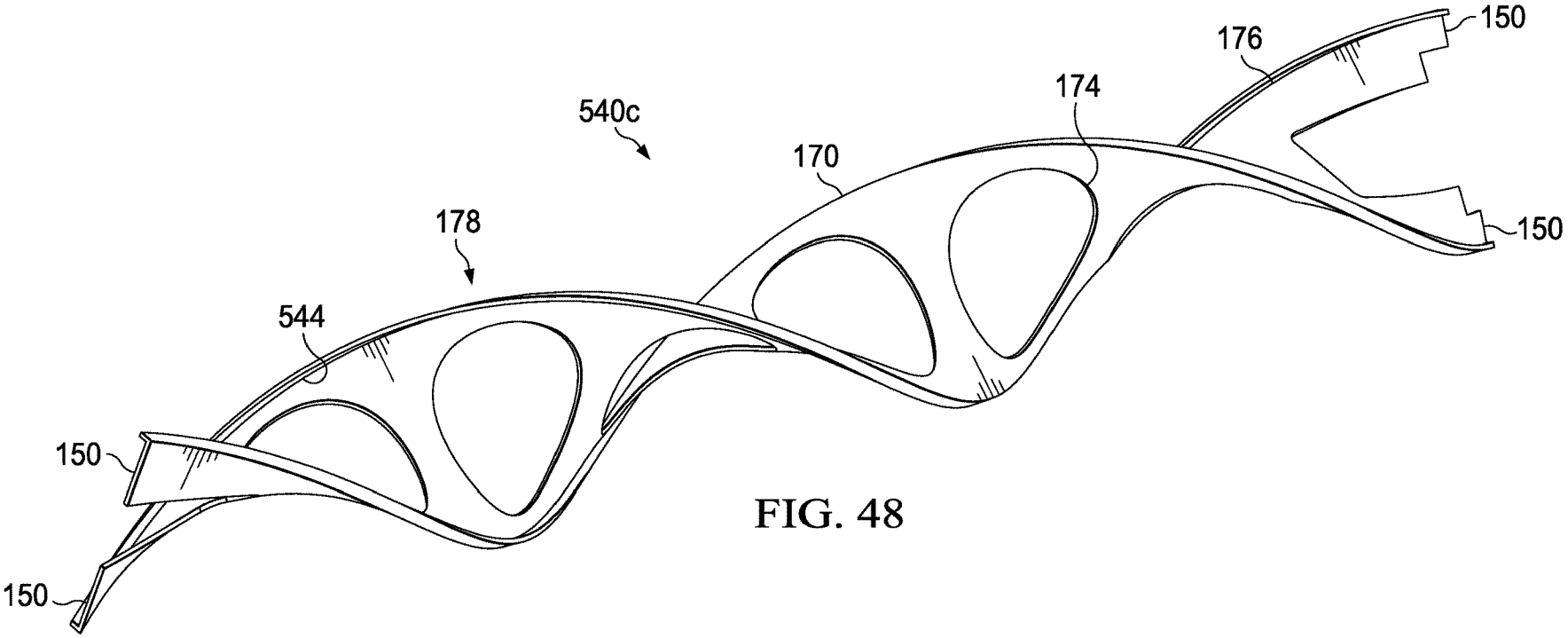
FIG. 48 illustrates a curved charge holder, in accordance with embodiments of the present disclosure.
Figure 49:
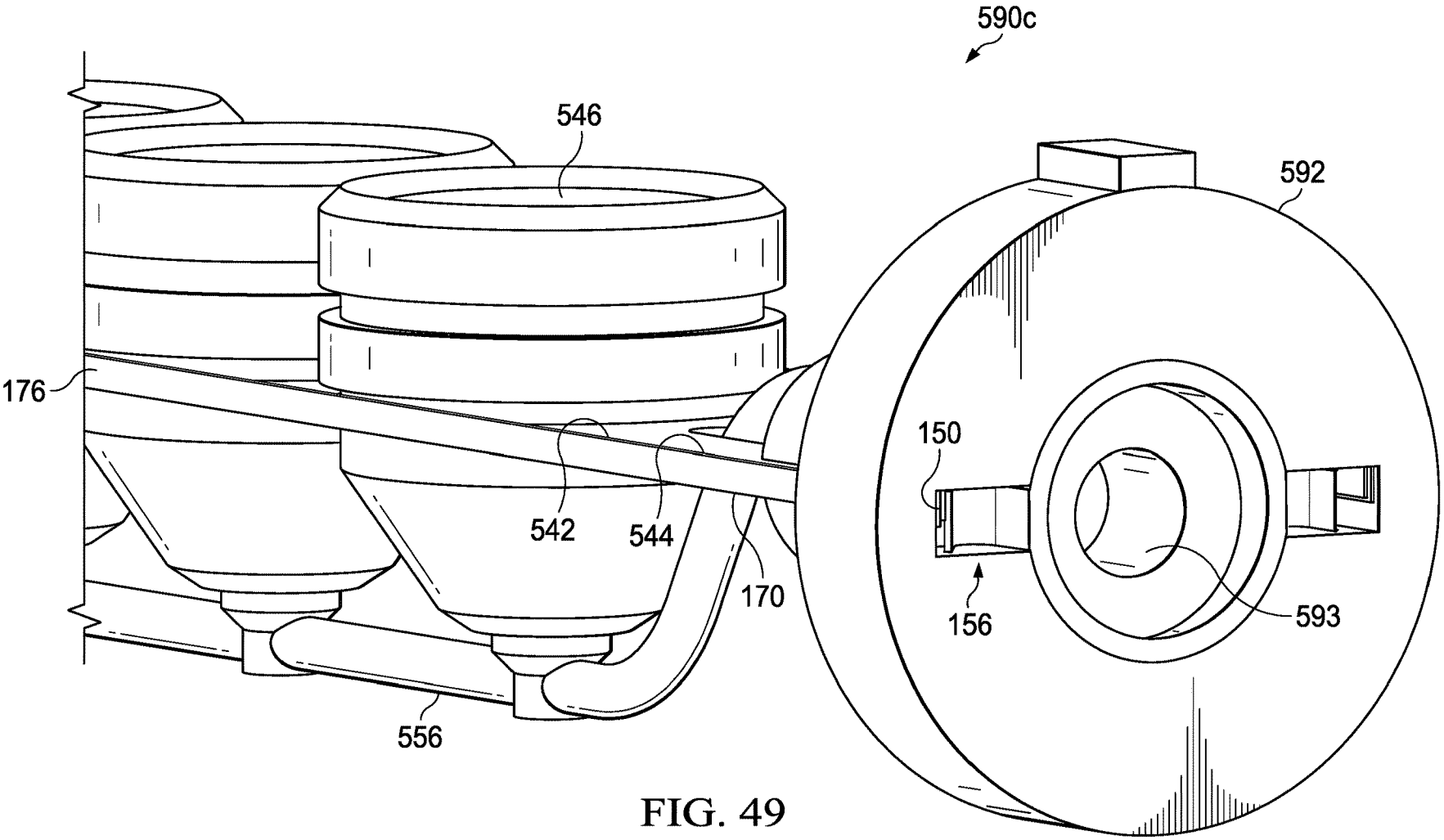
FIG. 49 illustrates an end fitting connected to the charge holder, in accordance with embodiments of the present disclosure.

If desired, the charge plate 170 may be formed of deformable (e.g. bendable, twistable, moldable, etc.) material that can be shaped or re-shaped, as-needed, to provide the desired explosive orientation and positioning for the perforating gun 516. In the present embodiment, the flat charge plate can be bent to form a curved charge plate. For example, referring to FIGS. 47 & 48, the charge holes 174 may first be punched or formed into the flat plate 170 or plate material, then the plate 170 selectively twisted or molded into a desired curved shape to form a curved charge plate with the desired respective angles/orientations for the charge holes 174 (and the explosives ultimately placed therein). In different embodiments, any suitable deformable material that is, or later becomes known to be, capable of retaining a desired non-planar shape may be used to form the charge plate 170. For example, the plate 170 may be constructed of plastically deformable material, such as thermoplastic material (e.g. heated, bent and recured), bendable metal, nylon, cardboard or other material or material combinations. In some instances, the charge plate material may require a certain amount of over-bending or over-molding due to spring-back to arrive at the desired final shape and orientation of charge holes 174.

Referring to FIGS. 45-52, in some instances, it may be desirable to construct the plate 170 at least partially of insulative material to form a non-conductive, or insulator, charge holder 540*c* (e.g. as described above). However, the present disclosure is not limited by the type of material, configuration or method of forming the charge plate 170.

If desired, the inner body conductor 542, such as the through-connector 544 (e.g. as described below), may be pre-applied to the pre-formed plate 170, or the roll or sheet of plate material, in advance to save on the time, labor and expense of wrapping wire (or other types of) inner body conductor 42 during assembly of the gun 516, for any other reason or a combination thereof.

When included, the charge plate 170 may be secured in the gun 516 in any suitable manner. For example, the charge plate 170 form of charge holder 540 may be releasably, mechanically engaged with and carried by the end fitting 592, 596 similarly as described above. In the present embodiment, referring to FIGS. 47 & 48, each charge plate 170 is shown including one or more fingers 150 that engage respective aligned receiving slots 156 (e.g. FIG. 49) in the associated end fitting 592, 596. In this example, the fingers 150 are not twist-locked to the end fittings 592, 596, but engaged with an interference fit. If desired, multiple sets (not shown) of receiving slots 156 may be formed in each end fitting 592, 596 to provide different anchor locations for the charge plate 170. However, the charge plate 170 could be secured in the gun 516 in any other manner, such as with bolts, mateable features (e.g. one or more detents in end fitting 592, 596 and one or more slots in the charge plate 170, etc.), combined charge holder assembly 590*c* interference fit into carrier 530.

Charge plates 170 may be used for any suitable reason. For example, the use of charge plates 170 may allow simplification and improved durability and reliability of the inner body conductors 542 and the use of a non-wired inner body conductors 542 (e.g. through-connectors 544 as described below), custom design of the charge holder 540, improved efficiency and flexibility in the manufacture and assembly of the gun 516, improved effectiveness in use of the gun system 510, simplification of materials supply sourcing, the ability to accommodate last minute instructions from the user, for any other purposes or a combination thereof. In some embodiments, the charge plates 170 may be custom designed at the job site, field location or staging area (e.g. to accommodate last minute user specifications, provide as-needed perforating guns 516, etc.).

Referring again to the embodiments of FIGS. 37 & 44, in accordance with various distinct independent aspects of the present disclosure, electric current may be transmitted through the inner body conductor 542 along at least part of the length of the gun 516 (e.g. gun 516*a* generally from its upper to its lower ends 520, 522) to ultimately provide electric current to the detonator 550 of that gun 516*a* and to at least the next successive gun (e.g. 516*b*) in the gun system, for any other purpose(s) or a combination thereof. The inner body conductor 542 may have any suitable form, configuration, location, components and operation. In some embodiments, the inner body conductor 542 may be in the traditional form of insulated wires (not shown) or incorporate one or more wires, may be associated with the charge holder 540, any other suitable component or may itself form an independent component extending through the desired length of the gun 516.

In the present embodiment, the inner body conductor 542 includes one or more through-connectors 544. The through-connector 544 may have any suitable form, configuration, material construction, orientation and placement. The through-connector 544 may be fixed-in-place (e.g. applied to, embedded or formed in the charge holder 540), formed in a substantially straight orientation or in any desired pattern, continuous or non-continuous and may or may not include insulating material. For example, the through-connector 544 may not need to include insulating material when sufficiently insulated (e.g. from shorting) by one or more other components. In the present embodiment, the through-connector 544 does not include insulating material when used with the insulator charge holder 540*c* (which sufficiently insulates the through-connector(s) 544).

Still referring to FIGS. 37 & 44, the through-connector 544 may be applied to, formed into or onto or otherwise associated with the charge holder 540 (or other component) in any suitable manner and, if desired, in advance and prior to assembly of the gun 516. In the present embodiment, the through-connector 544 is a single conductive trace extending down the ID of the illustrated cylindrical insulator charge holder 540*c*. In other embodiments, the through-connector 544 may be run at least partially down the OD of the charge holder 540 or at any other suitable location. For example, when the charge holder 540 includes one or more charge plates 170 (e.g. FIGS. 45-47), the through-connector 544 may be provided at a known location (e.g. along the inside of an inwardly facing lip 176 on one or both side edges 178) to align it with other electrical components 524 it will engage when the gun 516 is assembled. In the present embodiment, the through-connector 544 is pre-applied to the roll or sheet of tray-like material as a specified location, the material is then cut to size to form the charge plate 170, the charge holes 174 are then punched or cut therein and, if necessary, the plate 170 is bent or molded into the desired shape. Thereafter, the explosives 546 can be dropped in and the plate 170 inserted into the carrier 530.

The use of through-connectors 544 can provide one or more advantages, such as eliminating the time and labor intensive effort and expense in assembling and connecting other forms of inner body conductors 542 (e.g. wrapping wire-type inner body conductors 542 around charge holders 540) and eliminating potential reliability issues, assembly errors and equipment failure events that can occur therewith (e.g. steel charge holders 540 nicking and damaging wire-type inner body conductors 542, assembly errors), saving on the need for and cost of steel charge holders 540 and the associated costs and safety and other problems associated with manufacturing, shipping and handling steel charge holders 540, better conservation and management of raw materials by avoiding the need for steel charge holders 540, any other benefits or a combination thereof.

The use of through-connectors 544 on charge plates 170 may provide the above and/or additional benefits. For example, providing the through-connector 544 along the same pre-defined path on the charge plate 170 may eliminate the need to plan out placement of the inner body conductor 542 for different variations of phasing and orientation of shaped charges 546 to be used in different guns 516. In the present embodiment, after the exemplary charge plate 170 (with one or more through-connectors 544 provided thereon) is selectively twisted into a non-planar shape, the twist will both route the through-connector 544 and orient the shaped-charges 546 as desired, eliminating the need to independently determine where the inner body connector 542 (e.g. wire) should be routed (for each different configuration of shaped-charges 546 or each gun 516).

Figure 54A:
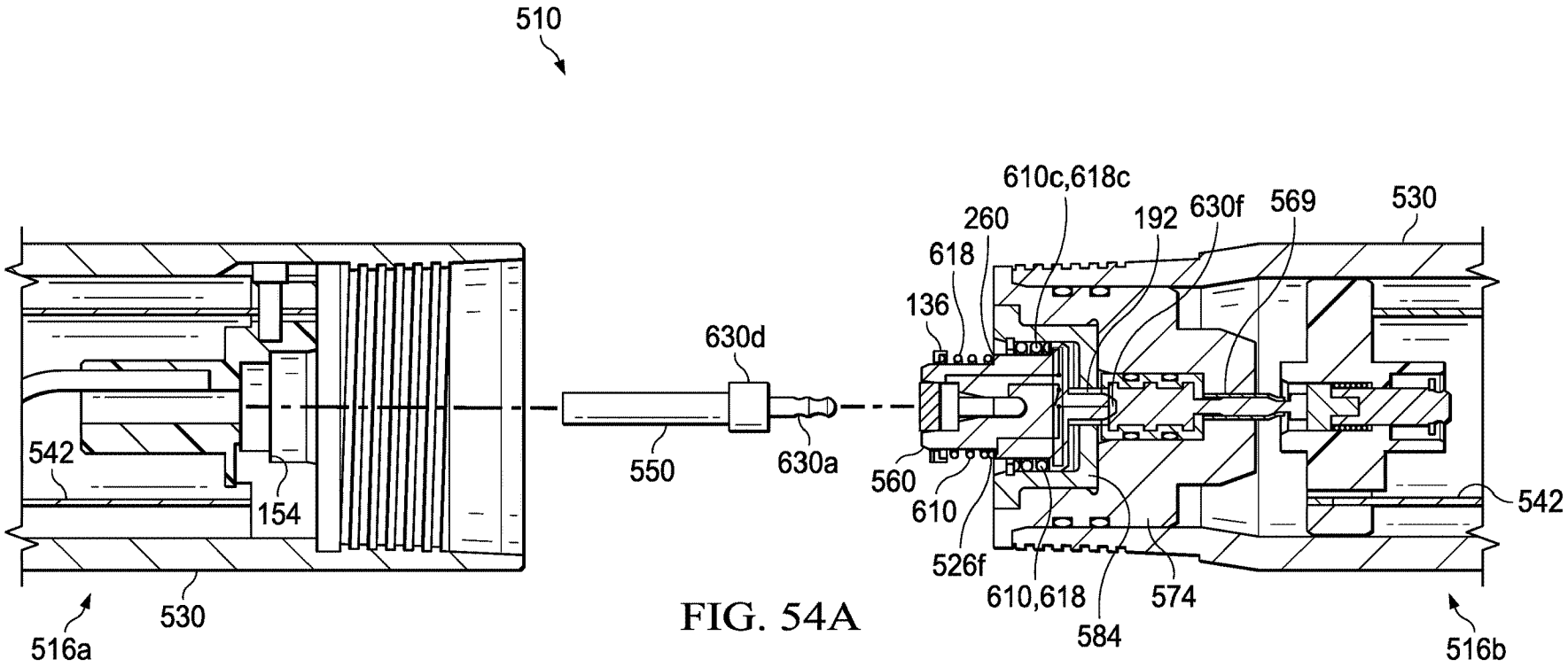
FIG. 54A illustrates the connection between two perforating guns, in accordance with embodiments of the present disclosure.
Figure 54B:
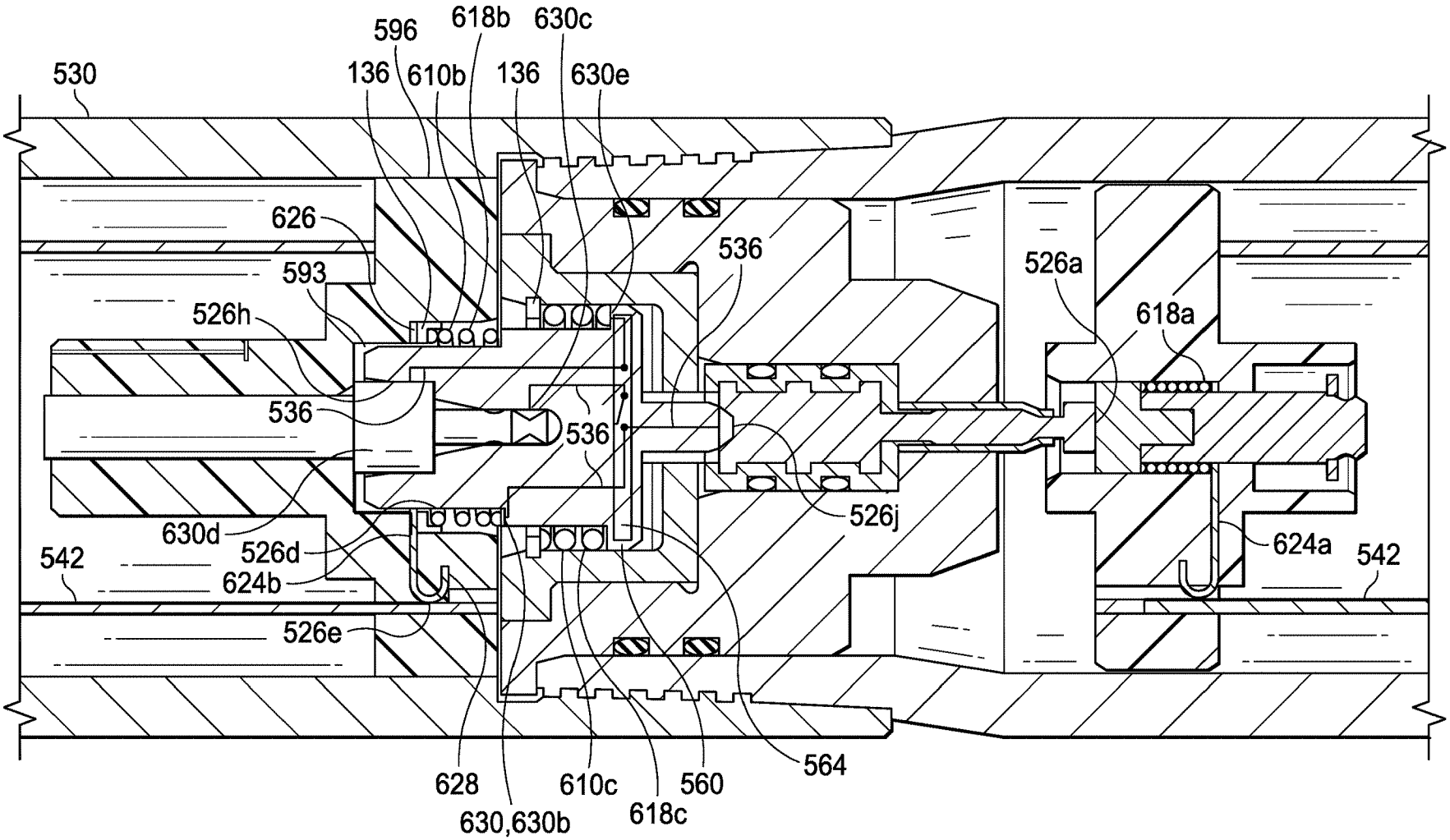
FIG. 54B illustrates the connection between two perforating guns, in accordance with embodiments of the present disclosure.

Referring now to the embodiment of FIGS. 54A-B, in accordance with other distinct independent aspects of the present disclosure, electric current may be transmitted to the switch 560, detonator 550, next successive gun 516, other components or a combination thereof in any suitable manner. For example, the inner body conductor 542 may transmit electric current to the switch 560 that actuates the detonator 550 of that gun 516 (e.g. gun 516*a*) and to the next successive gun 516 (e.g. gun 516*b*) or other component in the gun system 510 in any suitable manner and with any desired components.

In this embodiment, one or more intermediate conductors 618 (a.k.a. the second intermediate conductor 618*b*) may be disposed between the inner body conductor 42 and switch 560 to allow electric flow therebetween. This intermediate conductor 118 may have any suitable form, configuration, components, construction and operation. For example, the second intermediate conductor 618*b* may be a conductive spring 610 (a.k.a. the second contact spring 610*b*) electrically coupled, at or proximate to its uphole end, to the inner body conductor 542 and to one or more conductive contacts 630 of the switch 560 (a.k.a. the first conductive contact 630*b* of the switch 560) at or proximate to its downhole end (e.g. at conductive interface 526*f*).

Still referring to FIGS. 54A-B, the exemplary second contact spring 610*b* may be electrically coupled between the inner body conductor 542 and switch 560 in any suitable manner. In the present embodiment, the second contact spring 610*b* is a helical, or coil, spring but may take any other form (e.g. radial wave spring, biased sleeve). The illustrated spring 610 is axially-oriented in the gun 516 (e.g. inside the central bore 593 of the end fitting 596) and radially inwards of the inner body conductor 542. At its downhole end, the exemplary spring 610*b* is biased into electrical contact with the first conductive contact 630*b* of the switch 560. At its uphole end, the illustrated spring 610*b* is biased against and electrically contacts an intermediate electrical connector 624 (a.k.a. the second intermediate electrical connector 624*b*), which electrically contacts the inner body conductor 542. Thus, the conductor 618*b* (e.g. spring 610*b*) pushes or is pushed in both axial directions to assist in forming a reliable electrical connection between the inner body conductor 542 and switch 560. However, in other embodiments, the second contact spring 610*b* (or other form of second intermediate conductor 618*b*) could directly contact the inner body conductor 542 to allow the flow of electric current therebetween. Accordingly, the second intermediate conductor 618*b* could have any other form, configuration, location, and operation.

Referring still to FIGS. 54A-B, when included, the second intermediate electrical connector 624*b* may have any suitable form, configuration, location and operation. In this example, the second intermediate electrical connector 624*b* extends between the spring 610*b* and the inner body conductor 542 at respective fourth and fifth conductive interfaces 526*d*, 526*e*. The illustrated second intermediate electrical connector 624*b* is a shepherds-hook type connector (e.g. similar to the first intermediate electrical connector 624*a* as described above) and carried in the downhole end fitting 596. Similarly, this exemplary connector 624*b* includes a base, or ring, 626 (e.g. FIG. 53) configured to extend around the switch 560 in the central bore 593 of the end fitting 596 (or other component) and electrically contact the second contact spring 610*b*. At least one spring-biasable arm 628 is shown extending generally radially outwardly from the illustrated base 626 (e.g. through a slot (not shown) in the end fitting 596) and configured to electrically contact the inner body conductor 542. If desired, the connector 624*b* may abut a ledge 154 formed in the end fitting 596 and/or the illustrated arm 628 may be spring-biased radially outwardly to ensure effective electrical contact between the inner body conductor 542 and second intermediate conductor 618*b*. For example, when the exemplary charge holder assembly 590*c* is pushed into the carrier 530, the illustrated arm 628 may engage the inner body conductor 542 under friction to deflect it radially inwardly against its outward spring tension and thus assist in providing a robust and reliable electrical connection therebetween However, the second intermediate electrical connector 624*b* may have any other form (e.g. a piston and helical spring), configuration and location. And in other embodiments, the above-mentioned electrical components 524 may be not be at least partially housed in or associated with the downhole end fitting 596, but instead carried by or associated with any other component(s) of the gun system 510.

Referring still to FIGS. 54A-B, if desired, one or more additional electrical components 524 may be included at any desired location(s) in the electric flow path between the inner body conductor 542 and switch 560. For example, one or more wire-free, conductive spring retainers, or rings, 136 may be disposed between the intermediate conductor 618*b* and the intermediate electrical connector 624*b* and/or the first conductive contact 630*b* of the switch 560. Also, all or any combination of the second intermediate conductor 618*b*, second intermediate electrical connector 624*b*, first conductive contact 630*b* of the switch 560 and other electrical components 524 in this electrical flow path may be non-wired and form wire-free conductive interfaces 526 therebetween. In the embodiments herein, they are all wire-free. However, any other form, combination, configuration and location of components (or a single conductive component) may provide to electrically couple the inner body conductor 542 and associated switch 560.

Referring now to FIG. 54A-56, in other distinct independent aspects of the present disclosure, electric current may be provided to the detonator 550 in any suitable manner. For example, an electric circuit may be provided to the detonator 550 via the switch 560. In the illustrated embodiments, the switch 560 includes one or more conductive contacts 630 (a.k.a. the second conductive contact 630*c* of the switch 560) configured to be electrically coupled with one or more conductive contacts 630 of the detonator 550 (a.k.a. the first conductive contact 630*a* of the detonator 550) at one or more conductive interfaces 526*g* to provide electric current to the detonator 550 (e.g. controlled via switch functionality of the PCB 564). The exemplary switch 560 includes another conductive contact 630 (a.k.a. the third conductive contact 630*e* of the switch 560) configured to be electrically coupled with one or more conductive contacts 630 of the detonator 550 (a.k.a. the second conductive contact 630*d* of the detonator 550) at one or more conductive interfaces 526*h* to complete the circuit and, if desired, ground (e.g. as described below) the switch 560 and detonator 550. Depending upon the embodiment, some, all or none of the conductive contacts 630*a-f* and/or the conductive interfaces 526*f*, 526*g* may be wired or wire-free. In the present embodiments, they are all wire-free.

When included, the first and second conductive contact 630*a*, 630*d* of the detonator 550 may have any suitable form, configuration, construction and location. In FIGS. 54A-B, for example, each conductive contact 630*a*, 630*d* of the detonator 550 includes one or more metallic patch, ring, or band extending at least partially around the detonator 550. For another example, in FIGS. 55-56, the first conductive contact 630*a* of the detonator 550 includes one or more metallic pad, cap or tab at, or proximate to, the downhole end of the detonator 550, while the second conductive contact 630*d* includes one or more metallic patch, ring, or band extending at least partially around the detonator 550. For a further example, either or both contacts 630*a*, 630*d* may include a bow spring seated in and extending radially out of a receptacle (e.g. like used in vehicle cigarette lighters or cellphone charger).

Referring again to FIGS. 54A-56, the corresponding respective pairs of conductive contacts 630*c*, 630*e* of the exemplary switch 560 and conductive contacts 630*a*, 630*d* of the detonator 550 may be electrically connected in any suitable manner. For example, the respective conductive contacts 630*c* & 630*a* may directly contact or engage one another and the conductive contacts 630*e* & 630*d* may directly contact or engage one another when the gun 516 is assembled. In the present embodiments, the respective pairs of contacts 630 abut and electrically contact one another when the switch 560 and detonator 550 are mated together. The illustrated detonator 550 is shaped like a plug and the exemplary switch 560 is shaped like a jack (e.g. similar to an audio plug-jack connection) to form the electrical circuit when the switch 560 is pushed onto the detonator 550 or vice versa. However, any other suitable form (e.g. ball/socket) of electrical connection between the switch 560 and detonator 550 may be used. In some embodiments, one or more intermediate electrical components 524 may be provided between either or both respective pairs of contacts 630 of the switch 560 and detonator 550. In yet other embodiments, electric current may be provided to the detonator 550 from another component, such as the inner body conductor 542.

Figure 55:
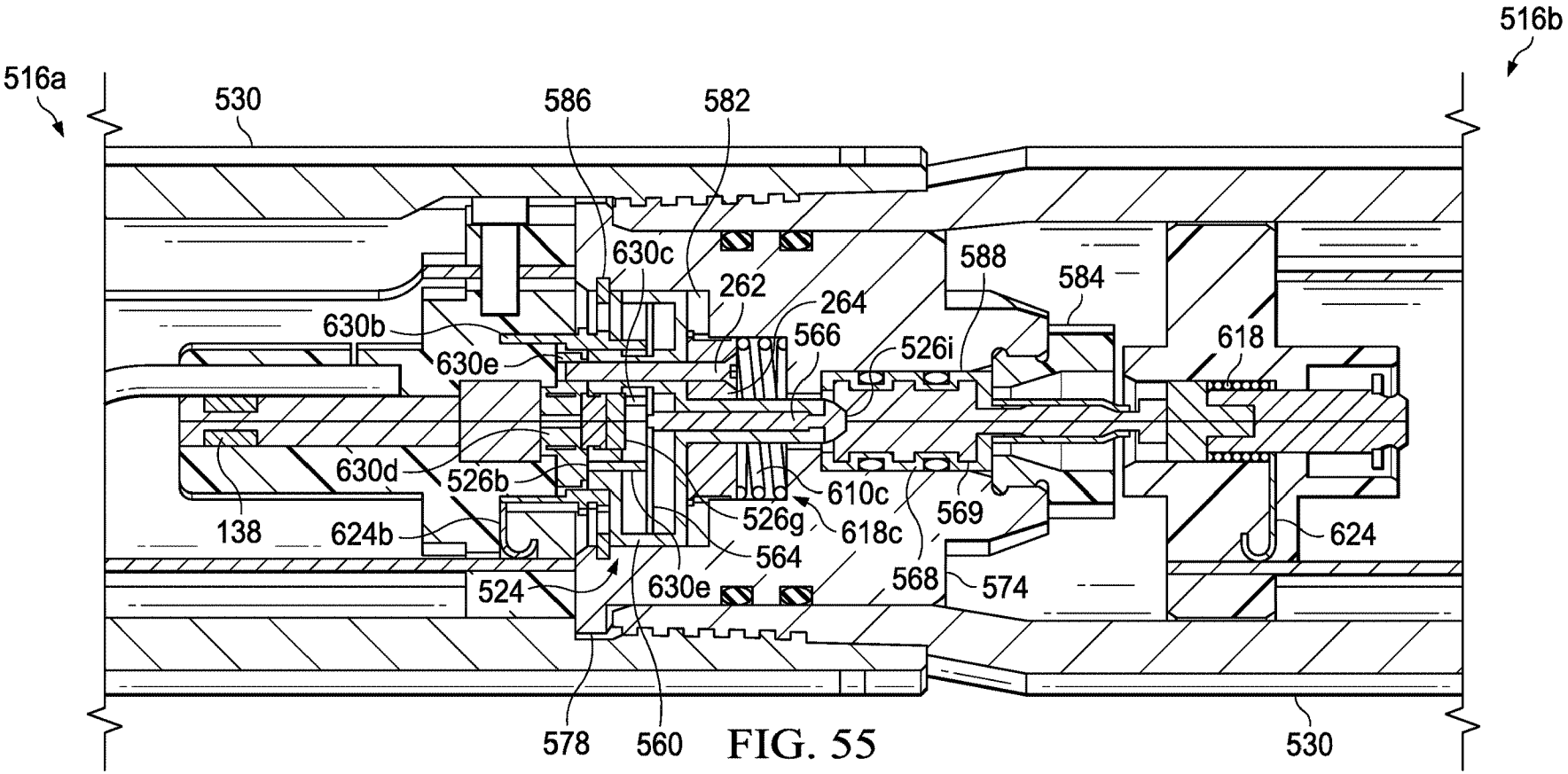
FIG. 55 illustrates the connection between two perforating guns, in accordance with embodiments of the present disclosure.
Figure 56:
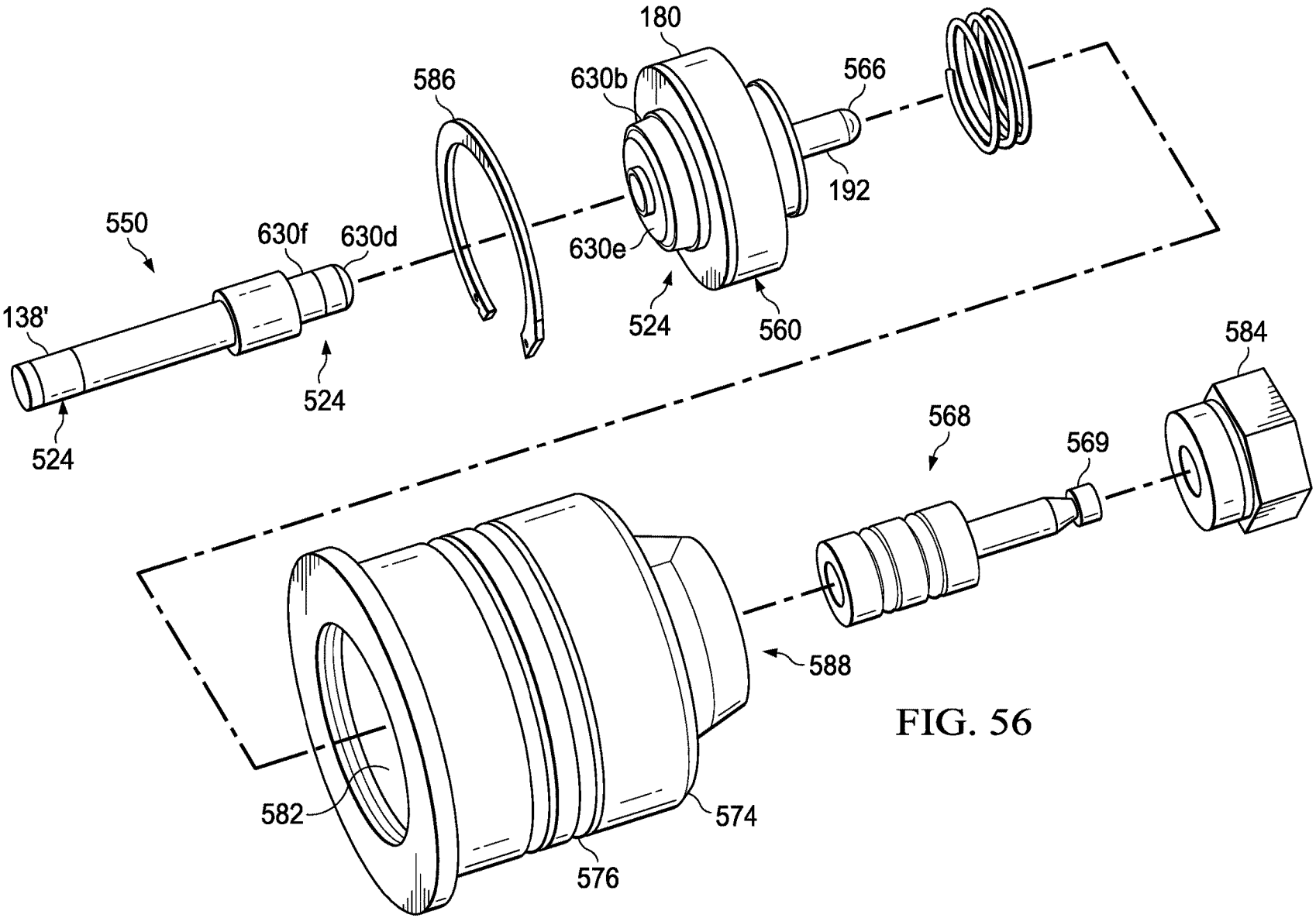
FIG. 56 is an exploded view of the downhole end of a perforating gun, in accordance with embodiments of the present disclosure.
Figure 57:
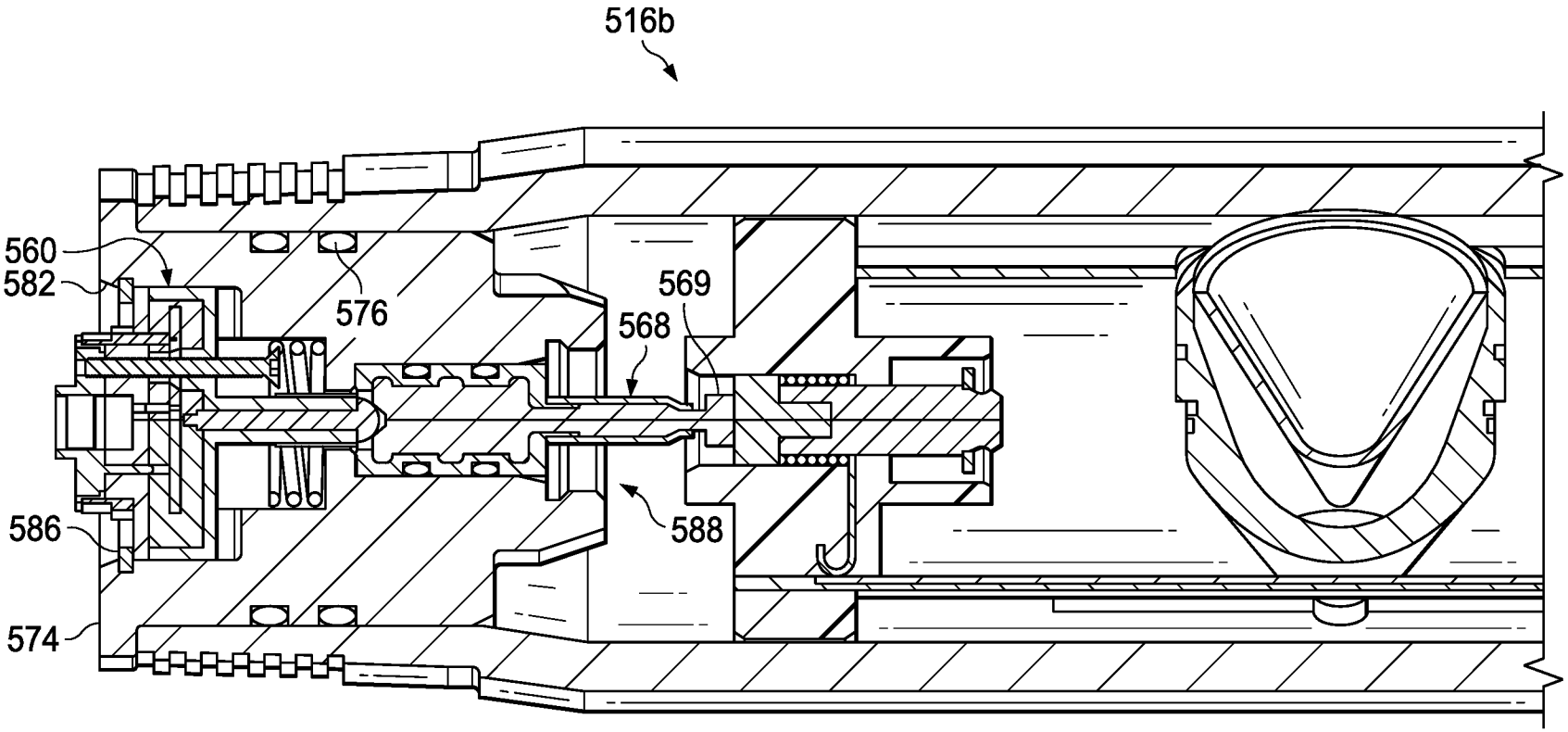

Referring to FIGS. 55 & 56, electric current may be transmitted to the next successive gun 516 (e.g. gun 516*b*) and/or other downhole components in any suitable manner. For example, electric current may be provided from the switch 560 to the feedthrough 569 and controlled via switch functionality of the PCB 564. In this embodiment, the switch 560 includes one or more switch conductors 566 configured to transmit electric current to the feedthrough conductor(s) 569 at one or more conductive interfaces 526*h*. The illustrated switch conductor 566 has an at least partially ball-shaped downhole end, while the feedthrough conductor 569 has an at least partially corresponding socket shaped uphole end to form a wire-free, ball-socket type conductive interface 526*i*.

In the embodiment of FIGS. 54A-B, the switch 560 instead includes at least one conductive contact 630 (e.g. the fourth conductive contact 630*f* of the switch 560) at or proximate to its downhole end for electrically contacting the feedthrough conductor 569. For example, one or more conductive traces 536 could be provided in the switch 560 to electrically couple the PCB 564 with the contact 630*f*. However, any other suitable form (e.g. plug-jack connection) of electrical connection between the switch 560 and feedthrough 568 may be used. In some embodiments, one or more intermediate electrical components 524 may be provided in the electrical path between the switch 560 and feedthrough 568. In yet other embodiments, electric current may be provided from another component, such as the inner body conductor 542, to the feedthrough 568 (or other component) to provide electricity in the downhole direction. Depending upon the embodiment, any desired combination of the switch conductor 566 or conductive contact 630*f*, feedthrough conductor 569, conductive interface 526*i* and the electric flow path between the gun 516*a* and feedthrough 568 may be wire-free. In the present embodiments, they are all wire-free.

Figure 58:
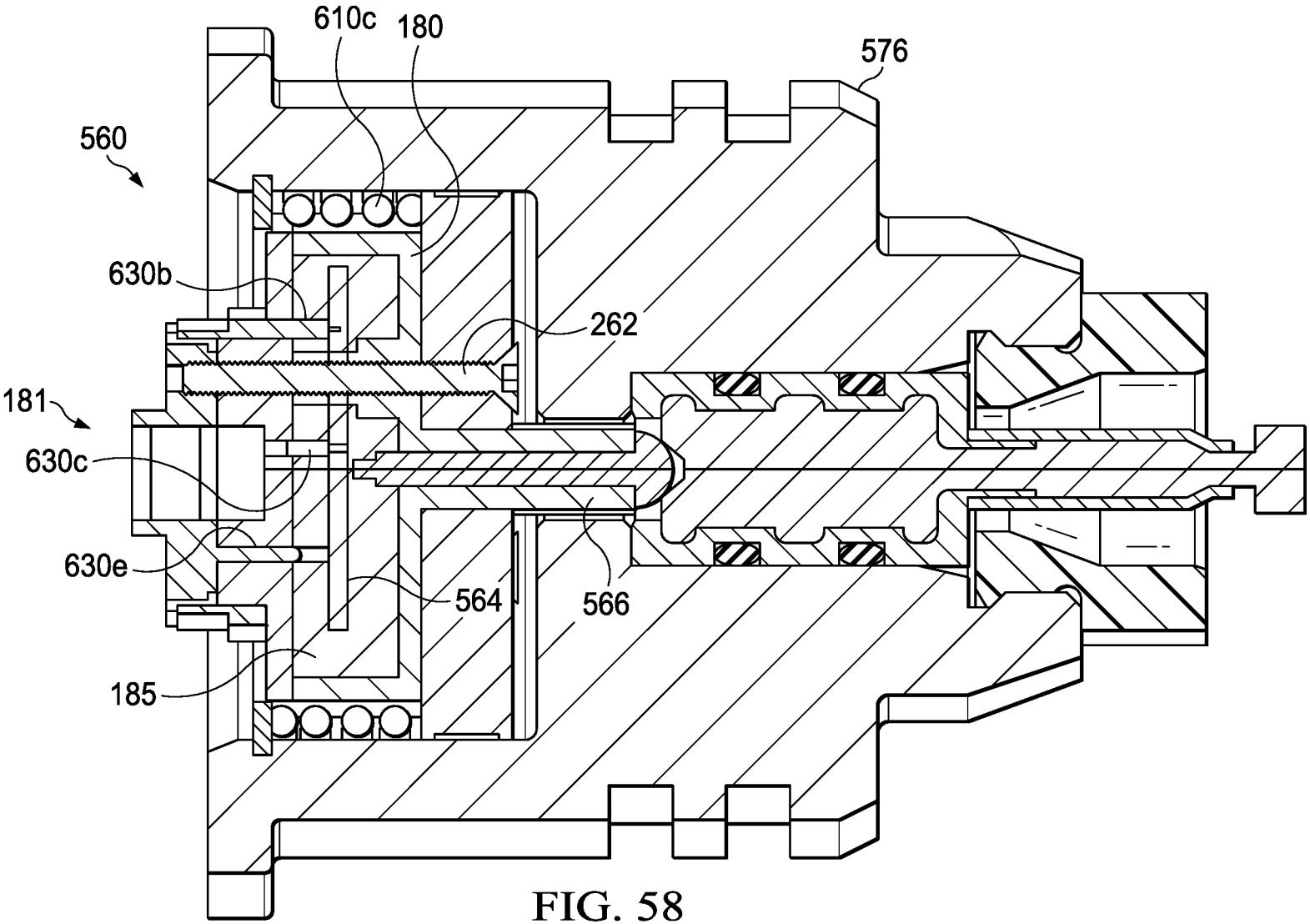
Figure 59:
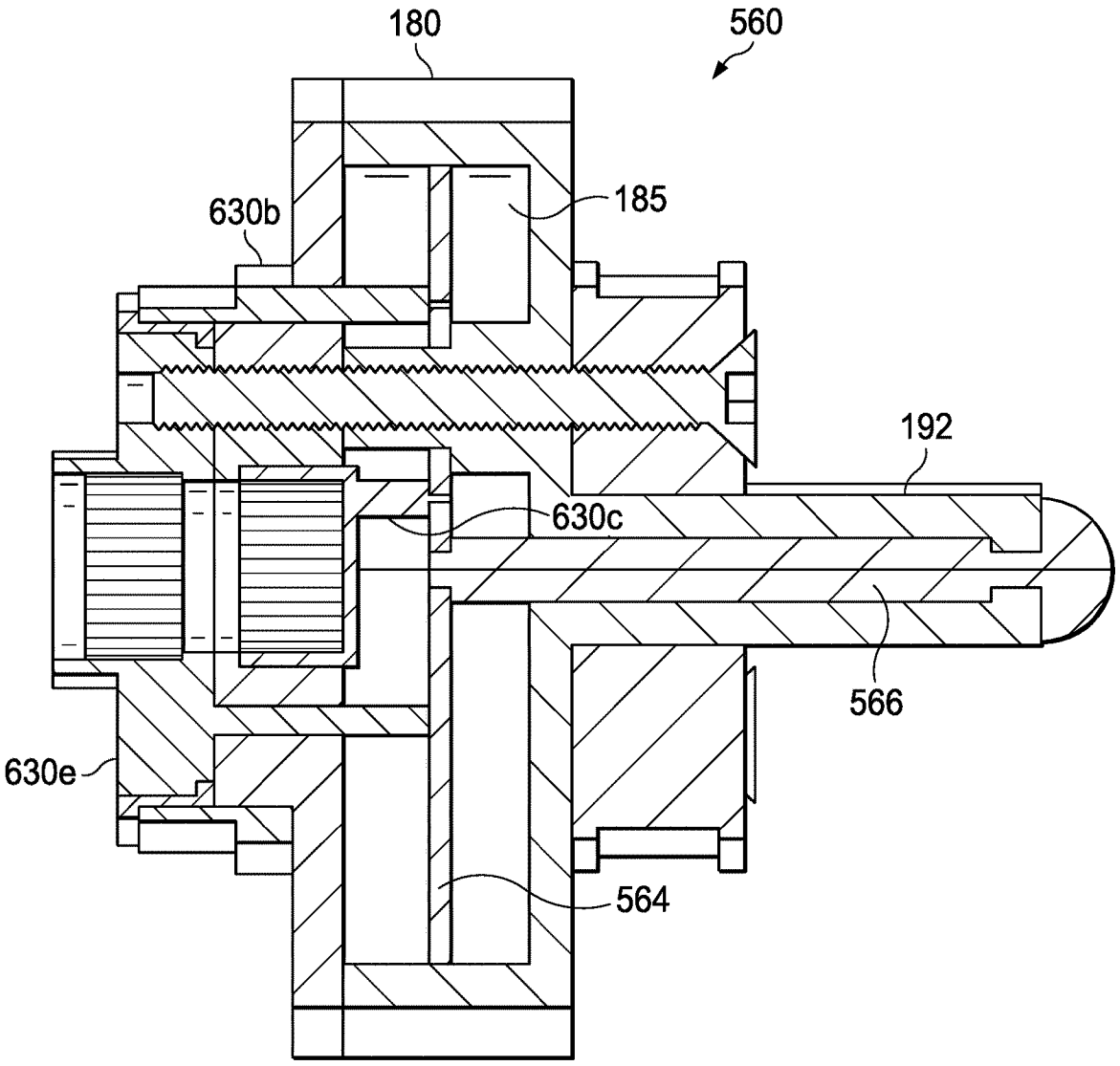
Figure 61:
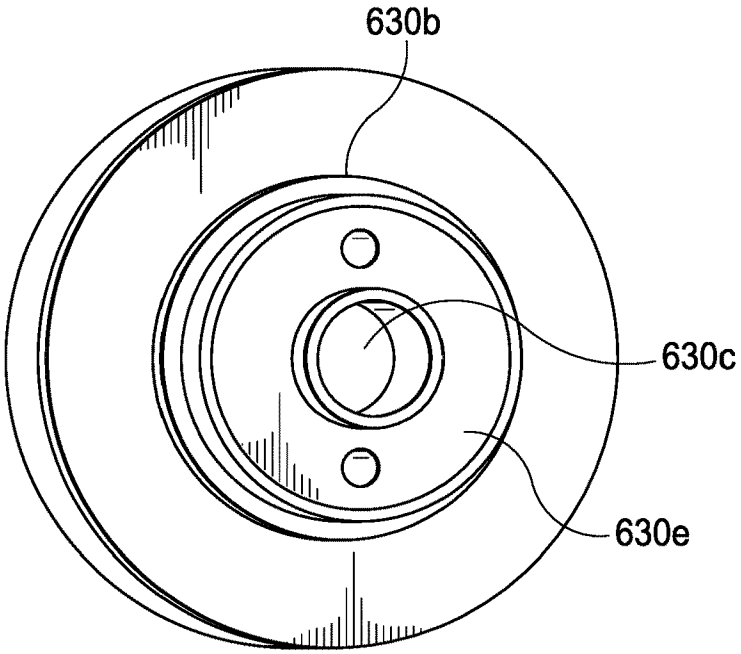
Figure 60:
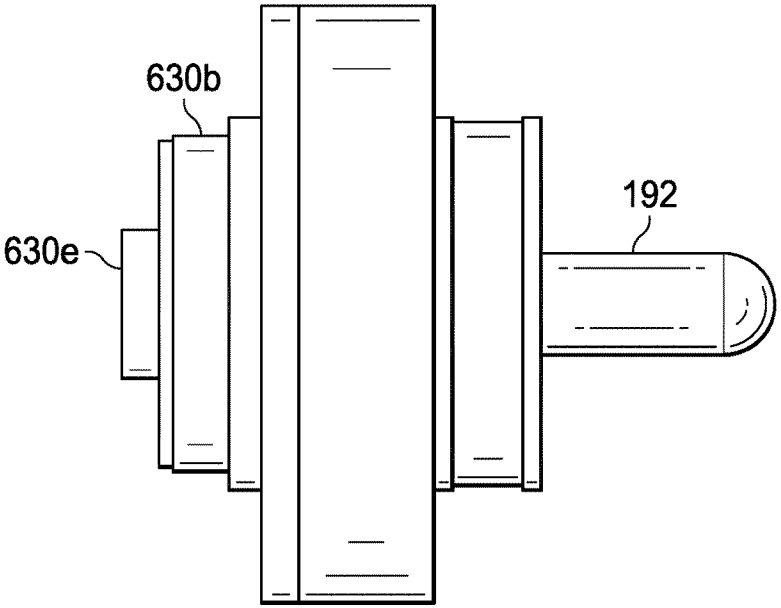

Referring now to FIGS. 58 & 59, in other distinct independent aspects of the present disclosure, the switch 560 may have any suitable form, configuration, components, construction and operation. In the illustrated embodiments, the switch 560 has a generally circular cross-sectional shape and, along with the PCB(s) 564 therein, faces uphole and downhole to optimize the use of space inside the cylindrical carrier 530, allow the switch 560 to extend out radially so it can be wider and thinner (e.g. shorter in the axial direction) which can free up axial space in the gun 510 for more explosives 546 or reduce the length of the gun 516 (e.g. allowing a larger quantity of guns 516 in the gun system 510 per run, reducing time, cost, manpower etc.), allow easy and/or wire free engagement, and relative rotatability, of the switch and detonator 550, for any other purpose(s) or a combination thereof. However, in other embodiments, the switch 560 may have any other cross-sectional shape (hexagonal, square, rectangular, etc.), orientation or configuration. The exemplary switch 560 includes a generally circular central bore 181 extending partially therein from its uphole end and configured to mate with or fit over part of the detonator 550 (FIG. 56) when the gun system 510 is assembled.

In this embodiment, the switch 560 includes a housing 180 that contains and insulates the PCB(s) 564 and conductive contacts 630*b*, 630*c*, and 630*e* and switch conductor 566. For example, the housing 180 may be constructed at least partially of non-conductive material (e.g. plastic) and can include one or more insulators 185 (e.g. filler material, such as epoxy, non-conductive rings or plates, etc.) to insulate and/or absorb shock around the PCB 564, for any other purpose(s) or a combination thereof. If needed, the exemplary housing 180 can include a non-conductive sleeve 192 extending outwardly therefrom in the downhole direction to at least partially surround and insulate the switch conductor 566.

When included, the conductive contacts 630*b*, 630*c*, 630*e* may have any suitable form, configuration, construction, components, location and operation. Referring to FIGS. 60-63, the illustrated contacts 630*b*, 630*c*, 630*e* each include at least one conductive pin 182 and associated conductor ring 183. Each exemplary respective pin 182 extends from the PCB 564 in the uphole direction then engage the corresponding conductor ring 183. For another example, in other embodiments, any of the contacts 630*b*, 630*c*, 630*e* may be biased outwardly to help ensure reliable and effective electrical connection with the components they contact. In some embodiments, the contact 630 itself may be a spring, such as a bow spring (e.g. like used in vehicle cigarette lighters or cellphone charger) or biased outwardly by one or more other components.

Figure 64:
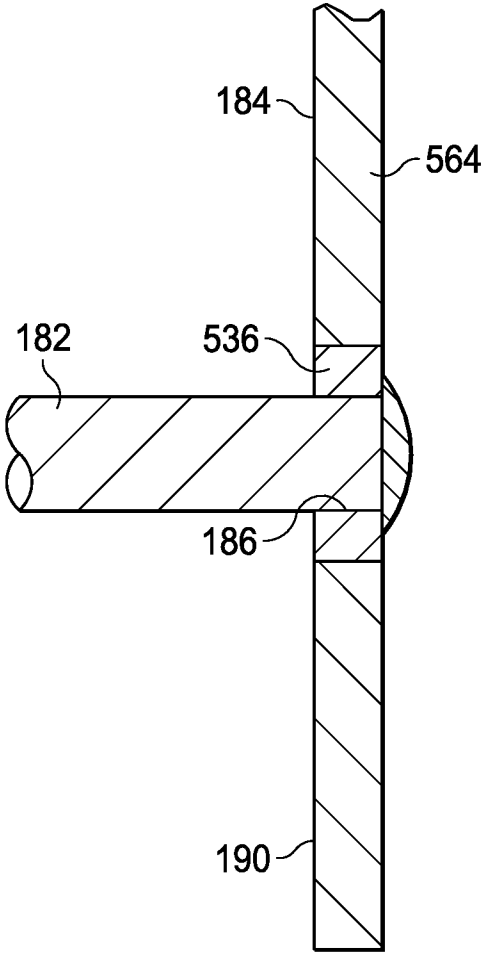
Figure 63:
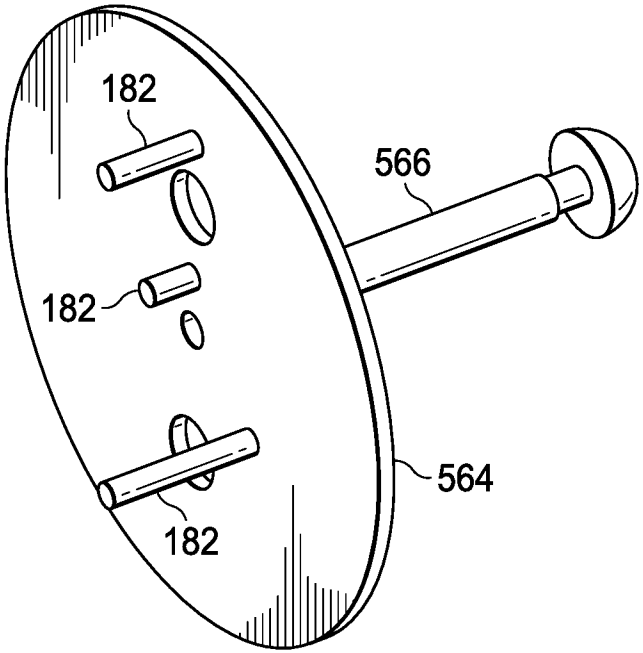

If desired, as shown in FIG. 64, each conductive pin 182 may extend outwards of the front face 184 of the PCB 564 from a corresponding hole 186 formed therein, contact one or more conductive traces 36 in the PCB 564 (e.g. that extends at least partially around the hole 186) and be soldered to the rear face 190 of the PCB 564 (e.g. similarly as in construction of semiconductor chips). Also if desired, the exemplary switch conductor 566 may engage the PCB 564 in the same manner but in the opposite direction. The exemplary switches 560 and PCB 564 are entirely wire-free, but in other embodiments the switch 560 and/or PCB 564 may include wires and have any other configuration of components.

In the embodiment of FIG. 54A-B, the conductive contacts 630*b*, 630*c* & 630*e* of the switch 560 are metallic rings, patches or bands electrically coupled with the PCB 564 with non-wired conductive traces 536. If desired, the conductive contact 630*b* may, for example, extend around a ledge 260 of the switch 560 and conductive contacts 630*c* & 630*e* may extend at least partially around the ID of the central bore 181 of the switch 560 to help provide strong electrical connections, for any other purpose(s) or a combination thereof. The illustrated conductive contact 630*f* of the switch 560 is a conductive pad, cap or patch also electrically coupled with the PCB 564 with non-wired conductive traces 536 and may be provided at the distal end of the housing 180 (e.g. at or near the tip of the sleeve 192). Thus, in this embodiment, all the conductive contacts 630 of the switch 560 are electrically coupled to the PCB 564 via one or more insulated, non-wired conductive traces 536 formed or provided in the switch 560. However, the conductive contacts 630*b*, 630*c*, 630*e* & 630*f* may have any other form, configuration and location and may be electrically coupled to the PCB 564 with wires or in any other manner. For example, any of the contacts 630*b*, 630*c*, 630*e*, 630*f* may be biased outwardly to help ensure reliable and effective electrical connection with the components they contact. In some embodiments, the contact 630 itself may be a spring, such as a bow spring (e.g. like used in vehicle cigarette lighters or cellphone charger) or biased outwardly by one or more other components.

If desired, the switch 560 and detonator 550 may be configured to be rotatable relative to each other to allow them to be provided and tested separately from other, allow the guns 516 to be threadably interconnected for any other purpose(s) or a combination thereof. For example, the absence of any wired connections between the switch 560 and detonator 550, cylindrical shape of the detonator 550, shape, configuration and location of the conductive contacts 630*a*, 630*d* of the detonator 550 and conductive contacts 630*c*, 630*e* of the switch 560 or any combination thereof may help allow relative rotatability between these components. In FIG. 37, the exemplary conductive contacts 630*c*, 630*e* of the switch 560 include metallic rings, patches or bands that will electrically contact the ring-shaped conductive contacts 630*a*, 630*d* of the detonator 550 after rotation and engagement of the components. In FIG. 55, the exemplary conductive contacts 630*c*, 630*c* include conductor rings 183 that will electrically contact the ring-shaped conductive contacts 630*a*, 630*d* of the detonator 550 after rotation and engagement of the components. In another example, the contacts 630*c*, 630*e* of the switch 560 may each only include one or more pins 182 that will electrically contact the ring-shaped conductive contacts 630*a*, 630*d* of the detonator 550 after rotation and engagement of the components. However, any other form and configuration of parts may be used to allow relative rotatability of the detonator 550 and switch 560.

In the illustrated embodiments, the switch 560 is rotatable relative to the downhole end fitting 596, such as to allow electrical coupling of the conductive contact 630*f* of the switch 560 and the second intermediate conductor 618*b*. However, this may not be necessary in other configurations.

Referring to FIGS. 54A-B, in accordance with various distinct independent aspects of the present disclosure, the switch 560 (e.g. PCB 564) and/or detonator 550 may be grounded in any suitable manner. For example, the detonator 550 and switch 560 may be grounded together to one or more carriers 530 in the gun system 510. In the present embodiment, the grounding path of the detonator 550 and switch 560 goes through the adjacent retainer 584, bulkhead 574 and carrier 530. However, in other configurations, the detonator 550 and/or switch 560 may be directly grounded to the bulkhead 574 (e.g. FIG. 55), carrier(s) 530 or other conductive component.

Still referring to FIGS. 54A-B, in the illustrated embodiment, the third conductive contact 630*e* of the switch 560 is electrically coupled to the retainer 584 to provide the grounding path. For example, an intermediate conductor 618 (the third intermediate conductor 618*c*) may be electrically coupled between the third conductive contact 130*e* and the retainer 584 to complete the grounding circuit.

This intermediate conductor 618 may have any suitable form, configuration, components, construction and operation. For example, the third intermediate conductor 618*c* may be a conductive spring 610 (a.k.a. the third contact spring 610*c*) that is biased and electrically coupled at or proximate to one end thereof to the conductive contact 630*e* and at its other end to the retainer 584 (e.g. through one or more conductive spring retainers, or rings, 136). The illustrated contact spring 610*c* is a helical, or coil, spring but may take any other form (e.g. radial wave spring, biased sleeve).

However, the third intermediate conductor 618*c* could have any other form and operation and any other combination, configuration and location of suitable components (or a single conductive component) may comprise the grounding path for the detonator 550 and/or switch 560. In addition, any or all of the components and features forming the grounding path of the detonator 550 and/or switch 560 may be non-wired and form wire-free conductive interfaces 526 therebetween. In the present embodiment, the entire grounding path of the detonator 550 and switch 560 has non-wired components and is wire free.

Still referring to FIGS. 54A-B, the illustrated contact spring 610*c* may provide one or more additional capabilities. For example, the spring 610*c* may bias the switch 560, and thus its fourth conductive contact 630*f*, in the downhole direction so the contact 130*f* can make good electrical contact with the feedthrough conductor 569. The higher the spring rate or biasing forces of the exemplary third contact spring 610*c* (e.g. on the switch 560 and its fourth conductive contact 630*f*) in the downhole direction, the more robust and reliable the flow of electric current to the feedthrough 568. For example, the pressure applied to the conductive interface 526*j* between the conductive contact 630*d* and feedthrough conductor 569 could deform imperfections of the contact 630*d* and feedthrough conductor 569 to enhance electrical signal transmission.

Figure 62:
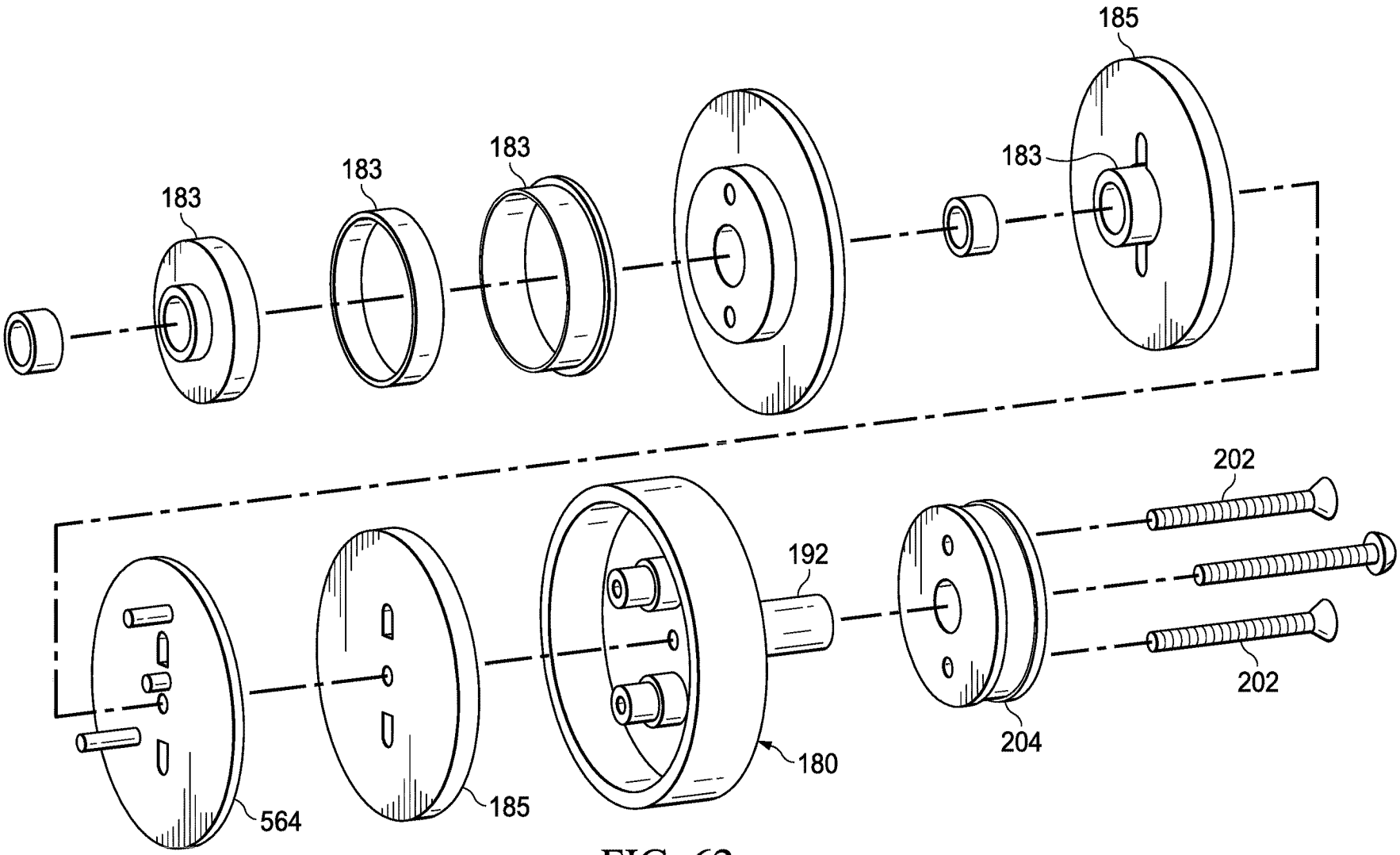

In the embodiment of FIGS. 55 & 62, the grounding path for the detonator 550 and switch 560 includes one or more bolts, or other mechanical connectors, 262 extending at least partially through the switch 560. The exemplary bolt(s) 262, which can be used to hold all (or some) of the components of the switch 560 together, is constructed at least partially of conductive material and electrically couples the third conductive contact 630*e* of the switch 560 and the third intermediate conductor 618*c* (e.g. the third contact spring 610*c*). If desired, the bolt 262 may engage a conductive grounding ring, or cap, 264 at the downhole end of the switch 560 to assist in providing good electrical connection between the contact 630*e* and conductor 618*c*, for any other purpose(s) or a combination thereof. In this embodiment, the third intermediate conductor 618*c* is biased between the bulkhead 574 and the grounding ring 264 (and possibly also the downhole end (head) of one or more bolts 262). The entire grounding path of the detonator 550 and switch 560 of this configuration includes all non-wired components and is wire free. However, any other configuration of components, with or without wires may be used to ground the switch 560 and/or detonator 550.

Referring specifically to FIG. 55, the illustrated contact spring 610*c* may provide one or more additional capabilities. In this example, the contact spring 610*c* biases the switch 560 in the uphole direction to help provide strong electrical connections for the conductive contacts 630 (e.g. contacts 630*b*, 630*c*, 630*e*) of the switch 560 at the uphole end of the switch 560, for any other purpose(s) or a combination thereof. The higher the spring rate or biasing forces of the exemplary third contact spring 610*c* in the uphole direction, the more robust and reliable the flow of electric current at the various conductive interfaces 526 formed by the switch contacts 630.

Referring back to FIG. 37, in accordance with various distinct independent aspects of the present disclosure, if desired, one or more redundant grounding paths (that differ from the primary grounding path, such as described above) may be provided in the gun system 510 to ensure grounding of the electrical circuit therein, such as if the primary ground fails (e.g. debris causes a break or blockage in the primary grounding path), for any other reason(s) or a combination thereof. Any suitable form, configuration, construction and location of components may be used to provide one or more redundant grounding paths. For example, the detonator 550 may be separately grounded to the carrier(s) 530 at a different location than the primary grounding path (e.g. as described above). In this embodiment, at least one redundant ground connector 188 may extend between and electrically couple the detonator 550 and the carrier 530. For example, the redundant ground connector 188 may electrically contact the second conductive contact 630*d* of the detonator 550, effectively grounding both the detonator 550 and switch 560.

Referring still to FIG. 37, when included, the redundant ground connector 188 may have any suitable form, configuration, location and operation. In this embodiment, the redundant ground connector 188 is a shepherds-hook type connector and carried in the downhole end fitting 596. This exemplary connector 188 includes a base, or ring, 626 (e.g. FIG. 53) configured to extend around the detonator 550 in the central bore 593 of the end fitting 596 (or other component) and electrically contact the second conductive contact 630*d* of the detonator 550. If desired, the base 626 may abut a ledge 148 of the detonator 550 and/or ledge 149 of the end fitting 596 to help ensure good electrical contact at that conductive interface 526*k* formed therebetween.

At least one spring-biasable arm 628 is shown extending generally radially outwardly from the illustrated base 626 (e.g. through a slot (629*b*, FIG. 42) in the end fitting 596) of the redundant ground conductor 188 and configured to electrically contact the carrier 530. If desired, the conductor 188 may abut a ledge 166 formed in the ID of the carrier 530 and/or the illustrated arm 628 may be spring-biased radially outwardly to help obtain strong electrical contact between the conductor 188 and carrier 530. For example, when the exemplary charge holder assembly 590*c* is pushed into the carrier 530, the illustrated arm 628 may engage the ledge 166 under friction to deflect it radially inwardly against its outward spring tension and thus assist in providing a robust and reliable electrical connection. However, the redundant ground conductor 188 may have any other form (e.g. a piston and helical spring), configuration and location.

In this example, the entire redundant grounding path of the detonator 550 and switch 560 is wire free. However, in other embodiments, wires may be included and any one or more additional or different electrical components 524 may be used at any desired location(s) to provide one or more redundant ground flow paths between any desired components.

Figure 66:
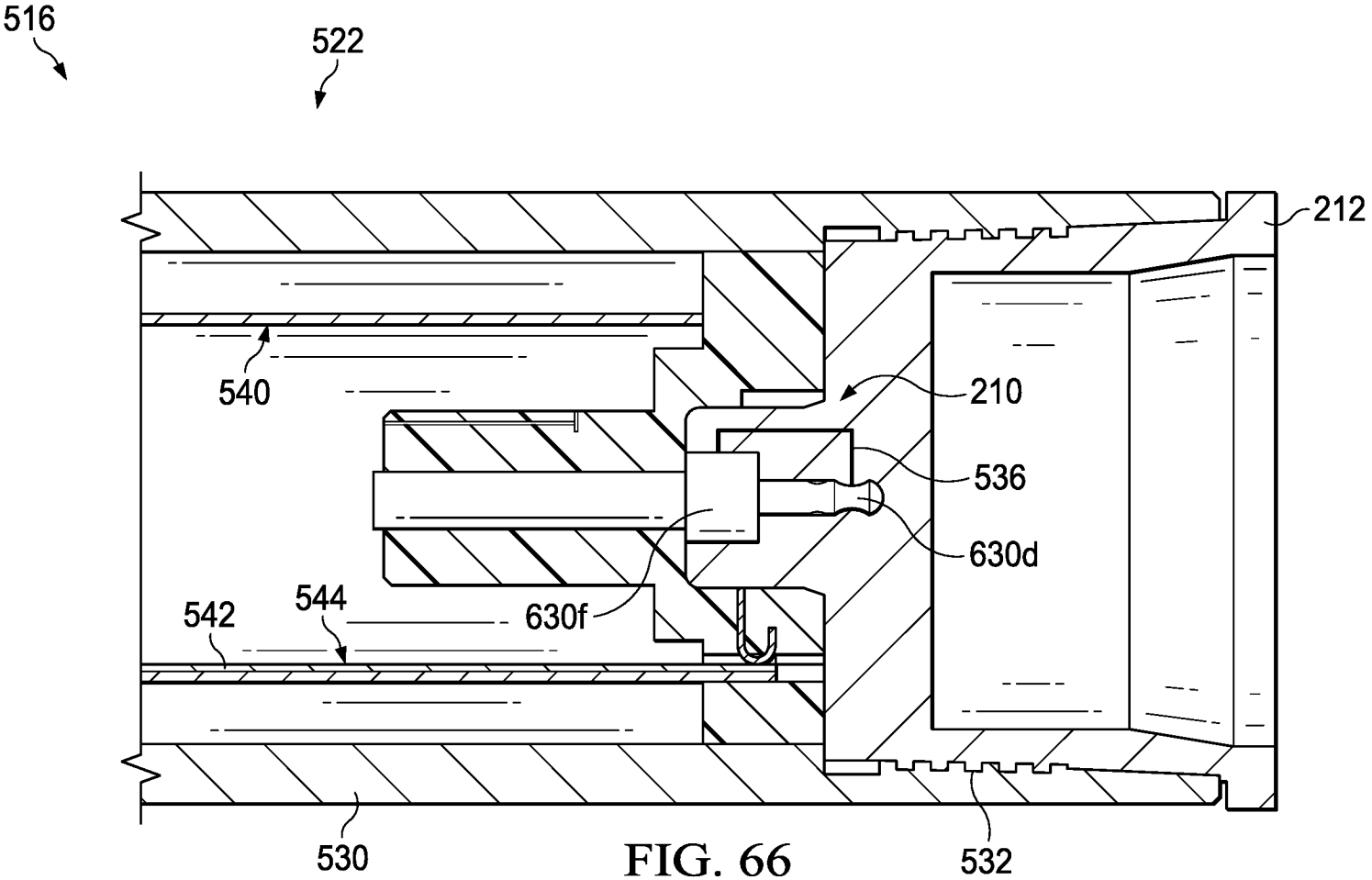

Referring back to FIG. 36, in some embodiments, an option to store, handle and/or ship the gun 516 with the charge holder assembly 590*c* and detonator 550 loaded therein may be provided. For example, an insulated shorting conductor 210 may be securely electrically coupled to both conductive contacts 630*a*, 630*d* of the detonator 550 to electrically connect them together. The insulated shorting conductor 210 may have any suitable form, configuration and operation. In this example, the shorting conductor 210 is a conductive trace 536 provided in a shipping plug 212 (FIG. 66) constructed at least partially of electrically non-conductive material to insulate the shorting conductor 210. In this embodiment, the shipping plug 212 is plastic and releasably, firmly (e.g. threadably) coupled with the carrier 530 at the downhole end 522 of the gun 516. The exemplary shipping plug 212 may also help protect the downhole end of the carrier 530 and/or the threads 532 thereof, one or more components in the carrier 530 during storage, handling and/or shipping of the gun 516 or a combination thereof. However, any other suitable arrangement and configuration of components may be used to electrically short the detonator 550 when loaded in the gun 516 and/or protect one or more components of the gun prior to use thereof.

Figure 65:
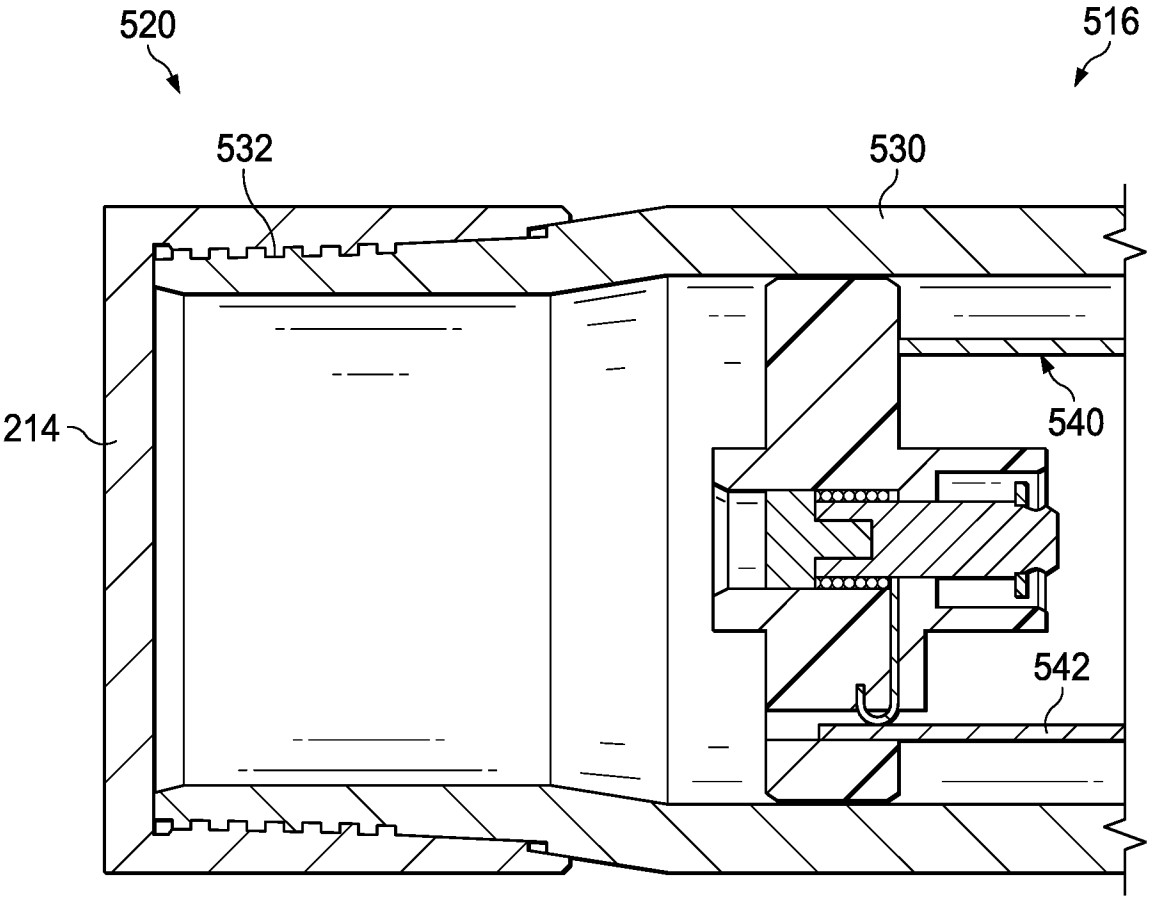

Referring back to FIG. 36, if desired, the upper end 520 of the gun 516 may be secured during storage, handling and/or shipment of the gun 516 with or without the charge holder assembly 590*c* and detonator 550 loaded therein. Referring to FIG. 65, in this embodiment, a shipping cap 214 (e.g. FIG. 65) is releasably, firmly (e.g. threadably) coupled with the carrier 530 at the uphole end 520 of the gun 516. The illustrated shipping cap 214 is plastic, but may be constructed of any other suitable material. The exemplary shipping cap 214 may also help protect the uphole end of the carrier 530 and/or the threads 532 thereof, one or more components in the carrier 530 during storage, handling and/or shipping of the gun 516 or a combination thereof. However, any other suitable arrangement and configuration of components may be used to protect one or more components of the gun prior to use thereof.

In some embodiments, when the gun system 510 is shipped with two (or more) pre-assembled guns 516, such as shown in FIGS. 36 & 44, the guns 516 can be quickly and simply interconnected for use at the work site without any tools simply by removing the respective shipping plugs 212 and caps 214 therefrom and threadably engaging the upper end 520 of the carrier 530 of one gun 516*b* (e.g. FIG. 37) to the lower end 522 of the carrier 530 of the other gun 516*a*.

When any of the exemplary gun systems 510 are shipped without the detonator 550 in the gun 516, such as shown in FIG. 54A, the detonator 550 simply needs to be pushed into the downhole end fitting 596 of the first gun 516*a* and the second gun 516*b* threadably engaged with the first gun 516*a* (e.g. FIG. 54B). The first gun 516*a* is quickly and easily armed and ready for use without any tools.

Figure 67:
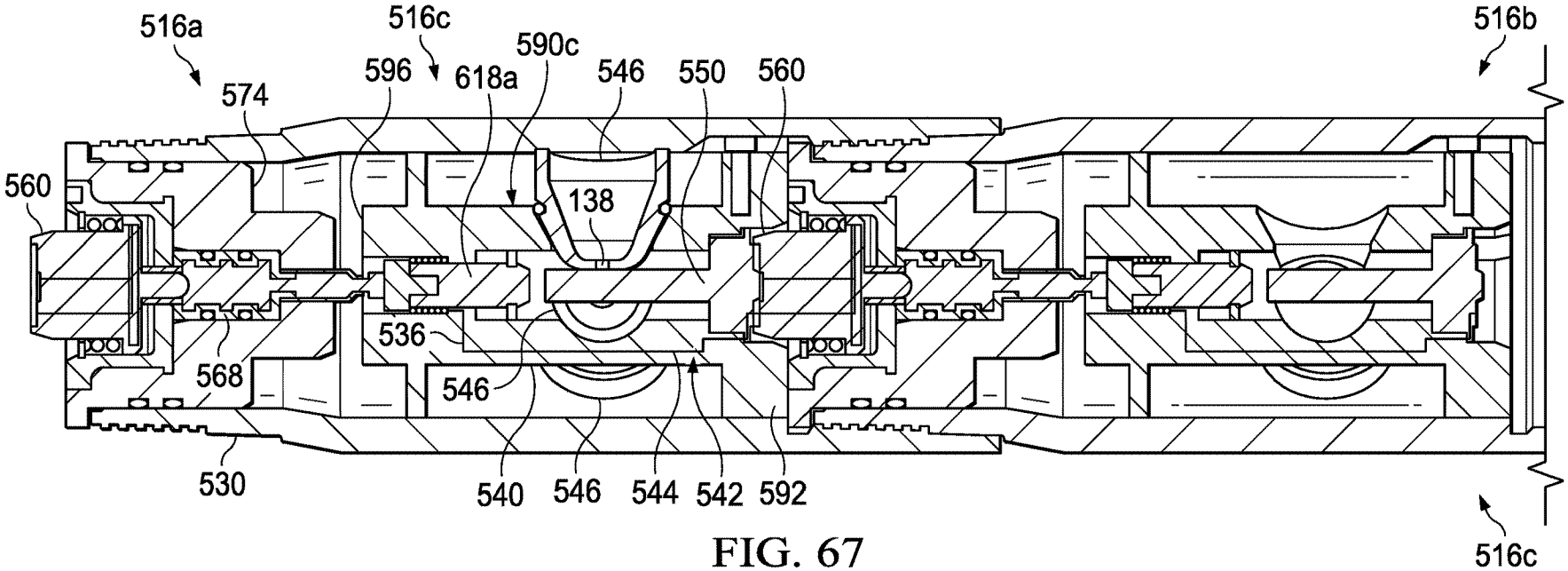

Now referring to FIG. 67, in other distinct independent aspects of the present disclosure, the gun 516 (a.k.a. gun 516*c*) may be configured to operate without det-cord. In this embodiment, the gun 516*c* may include all of the features of the embodiments described above and shown in the corresponding figures, except as described differently below or as may be evident from the appended figures or otherwise to persons skilled in the field of downhole perforating guns.

With that caveat, all of the detail description above and referenced figures are incorporated herein for the embodiment shown in FIG. 67.

In this embodiment, all of the explosives 546 in the gun 516*c* are directly coupled to and ignited by the detonator 550, allowing significant shortening of the length of the gun 516. For example, three (3 each) explosives 546 are shown positioned around and electrically coupled to the detonator 550 in the same radial plane. In other embodiments, fewer or more explosives 546 may be included in one or more planes (e.g. depending upon the size of the explosives 546). To help simplify and shorten the exemplary gun 516, the charge holder 540 and upper and lower end fitting 592, 596 may be formed of a single unitary charge holder assembly 590*c* (e.g. constructed of plastic or other suitable material). The illustrated inner body conductor 542 (e.g. through-connector 544) may include one or more wire-free conductive traces 536 electrically coupled to the first intermediate conductor 618*a* at its uphole end (e.g. without the need for a first intermediate connector 624*a*), and the switch 560 and/or detonator 550 at its downhole end (e.g. without the need for a second intermediate conductor 618*b* or second intermediate connector 624*b*). Thus, if desired, the entire gun 516*c* may be wire free. However, any other configuration of components may be used to provide a det-cord free gun 16 with or without the use of wires.

Now referring to FIG. 68, in other distinct independent aspects of the present disclosure, a wireless switch 560 and detonator 550 may be located in the same gun 516. In this embodiment, the gun 516 may include all of the features of the embodiments described above and shown in the corresponding figures, except as described differently below or as may be evident from the appended figures or otherwise to persons skilled in the field of downhole perforating guns. With that caveat, all of the detail description above and referenced figures are incorporated herein for the embodiment shown in FIG. 68.

As shown in FIG. 68, a switch 560 is positioned on the uphole side of bulkhead 74. In the illustrated embodiment, the switch 560 is coupled to a downhole end fitting 596, which is disposed between bulkhead 574 and switch 560. Consistent with the above discussion concerning other embodiments, it would be understood by one of skill in the art that alternatively the switch 560 could be positioned between the downhole end fitting 596 and the bulkhead 574.

As shown in the illustrated embodiment the downhole end fitting 596 and switch 560 are configured to receive detonator 550. In the illustrated embodiment, the wireless detonator axially extends within the carrier 530, parallel to the central axis 531, but is offset from the central axis 531. The isolated detonator 550 is described in further detail in FIG. 536 discussed below. It would be understood by one of skill in the art that this configuration of the switch 560 and detonator 550 is advantageous because, in addition to providing a wireless connection, it allows for a shorter gun.

Referring to FIG. 68, the threads 532 of the carrier 530 may be tapered at the downhole end and the uphole end. The tapered threads 532 allow the uphole gun 516*a* to form a sealed metal-to-metal contact with downhole gun 516*b*.

Still referring to FIG. 68, the charge holder 540 is coupled to the bulkhead 574. In the illustrated embodiment, the bulkhead 574 includes feedthrough 568 as described with reference to FIG. 70 below.

As illustrated in FIG. 69, the charge holder 540 comprises a charge hole 174 to house a shaped charge. The charge holder 540 also connects to an uphole end fitting 592 and a downhole end fitting 596. As discussed above, the downhole end fitting 596 is coupled to the switch 560 at the downhole end of the charge holder. The switch 560 and downhole end fitting 596 are configured to receive the detonator 550.

A bulkhead 574 is disposed between adjacent gun carriers. As illustrated in FIG. 70, a feedthrough 568 is disposed within the bulkhead 574. The feedthrough 568 does not contact the bulkhead 574, but is encompassed by insulator 571. In this embodiment, insulator 571 is formed around the conductor pin 570 of feedthrough 568 after the feedthrough 568 has been disposed within the bulkhead 574. In this way, the insulator 571 seals the feedthrough 568 within the central bore of the bulkhead without the need for o-rings or other additional sealing elements. In some embodiments, the insulator material is PEEK. It would be understood by one of skill in the art that alternative materials could be used. It would also be understood by one of skill in the art that one or more additional materials could be disposed about insulator 571 such that insulator 571 does not directly contact bulkhead 574.

In addition to being disposed within gun carrier 530, as shown in FIG. 68, bulkhead 574 and feedthrough 568 could also disposed in, or configured to be part of, an adjacent component. For example, as shown in FIG. 75, bulkhead 574*a* and feedthrough 568 could be disposed in a tandem sub or sub-assembly 575, which may be attached via a threaded connection to the downhole end of gun carrier 530. Although FIG. 75 depicts a more traditional bulkhead and feedthrough configuration, one of skill in the art would understand that a separate component such as a tandem sub 575 may also include a feedthrough 568 with an insulator 571 formed around the conductor pin 570, as discussed in the preceding paragraph.

As illustrated in FIG. 71, the wireless detonator 550 is housed within a detonator cap 802. The detonator cap 802 includes a banana plug 800 and a spring contact 804. The banana plug 800 and spring contact 804 provide the conductive contacts that enable the detonator 550 to maintain electrical contact with the switch 560 and electrical components of the perforating gun system.

As illustrated in FIG. 72, the charge holder 540 can be molded with a split mold design. In this design, the split charge holder 540 includes a channel 808 that allows a signal to travel from one end of the carrier to another end of the carrier. In certain embodiments, the channel 808 houses a wire. In other embodiments, the charge holder 540 is wireless and the channel 808 is configured to carry the signal without a wire. For example, through-connector 544 may be disposed within channel 808 to provide a wire-free electrical connection along at least part of the length of gun 516. The charge holder 540 also includes a charge hole 174 to house a shaped charge.

Now referring to FIG. 73, in other distinct independent aspects of the present disclosure, the gun 516 may be configured to operate with a charge tube adapter. In this embodiment, the gun 516 may include all of the features of the embodiments described above and shown in the corresponding figures, except as described differently below or as may be evident from the appended figures or otherwise to persons skilled in the field of downhole perforating guns. With that caveat, all of the detail description above and referenced figures are incorporated herein for the embodiment shown in FIG. 73.

In this embodiment, the charge holder 540 couples to a charge tube adapter 806. The charge tube adapter 806 is compatible with traditional charge tube so that a traditional charge tube 540 can be used with the components of the perforating gun system described herein. The charge tube adapter 806 is coupled to switch 560. As shown in FIGS. 74A and 74B, the charge tube adapter 806 is also configured to receive the isolated detonator shown in FIG. 71 above.

Now referring to FIGS. 76 and 77, in other distinct independent aspects of the present disclosure, the gun 900 may be configured to orient around a central axis in a modular configuration. In some embodiments, the gun is configured to orient around a central axis with a wireless configuration. In this embodiment, the gun 900 may include all of the features of the embodiments described above and shown in the corresponding figures, except as described differently below or as may be evident from the appended figures or otherwise to persons skilled in the field of downhole perforating guns. With that caveat, all of the detail description above and referenced figures are incorporated herein for the embodiment shown in FIG. 78.

In this embodiment, the gun 900 has a charge module 910*a* and a weight module 910*b*. The charge module 910*a* houses a charge holder 940 configured to retain a shaped charge 916 as described above with respect to FIG. 68. The weight module 910*b* houses a weight 924 configured to orient the gun 900 around bearing assemblies 926.

The charge module 910*a* includes a charge holder 940 with a charge opening 922 configured to retain a shaped charge 916. In this embodiment, the shaped charge 916 is coupled via a detonating cord 952 to and ignited by the detonator 950. For example, one shaped charge is shown positioned around and coupled to the detonator 950 via detonating cord 952. In other embodiments, more shaped charges 916 may be included.

In other distinct independent aspects of the present disclosure, a wireless switch 960 and detonator 950 may be located in the same gun 900. In this embodiment, the gun 900 may include all of the features of the embodiments described above and shown in the corresponding figures, except as described differently below or as may be evident from the appended figures or otherwise to persons skilled in the field of downhole perforating guns. With that caveat, all of the detail description above and referenced figures are incorporated herein for the embodiment shown in FIG. 78.

As shown in FIGS. 76 and 77, a switch 960 is positioned on the downhole end of gun 900. In the illustrated embodiment, the switch 960 is coupled to a downhole end fitting 996, which is disposed between bearing assembly 926 and switch 960. In this embodiment, the bearing assembly 926 provides the grounding mechanism for the switch 960.

As shown in the illustrated embodiment the downhole end fitting 996 and switch 960 are configured to receive detonator 950. The detonator 950 is described in further detail in FIG. 80 discussed below. It would be understood by one of skill in the art that this configuration of the switch 960 and detonator 950 is advantageous because, in addition to providing a wireless connection, it allows for a shorter gun.

Referring to FIGS. 76 and 77, the threads 932 of the gun 900 may be tapered at the downhole end and the uphole end. The tapered threads 932 allow the downhole gun 900*a* to form a sealed metal-to-metal contact with uphole gun 900*b*.

Still referring to FIGS. 76 and 77A, the charge module 910*a* is coupled to weight module 910*b* with a second bearing assembly 926, a collar 930, and second end fitting 980. The second end fitting is described in further detail in FIG. 85 below. As discussed above with respect to FIGS. 1-8, an electrical contact 920 is disposed within each bearing assembly 926 to maintain an electrical connection throughout the gun assembly.

As illustrated in FIG. 77B, the electrical connection is maintained throughout the gun assembly through physical contact between components. An electrical contact 920 is disposed within the bearing assembly 926 and forms a connection between the bulkhead 974 and the weight module 910*b*, the weight module 910*b* and the charge module 910*a*, and the charge module 910*a* and the downhole end fitting 996. The bearing assembly 926 comprises a soldering ring 923 disposed within the inner diameter of the bearing assembly 926. The soldering ring 923 is in physical contact with a spring 921. The spring 921 is disposed within the bearing assembly 926 and receives the electrical contact 920. This facilitates an electrical connection between the electrical contact 920 and the soldering ring 923. Additionally, the weight holder 912 and charge holder 940 include a mold to receive conductors 925 and 927. This configuration enables an electrical connection to travel from the uphole end of the gun 900 to the downhole end of the gun 900.

An integrated bulkhead 975 comprises a feedthrough 968 disposed within a bulkhead 974. The integrated bulkhead 975 maintains electrical connectivity between guns 900. The electrical contact 920*a* at the uphole end of the gun 900 is in physical contact with the feedthrough 968. The electrical contact 920*a* is also in physical contact with soldering ring 923*a* through spring 921*a*. The soldering ring 923*a* is in contact with conductor 925 within the weight holder 912. The conductor 925 is also in contact with soldering ring 923*b* and therefore electrical contact 920*b* through the same manner as referenced above. Soldering ring 923*b* is also in physical contact with conductor 927 within the charge holder 940. The conductor 927 is also in contact with electrical contact 920*c*. Electrical contact 920*c* is in physical contact with a soldering ring 923*c* as referenced above. Electrical contact 920 is also in physical contact with switch 960 which is in electrical communication with the detonator 950.

The weight module is described in further detail in FIG. 81 discussed below. Weight module 910*b* includes a weight 924 positioned within the cavity of the weight module 910*b*. Weight module 910*b* is coupled to the integrated bulkhead 975 with a third bearing assembly 926. In the illustrated embodiment, the integrated bulkhead 975 comprises feedthrough 968 and bulkhead 974 as described with reference to FIG. 78 below.

An integrated bulkhead 975 is disposed between adjacent guns. As illustrated in FIG. 80, the integrated bulkhead 975 comprises a feedthrough 968 disposed within a bulkhead 974. The feedthrough 968 does not contact the bulkhead 974, but is encompassed by insulator 971. In this embodiment, insulator 971 is formed around the conductor pin 970 of feedthrough 968 after the feedthrough 968 has been disposed within the bulkhead 974. In this way, the insulator 971 seals the feedthrough 968 within the central bore of the bulkhead without the need for o-rings or other additional sealing elements. In some embodiments, the insulator material is PEEK. It would be understood by one of skill in the art that alternative materials could be used. It would also be understood by one of skill in the art that one or more additional materials could be disposed about insulator 971 such that insulator 971 does not directly contact bulkhead 974. The bulkhead 974 in FIG. 76 operates the same as the bulkhead described in FIG. 70.

Now referring to FIGS. 78 and 79, in other distinct independent aspects of the present disclosure, the gun 1100 may be configured to orient around a central axis. In some embodiments, the gun is configured to orient around a central axis with a wireless configuration in a non-modular configuration. In this embodiment, the gun 1100 may include all of the features of the embodiments described above and shown in the corresponding figures, except as described differently below or as may be evident from the appended figures or otherwise to persons skilled in the field of downhole perforating guns. With that caveat, all of the detail description above and referenced figures are incorporated herein for the embodiment shown in FIG. 78.

In this embodiment, the gun 1100 has a gun tube 1110. The gun tube 1110 has a charge holder 1140. The charge holder 1140 is configured to retain a shaped charge 916 as described above with respect to FIG. 68. The gun tube 1110 further includes a cavity 1114. One or more weights 1124 are positioned in cavity 1114. The weights 1124 in FIG. 78 operate the same as the weights 124 described in FIGS. 1-8.

The charge holder 1140 includes a charge opening 922 configured to retain a shaped charge 916. In this embodiment, the shaped charge 916 is directly coupled to and ignited by the detonator 950. For example, one shaped charge is shown positioned around and electrically coupled to the detonator 950. In other embodiments, more shaped charges 916 may be included.

In other distinct independent aspects of the present disclosure, a wireless switch 960 and detonator 950 may be located in the same gun 900. In this embodiment, the gun 900 may include all of the features of the embodiments described above and shown in the FIGS. 76 and 77, except as described differently above with respect to the weights or as may be evident from the appended figures or otherwise to persons skilled in the field of downhole perforating guns. With that caveat, all of the detail description above and referenced figures are incorporated herein for the embodiment shown in FIG. 78.

As shown in FIGS. 78 and 79, a switch 960 is positioned on the downhole end of gun 900. In the illustrated embodiment, the switch 960 is coupled to a downhole end fitting 996, which is disposed between first bearing assembly 926 and switch 960. In this embodiment, the bearing assembly 926 provides the grounding mechanism for the switch 960.

As shown in the illustrated embodiment the downhole end fitting 996 and switch 960 are configured to receive detonator 950. The detonator 950 is described in further detail in FIG. 80 discussed below. It would be understood by one of skill in the art that this configuration of the switch 960 and detonator 950 is advantageous because, in addition to providing a wireless connection, it allows for a shorter gun.

Still referring to FIGS. 78 and 79, the gun carrier 1110 is coupled to the integrated bulkhead 975 with a second bearing assembly 926. In the illustrated embodiment, the integrated bulkhead 975 comprises bulkhead 974 and feed-through 968 as described with reference to FIG. 80 above.

As shown in FIGS. 78 and 79, in the non-modular configuration the weight 1124 is disposed in cavity 1114 so there is no need for a third bearing assembly 926.

As illustrated in FIG. 81, the charge holder 940 comprises a charge opening 922 to house a shaped charge 916. The charge holder 940 can be molded with a split mold design as illustrated in FIG. 72.

As illustrated in FIG. 82, the bearing assembly 926 comprises a housing preferably circular in shape and has an inner body 976, an outer body 962, and a cavity 984 that retains ball bearings 986. Bearing assembly 926 could instead be what persons skilled in the art refer to as a radial bearing. Any suitable structure to allow the rotation of charge module 910*a* and weight module 910*b* around axis A may be utilized. The bearing assembly 926 in FIG. 80 operates the same as the bearing assembly described in FIGS. 1-8.

As illustrated in FIG. 83, the detonator 950 is housed within a detonator cap 902. The detonator cap 902 enables the detonator 950 to act as a wireless detonator. The detonator cap 902 connects the wires of the detonator 950 to a contact 904. The detonator cap 902 includes a banana plug 903 and the contact 904. The banana plug 903 and contact 904 provide the conductive contacts that enable the detonator 950 to maintain electrical contact with the switch 960 and electrical components of the perforating gun system.

As illustrated in FIG. 84, weight module 910*b* includes a weight holder 912 that retains a weight 924. The weight 924 has a semi-cylindrical shape. A person of skill in the art would understand that one or more weights 924 may be used. One or more weights 924 can be of any size, shape, or weight suitable to move weight module 910*b* so that the one or more weights 924 cause weight module 910*b* to rotate relative to bearing assemblies 926 so the portion of weight holder 912 that retains one or more weights 924 is at the bottom of the wellbore (i.e., closest to the Earth's center) when gun 900 is positioned horizontally in a wellbore. Bearing assemblies 926 allow weight module 910*b* to rotate around axis A in either direction. Weight 924 as shown is semi-circular, comprised of steel, and fills about half of the volume of weight module 910*b*.

As illustrated in FIG. 84, the weight module 910*b* contains a collar 930. In some embodiments, the collar 930 comprises 36 teeth equidistantly spaced around the collar. The collar 930 threads onto the charge module 910*a*. As shown in FIG. 85, the second end fitting 980 of the charge module 910*a* includes teeth 981. The teeth of the charge module 910*a* allow the collar 930 to lock onto the charge module 910*a*. This allows the weight 924 to be set at a specific angle so that the shaped charges 916 are set in the desired position. The collar 930 also transfers torque from the weight module 910*b* to the charge module 910*a*.

As illustrated in FIG. 86, the gun 900 described in FIGS. 76 and 77 can be connected in series with multiple guns 900. In this embodiment, a first gun 900*a* is connected to a second gun 900*b* by threading the first gun 900*a* onto the second gun 900*b*. The integrated bulkhead 975 contained within first gun 900*a* provides the electrical connection between first gun 900*a* and second gun 900*b*.

Now referring to FIGS. 87 and 88, in other distinct independent aspects of the present disclosure, the gun 1200 may be configured to orient around a central axis with a wireless non-modular configuration. In this embodiment, the gun 1200 may include all of the features of the embodiments described above and shown in the corresponding figures, except as described differently below or as may be evidence from the appended figures or otherwise to persons skilled in the field of downhole perforating guns. With that caveat, all of the detail description above and referenced figures are incorporated herein for the embodiment shown in FIG. 78.

In this embodiment, the gun 1200 has a gun tube 1210. The gun tube 1210 has a charge holder 1240. The charge holder 1240 is configured to retain a shaped charge 1216 as described above with respect to FIG. 68. The charge holder 1240 is also configured to retain a weight 1224. One or more weights 1224 are attached to the charge holder 1240 via screws 1242. The weight 1224 is configured to orient the gun 1200 around bearing assemblies 1226 as discussed above.

The charge holder 1240 includes a charge opening 1222 configured to retain a shaped charge 1216. In this embodiment, the shaped charge 1216 is coupled with the detonating cord to the detonator 1250. This allows an electrical communication to travel from the detonator 1250 to ignite the shaped charge 1216. For example, one shaped charge is shown positioned around and electrically coupled to the detonator 1250. In other embodiments, more shaped charges 1216 may be included.

In other distinct independent aspects of the present disclosure, a wireless switch 1260 and detonator 1250 may be located in the same gun 1200. In this embodiment, the gun 1200 may include all of the features of the embodiments described above and shown in the FIGS. 78 and 79, except as described differently above with respect to the weights or as may be evident from the appended figures or otherwise to persons skilled in the field of downhole perforating guns. With that caveat, all of the detail description above and referenced figures are incorporated herein for the embodiment shown in FIG. 87.

As shown in FIGS. 87 and 88, a switch 1260 is positioned on the downhole end of gun 1200. In the illustrated embodiment, the switch 1260 is coupled to a downhole end fitting 1296, which is disposed between first bearing assembly 1226 and switch 1260. In this embodiment, the bearing assembly 1226 provides the grounding mechanism for the switch 1260.

As shown in the illustrated embodiment the downhole end fitting 1226 and switch 1260 are configured to receive detonator 1250. The detonator 1250 is described in further detail in FIGS. 90 and 91 discussed below. It would be understood by one of skill in the art that this configuration of the switch 1260 and detonator 1250 is advantageous because, in addition to providing a wireless connection, it allows for a shorter gun.

Still referring to FIGS. 87 and 88, the gun carrier 1210 is coupled to the integrated bulkhead 1275 with a second bearing assembly 1226. In the illustrated embodiment, the integrated bulkhead 1275 comprises a bulkhead 1274 and a feedthrough 1268 as described with reference to FIG. 80 above. One of skill in the art would understand that the guns 1200 described in FIG. 87 can be connected in series with multiple guns 1200 by threading the first gun onto the second gun via threads 1232. The integrated bulkhead 1275 contained within the first gun provides an electrical connection between the first gun and second gun as discussed with reference to FIG. 86 above.

As shown in FIGS. 87 and 88, in the non-modular configuration the weight 1224 is connected to the charge holder 1240 so there is no need for a third bearing assembly 1226.

As illustrated in FIG. 89, the charge holder 1240 can be configured so that the weight 1224 is positioned below the charge opening 1222 which houses the shaped charge 1216.

As illustrated in FIGS. 88 and 89, the weight 1224 has a semi-cylindrical shape. A person of skill in the art would understand that one or more weights 1224 may be used. One or more weights 1224 can be of any size, shape, or weight suitable to move charge holder 1240 so that the one or more weights 1224 cause charge holder 1240 to rotate relative to bearing assemblies 1226 so the portion of charge holder 1240 that retains one or more weights 1224 is at the bottom of the wellbore (i.e., closest to the Earth's center) when gun 1200 is positioned horizontally in a wellbore. Bearing assemblies 1226 allow charge module 1240 to rotate around axis A in either direction. Weight 1224 as shown is semi-circular, comprised of steel, and fills about half of the volume of charge holder 1240.

As illustrated in FIGS. 90 and 91, the detonator 1250 is housed within a detonator cap 1202. The detonator cap 1202 enables the detonator 950 to act as a wireless detonator, as described above with respect to FIG. 83. The detonator cap 1202 includes a banana plug 1203 and contact 1204. As illustrated in FIG. 90, the contact 1204*a* can be a flat surface that receives an electrical contact. As illustrated in FIG. 91, the contact 1204*b* can be a spring. It would be understood by one of skill in the art that a number of contacts could be used. The banana plug 1203 and contact 1204 provide the conductive contacts that enable the detonator 1250 to maintain electrical contact with the switch 1260 and electrical components of the perforating gun system.

In accordance with various distinct independent aspects of the present disclosure, various methods of manufacture, assembly and used of the exemplary guns 16 and gun system are apparent from the detailed description above and appended drawings.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. A downhole perforating gun system comprising:

a first cylindrical gun carrier comprising a first end, a second end, and a central axis extending axially therethrough;

an inner body conductor disposed within the first cylindrical gun carrier and being configured to communicate electrically in the downhole perforation gun system;

a charge holder disposed within the first cylindrical gun carrier and being configured to hold at least one charge;

a first bearing assembly disposed within the first cylindrical gun carrier such that the charge holder is rotatable relative to the first cylindrical gun carrier; and a weight module comprising one or more weights, wherein the weight module is rotatable by the weights via the first bearing assembly based on gravity acting on one or more of the one or more weights.

2. The downhole perforating gun system of claim 1, further comprising a second bearing assembly disposed within the first cylindrical gun carrier such that the charge holder is rotatable relative to the first cylindrical gun carrier.

3. The downhole perforating gun system of claim 1, further comprising a third bearing assembly disposed within the first cylindrical gun carrier such that the weight module is rotatable relative to the first cylindrical gun carrier.

4. The downhole perforating gun system of claim 1, further comprising a collar disposed within the weight module such that collar transfers torque from the weight module to the charge holder.

5. The downhole perforating gun system of claim 4, wherein the collar comprises a plurality of teeth such that the weight module can be set at a specific orientation.

6. The downhole perforating gun system of claim 1, wherein the charge holder further comprises a groove; and wherein the inner body conductor comprises a wireless conductor disposed within the groove.

7. The downhole perforating gun system of claim 1, wherein the first end of the first cylindrical gun carrier comprises an inner surface with first tapered threads.

8. The downhole perforating gun system of claim 7, further comprising a second cylindrical gun carrier comprising a first end and a second end, wherein the second end of the second cylindrical gun carrier comprises an outer surface with second tapered threads configured to engage with the first tapered threads on the inner surface of the first cylindrical gun carrier.

9. The downhole perforating gun system of claim 1, wherein the one or more weights are fixed to the charge holder.

10. The downhole perforating gun system of claim 1, wherein the weight module comprises a weight holder holding the one or more weights, the weight module being a distinct module modularly interconnected to the charge holder.

11. The downhole perforating gun system of claim 1, wherein the charge holder comprises at least one receptacle configured to hold the at least one charge; and wherein the weight module comprises:

a first of a plurality of the one or more weights disposed at a first location of the charge holder at a first end of the charge holder; and a second of a plurality of the one or more weights disposed at a second location of the charge holder at a second end of the charge holder.

12. The downhole perforating gun system of claim 1, wherein at least one of:

the weight module comprises one or more retainers configured to retain the weight module to the charge holder;

the one or more weights are longitudinal; and the one or more weights have a shape that is at least partially cylindrical.

13. The downhole perforating gun system of claim 1, comprising an insulated electrical conductor being configured to transmit electricity to the downhole perforating gun system and being at least partially disposed through the first bearing assembly.

14. The downhole perforating gun system of claim 13, wherein the insulated electrical conductor comprises an electrical contact having an extended position and a contracted position, the electrical contact being biased to the extended position by one or more biasing members.

15. The downhole perforating gun system of claim 14, wherein the one or more biasing members comprise a spring biasing the electrical contact.

16. The downhole perforating gun system of claim 15, wherein the spring biases along the central axis from the contracted position to the extended position.

17. The downhole perforating gun system of claim 14, comprising:

a detonator disposed in the first cylindrical gun carrier;

a detonator cord disposed in the first cylindrical gun carrier and having an end adjacent the detonator; and a switch disposed in the first cylindrical gun carrier and being electrically connected to the detonator, the insulated electrical conductor, and the inner body conductor.

18. The downhole perforating gun system of claim 1, wherein the first bearing assembly comprises a first structure disposed on the charge holder and comprises a second structure disposed inside the first cylindrical gun carrier.

19. The downhole perforating gun system of claim 18, wherein the first structure comprises a first housing member of a bearing housing; wherein the second structure comprises a second housing member of the bearing housing; and wherein the first bearing assembly comprises one or more bearings disposed between the first and second housing members.

20. The downhole perforating gun system of claim 18, comprising a tandem sub configured to connect to one of the first and second ends of the first cylindrical gun carrier, wherein the first structure of the first bearing assembly is engaged with at least a portion of the charge holder; and wherein the second structure of the first bearing assembly is engaged with at least a portion of the tandem sub.

21. The downhole perforating gun system of claim 18, comprising a tandem sub configured to connect to one of the first and second ends of the first cylindrical gun carrier, wherein the first structure of the first bearing assembly is engaged with at least a portion of the charge holder; and wherein the second structure of the first bearing assembly is engaged with at least a portion the first cylindrical gun carrier.

22. The downhole perforating gun system of claim 18, wherein at least a portion of the second structure is engaged with at least a portion of the first cylindrical gun carrier.

23. The downhole perforating gun system of claim 1, comprising:

a tandem sub configured to connect to one of the first and second ends of the first cylindrical gun carrier;

a first electrical contact disposed on the tandem sub; and a second electrical contact disposed on the charge holder, at least a portion of the second electrical contact being biased relative to the first electrical contact.

24. The downhole perforating gun system of claim 23, wherein at least one of the first and second electrical contacts passes through the first bearing assembly.

25. The downhole perforating gun system of claim 1, comprising:

a tandem sub configured to connect to an end of the first cylindrical gun carrier;

a first electrical contact disposed on the charge holder; and a second electrical contact disposed on the tandem sub, at least a portion of the second electrical contact being biased relative to the first electrical contact.

26. The downhole perforating gun system of claim 25, wherein at least one of the first and second electrical contacts pass through the first bearing assembly.

27. A downhole perforating gun system comprising:

a first cylindrical gun carrier comprising a first end, a second end, and a central axis extending axially therethrough;

an inner body conductor disposed within the first cylindrical gun carrier and being configured to communicate electrically in the downhole perforation gun system;

a charge holder disposed within the first cylindrical gun carrier and being configured to hold at least one charge;

a first bearing assembly disposed within the first cylindrical gun carrier such that the charge holder is rotatable relative to the first cylindrical gun carrier;

a bulkhead disposed proximate the first end of the first cylindrical gun carrier and comprising a central throughbore;

a sealing element disposed within a groove formed on an outer surface of the bulkhead;

a feedthrough comprising a conductor pin disposed within the central throughbore of the bulkhead, the feedthrough being configured to communicate electrically in the downhole perforation gun system; and a weight module comprising one or more weights, wherein the weight module is rotatable by the one or more weights via the first bearing assembly based on gravity acting on one or more of the one or more weights.

28. The downhole perforating gun system of claim 27, further comprising a second bearing assembly disposed within the first cylindrical gun carrier such that the charge holder is rotatable relative to the first cylindrical gun carrier.

29. The downhole perforating gun system of claim 28, further comprising a third bearing assembly disposed within the first cylindrical gun carrier such that the weight module is rotatable relative to the first cylindrical gun carrier.

30. The downhole perforating gun system of claim 29, further comprising a collar disposed within the weight module such that collar transfers torque from the weight module to the charge holder.

31. The downhole perforating gun system of claim 30, wherein the collar comprises a plurality of teeth such that the weight module can be set at a specific orientation.

32. The downhole perforating gun system of claim 27, further comprising a detonator comprising a first wireless conductive contact; and a switch located at an axial position between the first bearing assembly and the second end of the first cylindrical gun carrier, the switch comprising:

a second wireless conductive contact in electrical communication with the inner body conductor, a third wireless conductive contact in electrical communication with the feedthrough, and a fourth wireless conductive contact in electrical communication with the first wireless conductive contact of the detonator.

33. The downhole perforating gun system of claim 27, wherein the first end of the first cylindrical gun carrier comprises an inner surface with first tapered threads.

34. The downhole perforating gun system of claim 33, further comprising a second cylindrical gun carrier comprising a first end and a second end, wherein the second end of the second cylindrical gun carrier comprises an outer surface with second tapered threads configured to engage with the first tapered threads on the inner surface of the first cylindrical gun carrier.

35. The downhole perforating gun system of claim 27, wherein the weights are fixed to the charge holder.

36. A downhole perforating gun system comprising:

a first carrier having a first and a second end and defining an axial bore therethrough;

a holder disposed in the first carrier and being configured to hold at least one charge, the holder having eccentric weight associated therewith;

a first bearing assembly disposed in the first carrier, the holder being rotatable in the axial bore via the first bearing assembly based on gravity acting on the eccentric weight;

a bulkhead being sealed in the first carrier proximate the first end, the bulkhead defining a throughbore;

a feedthrough disposed in the throughbore of the bulkhead, the feedthrough being configured to communicate electrically in the downhole perforation gun system;

a body conductor disposed in the first carrier and being configured to communicate electrically in the downhole perforation gun system;

a detonator disposed in the first carrier; and a switch disposed in the first carrier, the switch having wireless conductive contacts in electrical communication with the body conductor, the feedthrough, and the detonator.

37. The downhole perforating gun system of claim 36, wherein the holder comprises a holder module and a weight module having a connection therebetween, the holder module being configured to hold the at least one charge, the weight module having the eccentric weight associated therewith, the connection transferring torque from the weight module to the holder module and being adjustable to set at a specific orientation between the holder module and the weight module.

38. The downhole perforating gun system of claim 36, wherein the first end of the first carrier comprises an inner tapered thread; and wherein the downhole perforating gun system comprising a second carrier having a first end and a second end, wherein the second end of the second carrier comprises an outer tapered thread configured to engage with the inner tapered thread of the first carrier.

* * * * *